US006534924B1

(12) United States Patent
Oguchi et al.

(10) Patent No.: US 6,534,924 B1
(45) Date of Patent: Mar. 18, 2003

(54) METHOD AND APPARATUS FOR MANUFACTURING ELECTRON SOURCE, AND METHOD MANUFACTURING IMAGE FORMING APPARATUS

(75) Inventors: Takahiro Oguchi; Mitsutoshi Kuno, both of Sagamihara; Noritake Suzuki, Atsugi, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/328,804

(22) Filed: Jun. 9, 1999

Related U.S. Application Data

(63) Continuation-in-part of application No. 09/280,665, filed on Mar. 29, 1999, now abandoned.

(30) Foreign Application Priority Data

| | | |
|---|---|---|
| Mar. 31, 1998 | (JP) | 10-087644 |
| Jun. 10, 1998 | (JP) | 10-162515 |
| Feb. 15, 1999 | (JP) | 11-036510 |
| Feb. 24, 1999 | (JP) | 11-047119 |
| Feb. 24, 1999 | (JP) | 11-047129 |
| Feb. 26, 1999 | (JP) | 11-051652 |
| Feb. 26, 1999 | (JP) | 11-052057 |
| Mar. 24, 1999 | (JP) | 11-080488 |
| May 28, 1999 | (JP) | 11-149810 |

(51) Int. Cl.[7] ..... G09G 3/22
(52) U.S. Cl. ..... 315/169.1; 345/74
(58) Field of Search ..... 315/169.1, 169.2, 315/169.3; 345/55, 76, 77, 78, 74

(56) References Cited

U.S. PATENT DOCUMENTS

| | | | |
|---|---|---|---|
| 5,066,883 A | 11/1991 | Yoshioka et al. | 313/309 |
| 5,734,361 A | 3/1998 | Suzuki et al. | |
| 5,975,012 A | 11/1999 | Hayashi et al. | 118/723 |

FOREIGN PATENT DOCUMENTS

| | | |
|---|---|---|
| EP | 0 620 581 | 10/1994 |
| EP | 0 726 591 | 8/1996 |
| EP | 0 729 168 | 8/1996 |
| EP | 0 785 564 | 7/1997 |
| EP | 0 803 892 | 10/1997 |
| JP | 64-31332 | 2/1989 |
| JP | 02-257551 | 10/1990 |
| JP | 07-176265 | 7/1995 |
| JP | 8-190852 | 7/1996 |
| JP | 08-248920 | 9/1996 |
| JP | 09-134666 | 5/1997 |
| JP | 09161664 A | 6/1997 |
| JP | 9-199006 | 7/1997 |
| JP | 11-120902 | 4/1999 |

OTHER PUBLICATIONS

European Search Report (No. 2663830) dated Sep. 16, 1999.

(List continued on next page.)

*Primary Examiner*—David Vu
(74) *Attorney, Agent, or Firm*—Fitzpatrick, Cella, Harper & Scinto

(57) ABSTRACT

This invention discloses an electron source manufacturing method including the step of applying a voltage to a plurality of conductive members by applying a potential to first portions of the plurality of conductive members serving as at least part of electron-emitting devices via a wiring commonly connected to the plurality of conductive members, and applying a potential to second portions of the plurality of conductive members, wherein the potential applied to the second portions of the plurality of conductive members is set to relax the difference in voltage applied to the plurality of conductive members owing to the difference between potentials at portions respectively connected to the first portions of the plurality of conductive members in the wiring commonly connected to the plurality of conductive members.

69 Claims, 96 Drawing Sheets

OTHER PUBLICATIONS

C. A. Mead, "Operation of Tunnel–Emission Devices," Journal of Applied Physics, vol. 32, No. 4, pp. 646–652, Apr., 1961.

M. I. Elinson, et al. "The Emission of Hot Electrons and The Field Emission of Electrons From Tin Oxide," Radio Engineering and Electronic Physics, pp. 1290–1296, Jul., 1965.

M. Hartwell, et al., "Strong Electron Emission From Patterned Tin–Indium Oxide Thin Films," International Electron Devices Meeting, pp. 519–521, 1975.

Hisashi Araki, et al., "Electroforming and Electron Emission of Carbon Thin Films," Journal of the Vacuum Society of Japan, vol. 26, No. 1, pp. 22–29, 1983.

G. Dittmer, "Electrical Conduction and Electron Emission of Discontinuous Thin Films," Thin Solid Films, vol. 9, pp. 317–328, 1972.

C. A. Spindt, et al., "Physical properties of thin–film field emission cathodes with molybdenum cones," Journal of Applied Physics, vol. 47, No. 12, pp. 5248–5263, Dec., 1976.

W. P. Dyke, et al., "Field Emission," Advances in Electronics and Electron Physics, pp. 89–185, vol. VIII, 1956.

FIG. 34

| ADDRESS | COMPEN-SATION POTENTIAL FOR TERMINAL Dy1 ( V ) | COMPEN-SATION POTENTIAL FOR TERMINAL Dy2 ( V ) | COMPEN-SATION POTENTIAL FOR TERMINAL Dy3 ( V ) | . | . | . | COMPEN-SATION POTENTIAL FOR TERMINAL Dyn−1 ( V ) | COMPEN-SATION POTENTIAL FOR TERMINAL Dyn ( V ) |
|---|---|---|---|---|---|---|---|---|
| t = 0 | 0 | 0 | 0 | 0 | 0 | 0 | 0 | 0 |
| t=1 MIN | −0.1 | −0.1 | −0.1 | . | . | . | −0.3 | −0.3 |
| . | . | . | . | . | . | . | . | . |
| t=29 MIN | −0.5 | −0.5 | −0.6 | . | . | . | −3.0 | −3.0 |

ACTIVATION CHARACTERISTICS WHEN THREE LINES ARE SIMULTANEOUSLY DRIVEN ( DETAILS OF P PORTION )

FIG. 95B
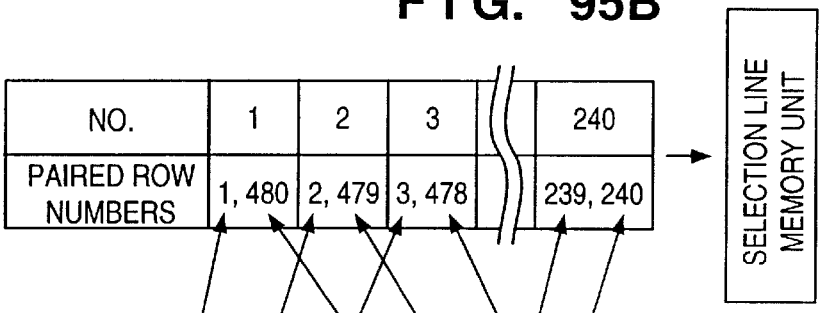
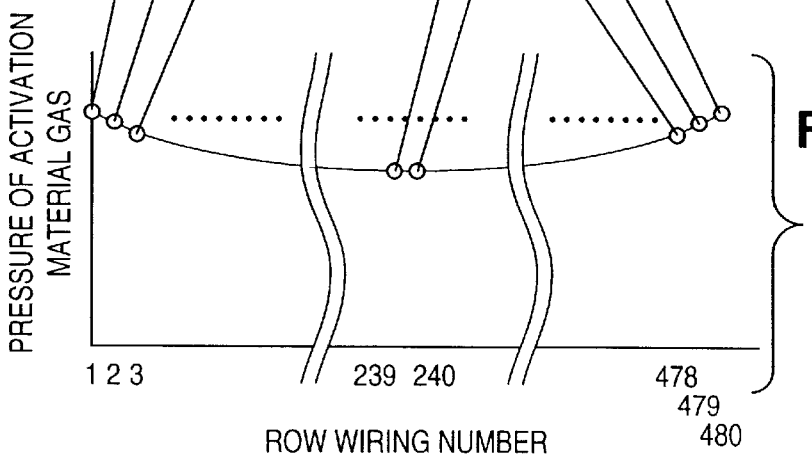
FIG. 95A

METHOD AND APPARATUS FOR MANUFACTURING ELECTRON SOURCE, AND METHOD MANUFACTURING IMAGE FORMING APPARATUS

This is a continuation-in-part application of U.S. patent application Ser. No. 09/280,665 filed on Mar. 29, 1999, now abandoned entitled "METHOD AND APPARATUS FOR MANUFACTURING ELECTRON SOURCE, AND METHOD OF MANUFACTURING IMAGE FORMING APPARATUS".

BACKGROUND OF THE INVENTION

1. Field of the Invention

The present invention relates to an electron source and an image forming apparatus as an application of the electron source.

2. Description of the Related Art

Conventionally, two types of devices, namely hot and cold cathode devices, are known as electron-emitting devices. Known examples of the cold cathode devices are field emission type electron-emitting devices (to be referred to as FE type electron-emitting devices hereinafter), metal/insulator/metal type electron-emitting devices (to be referred to as MIM type electron-emitting devices hereinafter), and surface-conduction emission (SCE) type electron-emitting devices.

Known examples of the FE type electron-emitting devices are described in W. P. Dyke and W. W. Dolan, "Field emission", Advance in Electron Physics, 8, 89 (1956) and C. A. Spindt, "Physical properties of thin-film field emission cathodes with molybdenium cones", J. Appl. Phys., 47, 5248 (1976).

A known example of the MIM type electron-emitting devices is described in C. A. Mead, "Operation of Tunnel-Emission Devices", J. Appl. Phys., 32,646 (1961).

A known example of the surface-conduction emission type electron-emitting devices is described in, e.g., to Elinson, "Radio Eng. Electron Phys., 10, 1290 (1965) and other examples will be described later.

The surface-conduction emission type electron-emitting device utilizes the phenomenon that electrons are a emitted from a small-area thin film formed on a substrate by flowing a current parallel through the film surface. The surface-conduction emission type electron-emitting device includes electron-emitting devices using an Au thin film [G. Dittmer, "Thin Solid Films", 9,317 (1972)], an $In_2O_3/SnO_2$ thin film [M. Hartwell and C. G. Fonstad, "IEEE Trans. ED Conf.", 519 (1975)), a carbon thin film [Hisashi Araki et al., "Vacuum", Vol. 26, No. 1, p. 22 (1983)], and the like, in addition to an $SnO_2$ thin film according to Elinson mentioned above.

FIG. 36 is a plan view showing the device by M. Hartwell et al. described above as a typical example of the device structures of these surface-conduction emission type electron-emitting devices. Referring to FIG. 36, reference numeral 3001 denotes a substrate; and 3004, a conductive thin film made of a metal oxide formed by sputtering. This conductive thinfilm 3004 has anH-shaped pattern, as shown in FIG. 36. Anelectron-emittingportion 3005 is formed by performing electrification processing (referred to as forming processing to be described later) with respect to the conductivethin film 3004. An interval L in FIG. 36 is set to 0.5 to 1 mm, and a width W is set to 0.1 mm. The electron-emitting portion 3005 is shown in a rectangular shape at the center of the conductive thin film 3004 for the sake of illustrative convenience. However, this does not exactly show the actual position and shape of the electron-emitting portion.

In the above surface-conduction emission type electron-emitting devices by M. Hartwell et al. and the like, typically the electron-emitting portion 3005 is formed by performing electrification processing called forming processing for the conductive thin film 3004 before electron emission. In the forming processing, for example, a constant DC voltage or a DC voltage which increases at a very low rate of, e.g., 1 V/min is applied across the two ends of the conductive thin film 3004 to partially destroy or deform the conductive thin film 3004, thereby forming the electron-emitting portion 3005 with an electrically high resistance. Note that the destroyed or deformed part of the conductive thin film 3004 has a fissure. Upon application of an appropriate voltage to the conductive thin film 3004 after the forming processing, electrons are emitted near the fissure.

The above surface-conduction emission type electron-emitting devices are advantageous because they have a simple structure and can be easily manufactured. For this reason, many devices can be formed on a wide area. As disclosed in Japanese Patent Laid-Open No. 64-31332 filed by the present applicant, a method of arranging and driving a lot of devices has been studied.

Regarding applications of surface-conduction emission type electron-emitting devices to, e.g., image forming apparatuses such as an image display apparatus and an image recording apparatus, electron-beam sources, and the like have been studied.

As an application to image display apparatuses, in particular, as disclosed in the U.S. Pat. No. 5,066,883 and Japanese Patent Laid-Open No. 2-257551 filed by the present applicant, an image display apparatus using the combination of an surface-conduction emission type electron-emitting device and a fluorescent substance which emits light upon reception of an electron beam has been studied. This type of image display apparatus using the combination of the surface-conduction emission type electron-emitting device and the fluorescent substance is expected to have more excellent characteristics than other conventional image display apparatuses. For example, in comparison with recent popular liquid crystal display apparatuses, the above display apparatus is superior in that it does not require a backlight because it is of a self-emission type and that it has a wide view angle.

Other prior arts are disclosed in Japanese Patent Laid-Open Nos. 7-176265 and 8-248920. The prior art also includes Japanese Patent Laid-Open No. 9-134666.

SUMMARY OF THE INVENTION

It is an object of the present invention to realize a more preferable electron source manufacturing method, image forming apparatus manufacturing method, or electron source manufacturing apparatus.

According to the present invention, an electron source manufacturing method is characterized by comprising the step of applying a potential to first portions of a plurality of conductive members serving as at least part of electron-emitting devices via a wiring commonly connected to the plurality of conductive members, and applying a potential to second portions of the plurality of conductive members, thereby applying a voltage to the plurality of conductive members, wherein the potential applied to the second portions of the plurality of conductive members is set to relax a difference in voltage applied to the plurality of conductive members owing to a difference between potentials at portions respectively connected to the first portions of the plurality of conductive members in the wiring commonly connected to the plurality of conductive members.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIG. 34 is a table showing the contents of a memory used in the eighth embodiment;

Figures 91A, 91B:
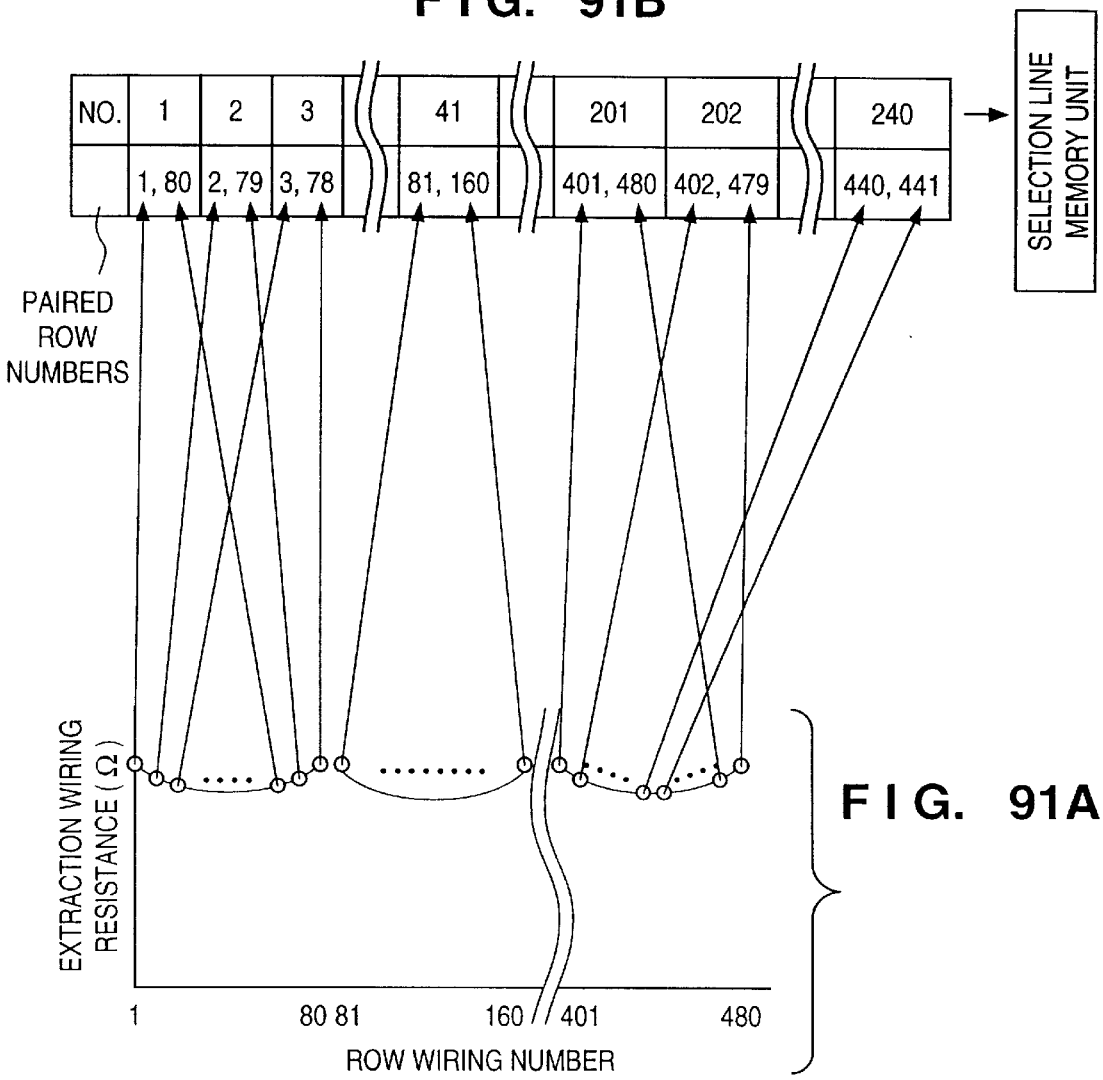
Figure 92:
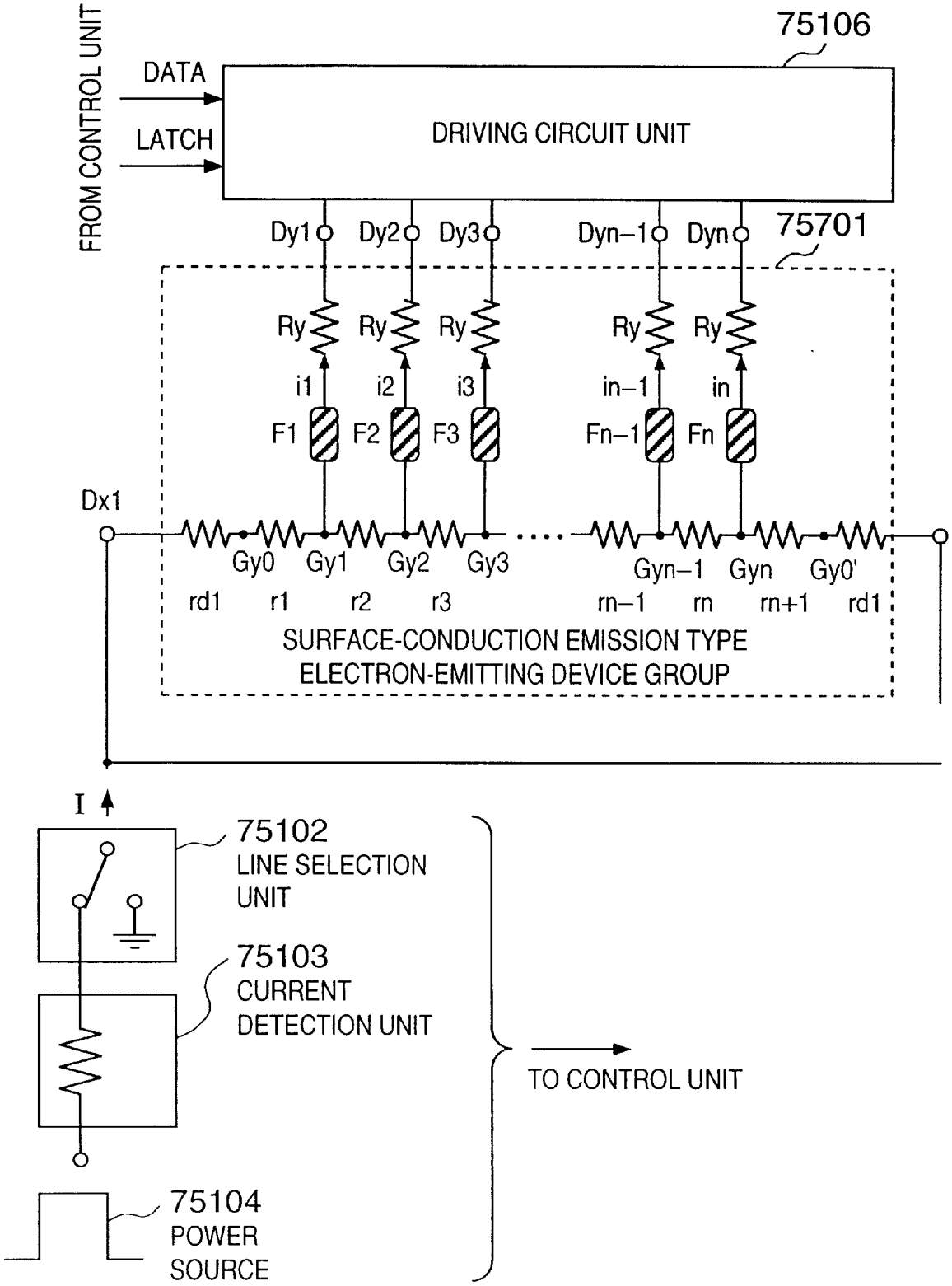
Figure 93A:
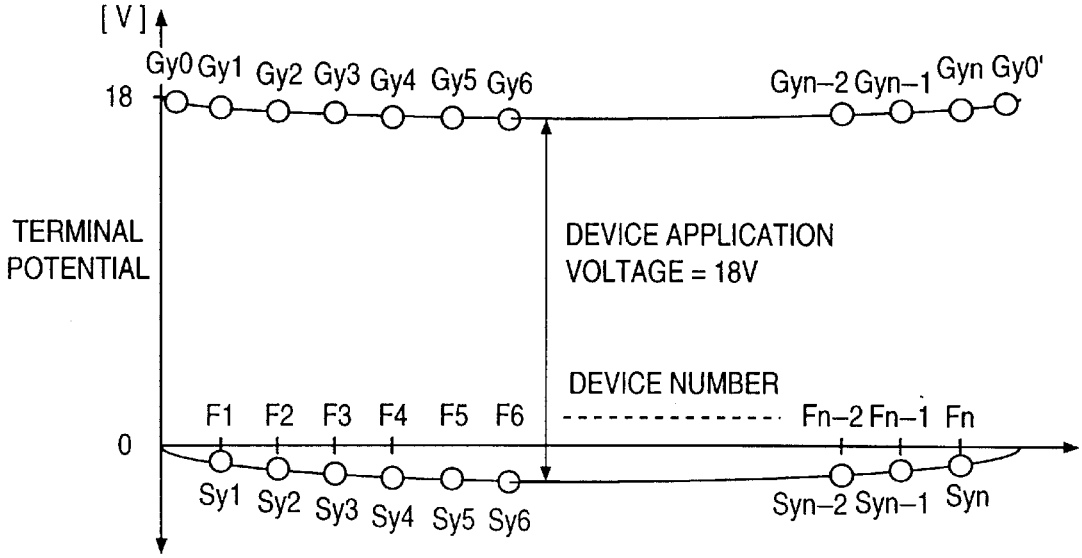
Figure 93B:
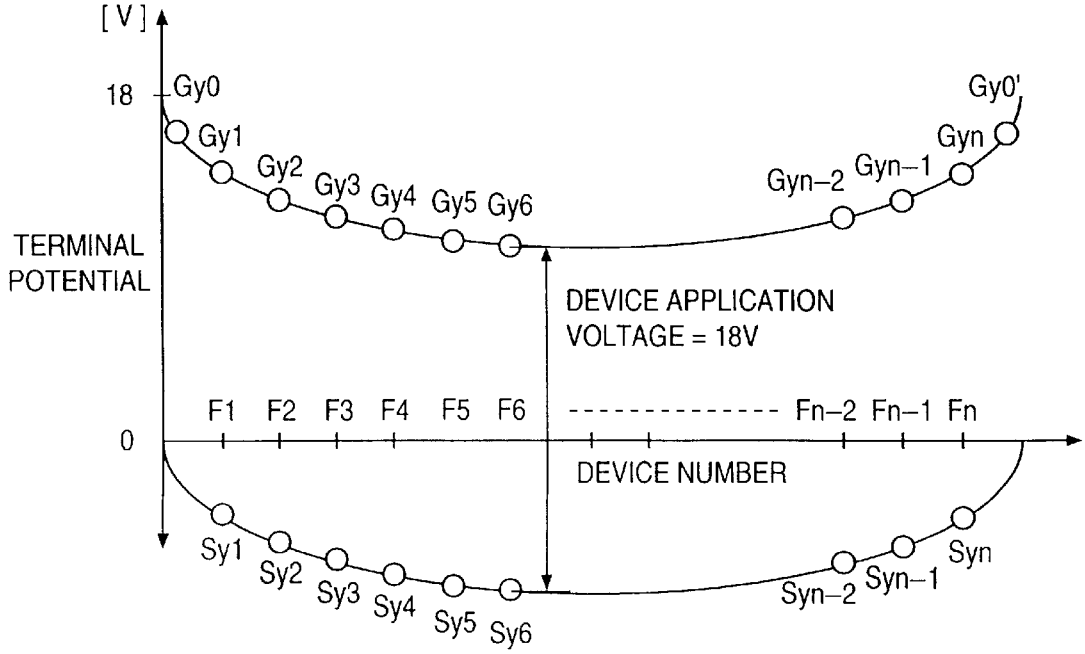
Figure 94A:
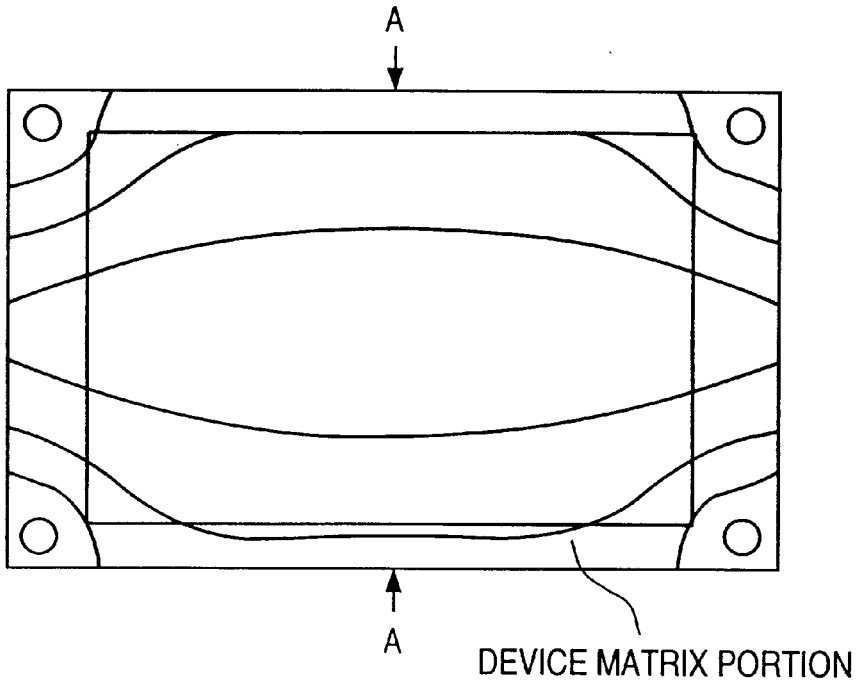
Figure 94B:
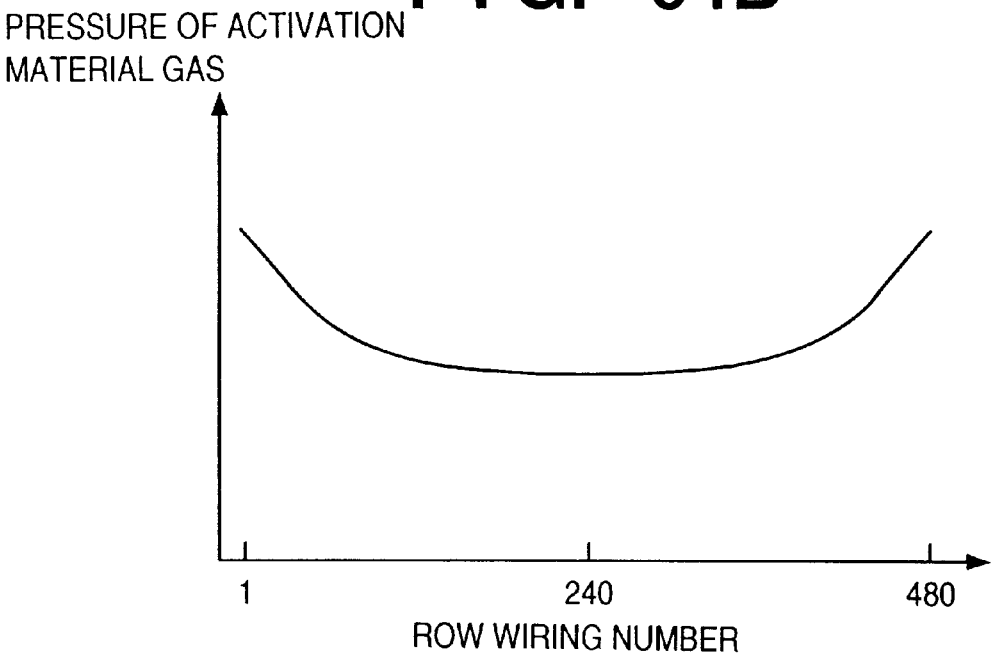

to FIGS. 91A and 91B are views for explaining a method of combining simultaneous selection lines in the 21st embodiment;

FIG. 92 is a block diagram showing the state of correcting the voltage distribution by the driving circuit unit;

FIGS. 93A and 93B are graphs each showing the voltage distribution which changes during activation processing;

FIGS. 94A and 94B are views for explaining the distribution of activation material gas in the 22nd embodiment; and FIGS. 95A and 95B are views for explaining a method of combining simultaneous selection lines in the 22nd embodiment.

DETAILED DESCRIPTION OF THE PREFERRED EMBODIMENTS

Detailed problems will be described below.

The present inventors have examined surface-conduction emission type electron-emitting devices of various materials, various manufacturing methods, and various structures, in addition to the above-mentioned conventional surface-conduction emission type electron-emitting device. Further, the present inventors have made extensive studies on a multi electron source having a large number of surface-conduction emission type electron-emitting devices, and an image display apparatus using this multi electron source.

Figure 37:
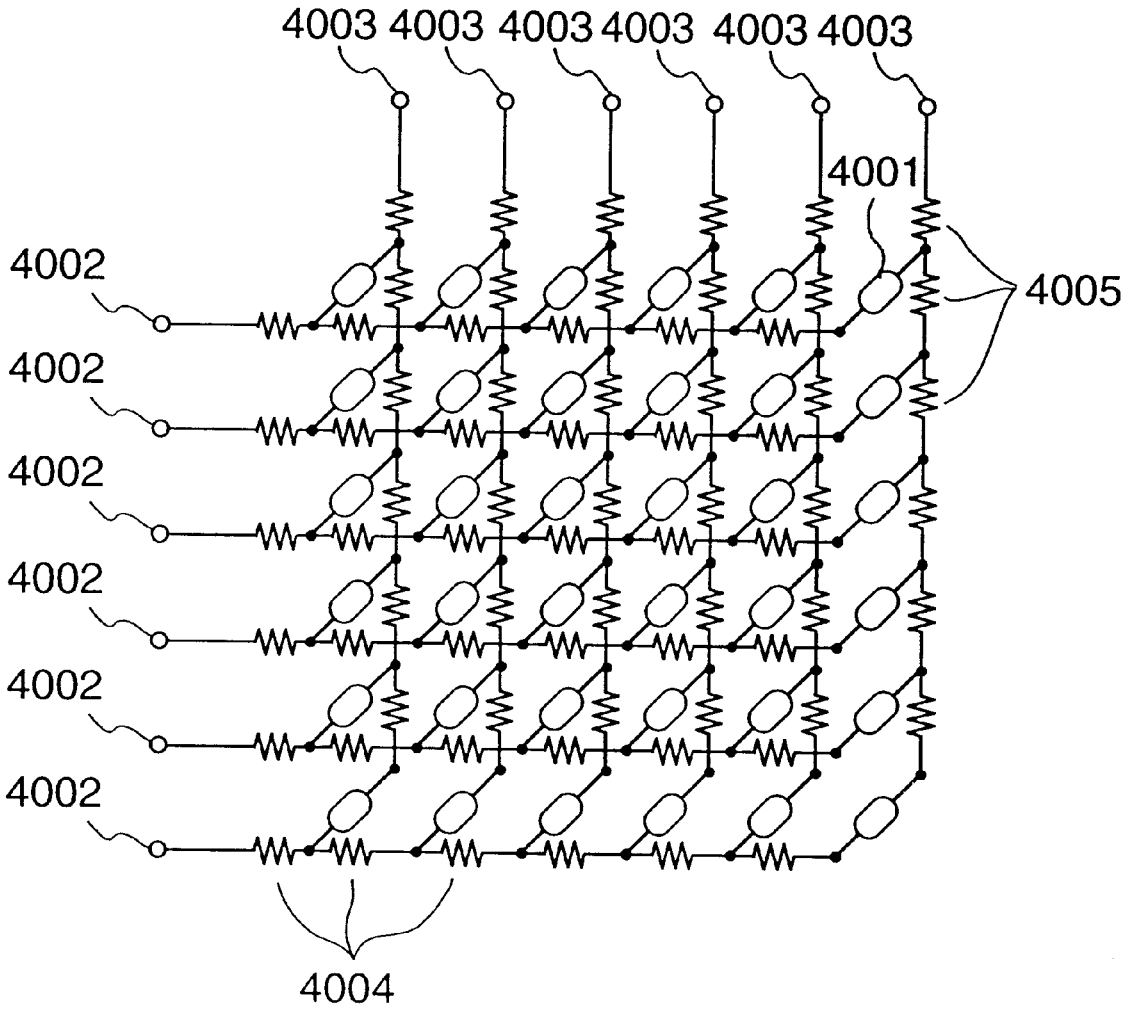
FIGS. 37, 38, 39, 40A, and 40B are circuit diagrams for explaining problems.

The present inventors have examined a multi electron source having an electrical wiring method shown in, e.g., FIG. 37. That is, a large number of surface-conduction emission type electron-emitting devices are two-dimensionally arranged in a matrix to obtain a multi electron source, as shown in FIG. 37.

Referring to FIG. 37, numeral 4001 denotes a surface-conduction emission type electron-emitting device; 4002, a row-direction wiring; and 4003, a column-direction wiring. The row- and column-direction wirings 4002 and 4003 actually have finite electrical resistances, which are represented as wiring resistances 4004 and 4005 in FIG. 37. This wiring method is called a simple matrix wiring method.

For the illustrative convenience, the multi electron source is illustrated in a 6×6 matrix, but the size of the matrix is not limited to this. For example, in a multi electron source for an image display apparatus, a number of devices enough to perform a desired image display are arranged and wired.

In a multi electron source in which surface-conduction emission type electron-emitting devices are arranged in a simple matrix, appropriate electrical signals are applied to the row- and column-direction wirings 4002 and 4003 to output a desired electron beam. For example, to drive the surface-conduction emission type electron-emitting devices on an arbitrary row in the matrix, a selection potential Vs is applied to the column-direction wiring 4002 on the row to be selected, and at the same time, a non-selection potential Vns is applied to the row-direction wirings 4002 on unselected rows. In synchronism with this, a driving potential Ve for outputting an electron beam is applied to the column-direction wirings 4003. According to this method, when potential drops across the wiring resistances 4004 and 4005 are neglected, a voltage (Ve−Vs) is applied to the surface-conduction emission type electron-emitting device on the selected row, and a voltage (Ve−Vns) is applied to the surface-conduction emission type electron-emitting devices on the unselected rows. When the potentials Ve, Vs, and Vns are set to appropriate levels, an electron beam having a desired intensity must be output from only the surface-conduction emission type electron-emitting device on the selected row. When different driving potentials Ve are applied to the respective column-direction wirings, electron beams having different intensities must be output from respective devices on the selected row. Since the surface-conduction emission type electron-emitting device has a high response speed, a time for outputting an electron beam can be changed by changing a time for applying the driving potential Ve.

A multi electron source obtained by arranging surface-conduction emission type electron-emitting devices in a simple matrix has a variety of applications. For example, when a voltage signal corresponding to image information is appropriately applied, the multi electron source can be applied as an electron source for an image display apparatus.

The present inventors have made extensive studies for improving the characteristics of the surface-conduction emission type electron-emitting device to find that activation processing is effectively performed during the manufacture.

As described above, the electron-emitting portion of the surface-conduction emission type electron-emitting device is formed by processing (forming processing) of flowing a current through a conductive thin film to partially destroy or deform this thin film, thereby forming a fissure. If activation processing is performed subsequently, electron-emitting characteristics can be greatly improved.

In activation processing, the electron-emitting portion formed by the forming processing is electrified under appropriate conditions to deposit a deposit such as carbon or carbon compound around the electron-emitting portion. For example, graphite monocrystalline, graphite polycrystalline, amorphous carbon, or mixture thereof is deposited to a thickness of 500 angstroms or less around the electron-emitting portion by periodically applying a voltage pulse in a vacuum atmosphere in which an organic substance exists at an appropriate partial pressure and the total pressure is $10^{-4}$ to $10^{-5}$ Torr. These conditions are merely an example and properly changed in accordance with the material and shape of the surface-conduction emission type electron-emitting device.

This processing can increase the emission current at the same application voltage typically 100 times or greater the emission current immediately after forming processing. (Note that the partial pressure of the organic substance in the vacuum atmosphere is desirably reduced after activation processing.)

For this reason, activation processing is desirably performed for each device in manufacturing a multi electron source formed by arranging a large number of surface-conduction emission type electron-emitting devices in a simple matrix.

When the surface-conduction emission type electron-emitting device which undergoes high-resistance processing and activation processing by forming processing during the manufacture is applied to an image forming apparatus, the following problem arises. The problem of activation processing during the manufacture will be explained.

Various image forming panels to which the surface-conduction emission type electron-emitting device is applied are demanded for high-quality, high-resolution images, as a matter of course. This is realized using a large number of surface-conduction emission type electron-emitting devices arranged in, e.g., a simple matrix. Accordingly, many device lines having several hundred to several thousand rows and columns are required, whereas the surface-conduction emission type electron-emitting devices are desired to have uniform device characteristics. To actually manufacture various high-quality, high-resolution image forming panels, a large number of surface-conduction emission type electron-emitting devices must be formed uniform.

Figure 38:
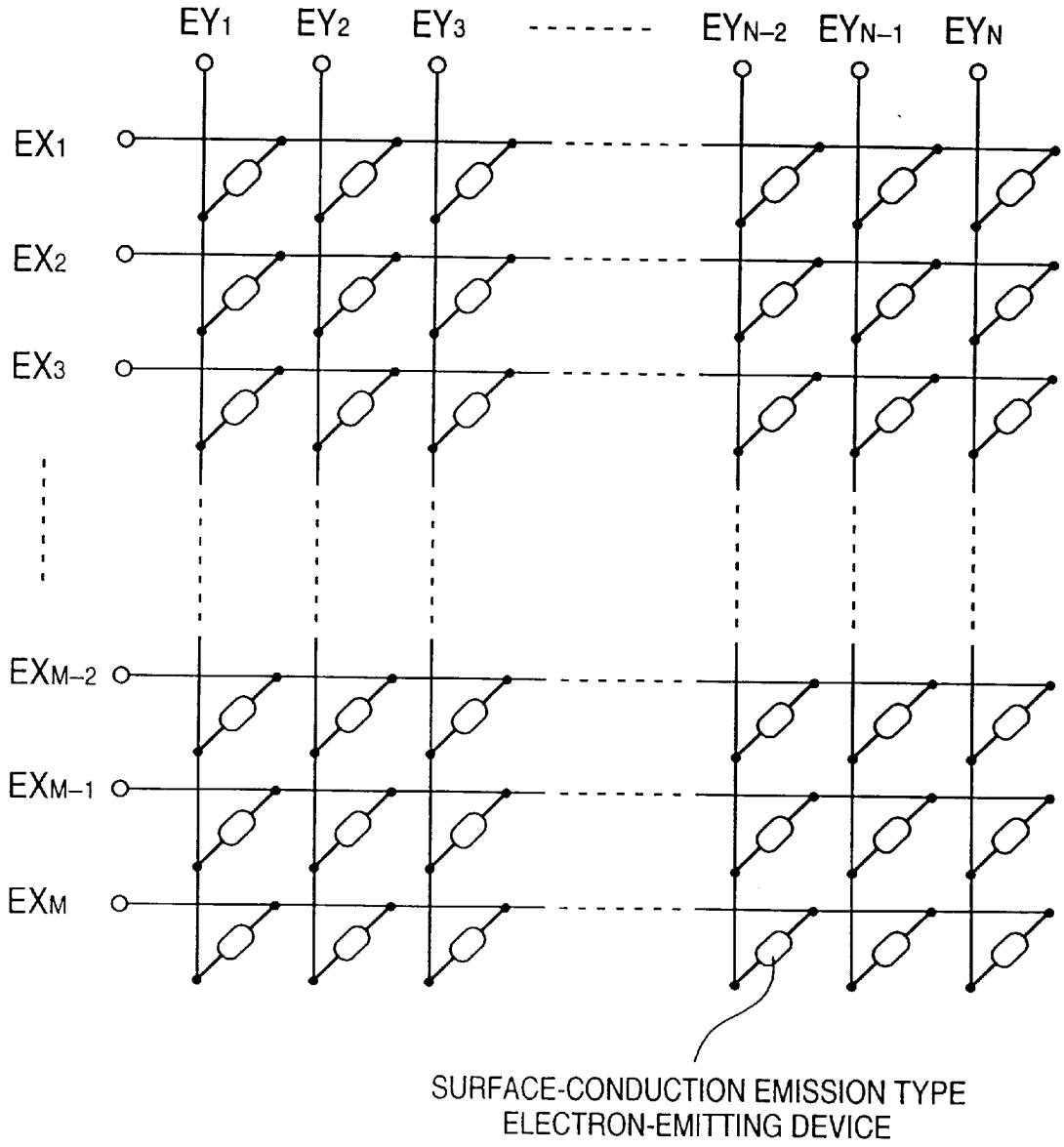

For example, as a method of forming a large number of surface-conduction emission type electron-emitting devices by activation processing, the present applicant adopted a method of dividing surface-conduction emission type electron-emitting devices arranged in a matrix into a plurality of groups and sequentially applying an activation voltage in units of groups. That is, an activation voltage was sequentially applied to M×N surface-conduction emission type electron-emitting devices as shown in FIG. 38 in units of rows. In FIG. 38, reference symbols $EY_1$ to $EY_N$ and $EX_1$ to $EX_M$ denote-wirings.

Figure 39:
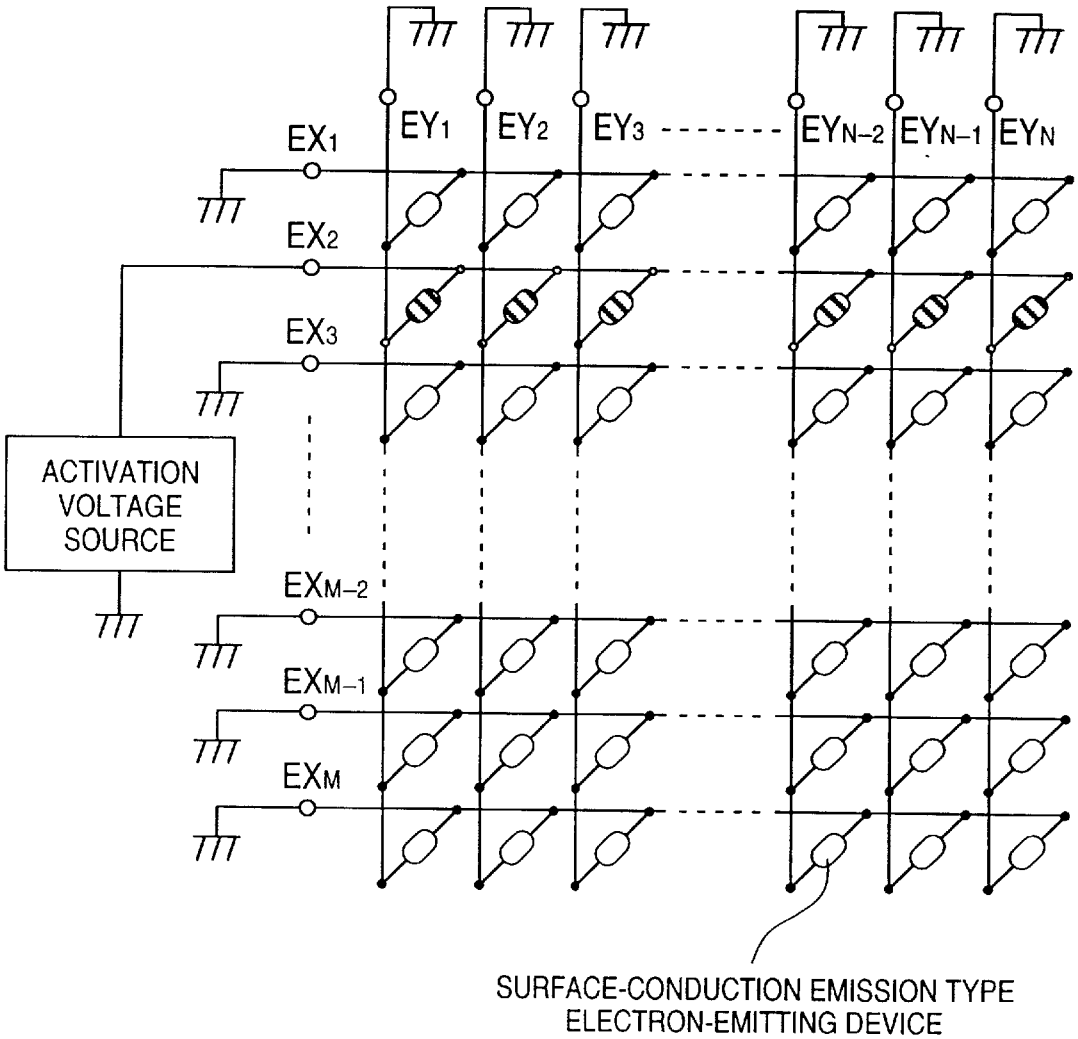

FIG. 39 shows the case in which an activation voltage is applied to surface-conduction emission type electron-emittingdevices (black devices in FIG. 39) on the second row. As shown in FIG. 39, the wiring $EX_2$ is connected to an activation potential source, and the remaining electrodes are set to the ground level, i.e., 0 V. According to this method, only the surface-conduction emission type electron-emitting devices on the second row receive the activation voltage in principle, and the remaining surface-conduction emission type electron-emitting devices do not receive any voltage or current. Activation was actually performed by this method to find that the surface-conduction emission type electron-emitting devices exhibited more uniform electron-emitting characteristics.

However, it is difficult to completely eliminate variations in electron-emitting characteristics, and particularly devices having different electron-emitting characteristics are distributed along one side of the matrix. More specifically, surface-conduction emission type electron-emitting devices on a side farther from the feeding terminal in activation, i.e., on the right side in FIG. 39 exhibited poor electron-emitting characteristics. If such devices are used for the electron source of an image forming apparatus, the brightness or density on one side of an image becomes short.

The present inventors have extensively studied and cleared up the cause of this problem as follows.

According to the above-mentioned method shown in FIG. 39, an activation voltage can be applied to only surface-conduction emission type electron-emitting devices on one row in principle. However, since the electrical resistances of the wirings $EY_1$ to $EY_N$ and $EX_1$ to $EX_M$ are not 0 in practice, a current flows to cause a potential drop. To prevent this, attention is paid to a group of surface-conduction emission type electron-emitting devices on the second row which receive an activation voltage in FIG. 39. A model including their wiring resistances is shown in FIG. 40A.

Figure 40A:
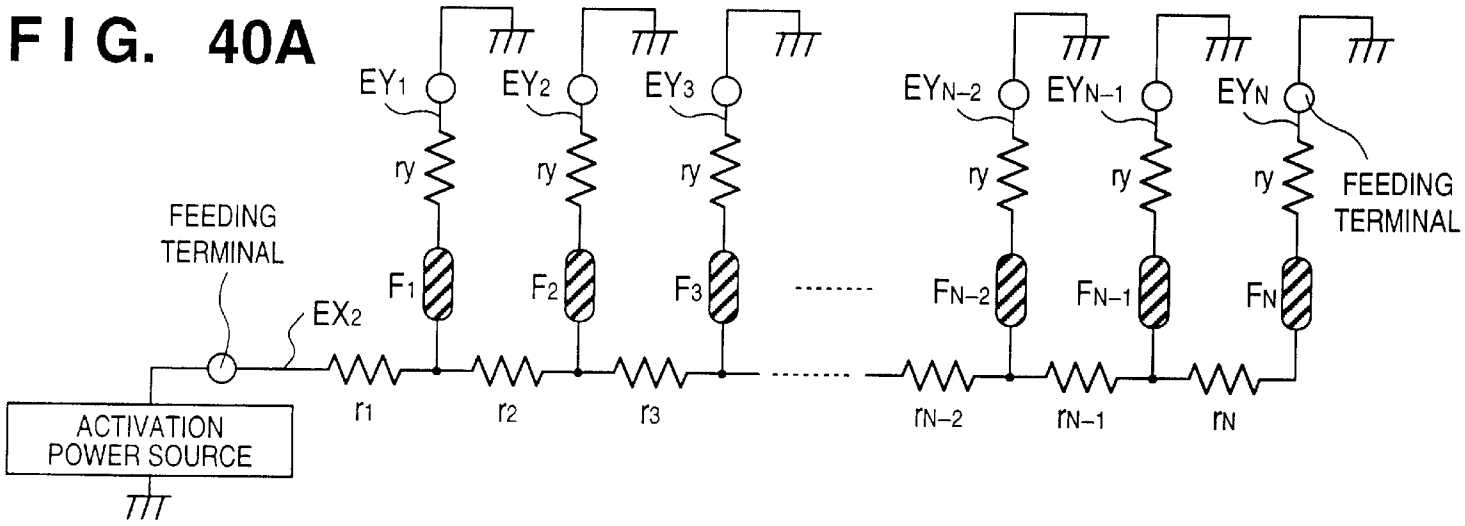

In FIG. 40A, reference symbols $F_1$ to $F_N$ denote surface-conduction emission type electron-emitting devices; r1 to rN, wiring resistances between devices on the row wiring $EX_2$; and ry, a wiring resistance from the feeding terminal of each of the wirings $EY_1$ to $EY_N$ to a corresponding surface-conduction emission type electron-emitting device. Since the row wiring $EX_2$ is generally designed to be formed from a material having a constant line width and thickness, r1 to rN can be considered to be equal except for variations in the manufacture. Since the wirings $EY_1$ to $EY_N$ are generally designed to be uniform, the resistances ry of the respective wirings can be considered to be equal.

Figure 40B:
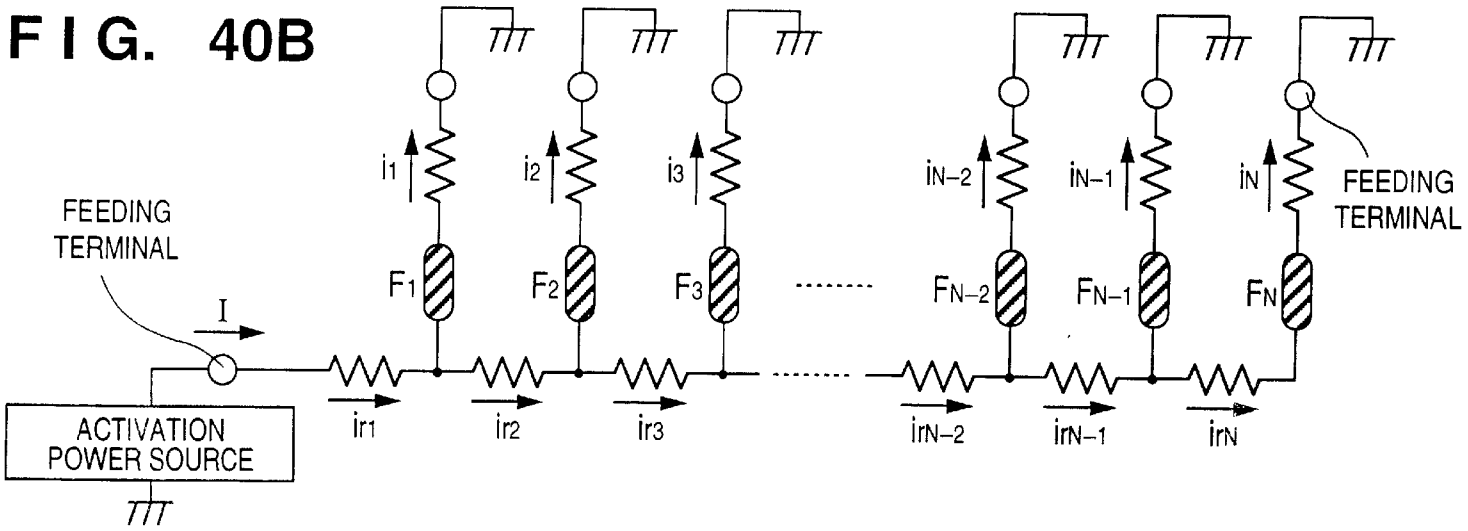

A current flowing through the model shown in FIG. 40A will be explained with reference to FIG. 40B. In FIG. 40B, letting I be a current supplied from the activation potential source, and $i_1$ to $i_N$ be currents flowing through rn the surface-conduction emission type electron-emitting devices $F_1$ to $F_N$, the current I is given by the sum of device currents $i_k$ flowing through devices $F_k$, i.e., $$I=\Sigma\{k=1 \text{ to } N\}i_k$$

In addition, letting ir1 to $i_{rN}$ be currents flowing through the wiring resistances r1 to rN of respective devices in the row direction, $$i_{rp}=I-\Sigma\{k=0 \text{ to } p-1\}i_k$$

(where $i_0=0$, and p=integer of 1 to N)

In other words, the current $i_{r1}$ flowing through r1 is equal to the sum of currents flowing through all surface-conduction emission type electron-emitting devices, and the current $i_{r2}$ flowing through r2 is equal to the difference obtained by subtracting the current $i_1$ flowing through the surface-conduction emission type electron-emitting device $F_1$ from the sum of currents flowing through all surface-conduction emission type electron-emitting devices. The current $i_{r1n}$ flowing through rN is equal to the current $i_N$ flowing through the surface-conduction emission type electron-emitting device $F_N$. Therefore, a row-direction wiring nearer the power source flows a larger current.

Figure 41:
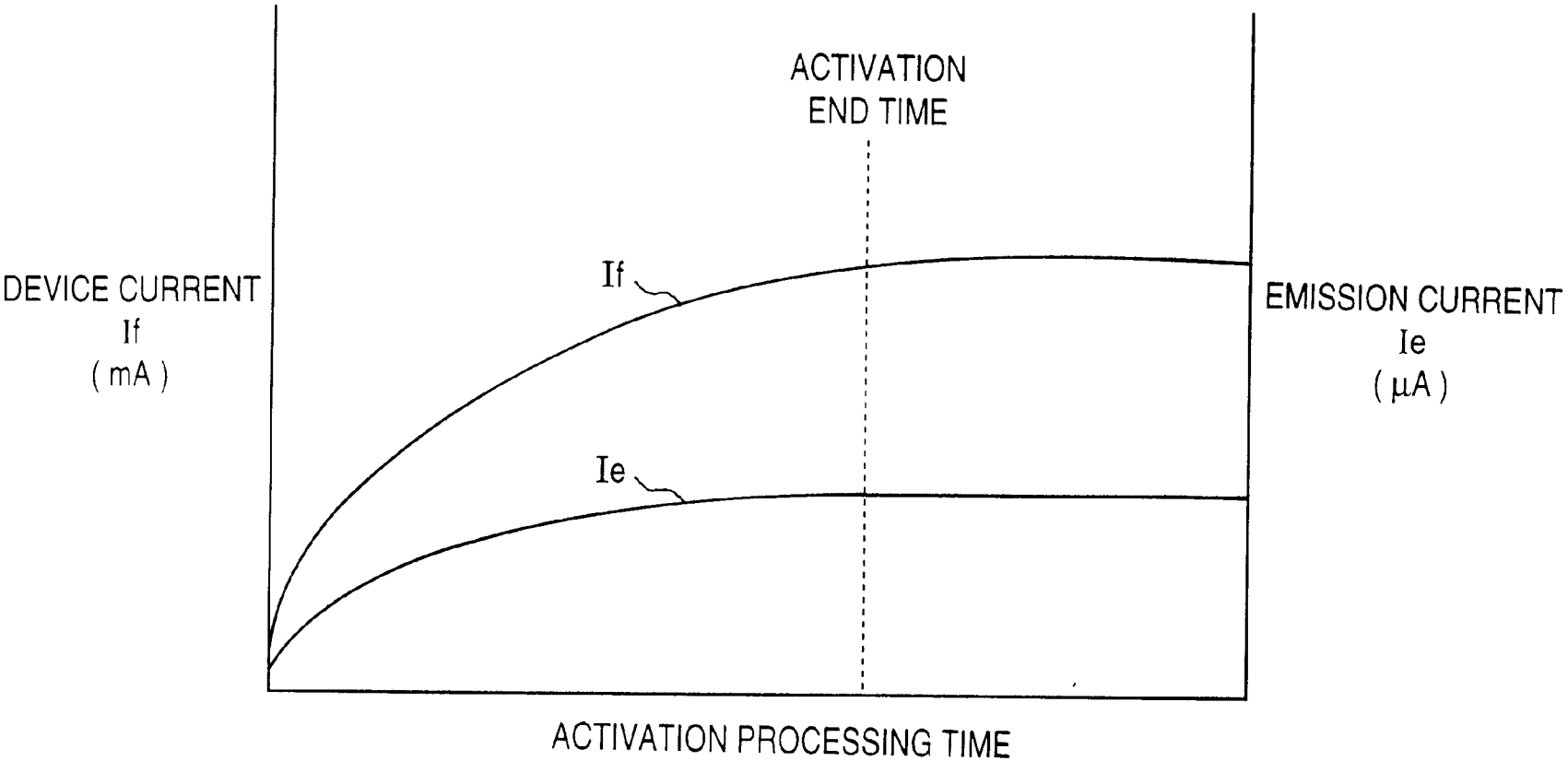
FIGS. 41 and 42 are graphs for explaining problems.

In activation processing, changes in device current and emission current are observed with the elapse of time after the start of activation. This will be explained with reference to FIG. 41. FIG. 41 is a graph showing activation characteristics when one of surface-conduction emission type electron-emitting devices arranged in a matrix is activated. As shown in FIG. 41, when activation processing starts, the device current ($I_f$ in FIG. 41) and emission current ($I_e$ in FIG. 41) flowing through the surface-conduction emission type electron-emitting device increase along with electrification and saturate at last. That is the current flowing through the surface-conduction emission type electron-emitting device increases along with the progress of activation processing, and the largest current flows through the surface-conduction emission type electron-emitting device at the end of activation processing.

Figure 42:
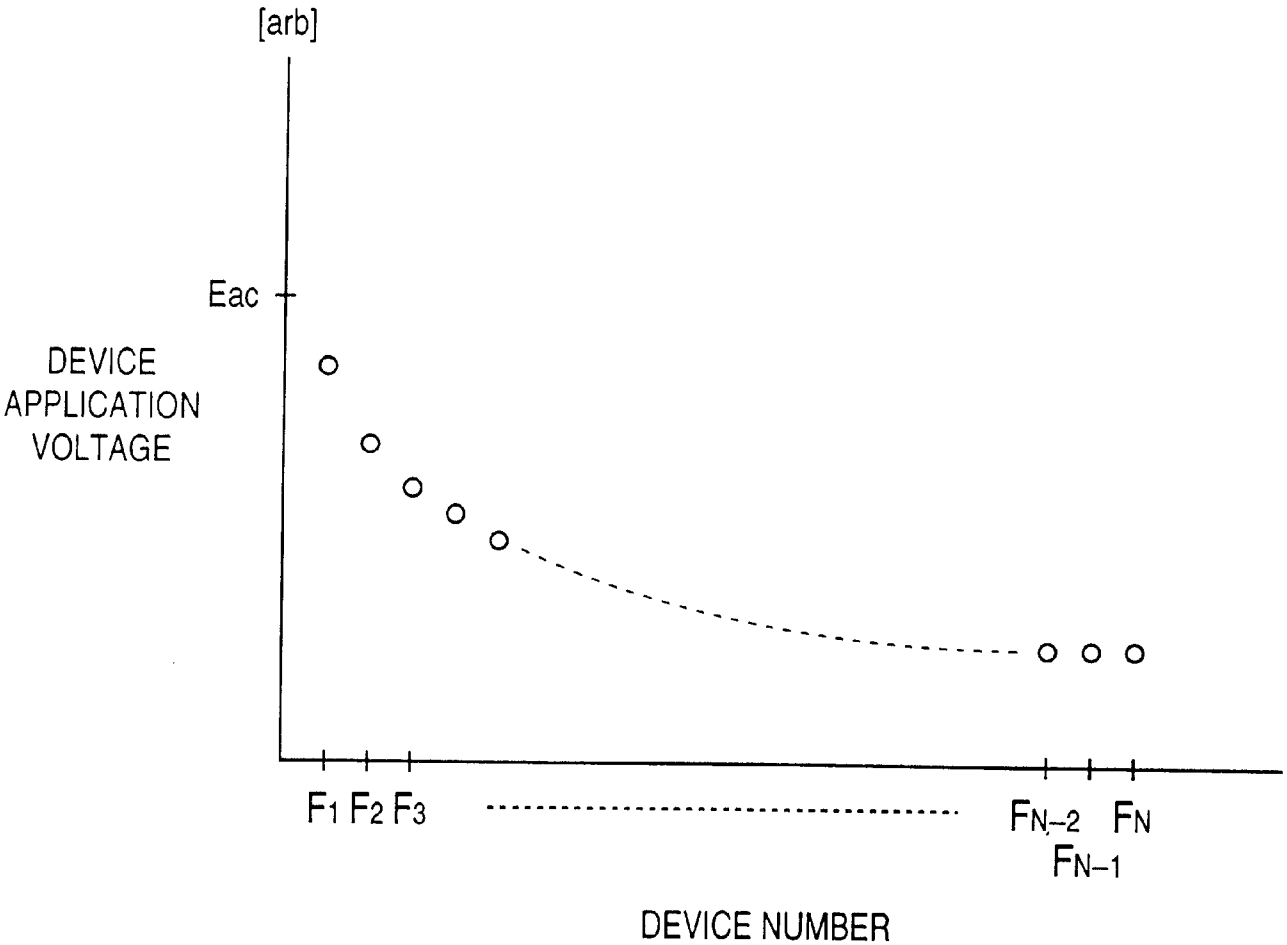

When an activation voltage is sequentially applied in units of rows in FIGS. 40A, 40B, and 41, potential drops occur via the wiring resistances r1 torN in accordance with the device currents $I_f$ flowing through respective devices along with the progress of activation, and the potential drops are maximized at the end of activation. At this time, surface-conduction emission type electron-emitting devices aligned on the same row exhibit a voltage distribution shown in FIG. 42. In FIG. 42, the abscissa represents the number of each surface-conduction emission type electron-emittingdevice, and the ordinate represents a voltage applied to the surface-conduction emission type electron-emitting device. Note that Eac on the ordinate represents the output potential of the activation potential source. If activation processing is performed in units of rows in this manner, voltages applied to respective devices at the end of activation are greatly distributed. As a result, devices having different electron-emitting characteristics are distributed along one side of the matrix. In particular, a device farther from the feeding terminal upon activation cannot receive a sufficient activation voltage, and ideal activation shown in FIG. 41 fails, resulting in poor electron-emitting characteristics of the surface-conduction emission type electron-emitting device. Hence, when devices arranged in a matrix are used for the electron source of an image forming apparatus, the brightness or density on one side of an image becomes short.

Figure 43A:
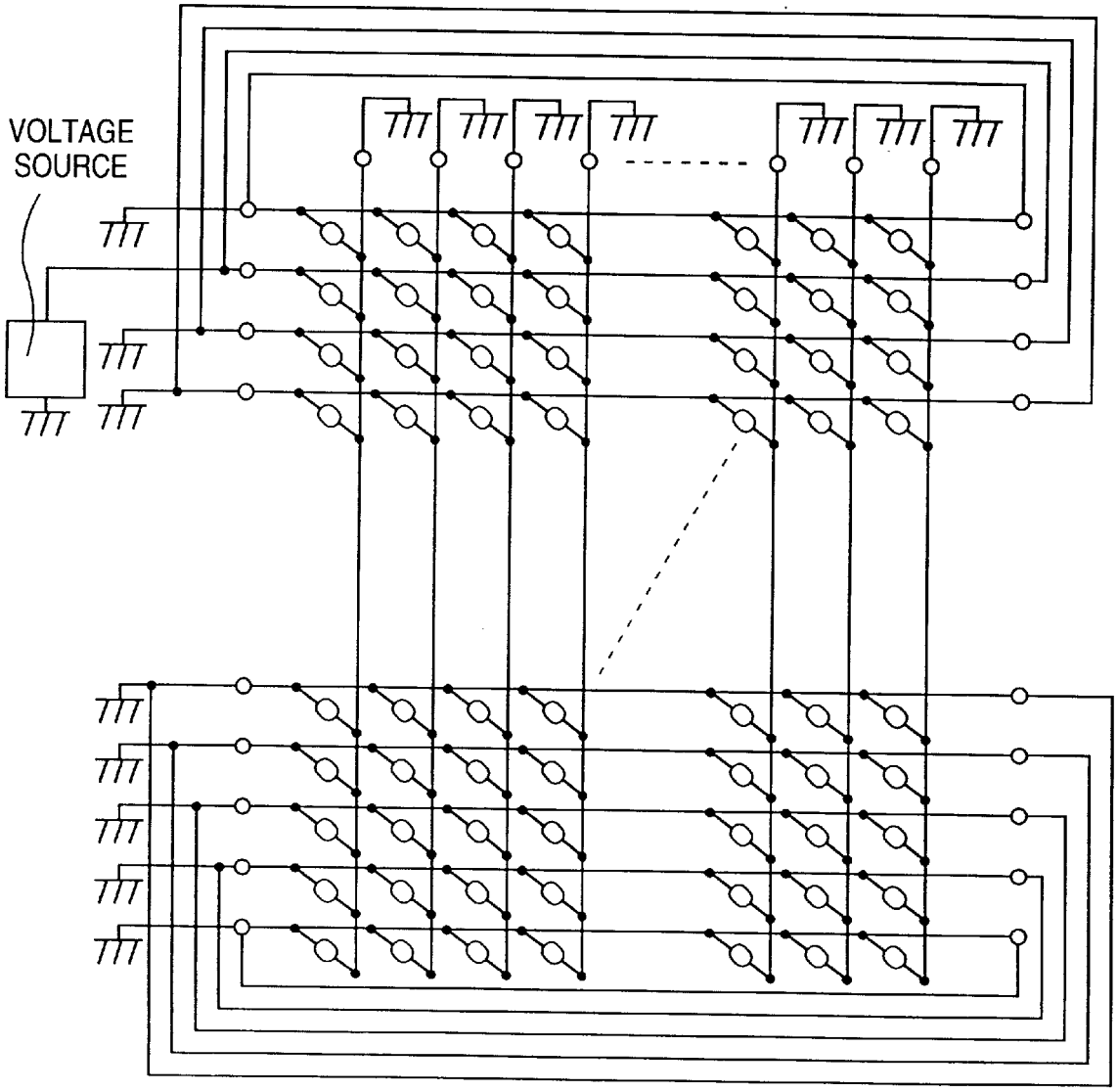
FIGS. 43A and 43B are a circuit diagram and a graph, respectively, for explaining problems.
Figure 43B:
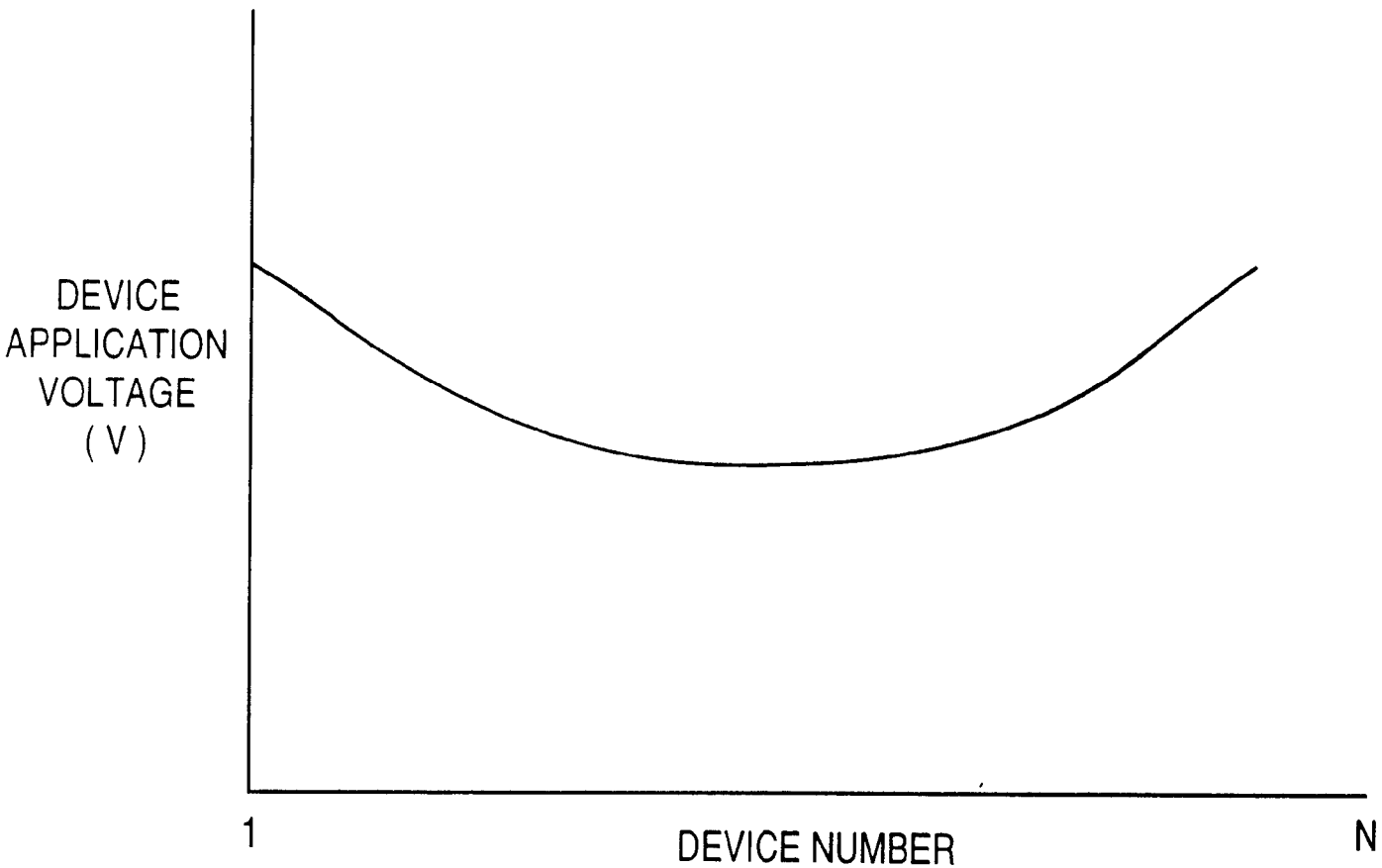

The above description concerns activation processing performed from one side of the substrate for surface-conduction emission type electron-emitting devices arranged in a simple matrix. The same problem also arises when electrodes are extracted from two sides. FIG. 43A is a circuit diagram showing an electrification circuit when electrodes are extracted from two sides, and FIG. 43B shows a device application voltage distribution in this case. As is apparent from FIGS. 43A and 43B, in electrification processing from electrodes on two sides, the characteristics of a surface-conduction emission type electron-emitting device at the center degrade due to the same reason as described in electrification processing from one side.

To solve this problem, a manufacturing method and apparatus which allow an electron source formed by arranging surface-conduction emission type electron-emitting devices in a simple matrix to obtain uniform electron-emitting characteristics, and an electron source manufactured by this method will be explained in the following embodiments.

The aspects of the present invention will be described.

According to one aspect of the present invention, an electron source manufacturing method is characterized by comprising the step of applying a potential to first portions of a plurality of conductive members serving as at least part of electron-emitting devices via a wiring commonly connected to the plurality of conductive members, and applying a potential to second portions of the plurality of conductive members, thereby applying a voltage to the plurality of conductive members, wherein the potential applied to the second portions of the plurality of conductive members is set to relax the difference in voltage applied to the plurality of conductive members owing to the difference between potentials at portions respectively connected to the first portions of the plurality of conductive members in the wiring commonly connected to the plurality of conductive members.

A voltage corresponding to the potential difference between the potentials of the first and second portions of the conductive member is applied to the conductive member. For example, when the potentials differ between respective portions on the wiring, if the potentials of the second portions of the conductive members are set equal, voltages applied between the first and second portions of the conductive members become different from each other. According to the present invention, voltages applied to the first and second portions of the conductive members can be made close to each other by setting the potential of the second portion to relax the difference between voltages.

To substantially apply a voltage between the first and second portions, different potentials are applied to the first and second portions. Either one potential may be the ground potential.

As the conductive member which receives the voltage and serves as at least part of the electron-emitting device, one having undergone, e.g., the forming step of the surface-conductlon emission type electron-emitting device can be suitably used.

As the conductive member, a conductive film can be used. As the form of a conductive member which receives the voltage, a form having a high-resistance portion between the first and second portions, e.g., a gap formed between the first and second portions can be adopted. The voltage application step can be particularly applied to the step of depositing a deposit in or near the gap. This voltage application step is suitable when a current flowing through the conductive member increases or a current flowing through the conductive member increases or a current flowing through a wiring connected to the conductive member increases, as will be described in the following embodiments.

When the electron source has pluralities of row and column wirings constituting a matrix, the voltage application step is performed for a plurality of conductive members having first portions connected to one row wiring by a potential applied to the row wiring and a potential applied to column wirings each connected to the second portion of each conductive member.

The potential applied to the second portion may be changed in accordance with a change in potential applied to the first portion. Especially when the resistance value between the first and second portions of the conductive member changes along with voltage application, the degree of potential drop on the wiring also changes, the potential of the first portion changes, and thus the potential applied to the second portion is desirably controlled in accordance with the change in potential of the first portion.

The potential applied to the first portion need not necessarily be measured. For example, this potential can be estimated by measuring a current flowing through the conductive member. A circuit for automatically setting the second potential in accordance with the measured current may be employed.

In addition, one or both of the potential applied to the first portion and the potential applied to the second portion are preferably applied as pulses.

In particular, preferably, a potential applied to the wiring commonly connected to the plurality of conductive members and the potential applied to the second portion are applied as pulses, and the pulse-like potential applied to the wiring commonly connected to the plurality of conductive members is applied after the pulse-like potential applied to the second portion.

The conductive member is preferably connected to one of a plurality of row wirings and one of a plurality of column wirings that constitute a matrix, and the voltage application step preferably comprises the step of applying a voltage to conductive members connected to a row wiring selected from the plurality of row wirings by a potential applied to the first portions in accordance with a potential applied to the selected row wiring and a potential applied to the second portions in accordance with a potential applied to the plurality of column wirings.

In the voltage application step, an unselected row wiring out of the plurality of row wirings preferably receives a potential for suppressing a current flowing through the unselected row wiring owing to the potential a difference from the potential applied to the column wiring.

Further, one or both of the potential applied to the unselected row wiring and the potential applied to the column wiring are preferably set to set the potential of the unselected row wiring to a potential between the maximum and minimum values of the potential applied to the plurality of column wirings, e.g., to an intermediate value between the maximum and minimum values.

One or both of the potential applied to the unselected row wiring and the potential applied to the column wiring are preferably set to set the ground potential between the maximum and minimum values of the potential applied to the plurality of column wirings.

The electron source manufacturing method preferably comprises the step of applying the voltage while sequentially switching row wirings to be selected, and more preferably comprises the step of selecting a given row wiring and applying the voltage to conductive members connected to the selected row wiring at a time interval, thereby applying the voltage and the step of selecting another row wiring during the time interval and applying the voltage to conductive members connected to this another row wiring.

As another aspect of the present invention, a method of manufacturing an image forming apparatus having an electron source and an image forming member for forming an image upon irradiation of electrons emitted by the electron source is characterized by comprising the steps of manufacturing the electron source by the electron source manufacturing method described above, and assembling the electron source and the image forming member.

As still another aspect of the present invention, an electron source manufacturing apparatus is characterized by comprising a first circuit for applying a potential to first portions of a plurality of conductive members serving as at least part of electron-emitting devices via a wiring commonly connected to the plurality of conductive members, and a second circuit for applying a potential to second portions of the plurality of conductive members, wherein the second circuit sets the potential applied to the second portions of the plurality of conductive members so as to relax a difference in voltage applied to the plurality of conductive members owing to a difference between potentials at portions respectively connected to the first portions of the plurality of conductive members in the wiring commonly connected to the plurality of conductive members.

For example, the apparatus preferably comprises a current monitoring circuit for monitoring a current flowing through the conductive member.

The second circuit preferably sets the potential on the basis of a current flowing through the conductive member.

The second circuit preferably controls the potential applied to the second portion in accordance with the application time of the potential to the second portion.

The second circuit may comprise memory means which is referred to in order to set the potential applied to the second portion.

The second circuit may include a circuit which generates potential differences which are equal to potential differences at the portions respectively connected to the first portions of the plurality of conductive members commonly connected in the wiring. The configuration can be realized by, for example, sinking an electric current from each of the plurality of conductive member or supplying an electric current to each of the plurality of conductive member at predetermined points of an equivalent wiring resistance array having a resistance substantially equal to the resistance of the wiring. The value of the current flowing the plurality of conductive members can be acquired by monitoring the current flowing the wiring and dividing the monitored values by the number of conductive members connected with the wiring. Alternatively, the current value flowing the plurality of conductive members can be acquired by measuring a current flowing the each wiring connected with the second portion. Further, the current can be acquired according to data previously measured. The potentials to be applied to the respective second portions are obtained by superposing the potential distribution and an offset potential.

If the first circuit applies a potential from the two sides of the wiring, the degree of potential drop can be suppressed.

A voltage applying circuit applying a voltage to a plurality of conductive members connected with a plurality of row wirings and a plurality of column wirings which form a matrix, comprising:

first circuit supplying a predetermined potential to a row wiring selected among the plurality of row wirings; and second circuit supplying a predetermined potential to each of the plurality of column wirings, wherein said second circuit includes a potential distribution generating circuit having an equivalent wiring resistance array and a source of a control current, wherein the equivalent wiring resistance array has a resistance substantially equal to the resistance of the row wiring, and the source of the control current serves to sink or supply a current flowing said plurality of conductive members.

The second circuit preferably has a circuit for superposing the potential distribution generated by said potential distribution generating circuit and an offset potential. For instance, a buffer amplifier may serve as such circuit.

The aforementioned conductive member may have various configurations. For instance, the conductive member may have a pair of electrodes which pass an electric current when different potentials are applied.

The present invention includes the following aspects as an electron source manufacturing method. The following aspects can be used in combination with the above-described aspects.

A method of manufacturing an electron source having a plurality of electron-emitting devices comprises the step of applying a voltage to some of a plurality of row wirings and a plurality of conductive members serving at least part of the electron-emitting devices connected to simultaneously selected row wirings by using a matrix wiring made up of pluralities of row and column wirings arranged substantially along directions perpendicular to each other, wherein the voltage application step has the step of applying a potential to first portions of the plurality of conductive members via the selected row wirings, and applying a potential to second portions of the plurality of conductive members via the plurality of column wirings, thereby applying a voltage by a difference between potentials applied via the row and column wirings, and the potential applied to the second portions of the plurality of conductive members is set to reduce differences between voltages applied to the respective conductive members caused by differences between potentials at portions connected to the first portions of the respective conductive members on the row wiring.

The voltage application step is preferably repeated a plurality of number of times until all the row wirings are selected at least once.

The voltage application step preferably comprises the step of determining simultaneous selection row wirings.

The determination step preferably comprises the step of excluding a row wiring through which a current having a predetermined value flows upon selection, from selection target row wirings.

The simultaneous selection row wirings are preferably row wirings not adjacent to each other.

The simultaneous selection row wirings are preferably row wirings having similar current values upon selection.

The simultaneous selection row wirings are preferably row wirings having similar compensation potentials applied from the column wirings upon selection.

The number of simultaneous driving row wirings may be changed to repeat the voltage application step a plurality of number of times.

The number of simultaneous selection row wirings may be determined based on power applied to the electron source in the voltage application step.

The simultaneous selection row wirings may be determined so that differences between potentials applied to the second portions of the respective conductive members connected to a plurality of simultaneously selected row wirings and common column wirings are set to not more than a predetermined value.

The potential applied to the column wiring in the voltage application step may be determined so that differences between potentials applied to the second portions of the respective conductive members connected to a plurality of simultaneously selected row wirings and common column wirings are set to not more than a predetermined value.

The potential applied via the column wiring may be determined based on current values flowing through selection row wirings.

The potential applied via the column wiring may be determined based on an average of currents flowing through simultaneous selection row wirings.

The method may further comprise the step of determining whether current values flowing through simultaneous selection row wirings are used to calculate an average.

Determination may be done based on a difference between a predetermined value and a maximum one of current values flowing through simultaneous selection row wirings, or a difference between a predetermined value and a minimum one of current values flowing through simultaneous selection row wirings.

The voltage application step preferably comprises the step of controlling the voltage applied to the conductive member to not less than a predetermined value.

The voltage application step preferably comprises the step of controlling the potential applied via the column wiring to not less than a predetermined value.

The method may further comprise the step of determining which of the plurality of row wirings is not selected.

The unselected row wiring may be an abnormal row wiring.

The unselected row wiring may be a row wiring flowing a current value which falls outside a predetermined range.

The unselected row wiring may be a row wiring having a rate of change in a flowing current value which falls outside a predetermined range.

The method preferably further comprises the further voltage application step of applying a voltage to conductive members serving as at least part of electron-emitting devices connected to an unselected row wiring.

The further voltage application step preferably comprises the step of selecting an unselected row wiring to apply a predetermined potential, and applying a potential different from a potential applied to the first portions from the row wiring receiving the predetermined potential via the plurality of column wirings, to the second portions of conductive members connected to the row wiring receiving the predetermined potential, thereby applying a voltage.

It is preferable that the further voltage application step comprise the step of selecting an unselected row wiring to apply a predetermined potential, and applying a potential different from a potential applied to the first portions from the row wiring receiving the predetermined potential via the plurality of column wirings, to the second portions of conductive members connected to the row wiring receiving the predetermined potential, thereby applying a voltage, and the potential applied to the second portions of the plurality of conductive members be set to reduce differences between voltages applied to the respective conductive members caused by differences between potentials at portions connected to the first portions of the respective conductive members on the row wiring.

It is preferable that the voltage application step comprise the step of determining simultaneous selection row wirings, and the determination step comprise the step of measuring wiring resistances of the plurality of row wirings, and determining simultaneous selection row wirings on the basis of the resistances.

The method may further comprise the step of arranging conductive members, and the determination step may be done before the conductive members are arranged.

The method may further comprise the step of forming gap portions serving as electron-emitting portions in conductive members, and the determination step may be done before the gap portions are formed. The determination step may be done before the gap portions are formed after the conductive members are formed.

The voltage application step preferably comprises the step of determining simultaneous selection row wirings, and the determination step may comprise the step of determining simultaneous selection row wirings on the basis of a structure of the electron source.

It is preferable that the voltage application step comprise the step of determining simultaneous selection row wirings, and the determination step comprise the step of determining simultaneous selection row wirings on the basis of potential drops on extraction wirings respectively connected to the plurality of row wirings. In particular, row wirings having similar potential drops are preferably simultaneously selected.

It is preferable that the voltage application step comprise the step of determining simultaneous selection row wirings, and the determination step comprise the step of determining simultaneous selection row wirings on the basis of atmospheres at positions of respective conductive members. In particular, row wirings having similar atmosphere distribution at the positions of connected conductive members are preferably simultaneously selected.

The determination step preferably comprises the step of determining simultaneous selection row wirings on the basis of atmospheric pressures at positions of respective conductive members. Especially, row wirings having similar atmosphere partial pressures at the positions of connected conductive members are preferably simultaneously selected. As described above, this aspect can be suitably used in the step of depositing a deposit on the electron-emitting portion, and simultaneous selection row wirings are suitably determined based on the partial pressure of a material as the deposit material.

The present invention includes some aspects as an electron source manufacturing apparatus.

An apparatus for manufacturing an electron source having a plurality of electron-emitting devices comprises a device for applying a voltage to some of a plurality of row wirings and a plurality of conductive members serving as at least part of the electron-emitting devices connected to simultaneously selected row wirings by using a matrix wiring made up of pluralities of row and column wirings arranged substantially along directions perpendicular to each other, the voltage application device having means for applying a potential to first portions of the plurality of conductive members via the selected row wirings, and means for applying a potential to second portions of the plurality of conductive members via the plurality of column wirings, wherein the potential applied to the second portions of the plurality of conductive members is set to reduce differences between voltages applied to the respective conductive members caused by differences between potentials at portions connected to the first portions of the respective conductive members on the row wiring.

Detailed embodiments will be described below.

First Embodiment

An activation apparatus for a surface-conduction emission type electron-emitting device according to an embodiment of the present invention will be described with reference to FIG. 1. First, the arrangement and manufacturing method of a display panel to which the present invention is applied will be exemplified.

Arrangement and Manufacturing Method of Display Panel

Figure 1:
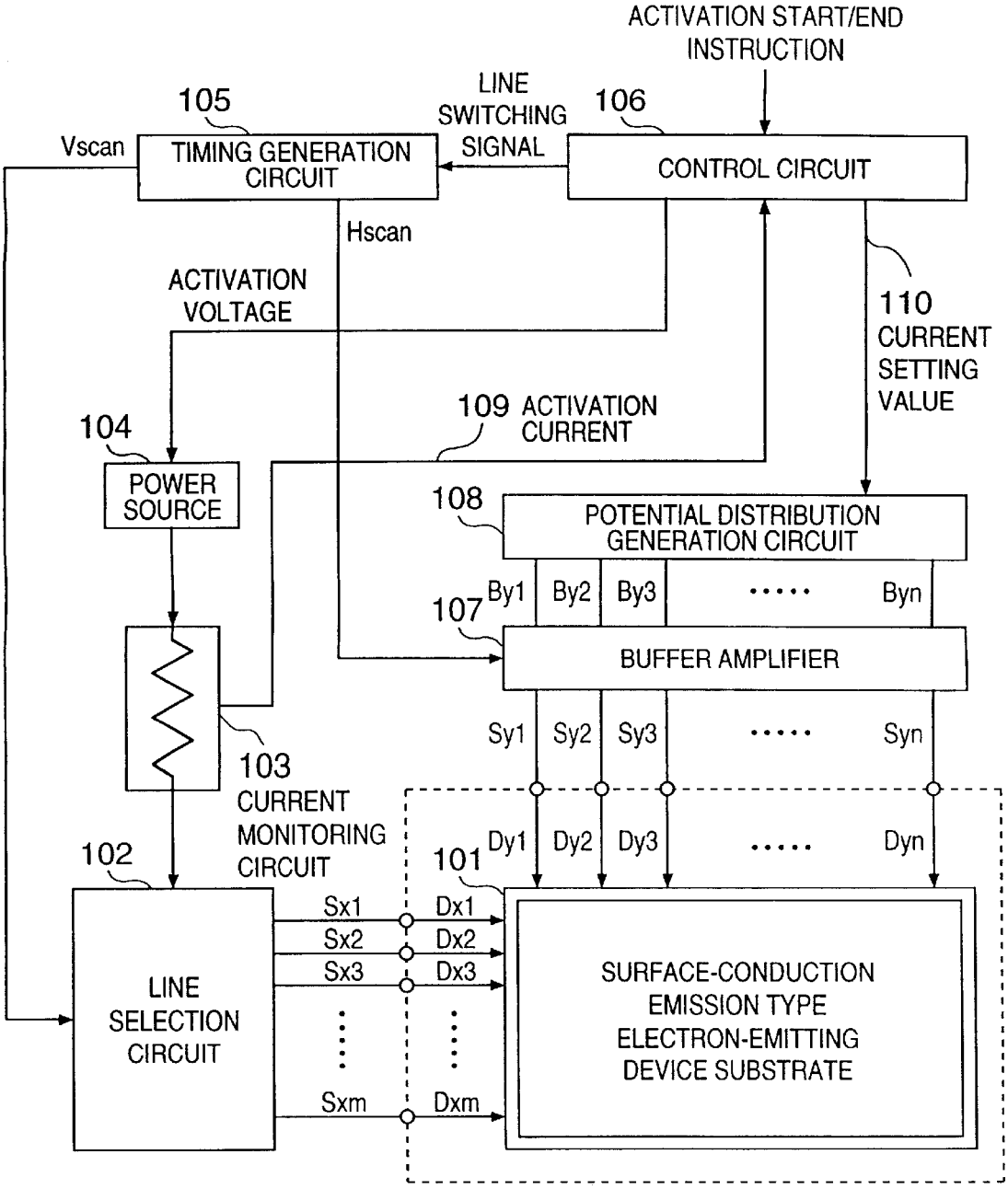
FIG. 1 is a block diagram showing an activation apparatus according to the first embodiment of the present invention.
Figure 22:
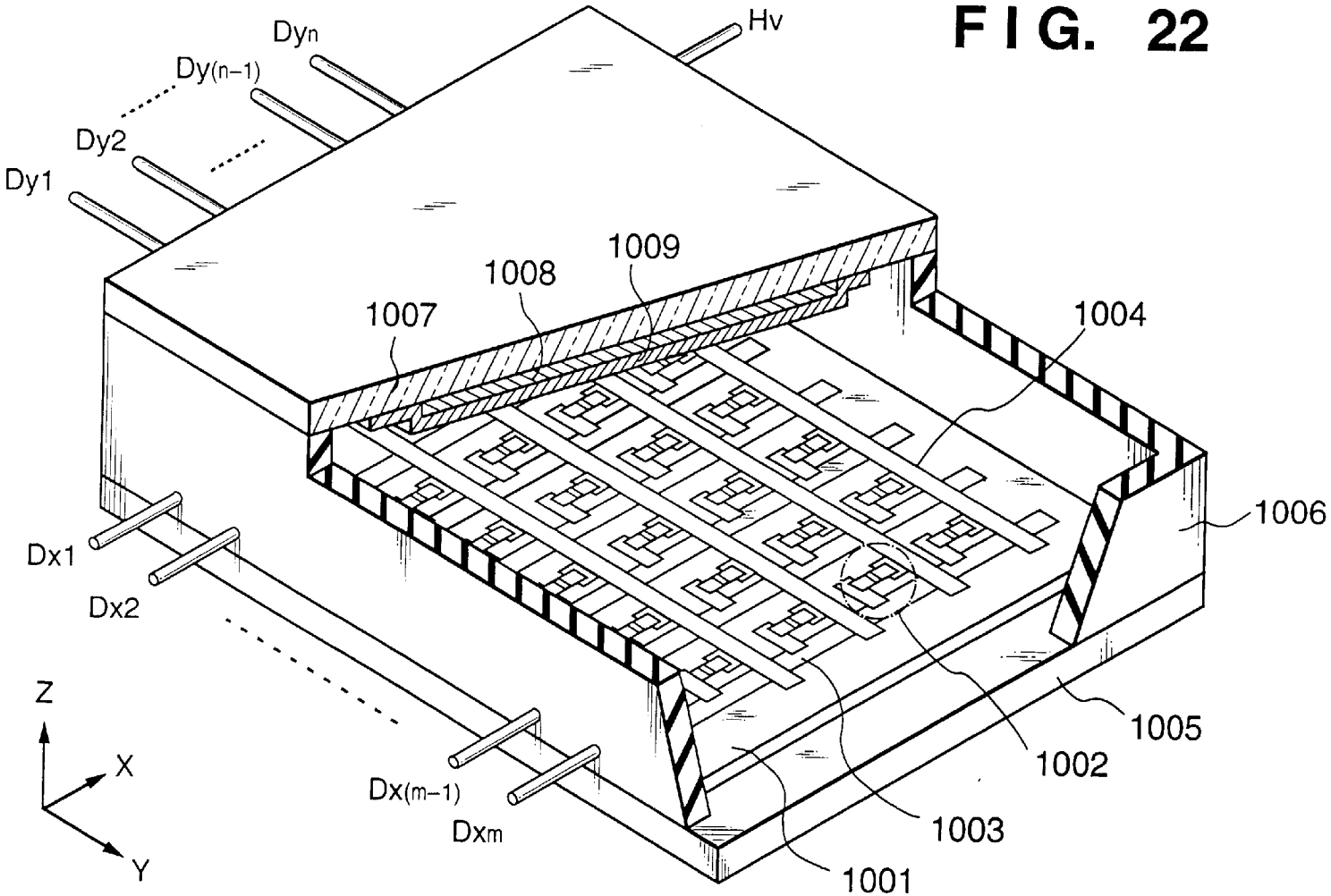
FIG. 22 is a partially cutaway perspective view showing the display panel of an image display apparatus according to the embodiment of the present invention.

FIG. 22 is a partially cutaway perspective view of a display panel 101 used in the embodiment in FIG. 1, showing the internal structure of the panel.

In FIG. 22, reference numeral 1005 denotes a rear plate; 1006, a side wall; and 1007, a face plate. These parts 1005 to 1007 constitute an airtight container for maintaining the inside of the display panel vacuum. To construct the airtight container, it is necessary to seal-connect the respective parts to obtain sufficient strength and maintain airtight condition. For example, frit glass is applied to junction portions, and sintered at 400 to 500° C. in air or nitrogen atmosphere, thus the parts are seal-connected. A method for exhausting air from the inside of the container will be described later.

The rear plate 1005 has a substrate 1001 fixed thereon, on which n×m cold cathode devices 1002 are formed (m, n=positive integer equal to 2 or more, properly set in accordance with a desired number of display pixels. For example, in a display apparatus for high-resolution television display, preferably n=3,000 or more, m=1,000 or more. In the first embodiment, n=3,072 or more, m=1,024.) The n×m cold cathode devices are arranged in a simple matrix with m row-direction wirings 1003 and n column-direction wirings 1004. The portion constituted by the components denoted by references 1001 to 1004 will be referred to as a multi electron source. The manufacturing method and structure of the multi electron source will be described in detail later.

In this embodiment, the substrate 1001 of the multi electron source is fixed to the rear plate 1005 of the airtight container. If, however, the substrate 1001 of the multi electron source has sufficient strength, the substrate 1001 of the multi electron source may also serve as the rear plate of the airtight container.

Figure 23A:
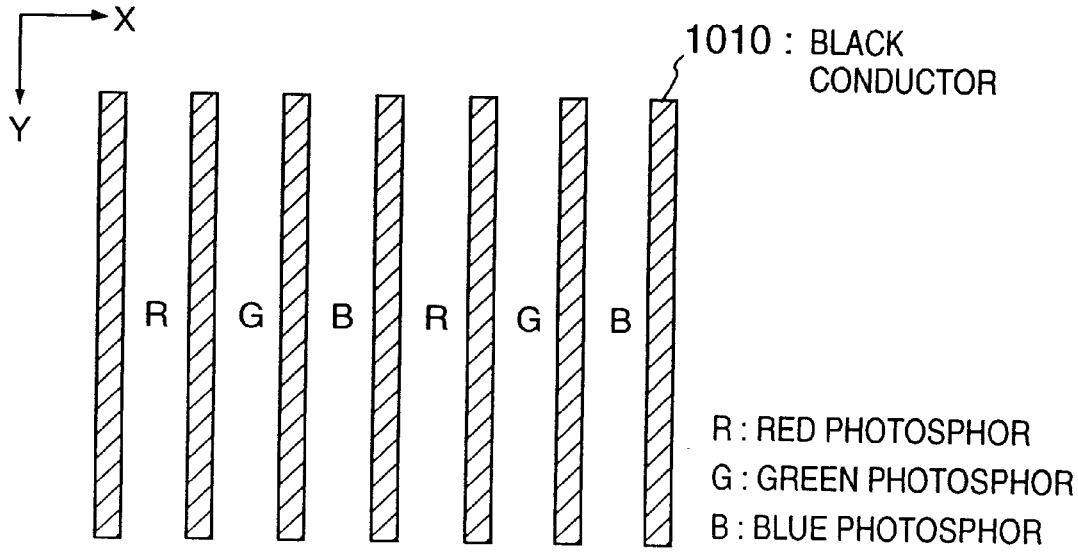
FIGS. 23A and 23B are plan views showing examples of the alignment of fluorescent substances on the face plate of the display panel.

A fluorescent film 1008 is formed on the lower surface of the face plate 1007. As this embodiment is a color display apparatus, the fluorescent film 1008 is coated with red, green, and blue fluorescent substances, i.e., three primary color fluorescent substances used in the CRT field. As shown in FIG. 23A. the respective color fluorescent substances are formed into a striped structure, and black conductive members 1010 are provided between the stripes of the fluorescent substances. The purpose of providing the black conductive members 1010 is to prevent display color misregistration even if the electron-beam irradiation position is shifted to some extent, to prevent degradation of display contrast by shutting off reflection of external light, to prevent the charge-up of the fluorescent film by the electron beam, and the like. As a material for the black conductive members 1010, graphite is used as a main component, but other materials may be used so long as the above purpose is attained.

Figure 23B:
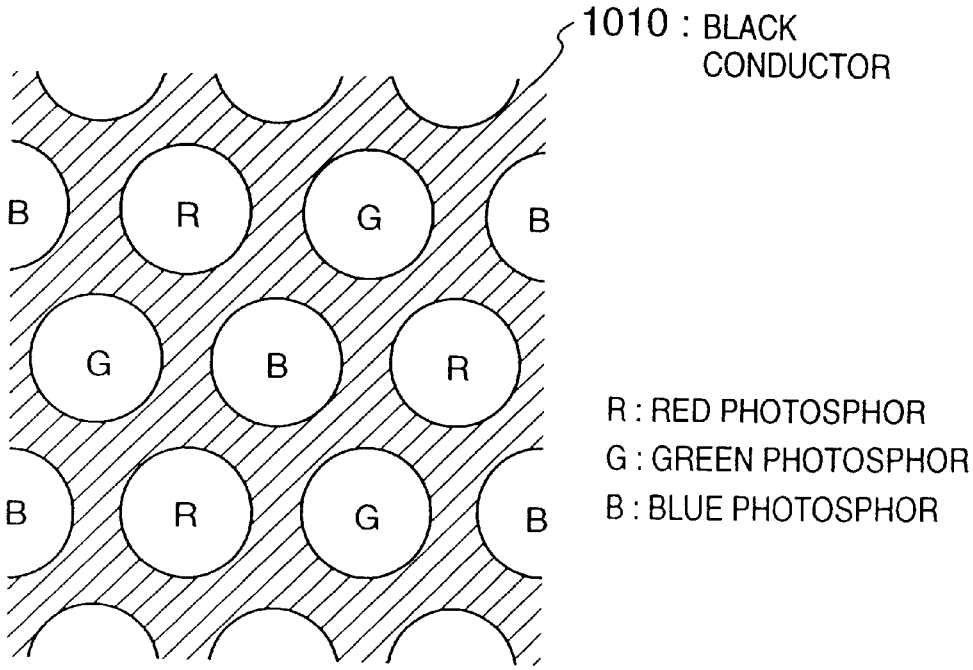

Further, three-primary colors of the fluorescent film is not limited to the stripes as shown in FIG. 23A. For example, delta arrangement as shown in FIG. 23B or any other arrangement may be employed.

Note that when a monochrome display panel is formed, a single-color fluorescent substance may be applied to the fluorescent film 1008, and the black conductive member may be omitted.

Furthermore, a metal back 1009, which is well-known in the CRT field, is provided on the fluorescent film 1008 on the rear plate side. The purpose of providing the metal back 1009 is to improve the light-utilization ratio by mirror-reflecting part of the light emitted by the fluorescent film 1008, to protect the fluorescent film 1008 from collision with negative ions, to be used as an electrode for applying an electron-beam accelerating voltage, to be used as a conductive path for electrons which excited the fluorescent film 1008, and the like. The metal back 1009 is formed by forming the fluorescent film 1008 on the face plate substrate 1007, smoothing the front surface of the fluorescent film, and depositing A1 thereon by vacuum deposition. Note that when fluorescent substances for a low voltage is used for the fluorescent film 1008, the metal back 1009 is not used.

Furthermore, for application of an accelerating voltage or improvement of the conductivity of the fluorescent film, transparent electrodes made of, e.g., ITO may be provided between the face plate substrate 1007 and the fluorescent film 1008, although such electrodes are not used in this embodiment.

$D_{x1}$ to $D_{xm}$, $D_{y1}$ to $D_{yn}$, and Hv are electric connection terminals for an airtight structure provided to electrically connect the display panel to an electric circuit (not shown). $D_{x1}$ to $D_{xm}$ are electrically connected to the row-direction wirings 1003 of the multi electron source; $D_{y1}$ to $D_{yn}$, to the column-direction wirings 1004 of the multi electron source; and Hv, to the metal back 1009 of the face plate.

To evacuate the airtight container, after forming the airtight container, an exhaust pipe and a vacuum pump (neither is shown) are connected, and the airtight container is evacuated to a vacuum of about $10^{-7}$ Torr. Thereafter, the exhaust pipe is sealed. To maintain the vacuum in the airtight container, a getter film (not shown) is formed at a predetermined position in the airtight container immediately before/after the sealing. The getter film is a film formed by heating and evaporating a getter material mainly consisting of, e.g., Ba, by heating or RF heating. The suction effect of the getter film maintains a vacuum of $1\times10^{-5}$ or $1\times10^{-7}$ Torrin the container.

The basic arrangement and manufacturing method of the display panel according to the first embodiment of the present invention have been briefly described above.

A method of manufacturing the multi electron source used in the display panel of this embodiment will be described below. In manufacturing the multi electron source used in the image display apparatus of the present invention, any material, shape, and manufacturing method for cold cathode device devices may be employed as long as an electron source can be obtained by arranging cold cathode devices in a simple matrix. Therefore, cold cathode devices such as surface-conduction emission type electron-emitting devices, FE type devices, or MIM type devices can be used.

Under circumstances where inexpensive display apparatuses having large display areas are required, a surface-conduction emission type electron-emitting device, of these cold cathode devices, is especially preferable. More specifically, the electron-emitting characteristic of an FE type device is greatly influenced by the relative positions and shapes of the emitter cone and the gate electrode, and hence a high-precision manufacturing technique is required to manufacture this device. This poses a disadvantageous factor in attaining a large display area and a low manufacturing cost. According to an MIM type device, the thicknesses of the insulating layer and the upper electrode must be decreased and made uniform. This also poses a disadvantageous factor in attaining a large display area and a low manufacturing cost. In contrast to this, a surface-conduction emission type electron-emitting device can be manufactured by a relatively simple manufacturing method, and hence an increase in display area and a decrease in manufacturing cost can be attained. The present inventors have also found that among the surface-conduction emission type electron-emitting devices, an electron beam source having an electron-emitting portion or its peripheral portion consisting of a fine particle film is excellent in electron-emitting characteristic and can be easily manufactured. Such a device can therefore be most suitably used for the multi electron source of a high-brightness, large-screen image display apparatus. For this reason, in the display panel of this embodiment, surface-conduction emission type electron-emitting devices each having an electron-emitting portion or its peripheral portion made of a fine particle film are used. The basic structure, manufacturing method, and characteristics of the preferred surface-conduction emission type electron-emitting device will be described first. The structure of the multi electron source having many devices arranged in a simple matrix will be described later.

Preferred Structure of Surface-Conduction Emission Type Electron-Emitting Device and Preferred Manufacturing Method Typical examples of surface-conduction emission type electron-emitting devices each having an electron-emitting portion or its peripheral portion made of a fine particle film include two types of devices, namely flat and step type devices.

Flat Surface-Conduction Emission Type Electron-Emitting Device

Figure 24A:
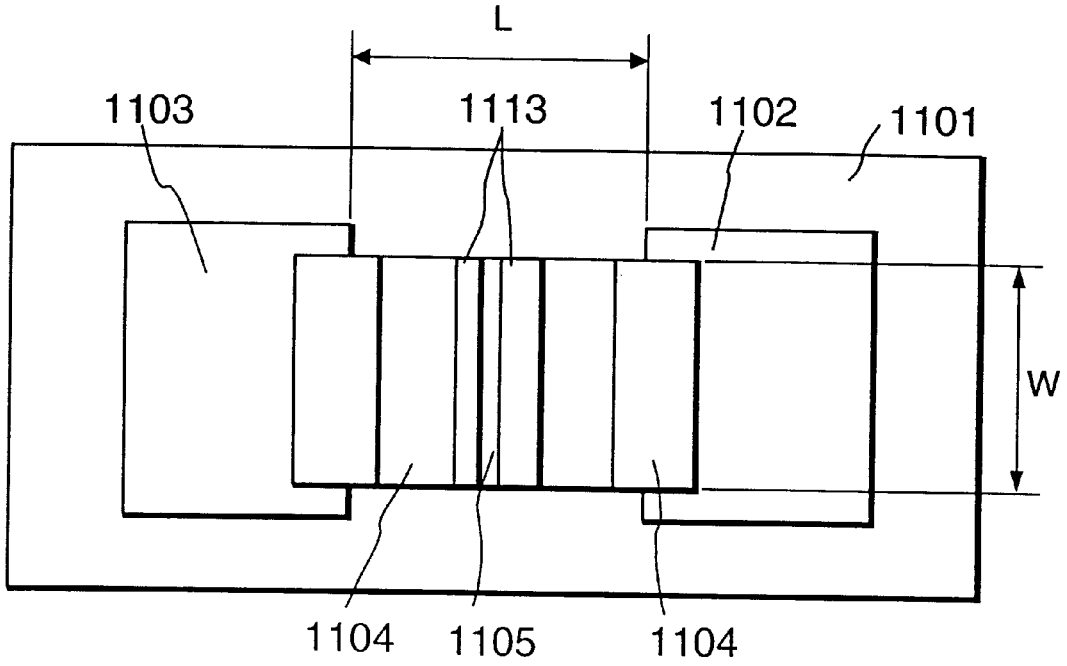
FIGS. 24A and 24B are a plan view and a sectional view, respectively, showing a flat surface-conduction emission type electron-emitting device used in the embodiment.
Figure 24B:
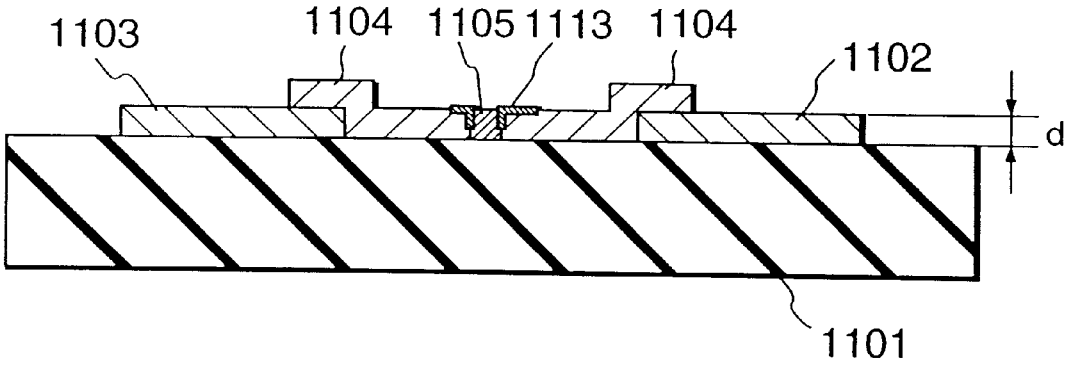

First, the structure and manufacturing method of a flat surface-conduction emission type electron-emitting device will be described. FIGS. 24A and 24B are a plan view and a sectional view, respectively, for explaining the structure of the flat surface-conduction emission type electron-emitting device. Referring to FIGS. 24A and 24B, reference numeral 1101 denotes a substrate; 1102 and 1103, device electrodes; 1104, a conductive thin film; 1105, an electron-emitting portion formed by the forming processing; and 1113, a thin film formed by the activation processing.

As the substrate 1101, various glass substrates of, e.g., quartz glass and soda-lime glass, various ceramic substrates of, e.g., alumina, or any of those substrates with an insulating layer formed thereon can be employed.

The device electrodes 1102 and 1103, provided in parallel to the substrate 1101 and opposing to each other, comprise conductive material. For example, any material of metals such as Ni, Cr, Au, Mo, W, Pt, Ti, Cu, Pd and Ag, or alloys of these metals, otherwise metal oxides such as $In_2O_3$—$SnO_2$, or semiconductive material such as polysilicon, can be employed. These electrodes 1102 and 1103 can be easily formed by the combination of a film-forming technique such as vacuum-evaporation and a patterning technique such as photolithography or etching, however, any other method (e.g., printing technique) may be employed.

The shape of the electrodes 1102 and 1103 is appropriately designed in accordance with an application object of the electron-emitting device. Generally, an interval L between electrodes is designed by selecting an appropriate value in a range from hundreds angstroms to hundreds micrometers. Most preferable range for a display apparatus is from several micrometers to ten micrometers. As for electrode thickness d, an appropriate value is selected in a range from hundreds angstroms to several micrometers.

The conductive thin film 1104 comprises a fine particle film. The "fine particle film" is a film which contains a lot of fine particles (including masses of particles) as film-constituting members. In microscopic view, normally individual particles exist in the film at predetermined intervals, or in adjacent to each other, or overlapped with each other.

One particle has a diameter within a range from several angstroms to thousand angstroms. Preferably, the diameter is within a range from 10 angstroms to 200 angstroms. The thickness of the fine particle film is appropriately set in consideration of conditions as follows. That is, condition necessary for electrical connection to the device electrode 1102 or 1103, condition for the forming processing to be described later, condition for setting electrical resistance of the fine particle film itself to an appropriate value to be described later etc.

Specifically, the thickness of the film is set in a range from several angstroms to thousand angstroms, more preferably, 10 angstroms to 500 angstroms.

Materials used for forming the fine particle film are. e.g., metals such as Pd, Pt, Ru, Ag, Au, Ti, In, Cu, Cr, Fe, Zn, Sn, Ta, W and Pb, oxides such as PdO, $SnO_2$, $In_2O_3$, PbO and $Sb_2O_3$, borides such as $HfB_2$, $ZrB_2$, $LaB_6$, $CeB_6$, $YB_4$ and $GdB_4$, carbides such as TiC, ZrC, HfC, TaC, SiC, and WC, nitrides such as TiN, ZrN and HfN, semiconductors such as Si and Ge, and carbons. Any of appropriate material(s) is appropriately selected.

As described above, the conductive thin film 1104 is formed With a fine particle film, and sheet resistance of the film is set to reside within a range from $10^3$ to $10^7$ (Ω/□).

As it is preferable that the conductive thin film 1104 as is electrically connected to the device electrodes 1102 and 1103, they are arranged so as to overlap with each other at one portion. In FIGS. 24A and 24B, the respective parts are overlapped in order of, the substrate, the device electrodes, and the conductive thin film, from the bottom. This overlapping order may be, the substrate, the conductive thin film, and the device electrodes, from the bottom.

The electron-emitting portion 1105 is a fissured portion formed at a part of the conductive thin film 1104. The electron-emitting portion 1105 has a resistance characteristic higher than peripheral conductive thin film. The fissure is formed by the forming processing to be described later on the conductive thin film 1104. In some cases, particles, having a diameter of several angstroms to hundreds angstroms, are arranged within the fissured portion. As it is difficult to exactly illustrate actual position and shape of the electron-emitting portion, therefore, FIGS. 24A and 24B show the fissured portion schematically.

The thin film 1113, which comprises carbon or carbon compound material, covers the electron-emitting portion 1115 and its peripheral portion. The thin film 1113 is formed by the activation processing to be described later after the forming processing.

The thin film 1113 is preferably graphite monocrystalline, graphite polycrystalline, amorphous carbon, or mixture thereof, and its thickness is 500 angstroms or less, more preferably, 300 angstroms or less.

As it is difficult to exactly illustrate actual position or shape of the thin film 1113, FIGS. 24A and 24B show the film schematically. FIG. 24A shows the device where a part of the thin film 1113 is removed.

The preferred basic structure of the surface-conduction emission type electron-emitting device is as described above. In the embodiment, the device has the following constituents.

That is, the substrate 1101 comprises a soda-lime glass, and the device electrodes 1102 and 1103, an Ni thin film. The electrode thickness d is 1,000 angstroms and the electrode interval L is 2 μm.

The main material of the fine particle film is Pd or PdO. The thickness of the fine particle film is about 100 angstroms, and its width W is 100 μm.

Next, a method of manufacturing a preferred flat surface-conduction emission type electron-emitting device will be described with reference to FIGS. 25A to 25D which are sectional views showing the manufacturing processes of the surface-conduction emission type electron-emitting device. Note that reference numerals are the same as those in FIG. 24B.

Figure 25A:
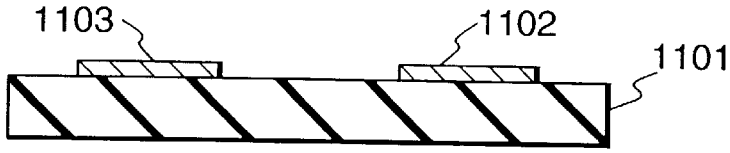
FIGS. 25A, 25B, 25C, 25D, and 25E are sectional views showing the steps in manufacturing the flat surface-conduction emission type electron-emitting device.

1) First, as shown in FIG. 25A, the device electrodes to 1102 and 1103 are formed on the substrate 1101.

In formation, first, the substrate 1101 is fully washed with a detergent, pure water and an organic solvent, then, material of the device electrodes is deposited there. (As a depositing method, a vacuum film-forming technique such as evaporation and sputtering may be used.) Thereafter, patterning using a photolithography etching technique is performed on the deposited electrode material. Thus, the pair of device electrodes (1102 and 1103) shown in FIG. 24A are formed.

Figure 25B:
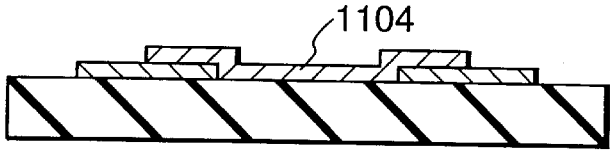

2) Next, as shown in FIG. 25B, the conductive thin film 1104 is formed.

In formation, first, an organic metal solvent is applied to the substrate in FIG. 25A, then the applied solvent is dried and sintered, thus forming a fine particle film. Thereafter, the fine particle film is patterned into a predetermined shape by the photolithography etching method. The organic metal solvent means a solvent of organic metal compound containing material of minute particles, used for forming the conductive thin film, as main component. (More specifically, Pd is used in this embodiment. In the embodiment, application of organic metal solvent is made by dipping, however, any other method such as a spinner method and spraying method may be employed.)

As a film-forming method of the conductive thin film made with the minute particles, the application of organic metal solvent used in the embodiment can be replaced with any other method such as a vacuum evaporation method, a sputtering method or a chemical vapor-phase accumulation method.

Figure 25C:
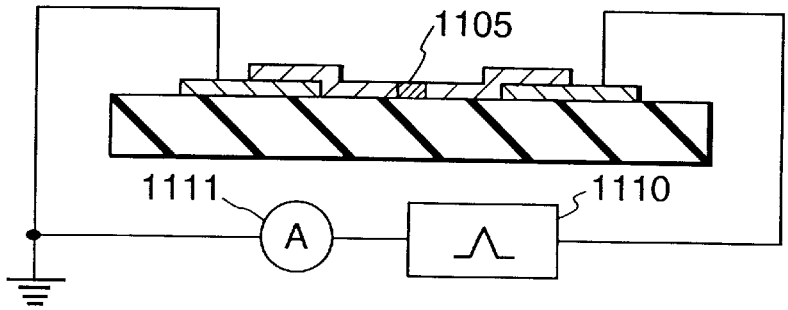

3) Then, as shown in FIG. 25C, appropriate voltage is applied between the device electrodes 1102 and 1103, from a power source 1110 for the forming processing, then the forming processing is performed, thus forming the electron-emitting portion 1105.

The forming processing here is electric energization of a conductive thin film 1104 to appropriately destroy, deform, or deteriorate a part of the conductive thin film, thus changing the film to have a structure suitable for electron emission. In this embodiment, a fine particle film is used as the conductive thin film 1104. In the conductive thin film made of the fine particle film, the portion changed for electron emission (i.e., electron-emitting portion 1105) has an appropriate fissure in the thin film. Comparing the thin film 1104 having the electron-emitting portion 1105 with the thin film before the forming processing, the electrical resistance measured between the device electrodes 1102 and 1103 has greatly increased.

Figure 26:
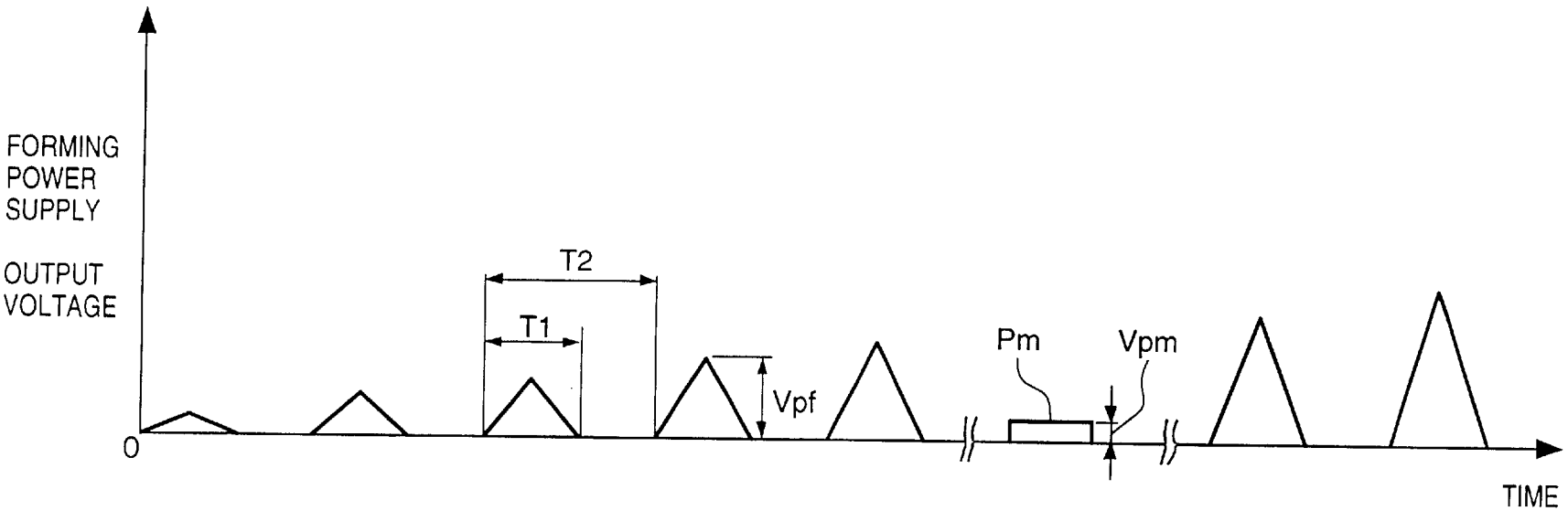
FIG. 26 is a graph showing an application voltage waveform in forming processing.

The electrification method will be explained in more detail with reference to FIG. 26 showing an example of waveform of appropriate voltage applied from the forming power source 1110. Preferably, in case of forming a conductive thin film of a fine particle film, a pulse-like voltage is employed. In this embodiment, as shown in FIG. 26, a triangular-wave pulse having a pulse width T1 is continuously applied at pulse interval of T2. Upon application, a wave peak value Vpf of the triangular-wave pulse is sequentially increased. Further, a monitor pulse Pm to monitor status of forming the electron-emitting portion 1105 is inserted between the triangular-wave pulses at appropriate intervals, and current that flows at the insertion is measured by a galvanometer 1111.

In this embodiment, in $10^{-5}$ Torr vacuum atmosphere, the pulse width T1 is set to 1 msec; and the pulse interval T2, to 10 msec. The wave peak value Vpf is increased by 0.1 V, at each pulse. Each time the triangular-wave has been applied for five pulses, the monitor pulse Pm is inserted. To avoid ill-effecting the forming processing, a voltage Vpm of the monitor pulse is set to 0.1 V. when the electrical resistance between the device electrodes 1102 and 1103 becomes $1\times10^{6}$ Ω, i.e., the current measured by the galvanometer 1111 upon application of monitor pulse becomes $1\times10^{-7}$ A or less, the electrification of the forming processing is terminated.

Note that the above processing method is preferable to the surface-conduction emission type electron-emitting device of this embodiment. In case of changing the design of the surface-conduction emission type electron-emitting device concerning, e.g., the material or thickness of the fine particle film, or the device electrode interval L, the conditions for electrification are preferably changed in accordance with the change of device design.

Figure 25D:
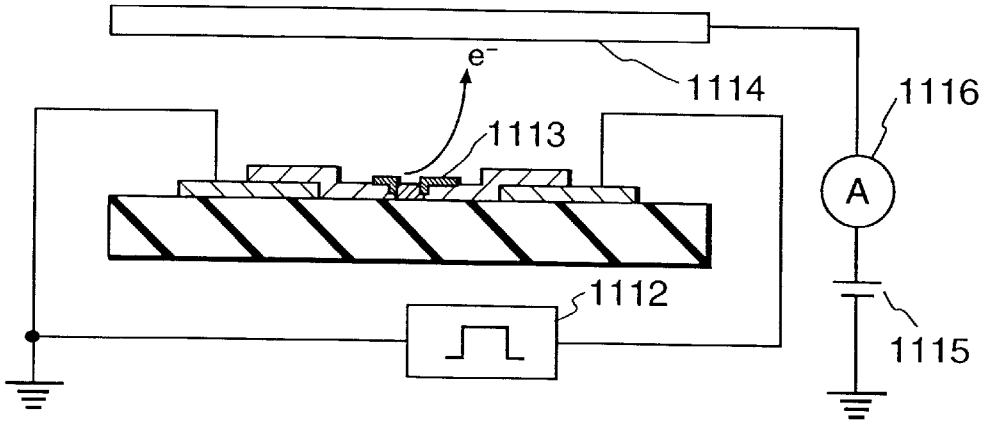

(4) Next, as shown in FIG. 25D, appropriate voltage is applied, from an activation power source 1112, between the device electrodes 1102 and 1103, and the activation processing is performed to improve electron-emitting characteristic.

The activation processing here is electrification of the electron-emitting portion, particularly, the electron-emitting portion 1105 formed by the forming processing, on appropriate condition(s), for depositing carbon or carbon compound around the electron-emitting portion 1105. In FIG. 25D, the deposited material of carbon or carbon compound is shown as material 1113. Comparing the electron-emitting portion 1105 with that before the activation processing, the emission current at the same application voltage has become, typically 100 times or greater.

The activation is made by periodically applying a voltage pulse in $10^{-4}$ or $10^{-5}$ Torr vacuum atmosphere, to accumulate carbon or carbon compound mainly derived from organic compound(s) existing in the vacuum atmosphere. The accumulated material 1113 is any of graphite monocrystalline, graphite polycrystalline, amorphous carbon or mixture thereof. The thickness of the accumulated material 1113 is 500 angstroms or less, more preferably, 300 angstroms or less.

Figure 27A:
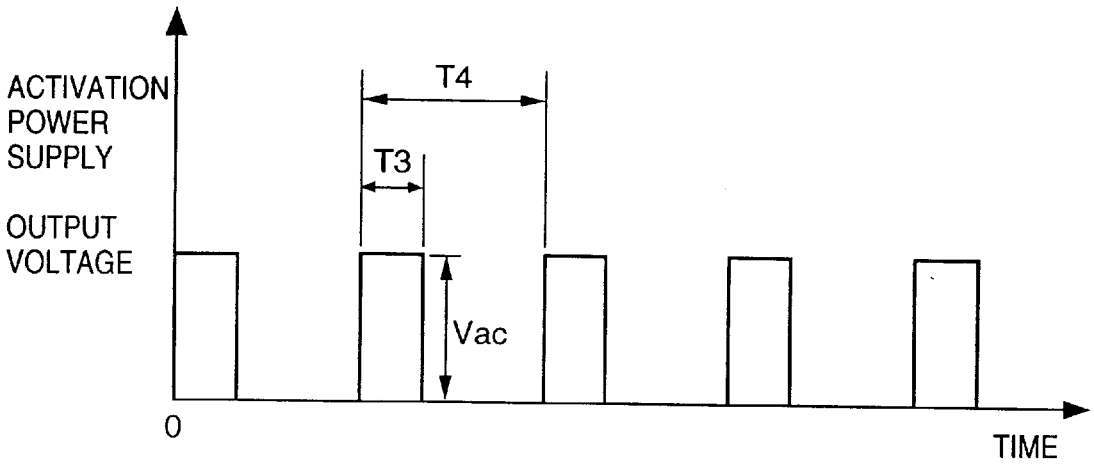
FIGS. 27A and 27B are graphs respectively showing the an application voltage waveform and a change in emission current $I_e$ in the activation processing.

The electrification method will be described in more detail with reference to FIG. 27A showing an example of waveform of appropriate voltage applied from the activation power source 1112. In this embodiment, the activation processing is performed by periodically applying a rectangular wave at a predetermined voltage. A rectangular-wave voltage Vac is set to 14 V; a pulse width T3, to 1 msec; and a pulse interval T4, to 10 msec. Note that the above electrification conditions are preferable for the surface-conduction emission type electron-emitting device of the embodiment. In the case in which the design of the surface-conduction emission type electron-emitting device is changed, the electrification conditions are preferably changed in accordance with the change of device design.

Figure 27B:
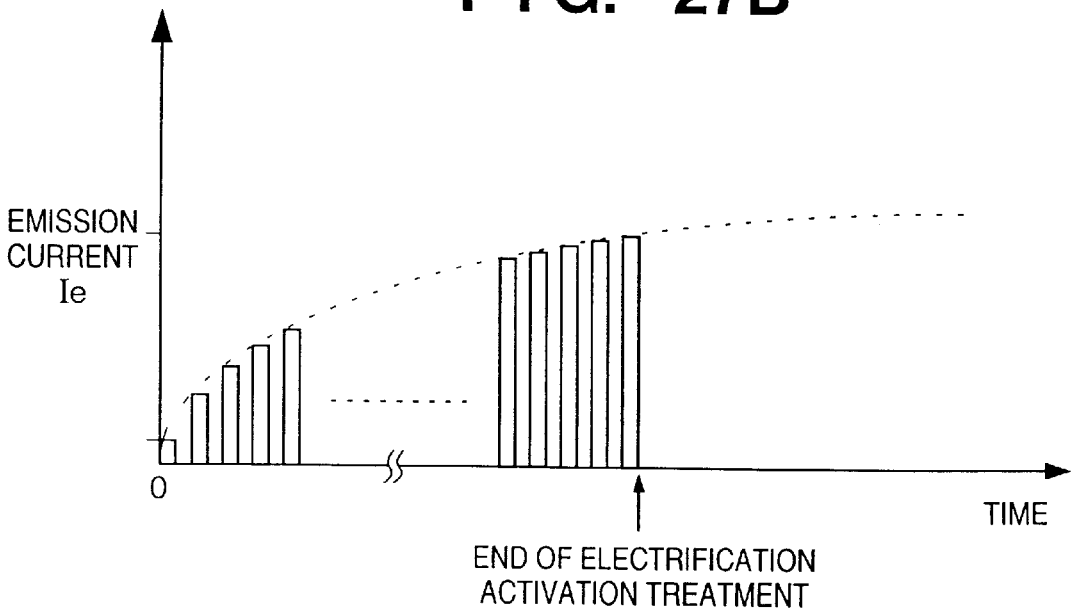

In FIG. 25D, reference numeral 1114 denotes an anode electrode, connected to a direct-current (DC) high-voltage power source 1115 and a galvanometer 1116, for capturing emission current $L_c$ emitted from the surface-conduction emission type electron-emitting device. (In the case in which the substrate 1101 is incorporated into the display panel before the activation processing, the A1 layer on the fluorescent surface of the display panel is used as the anode electrode 1114.) While applying voltage from the activation power source 1112, the galvanometer 1116 measures the emission current $I_e$, thus monitors the progress of activation processing, to control the operation of the activation power source 1112. FIG. 27B shows an example of the emission current $I_e$ measured by the galvanometer 1116. As application of pulse voltage from the activation power source 1112 is started in this manner, the emission current $I_e$ increases with elapse of time, gradually comes into saturation, and almost never increases then. At the substantial saturation point, the voltage application from the activation power source 1112 is stopped, then the activation processing is terminated.

Note that the above electrification conditions are preferable to the surface-conduction emission type electron-emitting device of the embodiment. In case of changing the design of the surface-conduction emission type electron-emitting device, the conditions are preferably changed in accordance with the change of device design.

Figure 25E:
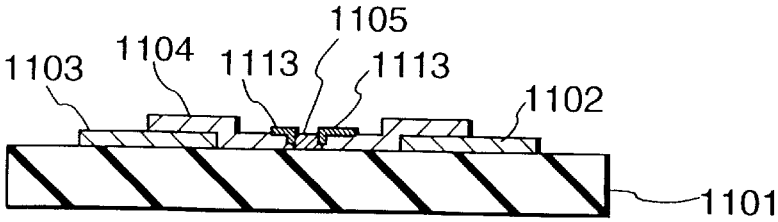

As described above, the surface-conduction emission type electron-emitting device as shown in FIG. 25E is manufactured.

Step Surface-Conduction Emission Type Electron-Emitting Device

Next, another typical structure of the surface-conduction emission type electron-emitting device where an electron-emitting portion or its peripheral portion is formed of a fine particle film, i.e., a stepped surface-conduction emission type electron-emitting device will be described.

Figure 28:
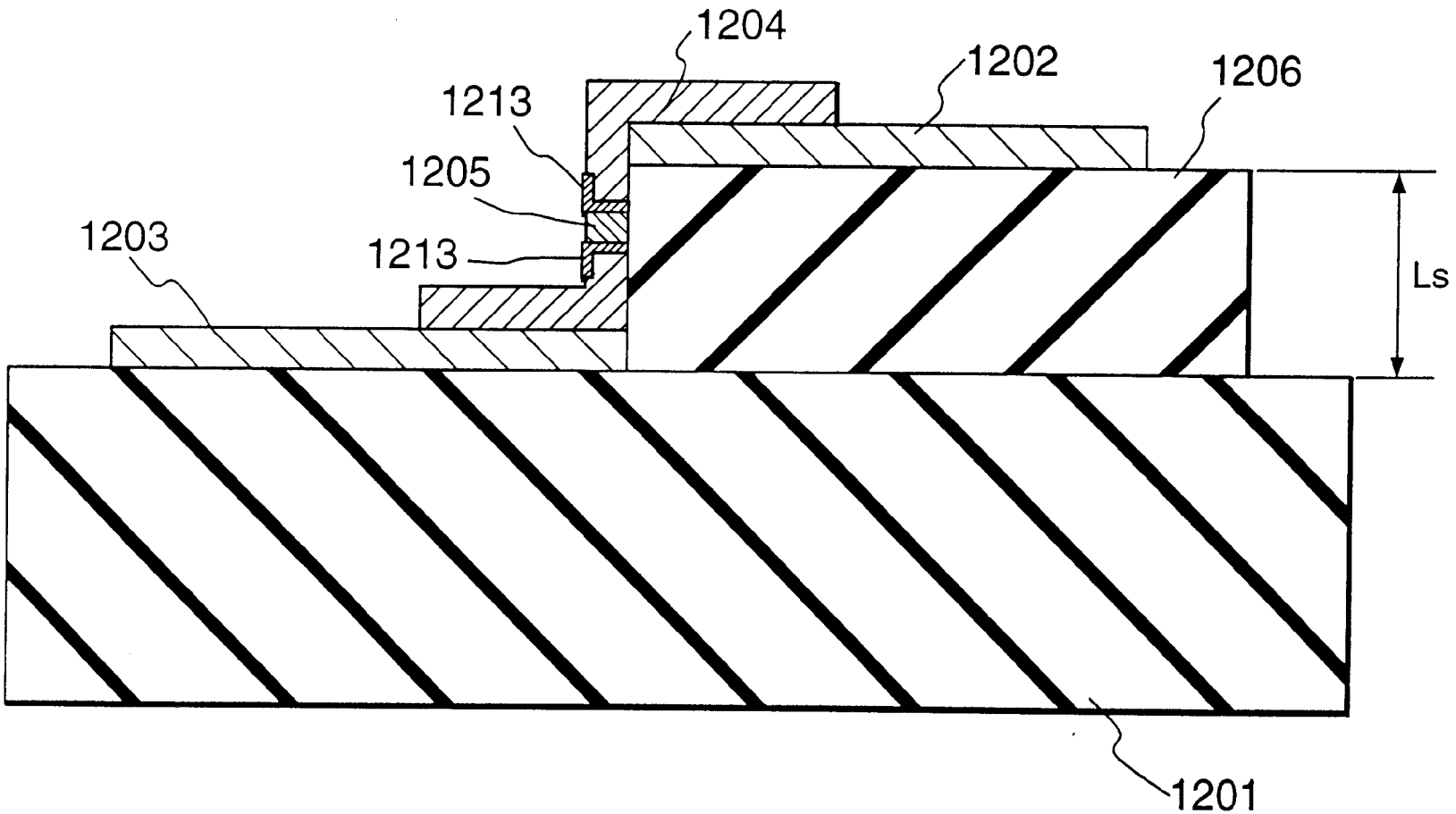
FIG. 28 is a sectional view showing a step surface-conduction emission type electron-emitting device used in the embodiment.

FIG. 28 is a sectional view schematically showing the basic construction of the step surface-conduction emission type electron-emitting device. Referring to FIG. 28, reference numeral 1201 denotes a substrate; 1202 and 1203, device electrodes; 1206, a step-forming member for making height difference between the electrodes 1202 and 1203; 1204, a conductive thin film using a fine particle film; 1205, an electron-emitting portion formed by the forming processing; and 1213, a thin film formed by the activation processing.

Difference between the step device from the above-described flat device is that one of the device electrodes (1202 in this example) is provided on the step-forming member 1206 and the conductive thin film 1204 covers the side surface of the step-forming member 1206. The device interval L in FIG. 24A is set in this structure as a height difference Ls corresponding to the height of the step-forming member 1206. Note that the substrate 1201, the device electrodes 1202 and 1203, the conductive thin film 1204 using the fine particle film can comprise the materials given in the explanation of the flat surface-conduction emission type electron-emitting device. Further, the step-forming member 1206 comprises electrically insulating material such as $SiO_2$.

Next, a method of manufacturing the stepped surface-conduction emission type electron-emitting device will be described with reference FIGS. 29A to 29F which are sectional views showing the manufacturing processes. In these figures, reference numerals of the respective parts are the same as those in FIG. 28.

Figure 29A:
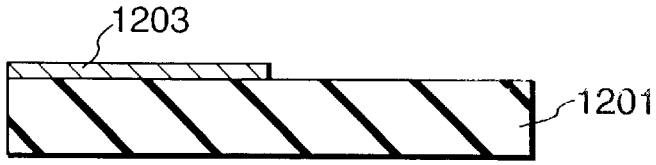
FIGS. 29A. 29B, 29C, 29D, 29E, and 29F are sectional views showing the steps in manufacturing the step surface-conduction emission type electron-emitting device.

(1) First, as shown in FIG. 29A, the device electrode 1203 is formed on the substrate 1201.

Figure 29B:
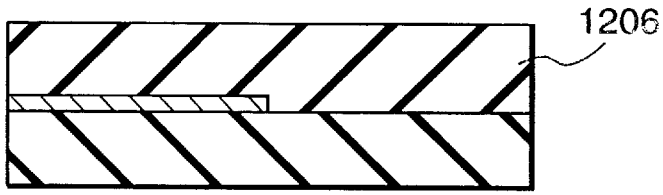

(2) Next, as shown in FIG. 29B, an insulating layer for forming the step-forming member is deposited. The insulating layer may be formed by accumulating, e.g., $SiO_2$ by a sputtering method, however, the insulating layer may be formed by a film-forming method such as a vacuum evaporation method or a printing method.

Figure 29C:
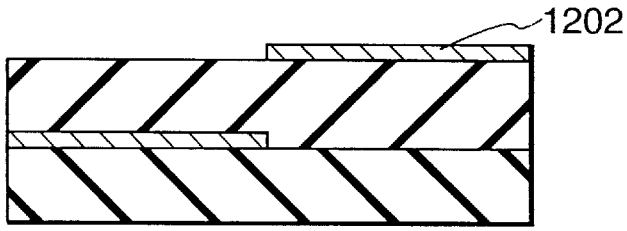

(3) Next, as shown in FIG. 29C, the device electrode 1202 is formed on the insulating layer.

Figure 29D:
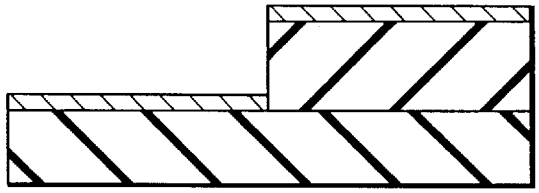

(4) Next, as shown in FIG. 29D, a part of the insulating layer is removed by using, e.g., an etching method, to expose the device electrode 1203.

Figure 29E:
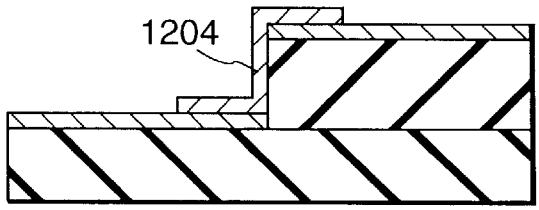

(5) Next, as shown in FIG. 29E, the conductive thin film 1204 using the fine particle film is formed. Upon formation, similar to the above-described flat device structure, a film-forming technique such as an applying to method is used.

(6) Next, similar to the flat device structure, the forming processing is performed to form an electron-emitting portion. (The forming processing similar to that explained using FIG. 25C may be performed.)

(7) Next, similar to the flat device structure, the activation processing is performed to deposit carbon or carbon compound around the electron-emitting portion. (Activation processing similar to that explained using FIG. 25D may be performed).

Figure 29F:
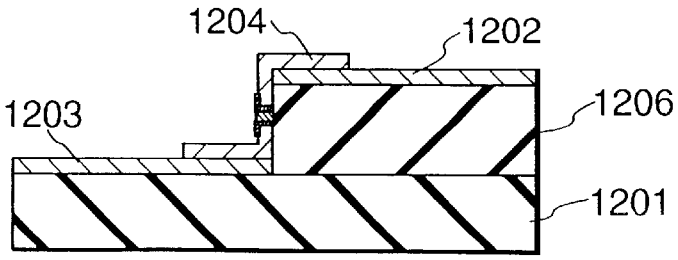

As described above, the stepped surface-conduction emission type electron-emitting device shown in FIG. 29F is manufactured.

Characteristic of Surface-Conduction Emission Type Electron-Emitting Device Used in Display Apparatus The structure and manufacturing method of the flat surface-conduction emission type electron-emitting device and those of the stepped surface-conduction emission type electron-emitting device are as described above. Next, the characteristic of the electron-emitting device used in the display apparatus will be described below.

Figure 30:
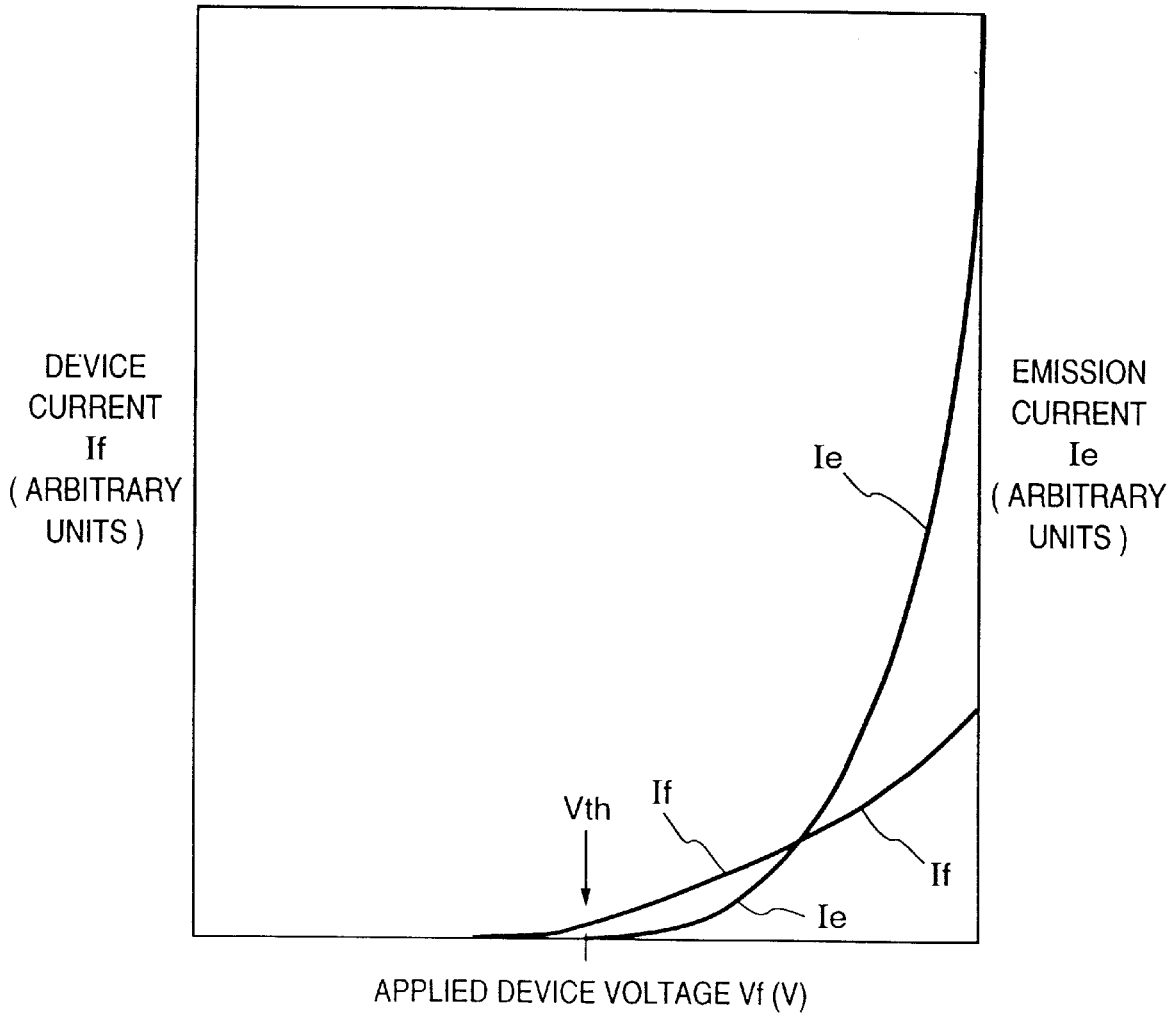
FIG. 30 is a graph showing the typical characteristics of the surface-conduction emission type electron-emitting device used in the embodiment.

FIG. 30 shows a typical example of (emission current $I_e$) to (device voltage (i.e., voltage to be applied to the device) $V_f$) characteristic and (device current $I_f$) to (device application voltage $V_f$) characteristic of the device used in the display apparatus. Note that compared with the device current $I_f$, the emission current $I_e$ is very small, therefore it is difficult to illustrate the emission current $I_e$ by the same measure of that for the device current $I_f$. In addition, these characteristics change due to change of designing parameters such as the size or shape of the device. For these reasons, two lines in the graph of FIG. 30 are respectively given in arbitrary units.

Regarding the emission current $I_e$, the device used in the display apparatus has three characteristics as follows:

First, when voltage of a predetermined level (referred to as "threshold voltage $V_{th}$") or greater is applied to the device, the emission current $I_e$ drastically increases, however, with voltage lower than the threshold voltage $V_{th}$, almost no emission current $I_e$ is detected.

That is, regarding the emission current $I_e$ the device has a nonlinear characteristic based on the clear threshold voltage $V_{th}$.

Second, the emission current $I_e$ changes in dependence upon the device application voltage $V_f$. Accordingly, the emission current $I_e$ can be controlled by changing the device voltage $V_f$.

Third, the emission current $I_e$ is output quickly in response to application of the device voltage $V_f$ to the device. Accordingly, an electrical charge amount of electrons to be emitted from the device can be controlled by changing period of application of the device voltage $V_f$.

The surface-conduction emission type electron-emitting device with the above three characteristics is preferably applied to the display apparatus. For example, in a display apparatus having a large number of devices provided corresponding to the number of pixels of a display screen, if the first characteristic is utilized, display by sequential scanning of display screen is possible. This means that the threshold voltage $V_{th}$ or greater is appropriately applied to a driven device in accordance with a desired emission luminance, while voltage lower than the threshold voltage $V_{th}$ is applied to an unselected device. In this manner, sequentially changing the driven devices enables display by sequential scanning of display screen.

Further, emission luminance can be controlled by utilizing the second or third characteristic, which enables multi-gradation display.

Structure of Multi Electron-Beam Source With Many Devices Arranged in Simple Matrix Next, the structure of the multi electron source having the above-described surface-conduction emission type electron-emitting devices arranged on the substrate with the simple-matrix wiring will be described below.

Figure 31:
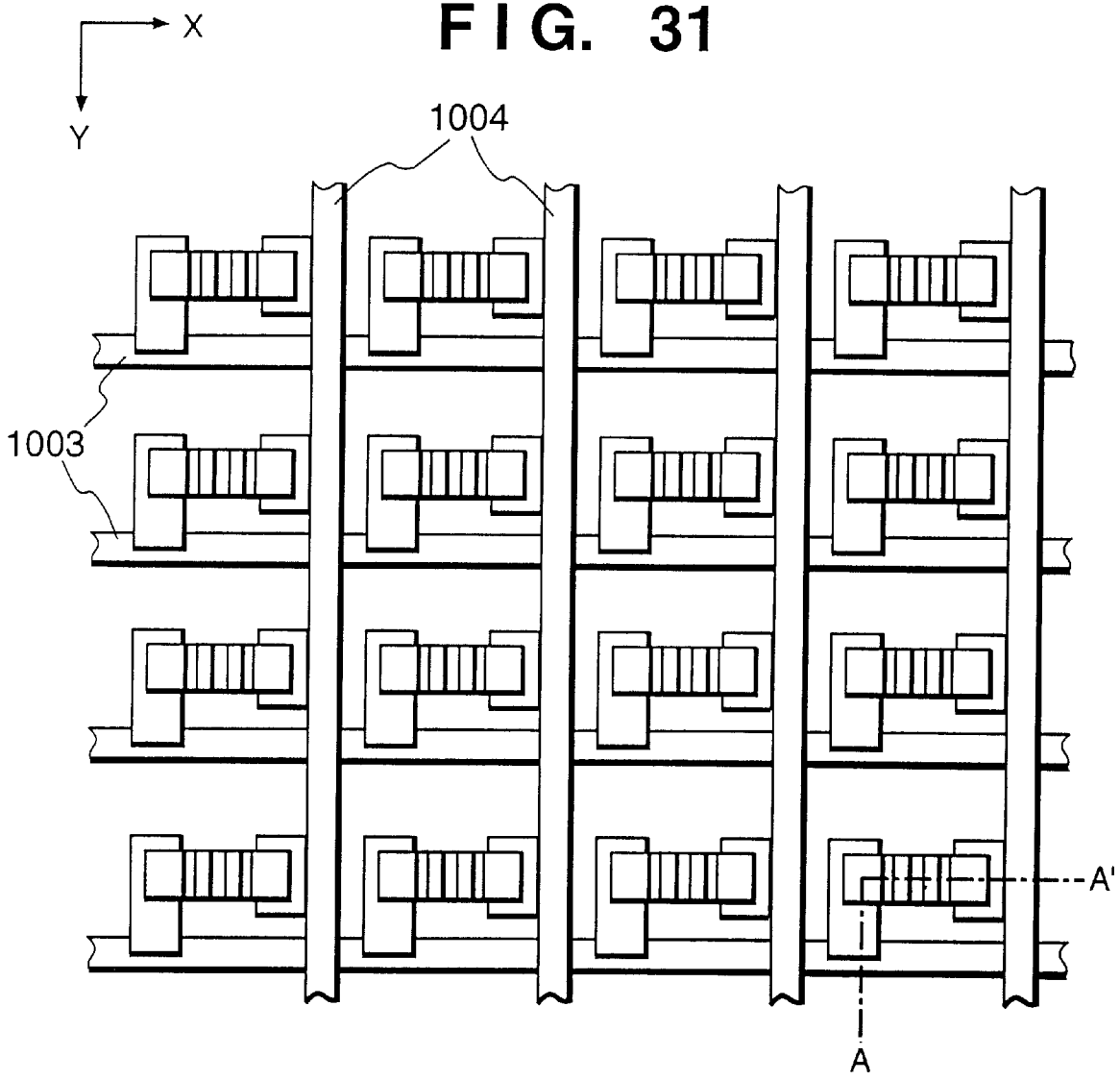
FIG. 31 is a plan view showing the substrate of a multi electron source used in the embodiment.

FIG. 31 is a plan view of the multi electron source used in the display panel in FIG. 22. There are surface-conduction emission type electron-emitting devices like the one shown in FIGS. 24A and 24B on a substrate. These devices are arranged in a simple matrix with the row-direction wiring 1003 and the column-direction wiring 1004. At an intersection of the wirings 1003 and 1004, an insulating layer (not shown) is formed between the wires, to maintain electrical insulation.

Figure 32:
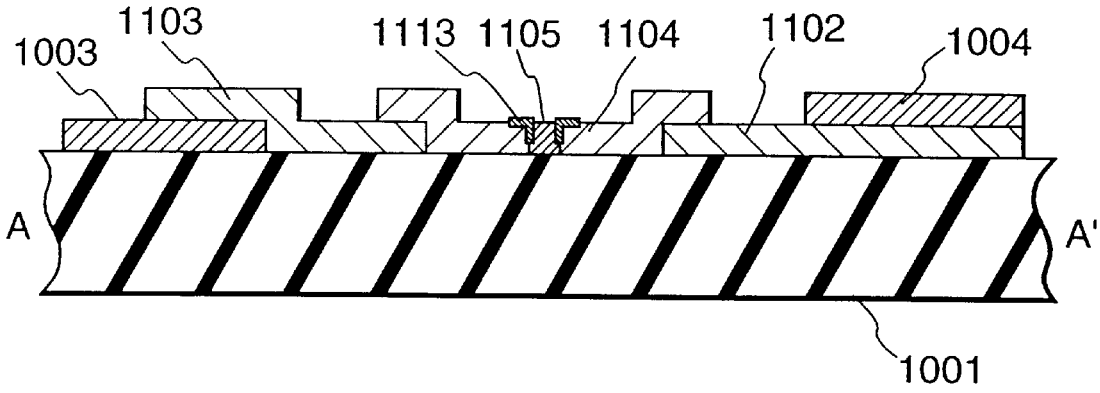
FIG. 32 is a sectional view showing part of the substrate of the multi electron source used in the embodiment.

FIG. 32 shows a cross-section cut out along the line A–A' in FIG. 31.

Note that a multi electron source having such a structure is manufactured by forming the row- and column-direction wirings 1003 and 1004, the inter-electrode insulating layers (not shown), and the device electrodes and conductive thin films of the surface-conduction emission type electron-emitting devices on the substrate, then supplying electricity to the respective devices via the row- and column-direction wirings 1003 and 1004, thus performing the forming processing and the activation processing.

Arrangement of Activation Apparatus

The structure and manufacturing method of the display panel have been described. Next, the aforementioned activation of the surface-conduction emission type electron-emitting device will be explained below with reference to the accompanying drawings.

In FIG. 1, a plurality of surface-conductione mission type electron-emitting devices are arranged in a matrix on a surface-conduction emission type electron-emitting device substrate 101 to be activated, and have already undergone forming processing. The substrate 101 is connected to an evacuation device (not shown) and evacuated to about $10^{-4}$ to $10^{-5}$ Torr. The substrate 101 is further connected to an external electric circuit via row-direction wiring terminals $D_{x1}$ to $D_{xm}$ and column-direction wiring terminals $D_{y1}$ to $D_{yn}$. A line selection circuit 102 for selecting a line to be activated selects a row-direction wiring in accordance with an instruction from a timing generation circuit 105, and applies a selection potential of a power source 104 to the selected row-direction wiring. A current monitoring circuit 103 monitors a current flowing through the selected row upon applying the selection potential to the selected row-direction wiring. The current monitoring circuit 103 is made up of a detection resistance $R_{mon}$ and a measurement amplifier for measuring a potential difference generated across the resistance. With these components, the current monitoring circuit 103 detects the current $I_f$ and outputs it as an activation current value 109 to a control circuit 106. Note that the resistance value of the detection resistance $R_{mon}$ is set small enough to prevent influence on an application voltage to the surface-conduction emission type electron-emitting device by a potential drop caused by the flowing device current $I_f$. The power source 104 generates a potential to be applied to the row-direction wiring of the electron source in accordance with a command value from the control circuit 106.

A buffer amplifier circuit 107 drives the column-direction wiring terminals $D_{y1}$ to $D_{yn}$ of the surface-conduction emission type electron-emitting device substrate 101 at a timing synchronized with a control clock signal $H_{scan}$ from the timing generation circuit 105. An input value to the buffer amplifier, i.e., a potential amplitude value for driving the terminals $D_{y1}$ to $D_{yn}$ is determined by a potential distribution generation circuit 108.

In the first embodiment, the progress of activation is grasped by detecting a current amount flowing upon activation, i.e., the activation current 109 as output data from the current monitoring circuit 103. The control circuit 106 starts activation in response to an activation start command, and sequentially corrects the potential distribution of devices in the column direction that changes with the progress of activation, as will be described in detail later. That is, the control circuit 106 estimates a device current flowing through each device using an output from the current monitoring circuit 103, and sets the estimated value as a current setting value 110 in the potential distribution generation circuit 108. The potential distribution generation circuit 108 calculates a potential distribution generated in devices in the column direction in accordance with the current setting value 110 and generates this distribution as a potential. The calculated potential is applied to the column-direction electrode of each device via the buffer amplifier 107. In each device, a potential distribution generated by the device current and wiring resistance is corrected to suppress the difference in voltage applied to the device. The potential distribution is corrected until the end of activation by sequentially updating data of the potential distribution generation circuit 108 in accordance with the progress of activation.

Line Selection Circuit

Figure 2:
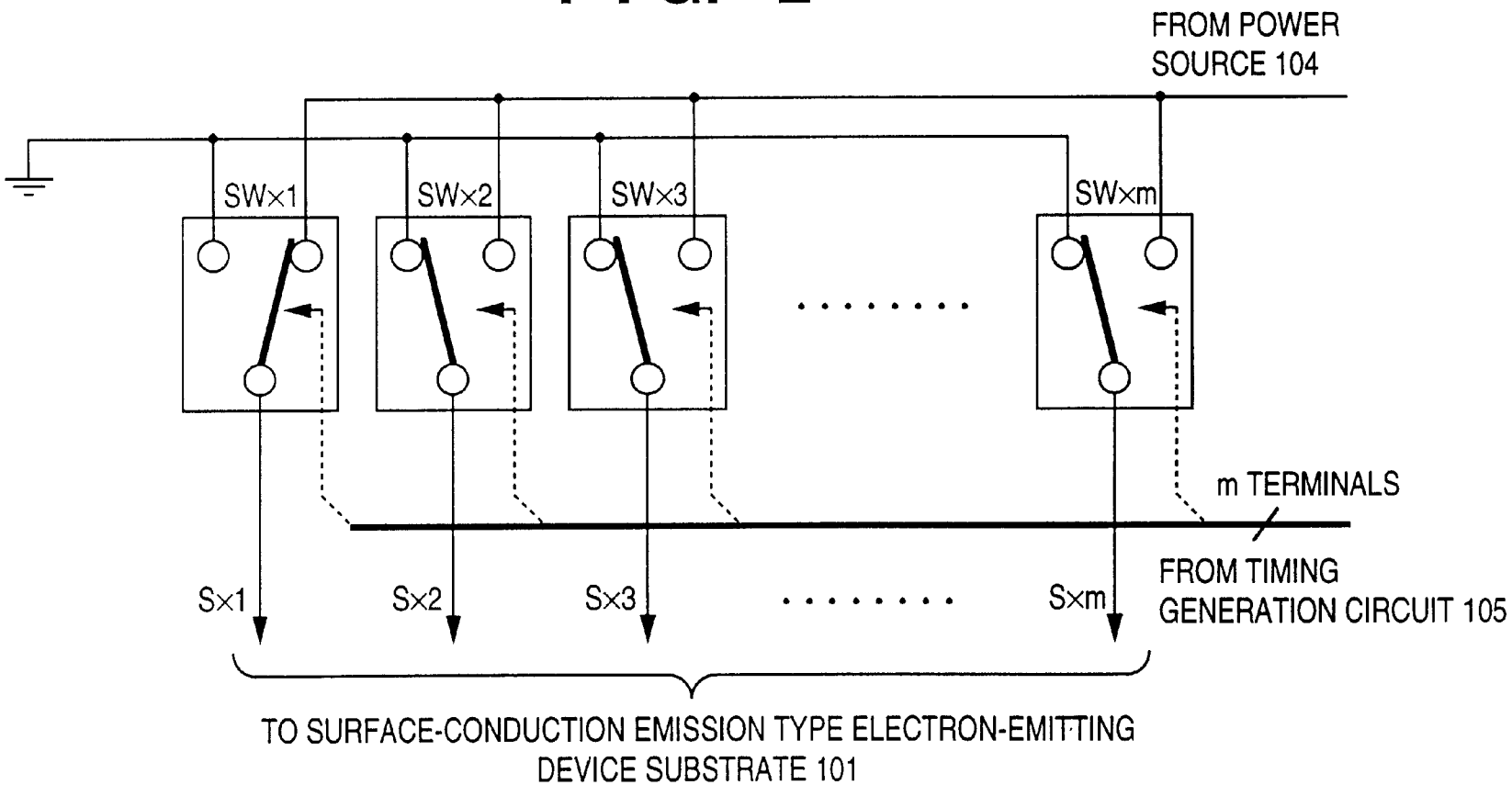
FIG. 2 is a circuit diagram showing a line selection circuit used in the first embodiment.

The line selection circuit 102 will be described with reference to FIG. 2.

This circuit incorporates m switching elements ($SW_{x1}$ to $SW_{Xm}$). Each switching element selects either one of the output potential of the power source 104 and 0 V (ground level), and the m switching elements are electrically connected to the terminals $D_{x1}$ to $D_{xm}$ of the surface-conduction emission type electron-emitting device substrate 101, respectively. Each switching element operates based on a control signal $V_{scan}$ output from the timing generation circuit 105. In practice, the switching elements can be easily constituted by a combination of switching elements such as FETs or relays. In FIG. 2, the first line ($S_{x1}$) is selected, the output potential of the power source 104 is applied to only the row-direction wiring $D_{x1}$, and the remaining lines are grounded.

Potential Distribution Generation Circuit

Figure 3:
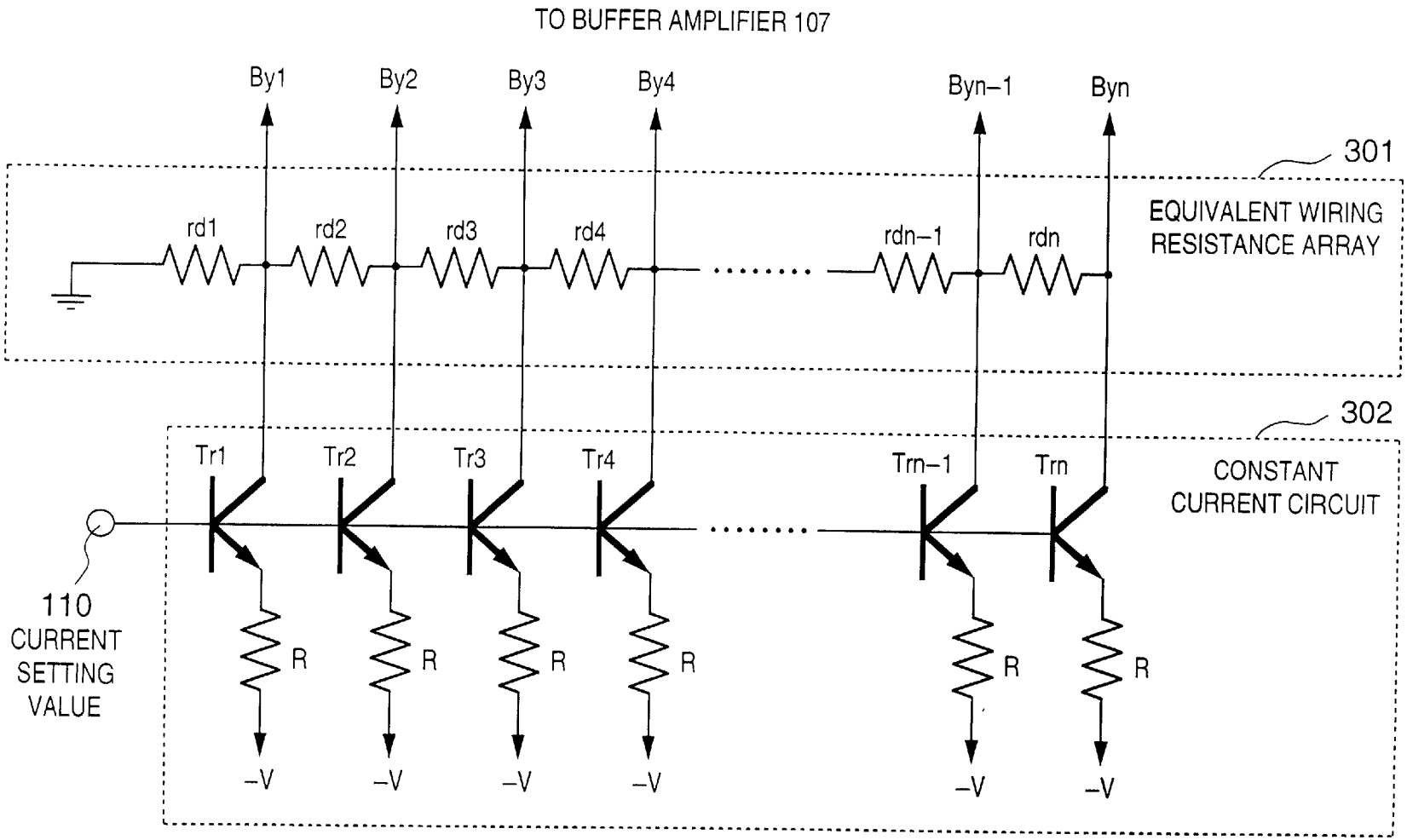
FIG. 3 is a circuit diagram showing a potential distribution generation circuit used in the first embodiment.

FIG. 3 is a circuit diagram showing the arrangement of the potential distribution generation circuit 108.

The circuit 108 operates to automatically calculate a compensation potential amount to be applied in the column direction and output it to the buffer amplifier 107 in order to compensate a potential drop caused by a device current flowing through each device and a row-direction wiring resistance (r1 to rN in FIG. 40) along with the progress of activation, as described above.

To achieve this operation, the potential distribution generation circuit 108 is made up of an equivalent wiring resistance array 301 and a constant current circuit 302.

The equivalent wiring resistance array 301 is a resistance array having a value equivalent to the wiring resistance on a given row wiring of the surface-conduction emission type electron-emitting device substrate 101 having a simple matrix arrangement (see FIG. 40). Resistances rd1 to rdn are set equal to the values r1 to rn of the wiring resistances of respective portions on the row wiring. Although a method of forming an electrode on the surface-conduction emission type electron-emitting device substrate 101 will be described below, the electrode is designed to be formed from a material having a constant line width and thickness, rd1 to rdn can be considered to be equal except for variations in the manufacture. The equivalent wiring resistance array 301 can therefore be n constituted by aligning simulation resistances equal to an actual resistance value on an array. Alternatively, an extra wiring for one line may be formed at the end of the surface-conduction emission type electron-emitting device substrate 101 and extracted to constitute the equivalent wiring resistance array 301.

The constant current circuit 302 includes a total of constant current circuits each made up of a transistor and resistance R in correspondence with the column-direction wiring terminals $D_{y1}$ to $D_{yn}$ of the surface-conduction emission type electron-emitting device substrate 101. Each constant current circuit operates to sink a current amount:

$$(\text{Base Input Potential}-0.6+V)/R$$

Note that the transistors of the constant current circuit 302 share a base, which receives a current setting value 303 as an input potential. Accordingly, all the constant current circuits operate to have the same current setting value.

Activation Processing

Subsequently, a procedure of activating the surface-conduction emission type electron-emitting device substrate 101 using the apparatus of the first embodiment will be described with reference to FIGS. 1, 4, 5A and 5B. Activation is performed to set the device currents of all devices to a target value. This target current value is determined in advance from a necessary electron-emitting amount or the like. In the first embodiment, activation processing is performed while monitoring an output from the current monitoring circuit 103 so as to set the device currents of respective devices on the surface-conduction emission type electron-emitting device substrate 101 to 2 mA at last.

An activation flow will be explained.

In FIG. 1, when the control circuit 106 receives an activation start command, it controls the timing generation circuit 105 and power source 104 in order to perform electrification processing in units of rows.

The control circuit 106 sets the current setting value 110 so as to set the column-direction wiring terminals $D_{y1}$ to $D_{yn}$ to the ground potential, and sequentially applies pulses of the activation potential Eac to the row-direction wiring terminals $D_{x1}$ to $D_{xm}$. This pulse has, for example, a pulse width of 1 msec and a pulse height of 18 V. Then, the pulse potentials are sequentially applied to the surface-conduction emission type electron-emitting device substrate 101 in units of rows to start activation in units of lines.

The first embodiment will exemplify activation when devices on the line of the row-direction wiring terminal $D_{x1}$ are activated.

Figure 4:
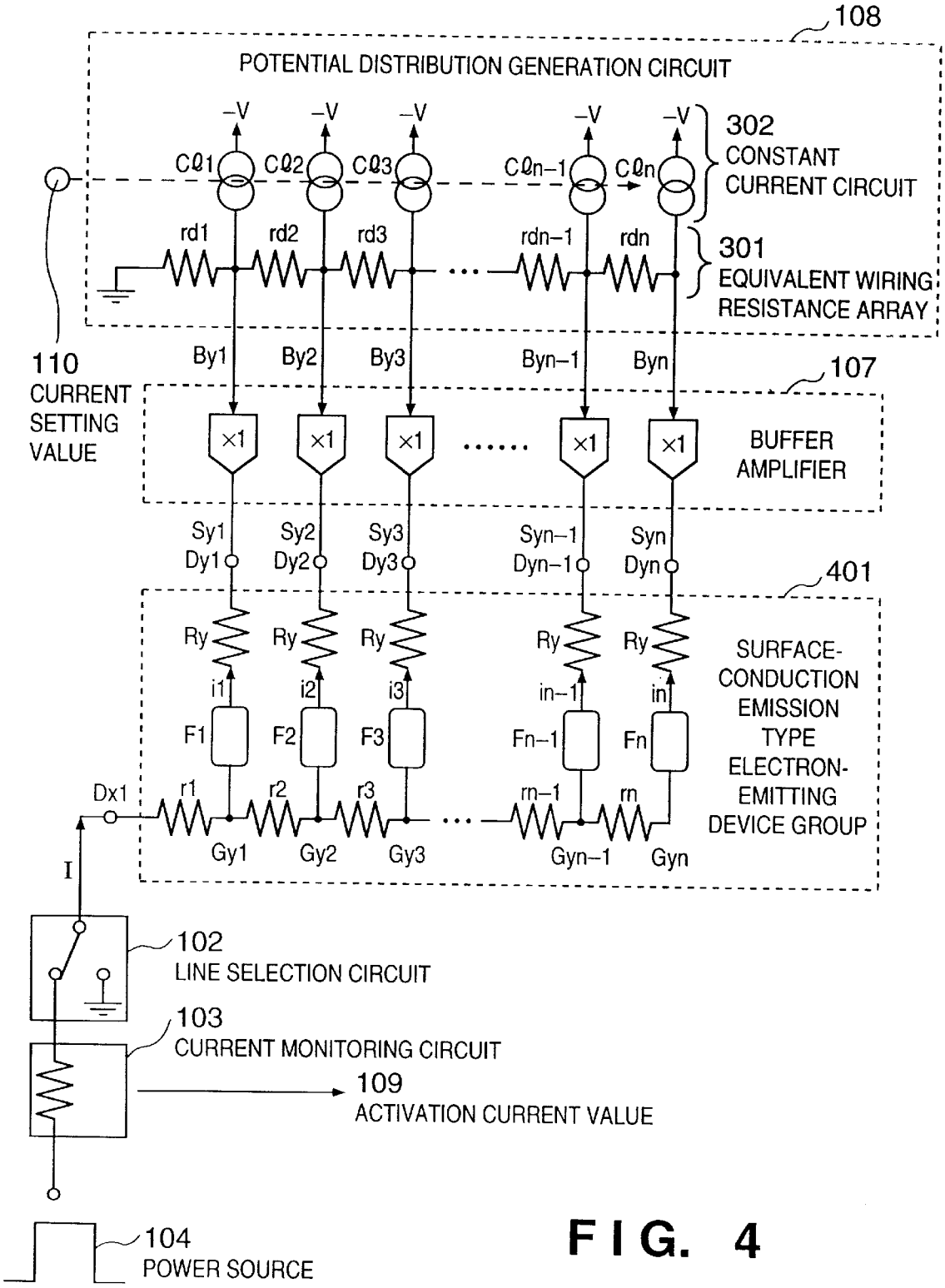
FIG. 4 is a circuit diagram showing a driving example of activating devices on a given line in the first embodiment.

Attention is paid to a surface-conduction emission type device group on the first row to which an activation voltage is applied, a surface-conduction emission type electron-emitting device group 401 is represented by a model including the wiring resistance, and the state in which this device group is activated will be explained with reference to FIG. 4. In FIG. 4, reference symbols $F_1$ to $F_n$ denote surface-conduction emission type electron-emitting devices on the line of the row-direction wiring terminal $D_{x1}$; r1 to rn, wring resistances at respective portions on a row wiring $D_{x1}$; and $R_y$, a wiring resistance from the feeding terminal of each of the wirings $D_{y1}$ to $D_{yn}$ to a corresponding surface-conduction emission type electron-emitting device. Since the row wiring is designed to be formed from a material having a constant line width and thickness in the first embodiment, r1 to rN can be considered to be equal except for variations in the manufacture. Since the wirings are designed to be uniform, the resistances $R_y$ of the respective wirings can be considered to be equal. Although the equivalent resistance value of the surface-conduction emission type electron-emitting device changes (decreases) before and after activation, the equivalent resistance of each device is much higher than the value $R_y$, and $R_y$ is substantially negligible in the first embodiment. The equivalent resistance value of the surface-conduction emission type electron-emitting device is designed higher than r1 to rn.

To activate the surface-conduction emission type electron-emitting device group 401, the control circuit 106 controls the line selection circuit 102 via the timing generation circuit 105, and connects the power source 104 for outputting the activation potential Eac and the current monitoring circuit 103 to the row-direction wiring terminal $D_{x1}$. Thus, the terminal $D_{x1}$ receives the activation potential Eac.

On the other hand, the terminals $D_{y1}$ to $D_{yn}$ as other electrode terminals of devices on the line $D_{x1}$ are driven by the buffer amplifier 107. The buffer amplifier 107 operates to sink activation currents il to in from the devices $F_1$ to $F_n$, and the output potential amplitude is determined by the potential distribution generation circuit 108.

The potential distribution circuit 108 is made up of the equivalent wiring resistance array 301 and constant current circuit 302, as described above. The resistance values rd1 to rdn of the equivalent wiring resistance array 301 are set equal to the wiring resistance values r1 to rn of the row wiring $D_{x1}$. N constant current sources $CI_1$ to to $CI_n$ constituting the constant current circuit 302 correspond to the devices $F_1$ to $F_n$ of the surface-conduction emission type electron-emitting device group 401, and equivalently replace device currents flowing through the devices along with the progress of activation.

In activation, the electrical characteristics of the device change as shown in FIG. 41. That is, the device current does not substantially flow at the start of activation, starts flowing at the same time as electrification, and saturates. At this time, the terminal potential of the device group on the row wiring $D_{x1}$ is monitored to find changes in potentials $G_{y1}$ to $G_{yn}$ due to the influence of the wiring resistances r1 to rn. The potential change increases with the progress of activation and maximizes at the end of activation. For example, for an activation current of 2 mA/device, r1 to rn=10 mΩ, and n=1000, a potential change:

$$\Delta V = \tfrac{1}{2} \times 1000 \times 1001 \times 2\ \text{mA} \times 10\ \text{m}\Omega \approx 10\ \text{V}$$

occurs at the terminal $G_{yn}$ of the device $F_n$ farthest from the feeding terminal.

To prevent this, a potential distribution identical to this potential distribution is generated by the potential distribution generation circuit 108, and the terminals $D_{y1}$ to $D_{yn}$ are driven by outputs $S_{y1}$ to $S_{yn}$ from the buffer amplifier 107 so as to cancel the differences in voltages applied to the respective devices.

More specifically, the potential drop distribution at the terminals $G_{y1}$ to $G_{yn}$ produced by currents flowing through the devices $F_1$ to $F_n$ along with the progress of activation is reproduced by outputs $B_{y1}$ to $B_{yn}$ from the potential distribution generation circuit 108. If activation of the devices $F_1$ to $F_n$ substantially uniformly progresses, the device currents i1 to in flowing through the respective devices are almost equal, and the current value can be given using a current amount I detected by the current monitoring circuit 103:

$$i_{ave} = (i_1 = i_2 = \ldots i_n =) I/n \tag{1}$$

By setting this $i_{ave}$ as a current setting value in the potential distribution generation circuit 108, a distribution identical to the potential drop distribution at the terminals $G_{y1}$ to $G_{yn}$ produced by currents flowing through the devices $F_1$ to $F_n$ is generated at the outputs $B_{y1}$ to $B_{yn}$ of the potential distribution generation circuit 108. By applying these potentials to the terminals $D_{y1}$ to $D_{yn}$ via the outputs $S_{y1}$ to $S_{yn}$ of the buffer amplifier 107, voltages applied between the terminals of the devices $F_1$ to $F_n$ can be made uniform regardless of the device number and the progress of activation.

Figure 5A:
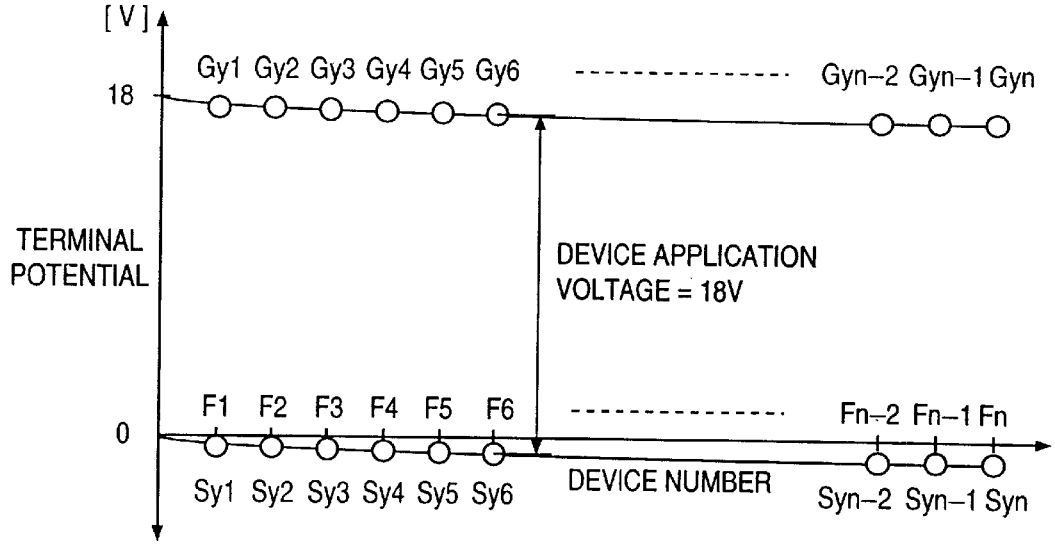
FIGS. 5A and 5B are graphs each showing the driving voltage distribution of respective devices when the devices on a given line are activated in the first embodiment.
Figure 5B:
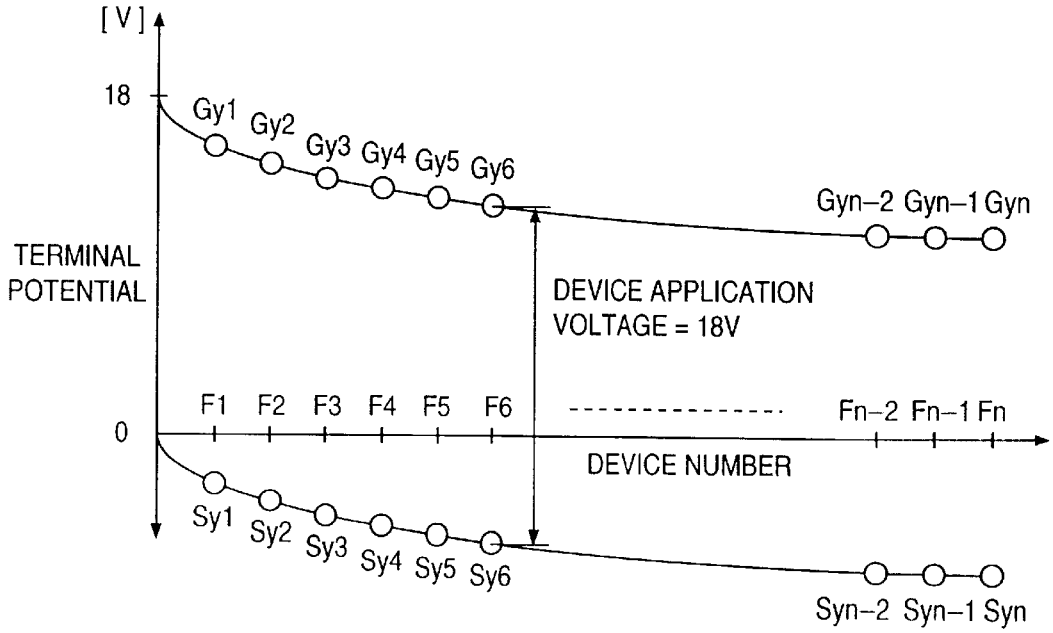

FIGS. 5A and 5B show the distributions of potentials applied across the devices $F_1$ to $F_n$ at the start and end of activation. FIG. 5A shows a potential distribution immediately after the start of activation. The abscissa represents device numbers $F_1$ to $F_n$, which indicate device positions. The ordinate represents terminal potentials at the two terminals of each device. As described above, currents flowing through respective devices are small immediately after the start of activation. Therefore, the activation potential Eac=18 V is applied from the power source 104 to the terminals $G_{y1}$ to $G_{yn}$ of the respective devices. Since almost no activation current flows, the current setting value of the potential distribution generation circuit 108 is almost 0, and the outputs $B_{y1}$ to $B_{yn}$ of the potential distribution generation circuit 108 and the outputs $S_{y1}$ to $S_{yn}$ of the buffer 107 are also at almost 0 V. For this reason, a predetermined application voltage up to 18 V is applied to the respective devices to progress activation.

FIG. 5B shows a potential distribution at the end of activation. At the end of activation, currents flowing through respective devices are almost 2 mA. The activation potential Eac=18 V applied from the power source 104 decreases owing to the influence of a potential drop caused by the wiring resistance upon application to the terminals $G_{y1}$ to $G_{yn}$ of the respective devices. At this time, if the current setting value of the potential distribution generation circuit 108 is set to 2 mA, the outputs $B_{y1}$ to $B_{yn}$ of the potential distribution generation circuit 108 and the outputs $S_{y1}$ to $S_{yn}$ of the buffer 107 have the same distribution as $G_{y1}$ to $G_{yn}$. As a result, a predetermined application voltage up to 18 V is applied to the respective devices to activate them.

More specifically, when the device current increases with the progress of activation, the distribution of potentials applied to devices always changes due to the influence of the wiring resistance. In this case, the control circuit 106 obtains a device current value in accordance with equation (1) from a current value detected by the current monitoring circuit 103 along with the progress of activation, and sets a current value corresponding to the obtained value as the current setting value of the potential distribution generation circuit 108. In this way, the outputs $B_{y1}$, to $B_{yn}$ of the potential distribution generation circuit 108 are sequentially updated to activate all devices by a constant voltage from the start to end of activation. When the device current of each device reaches 2 mA, activation ends.

The outputs $B_{y1}$ to $B_{yn}$ of the potential distribution generation circuit 108 described in the first embodiment have a very high response speed in updating the current setting value, so that the distribution can be updated every time a pulse voltage is applied from the power source 104.

Figure 15:
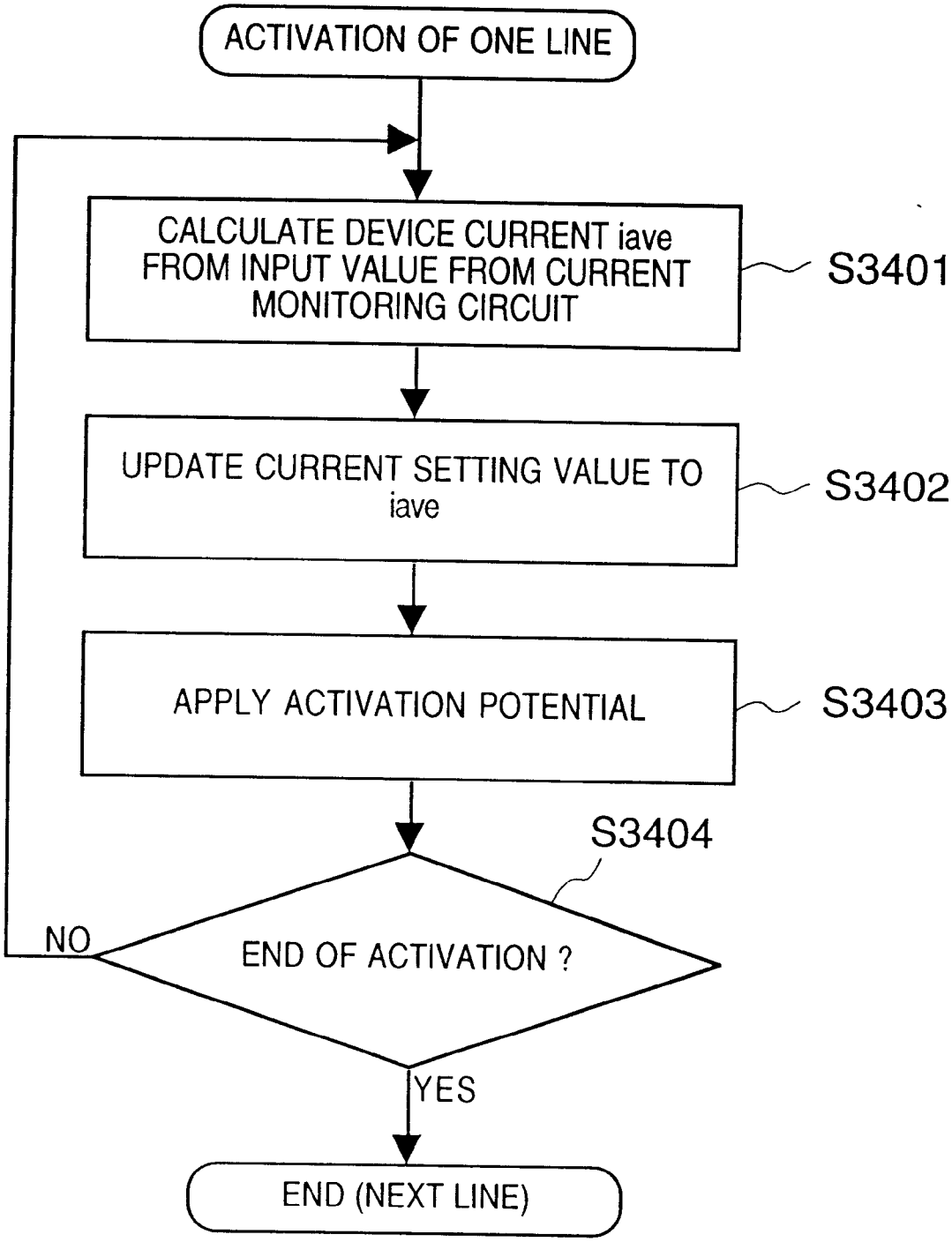
FIG. 15 is a flow chart showing a control procedure when activation is performed by a procedure of completing activation in units of lines and switching lines.

FIG. 15 shows an example of a control procedure by the control circuit 106 when activation is performed by a procedure of completing activation in units of lines and switching lines. FIG. 15 shows a procedure for one line. Since the substrate 101 generally has a plurality of lines, this control procedure is repeatedly executed for a plurality of lines.

In FIG. 15, the control circuit 106 calculates the average device current $i_{ave}$ from an input value from the current monitoring circuit (step S3401). Since the device current is very small before activation, as shown in FIG. 5A, the first pulse can be set to $i_{ave}\approx 0$ or to an initial value obtained experimentally. The control circuit 106 updates the current setting value 110 in accordance with the obtained device current value (step S3402). In this state, the control circuit 106 applies the activation potential to a selected line (step S3403). Upon completion of a predetermined activation procedure for the selected line, activation for this line ends (YES in step S3404). If a next line exists, the control circuit 106 outputs a line switching signal to select the next line. If activation for the selected line has not been completed yet the control circuit 106 returns to step S3401 to read an activation current value with respect to the activation potential applied in step S3403 from the current monitoring circuit 103, update the current setting value, and apply a next pulse to the selected line. This is repeatedly executed until activation ends.

The above description is directed to activation of devices on the row wiring $D_{x1}$. This procedure can similarly apply to activation of devices on another line. In this way, activation of all surface-conduction emission type electron-emitting devices on the substrate 101 is completed.

In activation, after activation of devices on a given line is completed, the line selection circuit 102 is switched to activate another activation line. Instead, a plurality of lines may be simultaneously activated while sequentially switching activation lines. In this case, the progress of activation may vary between lines. To prevent this, the average device currents of respective lines are sequentially stored in a memory or the like, and activation is performed while updating the output of the potential distribution generation circuit 108 at a high speed using the average device current stored in the memory in switching lines. Consequently, uniform activation can be realized. In FIG. 15, activation is completed in units of lines. When a plurality of lines are activated parallel while sequentially switching lines, a line switching signal must be output between steps S3403 and S3404.

To quickly complete activation of the surface-conduction emission type electron-emitting device substrate 101, a plurality of lines may be simultaneously driven. In this case, the current monitoring circuit 103 detects the sum of device currents for the plurality of lines. Consideration must be taken in estimating the current setting value set in the potential distribution generation circuit 108.

In the first embodiment, the power source 104 has a positive output, and activation is performed to flow a current from the terminal $D_{x1}$ to the terminals $D_{y1}$ to $D_{yn}$. Alternatively, the polarity may be inverted, and activation may be performed to flow a current from the terminals $D_{y1}$ to $D_{yn}$ to the terminal $D_{x1}$. In this case, since the potential distribution is also inverted, the buffer amplifier 107 is constituted as a (−1)-time inverting buffer amplifier to source the current, thereby obtaining the same effects.

As described above, the activation apparatus of the first embodiment can make the electron-emitting characteristics of all devices uniform. This electron source substrate is used to realize a high-quality image display apparatus almost free from variations in luminance or density.

Second Embodiment

An activation apparatus for the surface-conduction emission type electron-emitting device according to the second embodiment of the present invention will be described with reference to FIG. 6.

Figure 6:
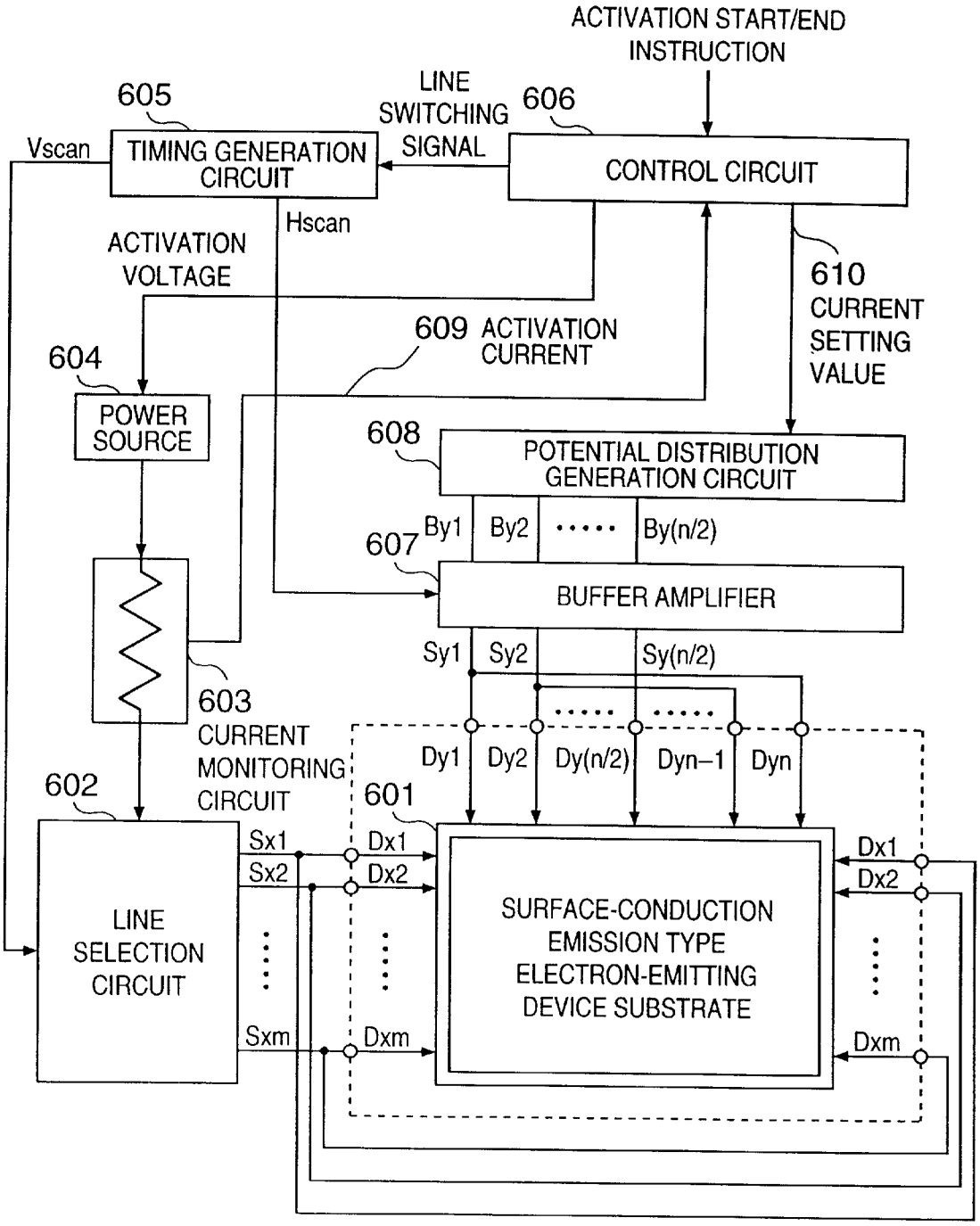
FIG. 6 is a block diagram showing an activation apparatus according to the second embodiment of the present invention.

In FIG. 6, a surface-conduction emission type electron-emitting device substrate 601 is different from the substrate 101 in FIG. 1 in that row-direction wiring terminals $D_{x1}$ to $D_{xm}$ are arranged on two sides. The terminals $D_{x1}$ to $D_{xm}$ extracted from the two sides as shown in FIG. 6 are connected to corresponding terminals on the same lines, and connected to a line selection circuit 602.

The operation of the whole apparatus, the activation procedure, and the like are the same as in the first embodiment, and a description thereof will be omitted. Since the wiring terminal extraction method is different, a potential distribution applied to the device upon activation changes, and thus the driving method is slightly different from that in the first embodiment and will be described.

FIG. 43A shows an equivalent circuit when the surface-conduction emission type electron-emitting device substrate 601 according to the second embodiment is activated. FIG. 43B shows a device application potential distribution when devices on the second line are activated in FIG. 43A. In two-side extraction, the distribution has a mirror-symmetrical profile.

Hence, a potential distribution amount to be applied to column-direction wiring terminals $D_{y1}$ to $D_{yn}$ in FIG. 6 also has a mirror-symmetrical profile. This potential distribution can be reproduced by constituting a potential distribution circuit 608 by 1 to (n/2) resistance arrays and constant current sources. If the output impedance of a buffer 607 is set sufficiently low, the circuit can be simplified by preparing (n/2) buffer amplifiers 607, and commonly connecting and driving terminals (e.g., $D_{y1}$ and $D_{yn}$, $D_{y2}$ and $D_{yn-1}$, and the like) having a symmetrical potential distribution. For example, in FIG. 4, the output $S_{y1}$ of the first column extending from the buffer amplifier is connected to the terminals $D_{y1}$ and $D_{yn}$, the output $S_{y2}$ of the second column is connected to the terminals $D_{y2}$ and $D_{yn-1}$, . . . , and the output $S_{yj}$ of the jth column is connected to the terminals $D_{yj}$ and $D_{yn-j+1}$. If n is an odd number, the output of the (n+1)/2 column is connected to only the terminal $D_{y(n+1)/2}$.

Figure 7A:
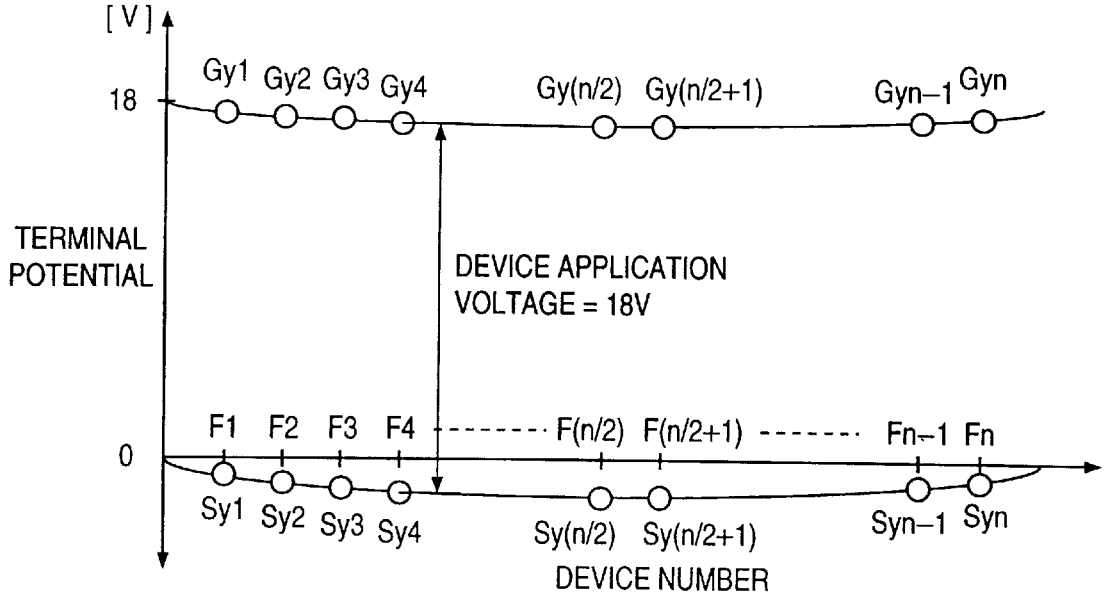
FIGS. 7A and 7B are graphs each showing the driving voltage distribution of respective devices when the devices on a given line are activated in the second embodiment.
Figure 7B:
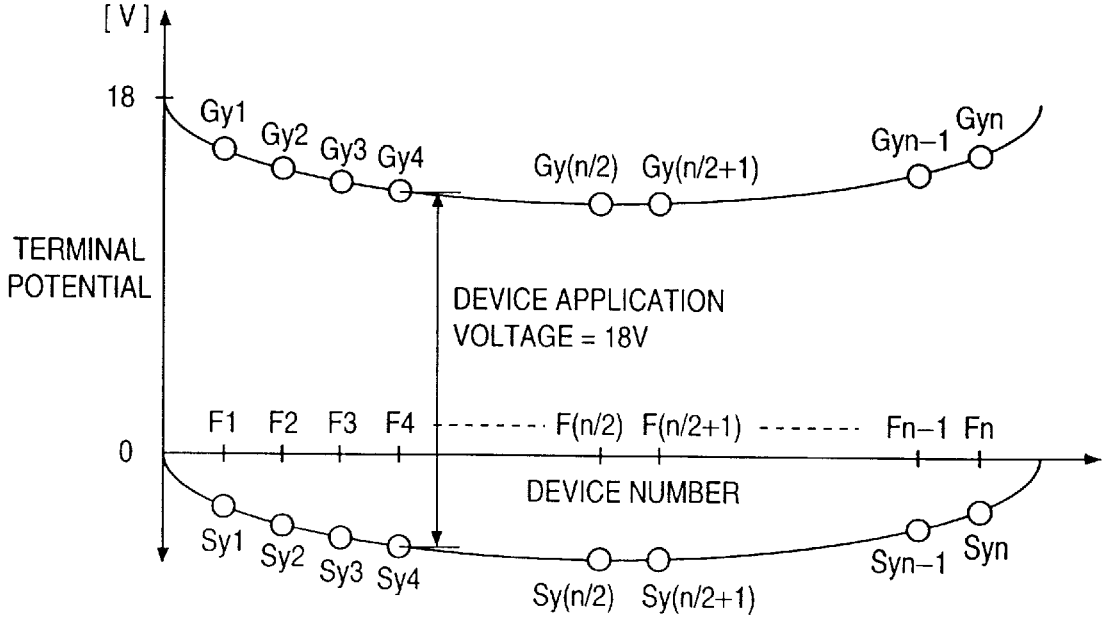

FIG. 7 shows the potential distribution of respective devices upon driving in the second embodiment. As described above, a mirror-symmetrical potential distribution profile can be obtained. The driving potentials $S_{y1}$ to $S_{yn}$ of the column-direction wiring terminals $D_{y1}$ to $D_{yn}$ also change with the progress of activation and are compensated to always apply a predetermined activation voltage to respective devices.

As described above, the apparatus of the second embodiment allows manufacturing an electron source in which all devices have uniform electron-emitting characteristics.

Third Embodiment

An activation apparatus for the surface-conduction emission type electron-emitting device according to the third embodiment of the present invention will be described with reference to FIG. 8.

Figure 8:
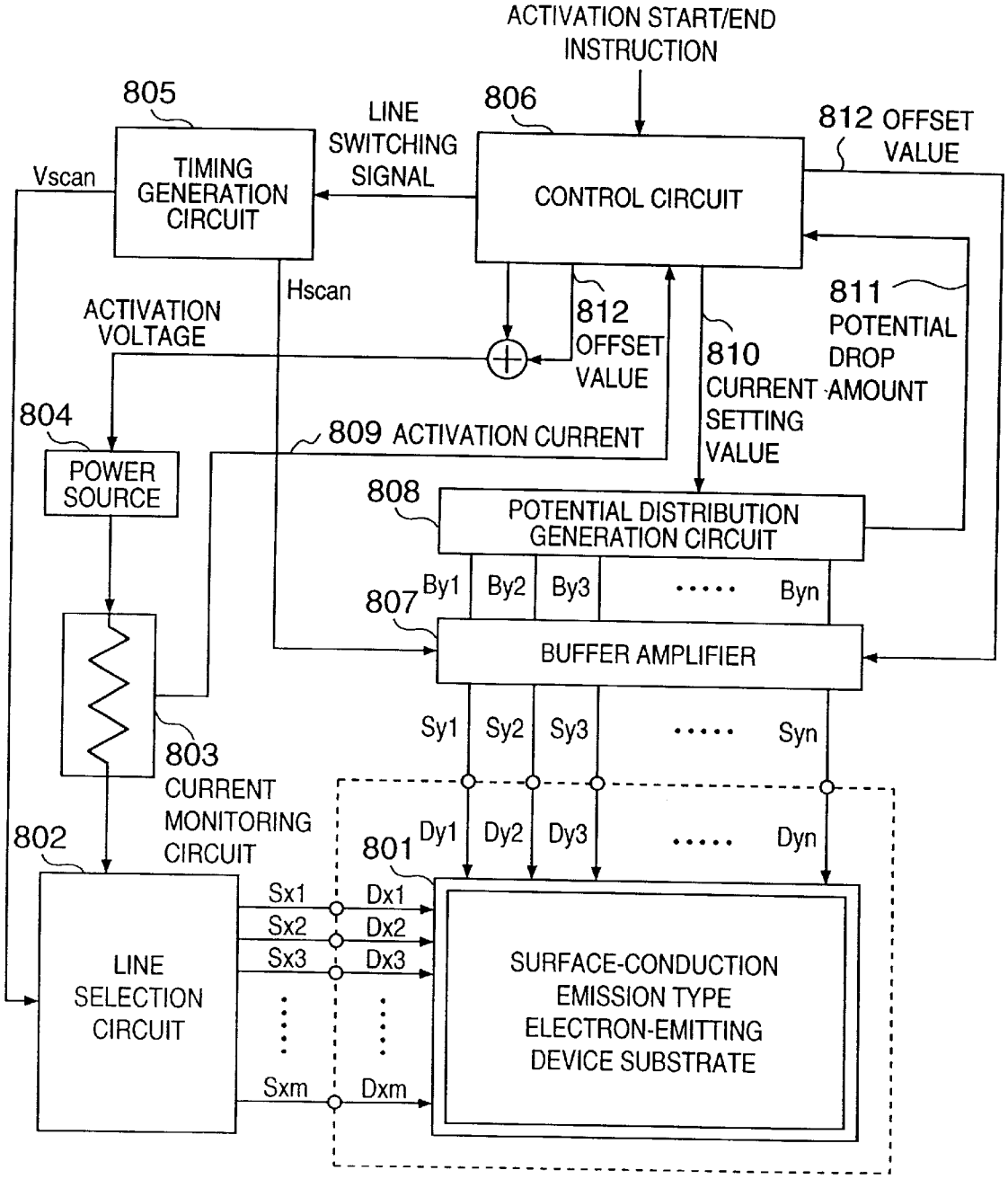
FIG. 8 is a block diagram showing an activation apparatus according to the third embodiment of the present invention.

In FIG. 8, a surface-conduction emission type electron-emitting device substrate 801 is the same as the tfl substrate 101 in FIG. 1. The operation of the whole apparatus, the activation procedure, and the like are the same as in the first embodiment, and a description thereof will be omitted.

The third embodiment is slightly different from the first embodiment in driving method in which an output from a potential distribution circuit 808 is not directly applied to column-direction wiring terminals $D_{y1}$ to $D_{yn}$, as will be described.

Figure 9:
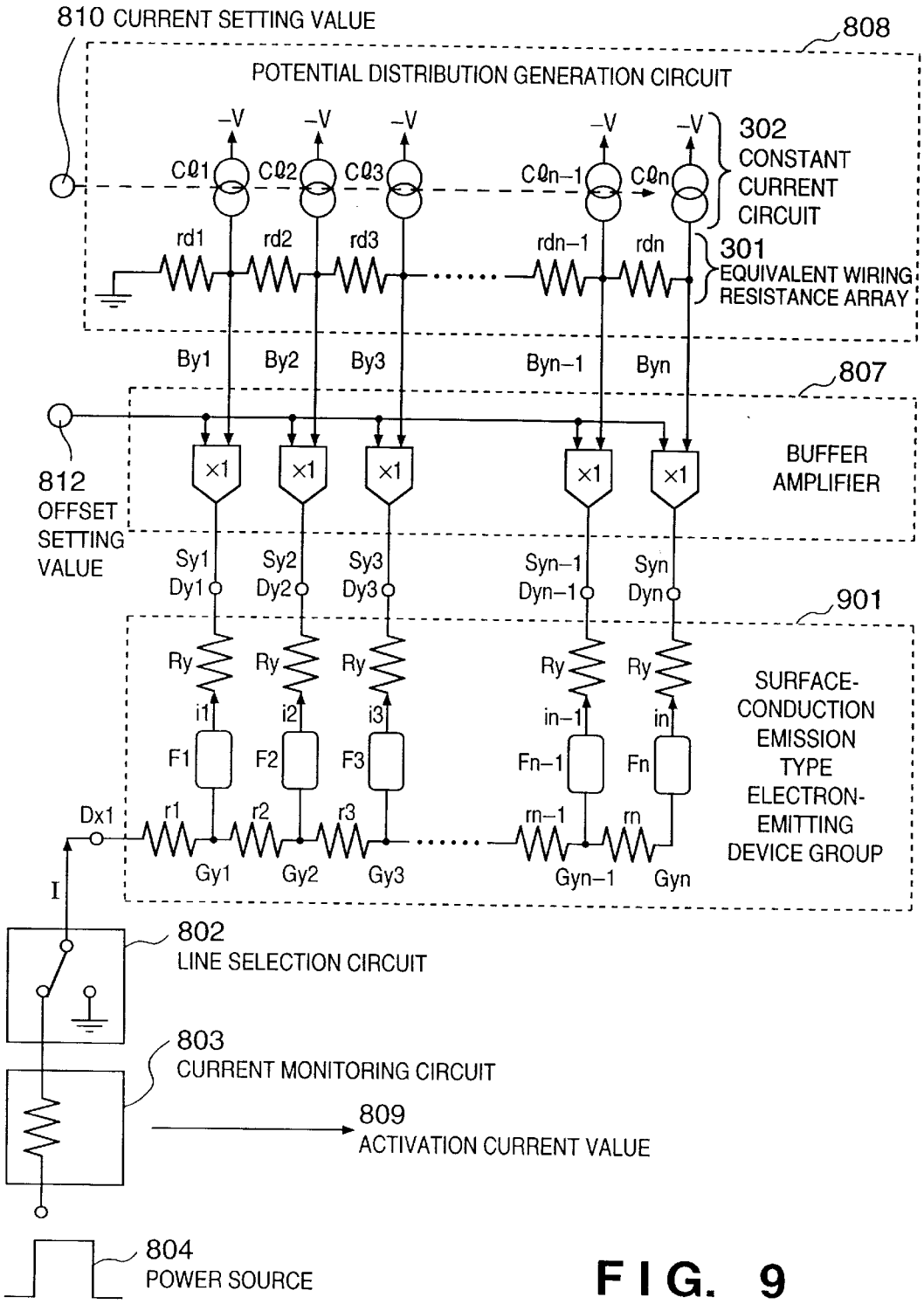
FIG. 9 is a circuit diagram showing a driving example of activating devices on a given line in the third embodiment.

Similar to the first embodiment, attention is paid to a surface-conduction emission type device group on the first row to which an activation voltage is applied, a surface-conduction emission type electron-emitting device group 901 is represented by a model including the wiring resistance, and the state in which this device group is activated will be explained with reference to FIG. 9. In FIG. 9, reference symbols $F_1$ to $F_n$ denote surface-conduction emission type electron-emitting devices on the line of a row-direction wiring terminal $D_{x1}$; r1 to rn, wring resistances at respective portions on a row wiring $D_{x1}$; and $R_y$, a wiring resistance from the feeding terminal of each of the wirings $D_{y1}$ to $D_{yn}$ to a corresponding surface-conduction emission type electron-emitting device.

To activate the surface-conduction emission type electron-emitting device group 901, a control circuit 806 controls a line selection circuit 802 via a timing generation circuit 805, and connects a power source 804 for outputting the activation potential Eac and a current monitoring circuit 803 to the row-direction wiring terminal $D_{x1}$. Thus, the terminal $DX_1$ is driven by the activation potential Eac.

On the other hand, the terminals $D_{y1}$ to $D_{yn}$ as other column-direction terminals of devices on the line $D_{x1}$ are driven by a buffer amplifier 807. In this case, the buffer amplifier 807 operates to sink activation currents il to in from the devices $F_1$ to $F_n$, and the output potential amplitude is determined by the potential distribution generation circuit 808. This operation is the same as in the first embodiment.

Also in the third embodiment, a potential distribution produced along with the progress of activation is generated by the potential distribution generation circuit 808, and the terminals $D_{y1}$ to $D_{yn}$ are driven by outputs $S_{y1}$ to $S_{yn}$ from the buffer amplifier 807 so as to cancel the potential distribution. At this time, output potential values $B_{y1}$ to $B_{yn}$ from the potential distribution circuit 808 are not directly applied to the terminals, but are added to an offset setting value 812 by the buffer amplifier 807 and then applied to the terminals. This offset setting value 812 is also added to an activation potential and applied as the amplitude of the power source 804.

The offset potential is added owing to the following reason. According to the present invention, when activation is performed in units of rows, a potential drop distribution generated in the column direction on the same row is compensated by application potentials from the column-direction wiring terminals $D_{y1}$ to $D_{yn}$. The application potentials from the column-direction wiring terminals $D_{y1}$ to $D_{yn}$ are applied to not only devices on an activated line but also devices on an inactivated line because surface-conduction emission type electron-emitting devices are arranged in a simple matrix. As a matter of course, the potentials of the column-direction wiring terminals $D_{y1}$ to $D_{yn}$ are as low as several V in maximum, so no problem arises even if these potentials are applied to devices on an inactivated line. It is however desirable to reduce changes in substrate temperature or a temperature distribution caused by application of potentials to devices on an inactivated line. Therefore, the offset potential is added to minimize the absolute values of potentials applied from the column-direction wiring terminals $D_{y1}$ to $D_{yn}$, thereby driving the terminals $D_{y1}$ to $D_{yn}$.

The offset potential value to be added is determined it as follows. The difference between maximum and minimum potentials generated at respective terminals at the output of the potential distribution circuit 808 is calculated as a potential drop amount 811. More specifically, in FIG. 9, the potential drop amount at the outputs $B_{y1}$ to $B_{yn}$ of the potential distribution circuit 808 is calculated by $$\text{Potential Drop Amount } 811 = \text{Potential } B_{y1} - \text{Potential } B_{yn}$$

Thus, the offset setting value 812 is determined by $$\text{Offset Potential } 812 = \tfrac{1}{2} \times \text{Potential Drop Amount } 811$$

and added. As a result, the absolute values of potentials applied from the column-direction wiring terminals $D_{y1}$ to $D_{yn}$ can be halved compared to the first embodiment.

Figure 10A:
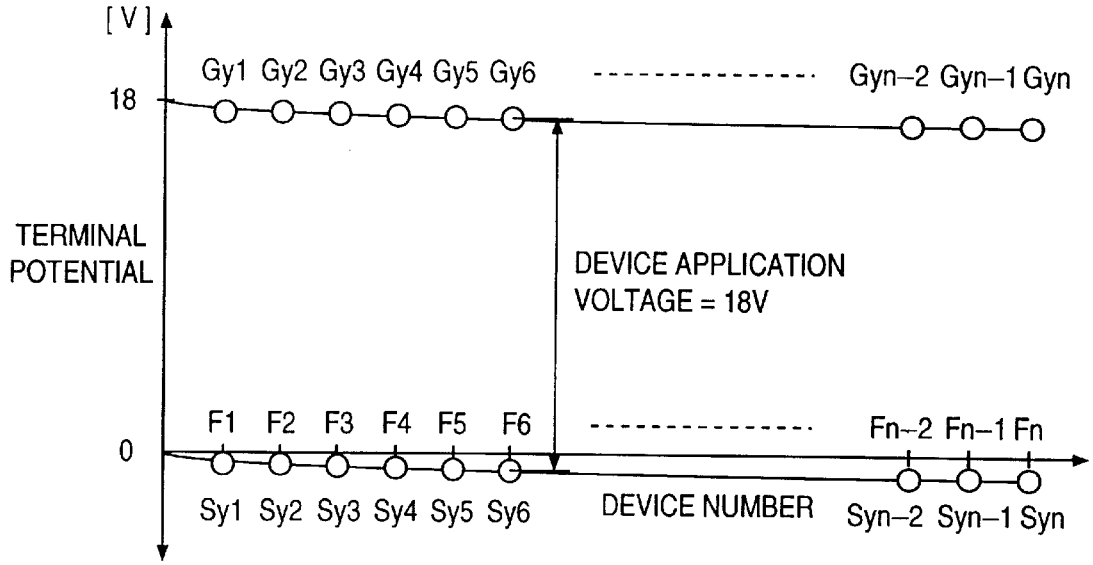
FIGS. 10A and 10B are graphs each showing the driving voltage distribution of respective devices when devices on a given line are activated in the third embodiment.
Figure 10B:
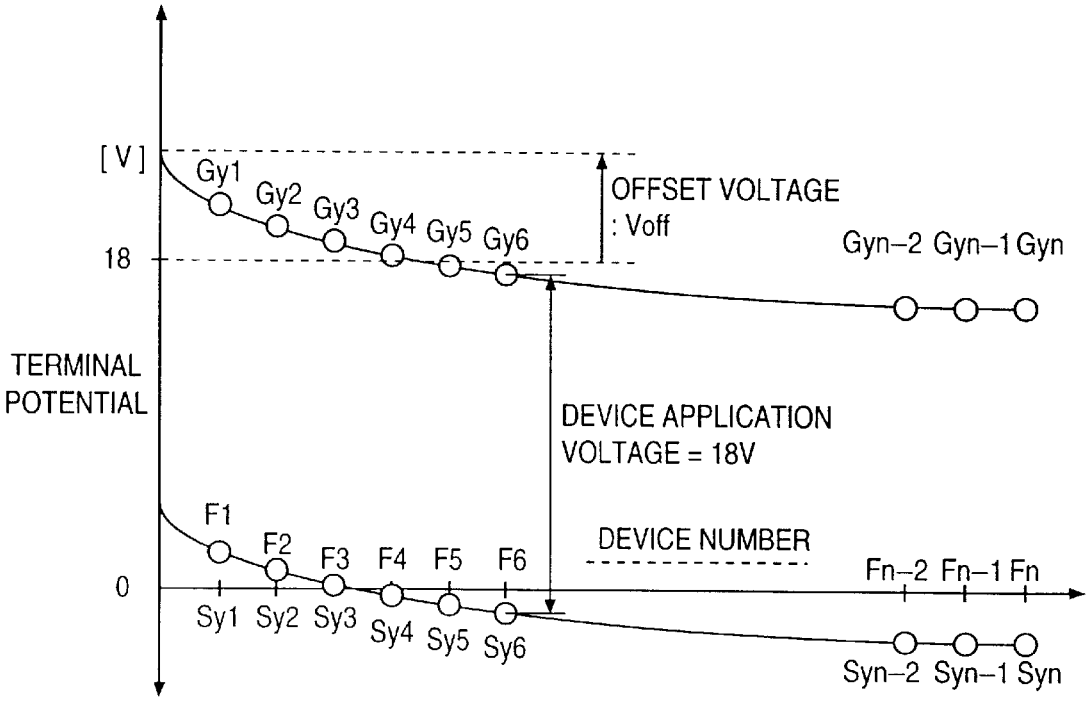

FIGS. 10A and 10B show the potential distributions of respective devices upondriving in the third embodiment. FIG. 10A shows a potential difference immediately after activation. At this time, since almost no device current flows, as described in the first embodiment, almost no potential distribution is generated, the offset potential value 821 is almost 0 V, and the potential distribution is almost the same as in FIG. 5A of the first embodiment. However, when activation progresses to generate a potential drop, the offset potential 821 is generated to obtain a potential distribution profile like the one shown in FIG. 10B. As shown in FIG. 10B, the potential distribution of respective devices is the same as in FIG. 5B of the first embodiment except that the offset potential is applied to the driving potentials $S_{y1}$ to $S_{yn}$ to be applied to the column-direction wiring terminals $D_{y1}$ to $D_{yn}$ to decrease the absolute values of the driving potentials. FIG. 10B also shows the state in which the potential applied from the row-direction wiring terminal DAl also changes to 18 $V+V_{off}$ along with this.

By applying the potential added with the offset potential used in the third embodiment, surface-conduction emission type electron-emitting devices having uniform characteristics can be attained similar to the first embodiment. In addition, the power applied in activating the surface-conduction emission type electron-emitting device substrate can be reduced. Note that the offset potential determination method is not limited to the above one, and the offset potential may be determined to minimize the power value applied to the entire surface-conduction emission type electron-emitting device substrate.

Fourth Embodiment

An activation apparatus for the surface-conduction emission type electron-emitting device according to the fourth embodiment of the present invention will be described with reference to FIG. 11.

Figure 11:
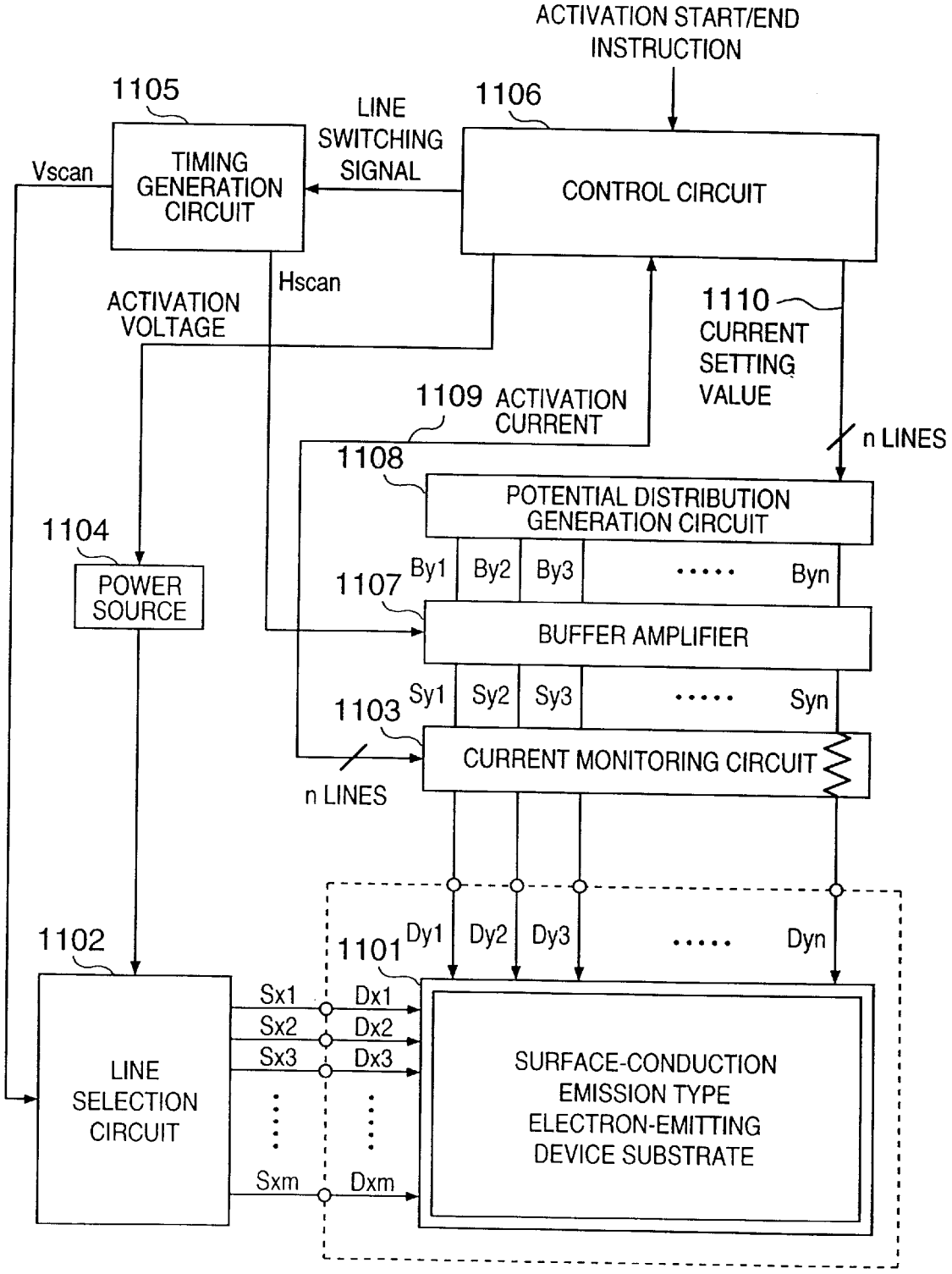
FIG. 11 is a block diagram showing an activation apparatus according to the fourth embodiment of the present invention.

Also in FIG. 11, a surface-conduction emission type electron-emitting device substrate 1101 is the same as the substrate 101 in FIG. 1. The operation of the whole apparatus, the activation procedure, and the like are the same as in the first embodiment, and a description thereof will be omitted.

The fourth embodiment is slightly different from the first embodiment in arrangements of a current monitoring circuit 1103 and a potential distribution circuit 1108, as will be described. That is, the current monitoring circuit 1103 is interposed between column-direction wiring terminals $D_{y1}$ to $D_{yn}$ and a buffer amplifier 1107 to individually monitor device currents flowing through respective devices upon activation.

Figure 12:
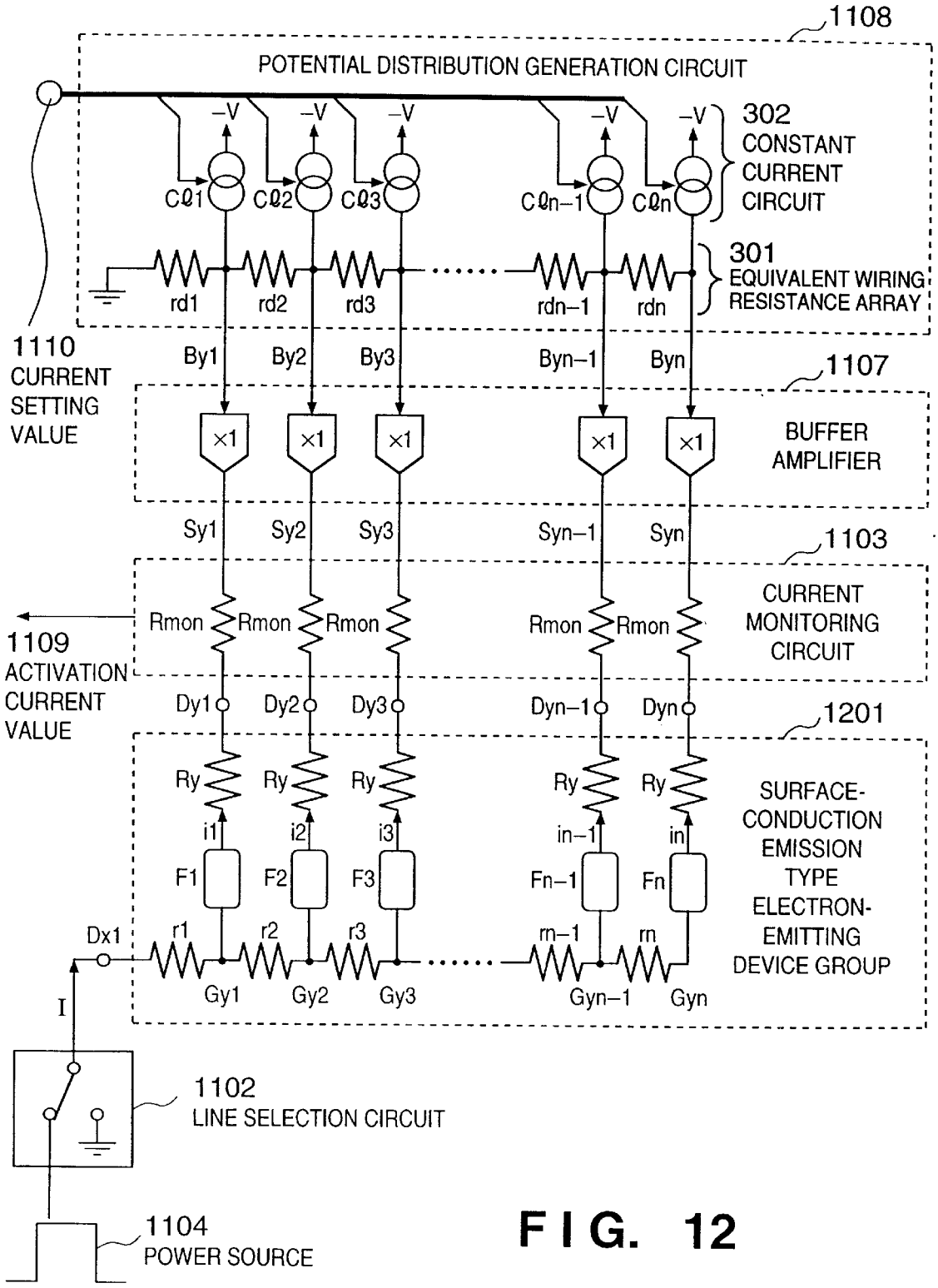
FIG. 12 is a circuit diagram showing a driving example of activating devices on a given line in the fourth embodiment.

Similar to the first embodiment, attention is paid to a surface-conduction emission type device group on the first row to which an activation voltage is applied, a surface-conduction emission type electron-emitting device group 1201 is represented by a model including the wiring resistance, and the state in which this device group is activated will be explained with reference to FIG. 12.

Also in the fourth embodiment, a potential distribution produced along with the progress of activation is generated by the potential distribution generation circuit 1108, and the terminals $D_{y1}$ to $D_{yn}$ are driven by outputs $S_{y1}$ to $S_{yn}$ from the buffer amplifier 1107 so as to cancel the potential distribution. In this case, the arrangement of a constant current circuit 302 constituting the potential distribution circuit 1108 is slightly different from that in the above embodiments. In other words, the constant current circuit 302 is changed to individually set the current setting values of n constant current sources constituting the constant current circuit 302. The circuit arrangement is changed from the circuit of FIG. 3 so as to individually set the base potentials of transistors constituting the constant current sources. With this change, current setting values 1110 corresponding to the n constant current sources can be externally supplied to individually drive the constant current sources in the potential distribution circuit 1108 shown in FIG. 12.

At the same time, the current monitoring circuit 1103 is changed to individually monitor device currents flowing through respective devices. The current monitoring circuit 1103 is made up of detection resistances $R_{mon}$ and a measurement amplifier for measuring a voltage generated across each detection resistance $R_{mon}$. With these components, the current monitoring circuit 103 detects the currents $I_f$ and outputs n detected activation current values 1109. Note that the resistance value of the detection resistance $R_{mon}$ is set small enough to prevent influence on an application potential to the surface-conduction emission type electron-emitting device by a potential drop caused by the flowing device current $I_f$.

Since the arrangement of the constant current circuit 302 constituting the potential distribution circuit 1108 is changed to individually set current setting values for respective rows, the potential drop distribution at terminals $G_{y1}$ to $G_{yn}$ along with the progress of activation can be more accurately reproduced by outputs $B_{y1}$ to $B_{yn}$ from the potential distribution circuit 1108. The above-described embodiments estimate current values flowing through respective devices from an activation current for one line, and control an output from the potential distribution generation circuit 108 on the assumption that activation of the devices $F_1$ to $F_n$ uniformly progresses and the device currents i1 to in flowing through respective devices are almost equal. In the fourth embodiment, however, a more accurate potential distribution can be reproduced by individually monitoring the activation currents of respective devices. The activation current values of respective devices are supplied as current setting values to constant current sources $CI_1$ to $CI_n$ on each row in the potential distribution circuit 1108, and potentials in accordance with a potential distribution in an activated line are applied to the terminals $D_{y1}$ to $D_{yn}$ via the outputs $S_{y1}$ to $S_{yn}$ of the buffer amplifier 1107. That is, the first embodiment employs the average value $i_{ave}$ as a device current, whereas the fourth embodiment employs a device current measured for each device. Consequently, voltages applied between the terminals of the devices $F_1$ to $F_n$ can be made uniform regardless of the device position and the progress of activation.

Note that when an output from the buffer amplifier 1107 is not 0 V, a current value detected by the current monitoring circuit 1103 does not always coincide with a device current flowing through each device. This will be explained. Although not shown in FIG. 12, application potentials from the column-direction wiring terminals $D_{y1}$ to $D_{yn}$ are applied to not only devices on an activated line but also devices on an inactivated line because surface-conduction emission type electron-emitting devices are arranged in a simple matrix. Therefore, a current $I_x$ of the xth row detected by the current monitoring circuit 1103 is $I_x$=Device Current Flowing Through Device $F_x$ Upon Application of 18 V+Current Flowing Through Inactivated Device (m−1) Connected to Terminal $D_{yx}$ Upon Application of Potential $S_{yx}$ The first term is a true device current, and the current amount of the second term is an error. In practice, the difference between the potential $S_y$ and the potential of an unselected line is small, and the current amount of the second term is small to a negligible degree. To more accurately measure the current, the following steps are executed.

(1) All the row-direction wiring terminals $D_{x1}$ to $D_{xm}$ are set to 0 V, and the column-direction wiring terminals $D_{y1}$ to $D_{yn}$ are driven by $S_{y1}$ to $S_{yn}$. A current $I_a$ measured at this time is the sum of (m) currents flowing through all devices connected to $D_{yx}$ upon application of the potential $S_{yx}$.

(2) One of the row-direction wiring terminals is selected, and the column-direction wiring terminals $D_{y1}$ to $D_{yn}$ are driven by $S_{y1}$ to $S_{yn}$. A current $I_b$ measured at this time is a "device current flowing through the device $F_x$ upon application of 18 V+a current flowing through the (m−1) inactivated devices connected to $D_{yx}$ upon application of potential $S_{yx}$".

By these two measurements,

Device Current Flowing Through Device $F_x$ Upon Application of 18 $V=I_b-I_a$ is calculated. If a potential distribution is calculated using this value, more accurate control can be achieved.

Fifth Embodiment

An activation apparatus for the surface-conduction emission type electron-emitting device according to the fifth embodiment of the present invention will be described with reference to FIG. 13.

Figure 13:
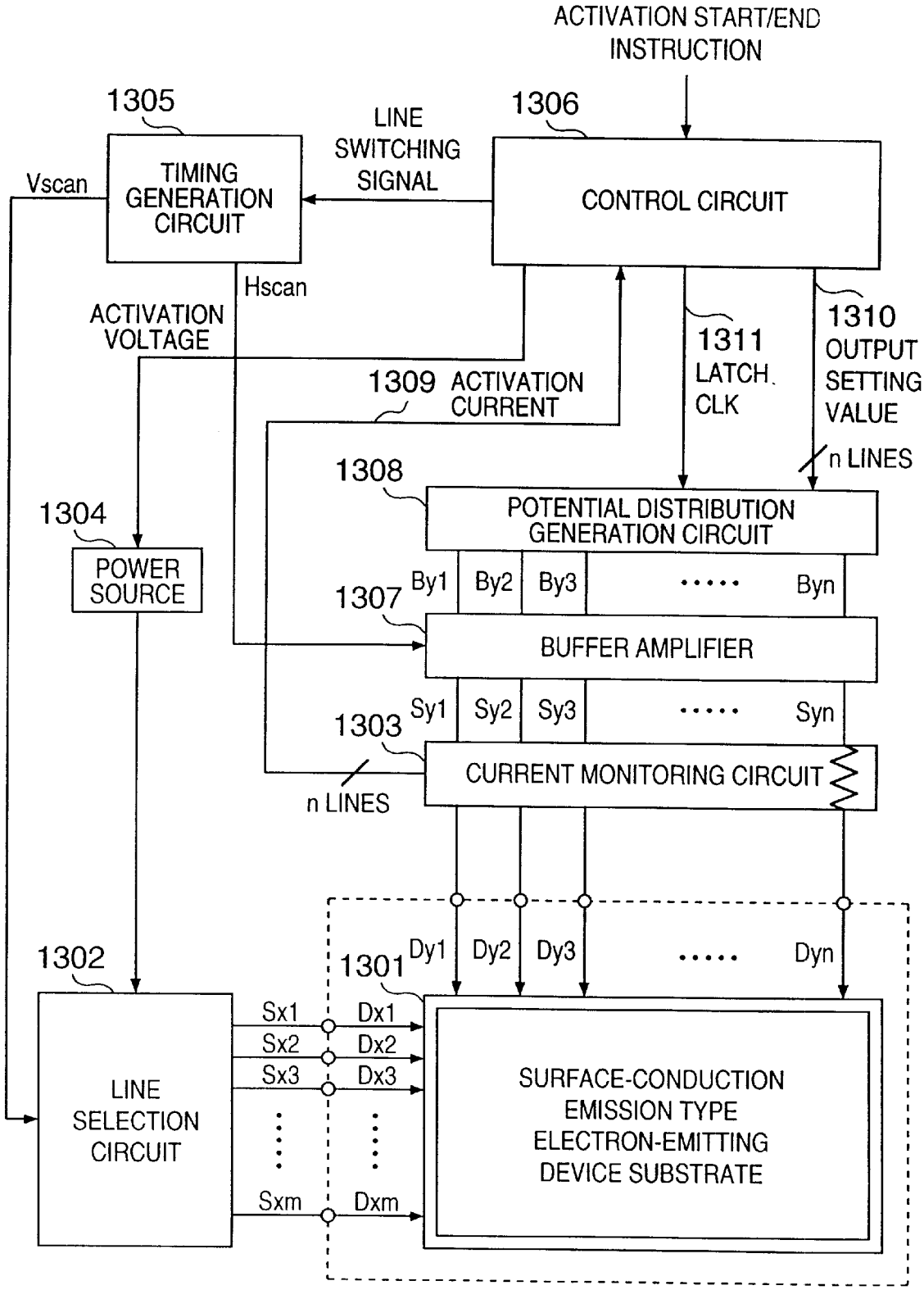
FIG. 13 is a block diagram showing an activation apparatus according to the fifth embodiment of the present invention.

Also in FIG. 13, a surface-conduction emission type electron-emitting device substrate 1301 is the same as the substrate 101 in FIG. 1. The operation of the whole apparatus, the activation procedure, and the like are the same as in the first embodiment, and a description thereof will be omitted. The arrangement of a current monitoring circuit 1303 is the same as in the fourth embodiment. The current monitoring circuit 1303 is interposed between column-direction wiring terminals $D_{y1}$ to $D_{yn}$ and a buffer amplifier 1307 to individually monitor device currents flowing through respective devices upon activation. However, the fifth embodiment is slightly different from the fourth embodiment in arrangement of a potential distribution circuit 1308. That is, a control circuit 1306 calculates a potential distribution amount from activation current values flowing through devices, and transfers a digital output value corresponding to the potential distribution obtained from the calculation result to the potential distribution generation circuit.

Figure 14:
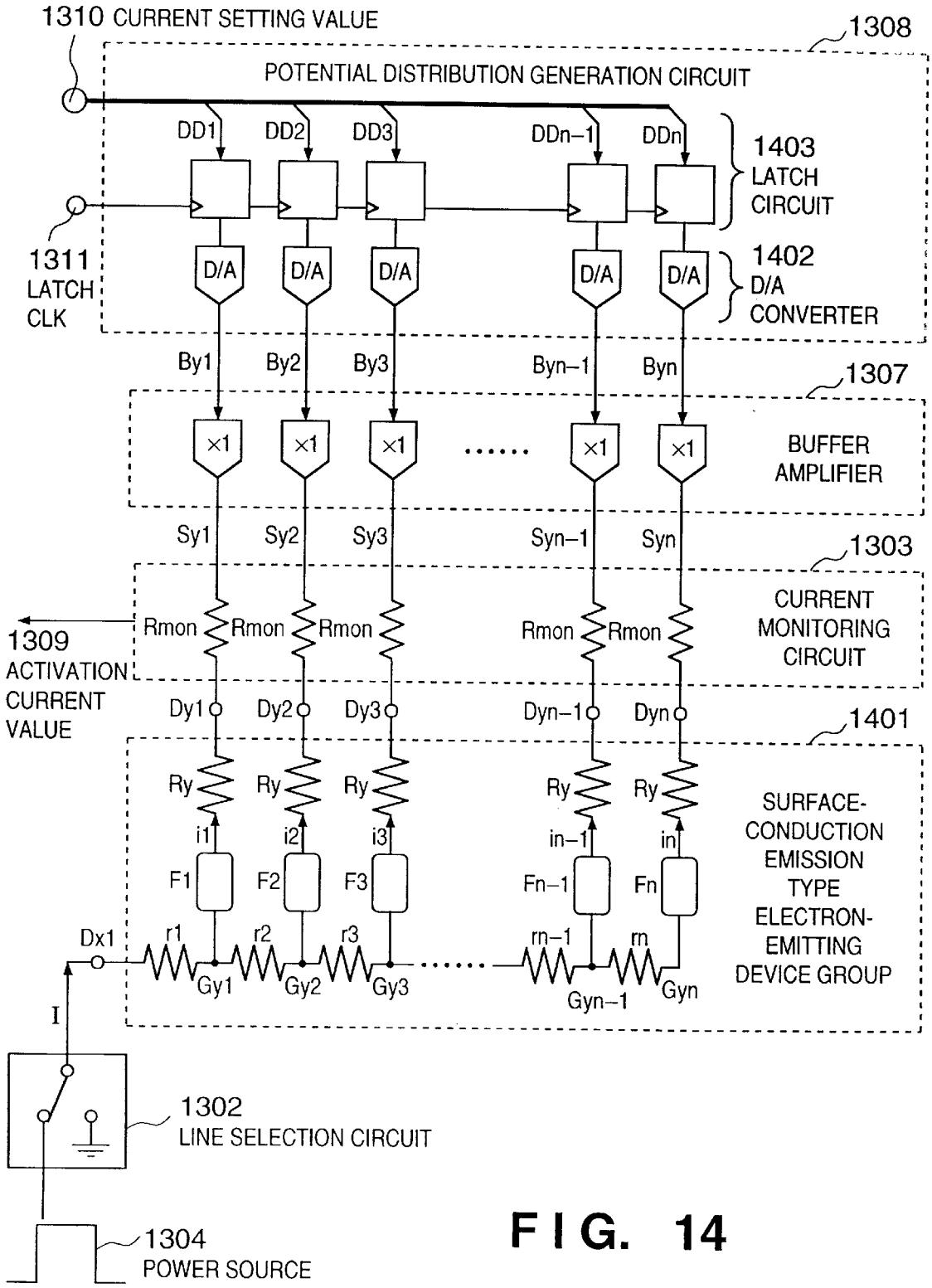
FIG. 14 is a circuit diagram showing a driving example of activating devices on a given line in the fifth embodiment.

Similar to the first embodiment, attention is paid to a surface-conduction emission type device group on the first row to which an activation voltage is applied, a surface-conduction emission type electron-emitting device group 1401 is represented by a model including the wiring resistance, and the state in which this device group is activated will be explained with reference to FIG. 14.

Also in the fifth embodiment, the terminals $D_{y1}$ to $D_{yn}$ are driven by outputs $S_{y1}$ to $S_{yn}$ from the buffer amplifier 1307 so as to cancel a potential distribution produced along with the progress of activation. The potential distribution circuit 1308 is constituted by n D/A converters 1402 and n latch circuits 1403. With this arrangement, digital output setting values 1310 corresponding to the n D/A converters are externally supplied to individually drive the D/A converters. The digital output setting value 1310 is set as a potential drop distribution amount calculated by the control circuit 1306. Independent potentials are set in the respective D/A converters, and all the outputs are simultaneously updated by a latch CLK 1311.

Similar to the fourth embodiment, the current monitoring circuit 1303 can individually monitor device currents flowing through respective devices. The current monitoring circuit 1303 is made up of detection resistances $R_{mon}$ and a measurement amplifier for measuring a voltage generated across each detection resistance $R_{mon}$ With these components, the current monitoring circuit 103 detects the currents $I_f$ and outputs n detected activation current values 1309.

In the fifth embodiment, a device potential distribution generated along with the progress of activation is calculated as follows. When device current values $i_1$ to in flowing through devices $F_1$ to $F_n$ are obtained from the current monitoring circuit 1303, potentials $B_{y1}$ to $B_{yn}$ to be output to the output terminals of the potential distribution circuit 1308 are calculated using the wiring resistance values r1 to rn:

$$B_{y1}=-r1\times\Sigma\{k=1 \text{ to } n\}ik$$

$$B_{y2}=-r2\times\Sigma\{k=2 \text{ to } n\}ik+B_{y1}$$

$$\ldots$$

$$B_{yn}=-rn\times in+B_{yn-1}+B_{yn-2}+\ldots+B_{y1}$$

Device currents flowing along with the progress of activation are measured. The control circuit 1306 sequentially updates the output potentials $B_{y1}$ to $B_{yn}$ by the above equations, and transfers corresponding digital output data to the latch circuits 1403 of the potential distribution circuit 1308. Upon completion of a series of operations: measurement of the device current→calculation of output data→transfer of data to the latch circuit, the control circuit 1306 applies the latch clock 1311 to all the latch circuits 1403 in order to update D/A data, and updates the data in synchronism with this. Then, the potential distribution circuit 1308 generates a potential distribution corresponding to a potential distribution amount generated at the terminals $G_{y1}$ to $G_{yn}$ of the devices $F_1$ to $F_n$. Note that when the number n of devices is large, a long time may be spent for a series of operations: measurement of the device current→calculation of output data→data transfer. This time can be shortened by parallel processing for respective devices.

By compensating an activation potential distribution generated in devices upon activation by the above-described method, the electron-emitting characteristics of all devices can be made uniform. Further, in the fifth embodiment, the output setting value is a digital value, and no constant current circuit or equivalent wiring resistance array is used. This can prevent a nonuniform activation voltage generated by the difference between the lines, such as the difference between a wiring resistance distribution on a line to be activated and a resistance value distribution in the equivalent wiring resistance array.

Sixth Embodiment

Activation for the surface-conduction emission type electron-emitting device according to the sixth embodiment of the present invention will be described with reference to FIG. 16.

Figure 16:
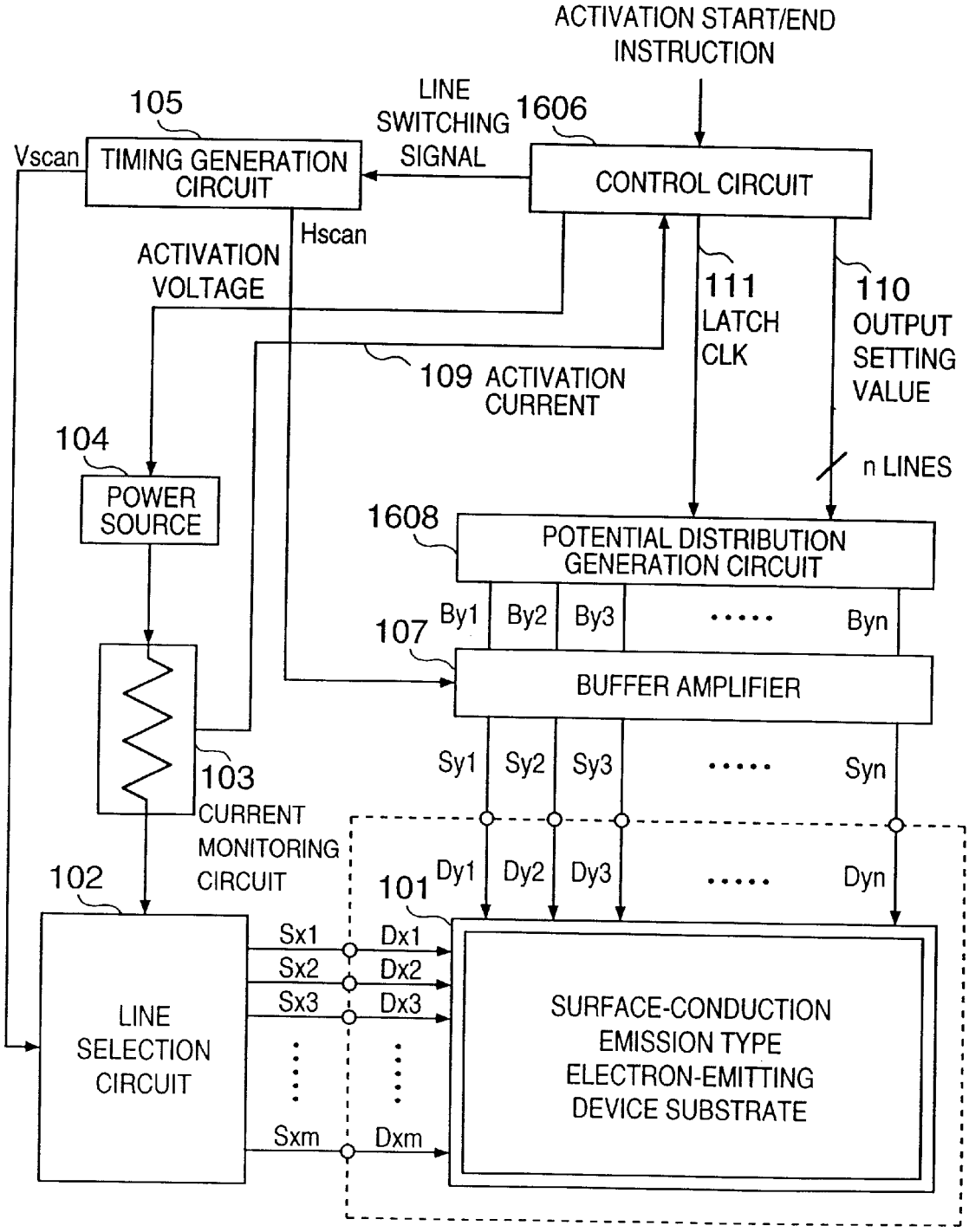
FIG. 16 is a block diagram showing an activation apparatus according to the sixth embodiment of the present invention.

Also in FIG. 16, a surface-conduction emission type electron-emitting device substrate 101 is the same as the substrate 101 in FIG. 1. The operation of the whole apparatus, the activation procedure, and the like are the same as in the first embodiment, and a description thereof will be omitted. The arrangement of a potential distribution circuit 1608 is the same as in the fifth embodiment, and a control circuit transfers a digital output value corresponding to a potential distribution to the potential distribution generation circuit. For this purpose, a control circuit 1606 outputs a latch clock 111 to the potential distribution generation circuit 1608. The remaining arrangement is the same as in the first embodiment.

In the sixth embodiment, the control circuit 1606 detects the progress of activation by a current amount flowing upon activation, i.e., an activation current 109 as output data from a current monitoring circuit 103. The control circuit 1606 starts activation in response to an activation start command, and sequentially corrects the potential distribution of devices in the column direction that changes with the progress of activation, as will be described in detail later. That is, the control circuit 1606 estimates a device current flowing through each device using an output from the current monitoring circuit 103, and calculates a potential distribution generated in devices in the column direction from the estimated value. By this driving method, a voltage distribution generated in respective devices by the activation current and row-direction wiring resistance is corrected to apply a constant voltage across all devices on an activated lines. By sequentially updating data of the potential distribution circuit 1608 in accordance with the progress of activation, the potential distribution is corrected until the end of activation.

Potential Distribution Generation Circuit

Figure 17:
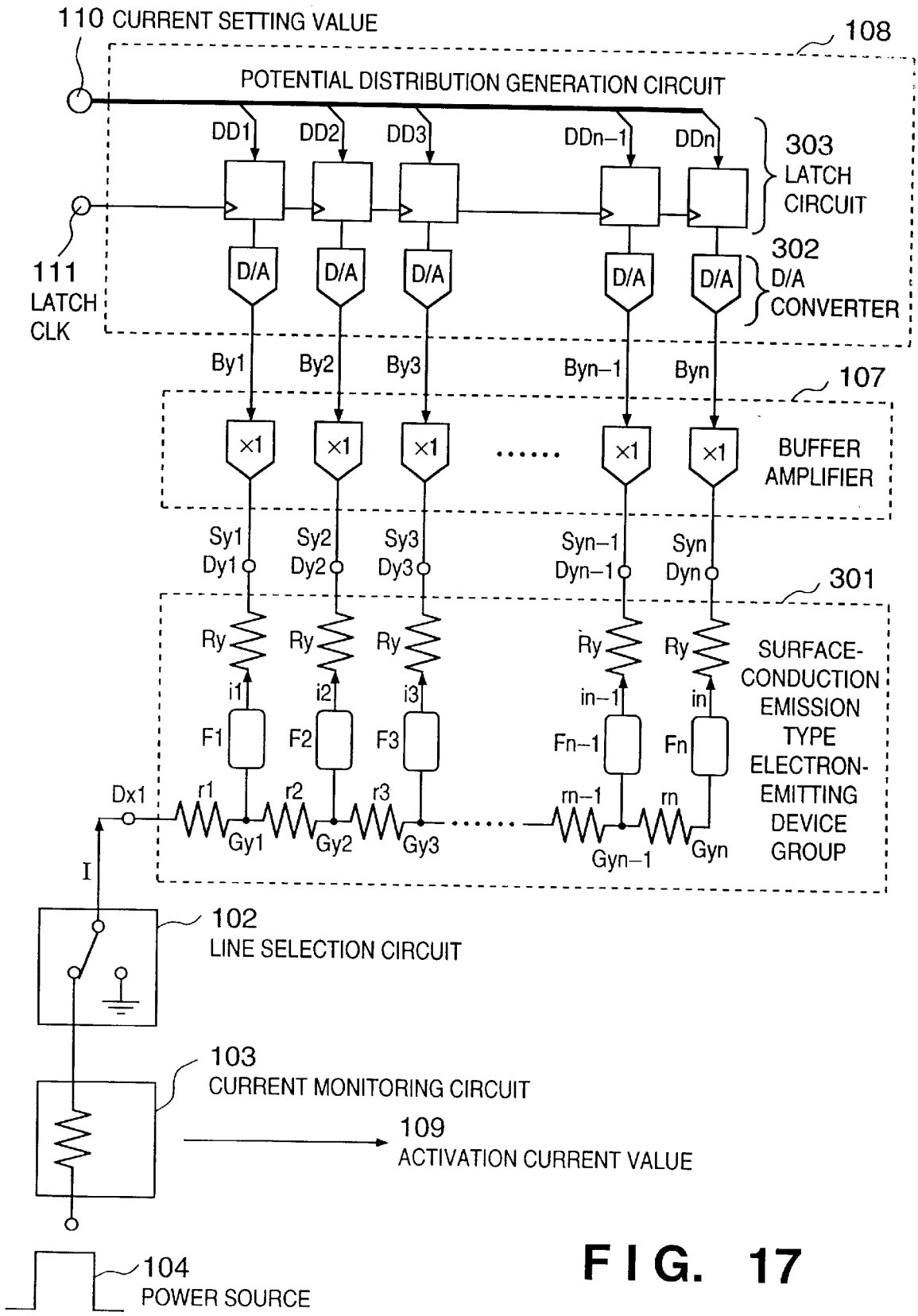
FIG. 17 is a circuit diagram showing a driving example of activating devices on a given line in the sixth embodiment.

FIG. 17 is a circuit diagram showing the arrangement of the potential distribution generation circuit 1608 to explain the state in which a given line is activated using the potential distribution circuit 1608.

The potential distribution generation circuit 1608 generates a compensation potential amount to be applied in the column direction and outputs it to the buffer amplifier 107 in order to compensate a potential drop caused by a device current flowing through each device and a row-direction wiring resistance (r1 to rN in FIG. 40) along with the progress of activation.

In the sixth embodiment, terminals $D_{y1}$ to $D_{yn}$ of the surface-conduction emission type electron-emitting device substrate 101 are driven by outputs ($S_{y1}$ to $S_{yn}$) from the buffer amplifier 107 so as to cancel a potential distribution generated along with the progress of activation.

The potential distribution generation circuit 1608 is constituted by n D/A converters 302 and n latch circuits 303. Digital output setting values 110 corresponding to the n D/A converters are externally set. More specifically, the control circuit 1606 calculates a potential drop distribution amount and sets it as the digital output setting value 110. Independent potentials are set in the respective D/A converters, and all the outputs are simultaneously updated by a latch CLK 111.

Activation Processing

Subsequently, a procedure of activating the surface-conduction emission type electron-emitting device substrate 101 using the apparatus of the sixth embodiment will be described with reference to FIGS. 16, 17, 5A and 5B. Activation is performed to set all device currents to a target value. This target current value is determined in advance from a necessary electron-emitting amount or the like. In the sixth embodiment, activation processing is performed while monitoring an output from the current monitoring circuit 103 so as to set the device currents of respective devices on the surface-conduction emission type electron-emitting device substrate 101 to 2 mA at last.

An activation flow will be explained.

When the control circuit 1606 receives an activation start command, it controls a timing generation circuit 105 and a power source 104 in order to perform electrification processing in units of rows.

The control circuit 1606 sets the current setting value 110 so as to set the column-direction wiring terminals $D_{y1}$ to $D_{yn}$ to the ground potential, and sequentially applies pulses of the activation potential Eac to row-direction wiring terminals $D_{x1}$ to $D_{xm}$. This pulse has, e.g., a pulse width of 1 msec and a pulse height of about 18 V. Then, the pulse potentials are sequentially applied to the surface-conduction emission type electron-emitting device substrate 101 in units of rows to start activation in units of lines.

The sixth embodiment will exemplify activation when n devices on the line of the row-direction wiring terminal $D_{x1}$ are activated.

Attention is paid to a surface-conduction emission type device group on the first row to which an activation voltage is applied, a surface-conduction emission type electron-emitting device group 301 is represented by a model including the wiring resistance, and the state in which this device group is activated will be explained with reference to FIG. 17. In FIG. 17, reference symbols $F_1$ to $F_n$ denote surface-conduction emission type electron-emitting devices on the line of the row-direction wiring terminal $D_{x1}$; r1 to rn, wring resistances at respective portions on a row wiring $EX_1$; and $R_y$, a wiring resistance from the feeding terminal of each of the wirings $D_{y1}$ to $D_{yn}$ to a corresponding surface-conduction emission type electron-emitting device. Since the row wiring is designed to be formed from a material having a constant line width and thickness in the sixth embodiment, r1 to rN can be considered to be equal except for variations in the manufacture. Since the wirings are designed to be uniform, the resistances $R_y$ of the respective wirings can be considered to be equal. Although the equivalent resistance value of the surface-conduction emission type electron-emitting device changes (decreases) before and after activation, the equivalent resistance of each device is much higher than the value $R_y$, and the influence of $R_y$ is substantially negligible. The equivalent resistance value of the surface-conduction emission type electron-emitting device is designed higher than r1 to rN.

To activate the surface-conduction emission type electron-emitting device group 301, the control circuit 1606 controls a line selection circuit 102 via the timing generation circuit 105, and applies the activation potential Eac to the row-direction wiring terminal $D_{x1}$ via the power source 104 and current monitoring circuit 103. Thus, the terminal $D_{x1}$ is driven by the activation potential Eac.

On the other hand, the terminals $D_{y1}$ to $D_{yn}$ as other electrode terminals of devices on the line $D_{x1}$ are driven by the buffer amplifier 107. The buffer amplifier 107 operates to sink activation currents i1 to in from the devices $F_1$ to $F_n$ or use them as a current source, and the output potential amplitude is determined by the potential distribution generation circuit 1608.

In activation, the electrical characteristics of the device change as shown in FIG. 41. That is, the device current does not substantially flow at the start of activation, starts flowing at the same time as electrification, and saturates. At this time, the terminal potential of the device group on the row wiring $D_{x1}$ is monitored to find changes in potentials $G_{y1}$ to $G_{yn}$ due to the influence of the wiring resistances r1 to rn. The potential change increases with the progress of activation and maximizes at the end of activation. For example, for an activation current of 2 mA/device, r1 to rn=5 mΩ, and n=1000, a potential change:

$$\Delta V = \tfrac{1}{2} \times 1000 \times 1001 \times 2\ \text{mA} \times 5\ \text{m}\Omega \approx 5\ \text{V}$$

occurs at the terminal $G_{yn}$ of the device $F_n$ farthest from the feeding terminal.

To prevent this, a potential distribution identical to this potential distribution is generated by the potential distribution generation circuit 1608, and the terminals $D_{y1}$ to $D_{yn}$ are driven by outputs $S_{y1}$ to $S_{yn}$ from the buffer amplifier 107 so as to cancel the potential distribution produced in respective devices.

More specifically, the potential drop distribution at the terminals $G_{y1}$ to $G_{yn}$ produced by currents flowing through the devices $F_1$ to $F_n$ along with the progress of activation is reproduced by outputs $B_{y1}$ to $B_{yn}$ from the potential distribution generation circuit 1608. If activation of the devices $F_1$ to $F_n$ substantially uniformly progresses, the device currents i1 to in flowing through the respective devices are almost equal, and the current value can be given using an activation current I (109) detected by the current monitoring circuit 103:

$$i_{ave}=(i_1=i_2= \ldots i_n=)I/n$$

(n is the number of column-direction devices)

The control circuit 1606 calculates a potential drop amount at each device terminal using $i_{ave}$ as a current value flowing through each device, and sets the calculated amount in the potential distribution generation circuit 1608. Accordingly, a potential drop distribution identical to the distribution at the device terminals $G_{y1}$ to $G_{yn}$ of the devices $F_1$ to $F_n$ is realized at the outputs $B_{y1}$ to $B_{yn}$ of the potential distribution generation circuit 1608. By applying these potentials to the terminals $D_{y1}$ to $D_{yn}$ via the outputs $S_{y1}$ to $S_{yn}$ of the buffer amplifier 107, voltages applied between the terminals of the devices $F_1$ to $F_n$ can be made uniform regardless of the device number and the progress of activation.

In the sixth embodiment, the potential distribution at device terminals produced along with the progress of activation is calculated as follows.

Assuming that activation substantially simultaneously progresses for respective devices, the device currents i1 to in flowing through the devices $F_1$ to $F_n$ are estimated from the activation current I (109) detected by the current monitoring circuit 103:

$$i_{ave}=(i_1=i_2= \ldots i_n=)I/n \tag{1}$$

At this time, the potentials $B_{y1}$ to $B_{yn}$ to be output to the output terminals of the potential distribution generation circuit 1608 are calculated using the wiring resistance values r1 to rn≈r:

$$\begin{aligned} B_{y1} &= -r1 \times \sum \{k = 1 \text{ to } n\} i_k \\ &\approx -r \times n \times i_{ave} \\ &\approx -r \times I \\ B_{y2} &= -r2 \times \sum \{k = 2 \text{ to } n\} i_k + B_{y1} \\ &\approx -r \times (n-1)/n \times I + (-r \times I) \\ &\ldots \\ B_{yn} &= -rn \times in + B_{yn-1} + B_{yn-2} + \ldots + B_{y1} \\ &\approx -r \times 1/n \times I + \ldots -r \times (n-1)/n \times I + (-r \times I) \\ &\approx -1/2 \times r \times (n+1) \times I \end{aligned} \tag{2}$$

Along with the progress of activation, the control circuit 1606 measures the activation current, and sequentially calculates the output potentials $B_{y1}$ to $B_{yn}$ from equation (2). The control circuit 1306 transfers digital output data corresponding to the output potentials $B_{y1}$ to $B_{yn}$ to the latch circuits 303 of the potential distribution circuit 1608. Upon completion of a series of operations: measurement of the device current→calculation of output data→transfer of data to the latch circuit, the control circuit 1606 applies the latch clock 110 to all the latch circuits 303 in order to update D/A data, and updates the data in synchronism with this. Then, the potential distribution generation circuit 1608 generates a potential distribution corresponding to a potential distribution amount generated at the terminals $G_{y1}$ to $G_{yn}$ of the devices to $F_1$ to $F_n$.

Similar to the first embodiment, FIGS. 5A and 5B show the distributions of potentials applied across the devices $F_1$ to $F_n$ at the start and end of activation in the sixth embodiment. FIG. 5A shows a potential distribution immediately after the start of activation. The abscissa represents device numbers $F_1$ to $F_n$, which indicate device positions. The ordinate represents terminal potentials at the two terminals of each device. As described above, currents flowing through respective devices are small immediately after the start of activation. Therefore, the activation potential Eac= 18 V is applied from the power source 104 to the terminals $G_{y1}$ to $G_{yn}$ of the devices. Since almost no activation current flows, the current setting value of the potential distribution generation circuit 1608 is almost 0, and the outputs $B_{y1}$ to $B_{yn}$ of the potential distribution generation circuit 1608 and the outputs $S_{y1}$ to $S_{yn}$ of the buffer 107 are also at almost 0 V. For this reason, a predetermined application voltage up to 18 V is applied to the respective devices to progress activation.

FIG. 5B shows a potential distribution at the end of activation. At the end of activation, currents flowing through respective devices are almost 2 mA. The activation potential Eac (application width: 18 V) applied from the power source 104 decreases owing to the influence of a potential drop caused by the wiring resistance upon application to the terminals $G_{y1}$ to $G_{yn}$ of the respective devices. At this time, if the current setting value of the potential distribution generation circuit 1608 is set to 2 mA, the outputs $B_{y1}$ to $B_{yn}$ of the potential distribution generation circuit 1608 and the outputs $S_{y1}$ to $S_{yn}$ of the buffer 107 have the same distribution as $G_{y1}$ to $G_{yn}$. As a result, a predetermined application voltage up to 18 V is applied to the respective devices to activate them.

More specifically, when the device current increases with the progress of activation, the potential distribution generated at the device terminal always changes due to the influence of the wiring resistance. In this case, the control circuit 1606 calculates the outputs $B_{y1}$ to $B_{yn}$ of the potential distribution generation circuit 1608 in accordance with equation (2) from the activation current values I sequentially detected by the current monitoring circuit 103 along with the progress of activation. The control circuit 1606 sequentially updates and sets values corresponding to the calculated values $B_{y1}$ to $B_{yn}$ for $DD_1$ to $DD_n$ of the latch circuits 303 included in the potential distribution generation circuit 1608. In this fashion, all devices are activated by a constant voltage from the start to end of activation. When the device current of each device reaches 2 mA, activation ends.

Figure 21:
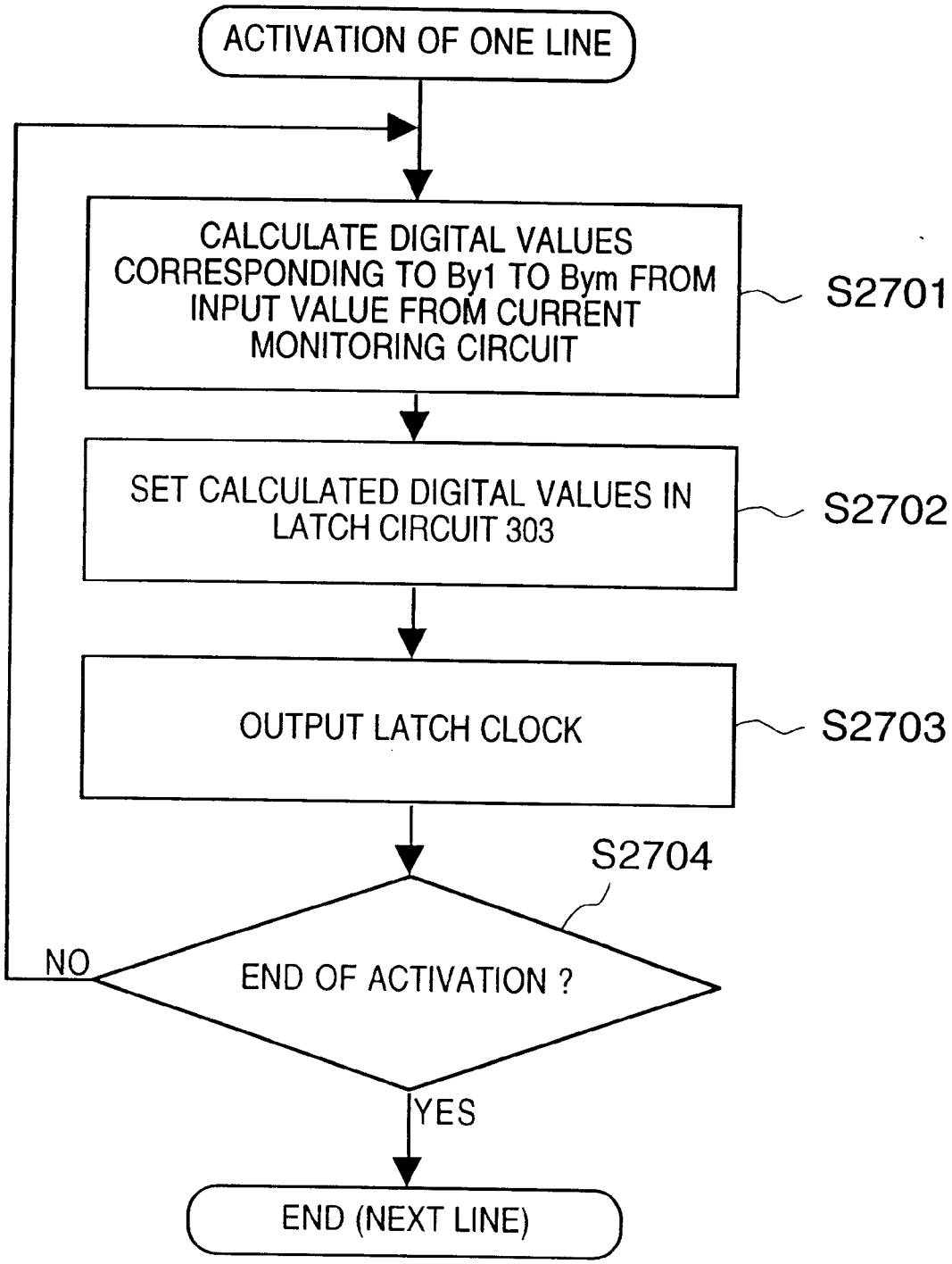
FIG. 21 is a flow chart showing a control procedure when activation is performed by a procedure of completing activation in units of lines and switching lines.

FIG. 21 shows an example of a control procedure by the control circuit 1606 when activation is performed by a procedure of completing activation in units of lines and switching lines. FIG. 21 shows a procedure for one line. Since the substrate 101 generally has a plurality of lines, this control procedure is repeatedly executed for a plurality of lines. In FIG. 21, the control circuit 1606 calculates digital values corresponding to the potentials $B_{y1}$ to $B_{yn}$ from an input value from the current monitoring circuit 103 (step S2701). The control circuit 1606 sets the calculated values in the latch circuits $DD_1$ to $DD_n$ (step S2702). In this state, the control circuit 1606 outputs a latch clock to the potential distribution generation circuit (step S2703). This is repeatedly executed until the above-described activation end conditions are satisfied. If the conditions are satisfied, activation for this line ends (YES in step S2704). If a next line exists, the control circuit 1606 outputs a line switching signal to select the next line. If activation for the selected line has not been completed yet, the control circuit 1606 returns to step S2701 to read an activation current value with respect to the activation potential applied in step S2703 from the current monitoring circuit 103, andrepeatedlyexecutes theprocessingfromstep S2701. The clock output in step S2703 may be a signal having a predetermined frequency which is generated based on a clock for controlling the operation of the control circuit 1606 itself.

By this method, an activation voltage distribution generated upon activation can be corrected to make the electron-emitting characteristics of all devices uniform.

The above description is directed to activation of devices on the row wiring $D_{x1}$. This procedure can similarly apply to activation of devices on another line. In this way, activation of all surface-conduction emission type electron-emitting devices on the substrate 101 is completed.

When a plurality of lines are activated, after activation of devices on a given line is completed, the line selection circuit 102 is switched to activate another activation line (activation is performed in units of lines) Alternatively, a plurality of lines may be simultaneously activated while sequentially switching activation lines. In this case, the progress of activation may vary between lines. To prevent this, the average device currents of respective lines are sequentially stored in a memory or the like, and activation is performed while updating the output of the potential distribution generation circuit 1608 at a high speed using the average device current stored in the memory in switching lines. At this time, when the row-direction wiring resistances r1 to rn become slightly different between lines, these values are also stored in a memory or the like, and when the potential distribution is updated, appropriately read out together with the average device current value of each line and used for calculation.

When the number n of devices is large, a long time may be spent for a series of operations: measurement of the activation current→calculation of output data→data transfer. This time can be shortened by parallel processing for respective devices. In the sixth embodiment, the potential distribution generation circuit 1608 is constituted by D/A converters equal in number to the number n of column-direction wirings of the surface-conduction emission type electron-emitting device substrate 101. Since the compensation potential distribution profile changes gradually, as shown in FIGS. 5A and 5B, the D/A converters may be thinned out, and potential values to be applied to the thinned column-direction wiring terminals may be defined by resistance division. This realizes a small number of D/A converters, a short calculation time, and low cost.

In the sixth embodiment, the power source 104 has a positive output, and activation is performed to flow a current from the terminal $D_{x1}$ to the terminals $D_{y1}$ to $D_{yn}$. Alternatively, the polarity may be inverted, and activation may be performed to flow a current from the terminals $D_{y1}$ to $D_{yn}$ to the terminal $D_{x1}$. In this case, since the potential distribution is also inverted, the buffer amplifier 107 is constituted as a (−1)-time inverting buffer amplifier to source the current, thereby obtaining the same effects.

In the sixth embodiment, the influence of the column-direction wiring resistance $R_y$ in FIG. 17 is ignored when the resistance of the column-direction wiring is much lower than the equivalent resistance of the surface-conduction emission type electron-emitting device. When, however, the resistance of the extraction wiring or the like increases to a noticeable degree, a potential drop caused by the column-direction wiring resistance may be compensated.

As described above, the activation apparatus of the sixth embodiment can make the electron-emitting characteristics of all devices uniform by monitoring activation currents and correcting the distribution of activation voltages to respective devices on one line. This electron source substrate is used to realize a high-quality image display apparatus almost free from variations in luminance or density.

Seventh Embodiment

An activation apparatus for the surface-conduction emission type electron-emitting device according to the seventh embodiment of the present invention will be described with reference to FIG. 18.

Figure 18:
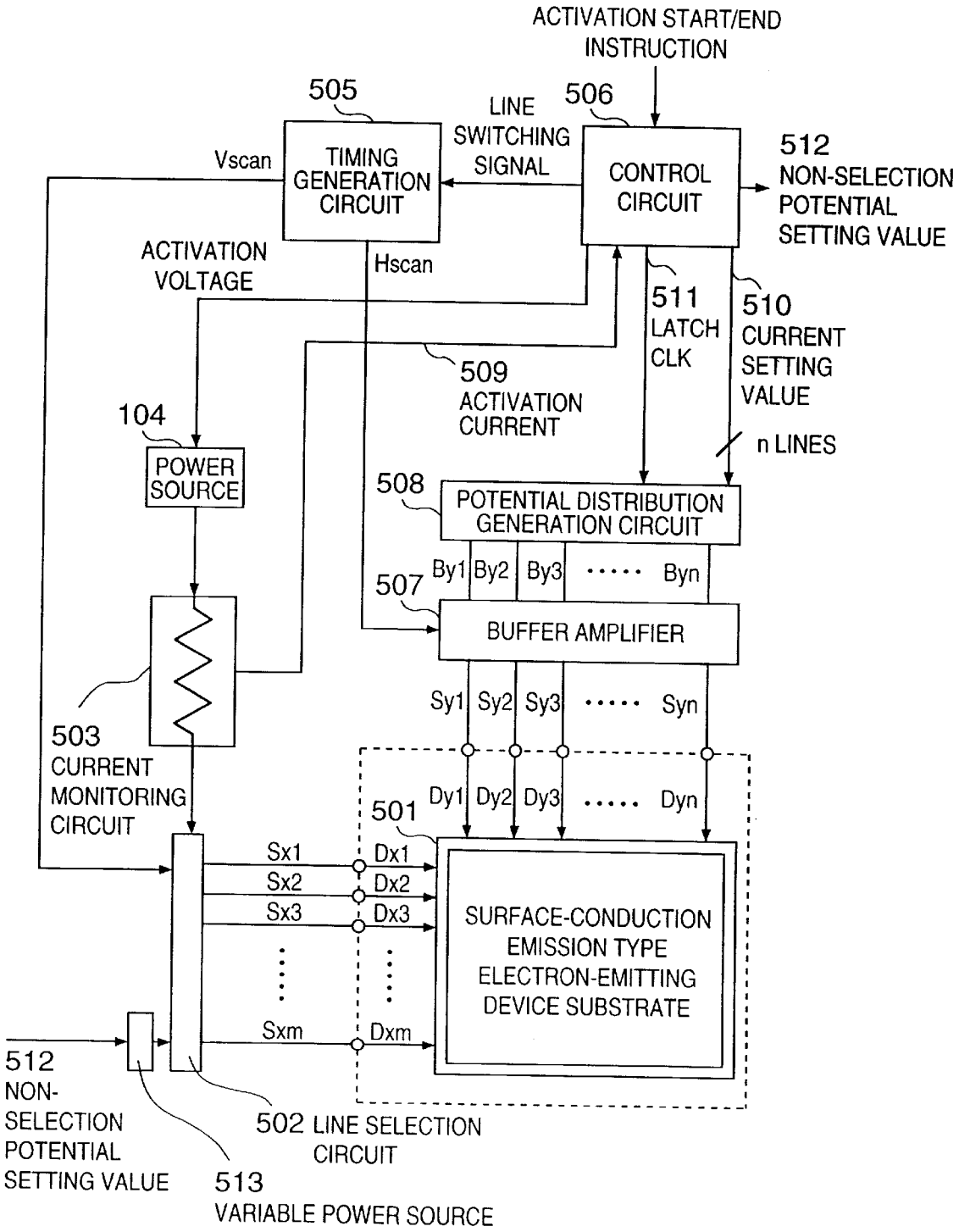
FIG. 18 is a block diagram showing an activation apparatus for a surface-conduction emission type electron-emitting device according to the seventh embodiment.

Also in FIG. 18, a surface-conduction emission type electron-emitting device substrate 501 is the same as the substrate 101 in FIG. 6. The operation of the whole apparatus, the activation procedure, and the like are the same as in the sixth embodiment, and a description thereof will be omitted.

The seventh embodiment is different from the sixth embodiment in method of driving a line selection circuit 502 of the surface-conduction emission type electron-emitting device substrate 501, as will be described.

The method of driving the line selection circuit 502 will be explained.

The line selection circuit 502 incorporates m switching elements ($SW_{x1}$ to $SW_{xm}$). Each switching element selects either one of the output potential of a power source 504 and the output potential of a variable power source 513, and the m switching elements are electrically connected to terminals $D_{x1}$ to $D_{xm}$ of the surface-conduction emission type electron-emitting device substrate 501. Each switching element operates based on a control signal $V_{scan}$ output from a timing generation circuit 105. In practice, the switching elements can be easily constituted by a combination of switching elements such as FETs or relays.

Figure 19:
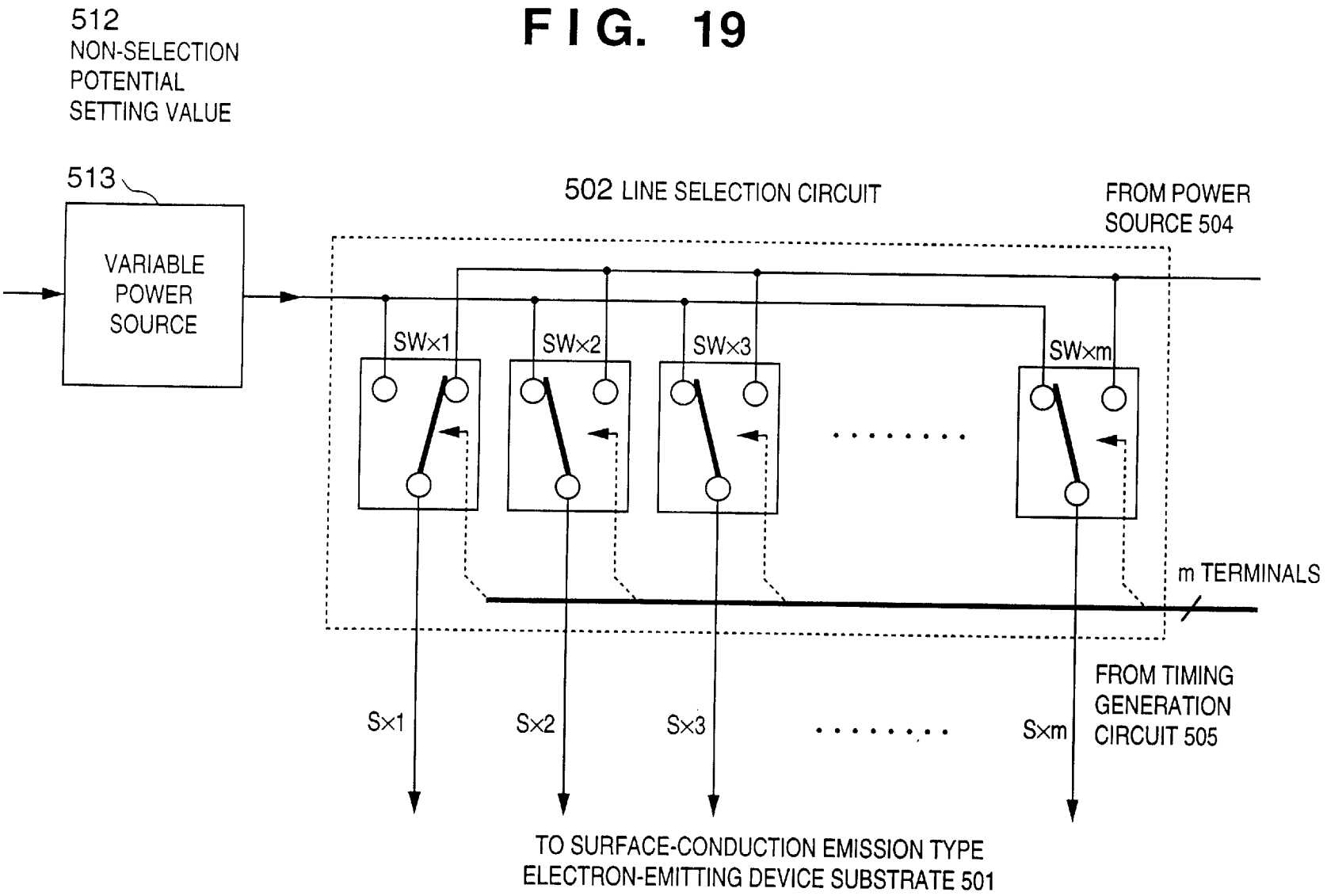
FIG. 19 is a circuit diagram showing a line selection circuit used in the activation apparatus of the seventh embodiment.

In FIG. 19, the first line ($S_{x1}$) is selected, the output potential of the power source 504 is applied to only the row-direction wiring $D_{x1}$, and the remaining lines ($S_{x2}$ to $S_{xm}$) are connected to the output potential of thevariable power source 513. The output potential of the variable power source 513 is set by a non-selection potential setting value 512 output from a control circuit 506.

In the seventh embodiment, a non-selection potential as a potential applied to unselected lines ($S_{x2}$ to $S_{xm}$) to which no activation voltage is applied is set to a potential other than the ground level. The reason is as follows.

According to the electron source manufacturing method of the seventh embodiment, when activation is performed in units of rows, a potential drop distribution generated in the column direction on the same row is compensated by application potentials from column-direction wiring terminals $D_{y1}$ to $D_{yn}$. The application potentials from the column-direction wiring terminals $D_{y1}$ to $D_{yn}$ are applied to not only devices on an activated line but also devices on an inactivated line because the surface-conduction emission type electron-emitting device substrate has a simple matrix arrangement. As a matter of course, the potentials of the column-direction wiring terminals $D_{y1}$ to $D_{yn}$ are as low as several V in maximum. It is however desirable to reduce an increase in power consumption by application of potentials to devices on an inactivated line. For this purpose, inactivated lines are grouped, and the non-selection potential setting value 512 is applied to the grouped lines so as to minimize the absolute values of voltages applied across devices connected to these lines.

The non-selection potential setting value 512 is determined by the control circuit 506 as follows. The difference between maximum and minimum potentials it generated at respective terminals at the output of a potential distribution circuit 508 is calculated as a potential drop amount. More specifically, in FIG. 18, the maximum potential distribution amount at outputs $B_{y1}$ to $B_{yn}$ of the potential distribution circuit 508 is calculated by $$\text{Maximum Potential Distribution Amount} = \text{Potential } B_{y1} - \text{Potential } B_{yn}$$

Thus, the non-selection potential setting value 512 is determined by $$\text{Non-Selection Potential Setting Value } \mathbf{512}\text{: } V_{off} = \tfrac{1}{2} \times \text{Maximum Potential Distribution Amount}$$

Also in the seventh embodiment similar to the first embodiment, the output of the potential distribution circuit 508 can be calculated using an activation current value 509 (I) of the current monitoring circuit 503 and wiring resistance values r1 to rn≈r:

$$\begin{aligned} B_{y1} &= -r1 \times \sum \{k = 1 \text{ to } n\} i_k \\ &\approx -r \times n \times i_{ave} \\ &\approx -r \times I \\ &\ldots \\ B_{yn} &= -rn \times in + B_{yn-1} + B_{yn-2} + \ldots + B_{y1} \\ &\approx -r \times 1/n \times I + \ldots - r \times (n-1)/n \times I + (-r \times I) \\ &\approx -1/2 \times r \times (n+1) \times I \end{aligned}$$

Hence, the non-selection potential setting value 512 is calculated by $$\begin{aligned} V_{off} &= -1/2 \times \text{Maximum Potential Distribution Amount} \\ &= -1/2(\text{Potential } B_{y1} - \text{Potential } B_{yn}) \\ &= -1/4 \times r \times (n-1) \times I \end{aligned}$$

The potential of an unselected line is set in this manner to perform driving, and then voltages:

$$(V_{off} - B_{y1}) \text{ to } (V_{off} - B_{yn})$$

that is, $$-\tfrac{1}{4} \times r \times (n-5) \times I \text{ to } -\tfrac{1}{4} \times r \times (n+3) \times I$$

are applied across devices on the unselected line.

When the non-selection potential setting value 512 is the ground level, voltages:

$$(V_{off} - B_{y1}) \text{ to } (V_{off} - B_{yn})$$

that is, $$r \times I \text{ to } \tfrac{1}{2} \times r \times (n+1) \times I$$

are applied across devices on an unselected line. By applying the non-selection potential setting value 512 to an unselected line, the absolute values of voltages applied across devices connected to the unselected line can be substantially halved (in general, n is as large as 1,000 or more).

Figure 20A:
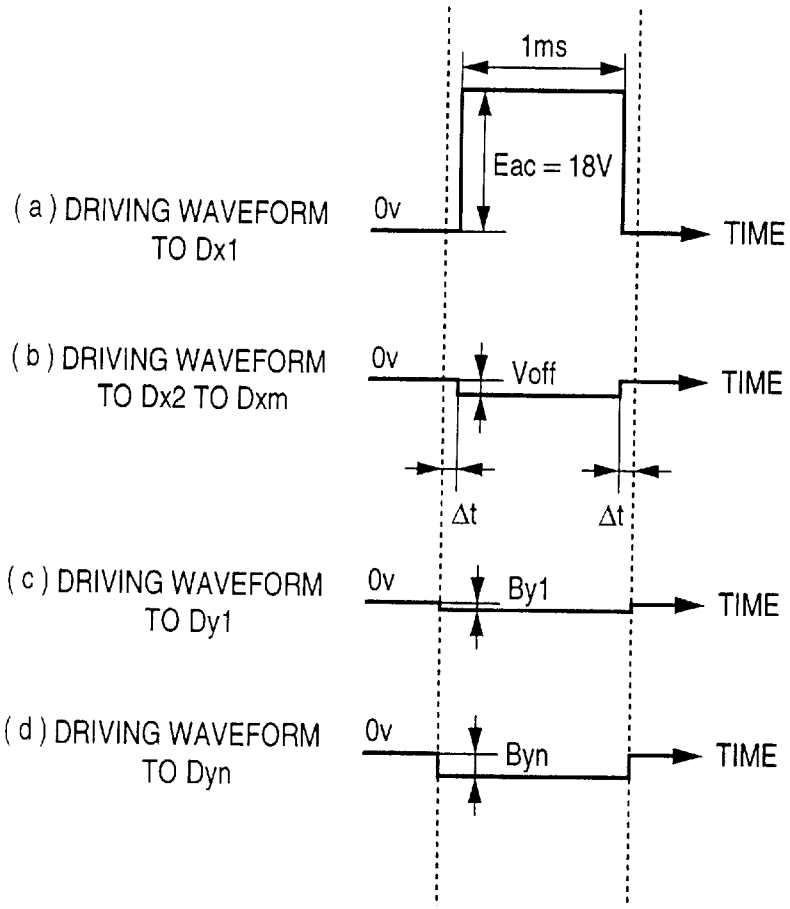
FIGS. 20A and 20B are waveform charts each showing a driving voltage waveform applied to each terminal of a surface-conduction emission type electron-emitting device substrate in the seventh embodiment.
Figure 20B:
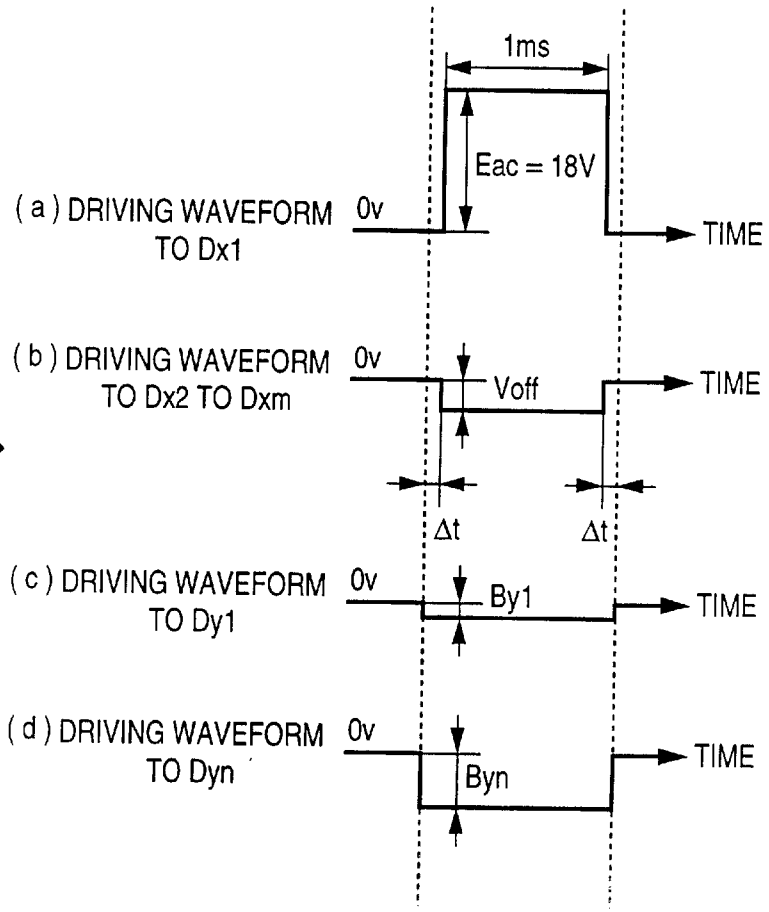

FIGS. 20A and 20B show changes in driving potential waveforms applied to each terminal of the surface-conduction emission type electron-emitting device substrate 501 at the start and end of activation.

FIG. 20A shows the driving potential waveform of each terminal immediately after the start of activation, and FIG. 20B shows the driving potential waveform at the end of activation.

As described above, each device is driven by a pulse having a driving potential of 18 V and a pulse width of 1 ms. Awaveform (a) in FIGS. 20A and 20B represents a driving waveform to the terminal $D_{x1}$ to be activated, which is driven by the power source 504 (driving potential: 18V, pulse width: 1 ms). A waveform (b) represents a driving waveform to the terminals $D_{x2}$ to $D_{xm}$ on unselected lines which are not activated, which is driven by the variable power source 513 set by the non-selection potential setting value 512. The non-selection potential setting value 512 is represented by $V_{off}$. Waveforms (c) and (d) represent driving waveforms to the column-direction terminals of the surface-conduction emission type electron-emitting device substrate 501, which are driven by a buffer amplifier 507. The waveform (c) represents a driving waveform to the terminal $D_{y1}$ exhibiting the minimum potential drop, and the waveform (d) represents a driving waveform to the terminal $D_{yn}$ exhibiting the maximum potential drop.

Immediately after the start of activation shown in FIG. 20A, almost no activation current flows. The potential drop amount caused by the wiring resistance is small, and the compensation potential amount and non-selection potential setting value $V_{off}$ are also small. Activation progresses, and a large activation current flows at the end of activation. Accordingly, the potential drop amount caused by the wiring resistance increases, and the compensation potential amount and non-selection potential setting value $V_{off}$ also increase, as shown in FIG. 20B. That is, the compensation potential distribution changes with the progress of activation to always apply the set voltage=18 V to each device.

Note that each device is driven by a pulse, as described above. Output of the pulse potential from the line selection circuit 502 starts after a change in pulse output from the buffer amplifier 507 for generating a potential distribution, and ends before a change in pulse output from the buffer amplifier 507. This will be explained. This time difference is represented by Δt in FIGS. 20A and 20B. Δt is about several usec.

The time difference Δt is set to cope with a delay in output timing between channels owing to variations in buffer amplifier output between amplifiers. That is, output of the pulse voltage from the line selection circuit 502 may start before a change in pulse output from the buffer amplifier 507 for generatinga potential distribution. In this case, if a delay occurs in output timing between channels, a sufficient driving voltage is instantaneously applied to only some of devices on a selected line. During this instantaneous time, all devices on the selected line are not driven to decrease a flowing activation current. The buffer amplifier applies a calculated potential on the assumption that all devices on the selected line are sufficiently driven. Therefore, a driving voltage higher than the set voltage is applied to the devices to make the characteristics non-uniform.

For this reason, output of the pulse potential from the line selection circuit 502 starts after a change in pulse output from the buffer amplifier 507 for generating a potential distribution, and ends before a change in pulse output from the buffer amplifier 507. With this setting, the influence of variations in output timing of the buffer amplifier can be avoided.

When a potential applied to an unselected line is made closer to the potential of the column wiring, as described in the seventh embodiment, the power applied in activating the surface-conduction emission type electron-emitting device substrate can be reduced. Note that the offset potential determination method is not limited to the above one, and the offset potential may be determined to minimize the power value applied to the entire surface-conduction emission type electron-emitting device substrate.

As described above, the activation apparatus of the seventh embodiment can make the electron-emitting characteristics of all devices uniform by monitoring activation currents and correcting the distribution of activation voltages to respective devices on one line. This electron source substrate is used to realize a high-quality image display apparatus almost free from variations in luminance or density.

Since a predetermined non-selection potential is applied to an inactivated line, an increase in power consumption by application of potentials to devices on an inactivated line can be reduced.

Moreover, output of the line selection pulse potential starts after a change in pulse output of the activation potential from the buffer amplifier, and ends before a change in pulse output of the activation potential from the buffer amplifier. Even if the output timing of the buffer amplifier varies, the influence can be avoided.

Eighth Embodiment

An activation apparatus for the surface-conduction emission type electron-emitting device according to the eighth embodiment of the present invention will be described with reference to FIG. 33.

Figure 33:
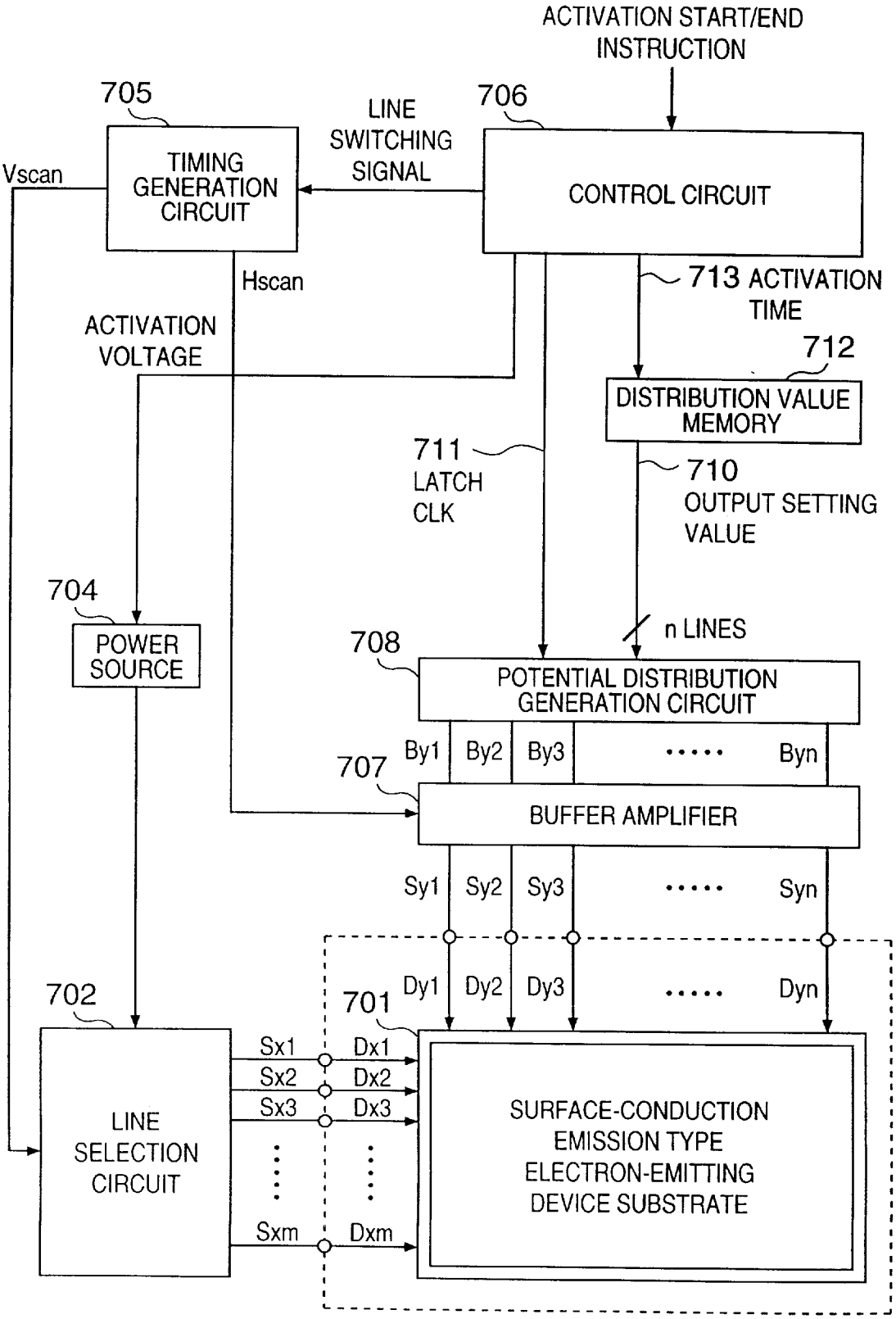
FIG. 33 is a block diagram showing an activation apparatus used in the eighth embodiment.

Also in FIG. 33, a surface-conduction emission type electron-emitting device substrate 701 is the same as the substrate 101 in FIG. 1. The operation of the whole apparatus, the activation procedure, and the like are the same as in the sixth embodiment, and a description thereof will be omitted.

The eighth embodiment is different from the sixth and seventh embodiments in the absence of any current monitoring circuit connected to a line selection circuit 702 of the surface-conduction emission type electron-emitting device substrate 701. Instead, the eighth embodiment adopts a distribution value memory 712 for storing a distribution potential value to be generated in a potential distribution generation circuit 708. Data of the distribution value memory 712 can be transferred to the potential distribution circuit 708 in accordance with a command from a control circuit 706. The reason will be described.

As is apparent from changes in activation time and current in FIGS. 27B, 5A, and 5B, the device current increases with electrification and saturates at last during activation processing. In the sixth and seventh embodiments, activation processing is performed while monitoring the device current by the current monitoring circuit so as to set the device current of each device on the surface-conduction emission type electron-emitting device substrate 101 to 2 mA at last. However, when the reproducibility of activation processing is high, and changes in activation time and current are almost the same in activating any device on the surface-conduction emission type electron-emitting device substrate 701, the end of activation can be determined by the electrification time of activation without monitoring the progress of activation by the current monitoring circuit.

The eighth embodiment will exemplify a method of compensating a potential drop caused in the line direction by the wiring resistance in the activation method of determining the end of activation by the electrification time of activation.

Similar to the sixth and seventh embodiments, activation was performed by applying pulses of an activation voltage having a pulse width of 1 msec, a pulse period of 10 msec, and a pulse height of 18 V. At that time, activation was performed for 30 min in order to obtain an activation device current of 2 mA/device.

Changes in activation time and current as shown in FIGS. 27B, 5A, and 5B were measured for 30 min in advance. A voltage amount to be output from the potential distribution generation circuit 708 was calculated from an activation current value with the lapse of a certain activation time in accordance with equations (1) and (2) in the sixth embodiment, and stored in the distribution value correction memory 712.

The distribution value correction memory 712 is addressed by an activation time t and column-direction wiring numbers 1 to n. With the lapse of a corresponding activation time, compensation potential values to be generated at the column-direction wiring numbers 1 to n are output as output setting values 710 to set the values of corresponding D/A converters of the potential distribution generation circuit 708. Then, the independent compensation potential amounts are set in the D/A converters, and all the outputs are simultaneously updated by a latch CLK.

FIG. 34 shows an example of compensation potential values stored in the distribution value correction memory 712. In FIG. 34, compensation potential amounts are stored in the distribution value correction memory 712 every activation time t=1 min. The compensation potential values of all the column-direction wiring numbers 1 to n are 0 V at the activation time t=0. Compensation potentials from −0.1 V to −0.3 V are generated after 1 min, and compensation potentials from −0.5 V to −3.0 V are generated after 29 min. That is, compensation potential data for the column-direction wiring number n×30 min are stored in the distribution value correction memory 712.

Figure 35:
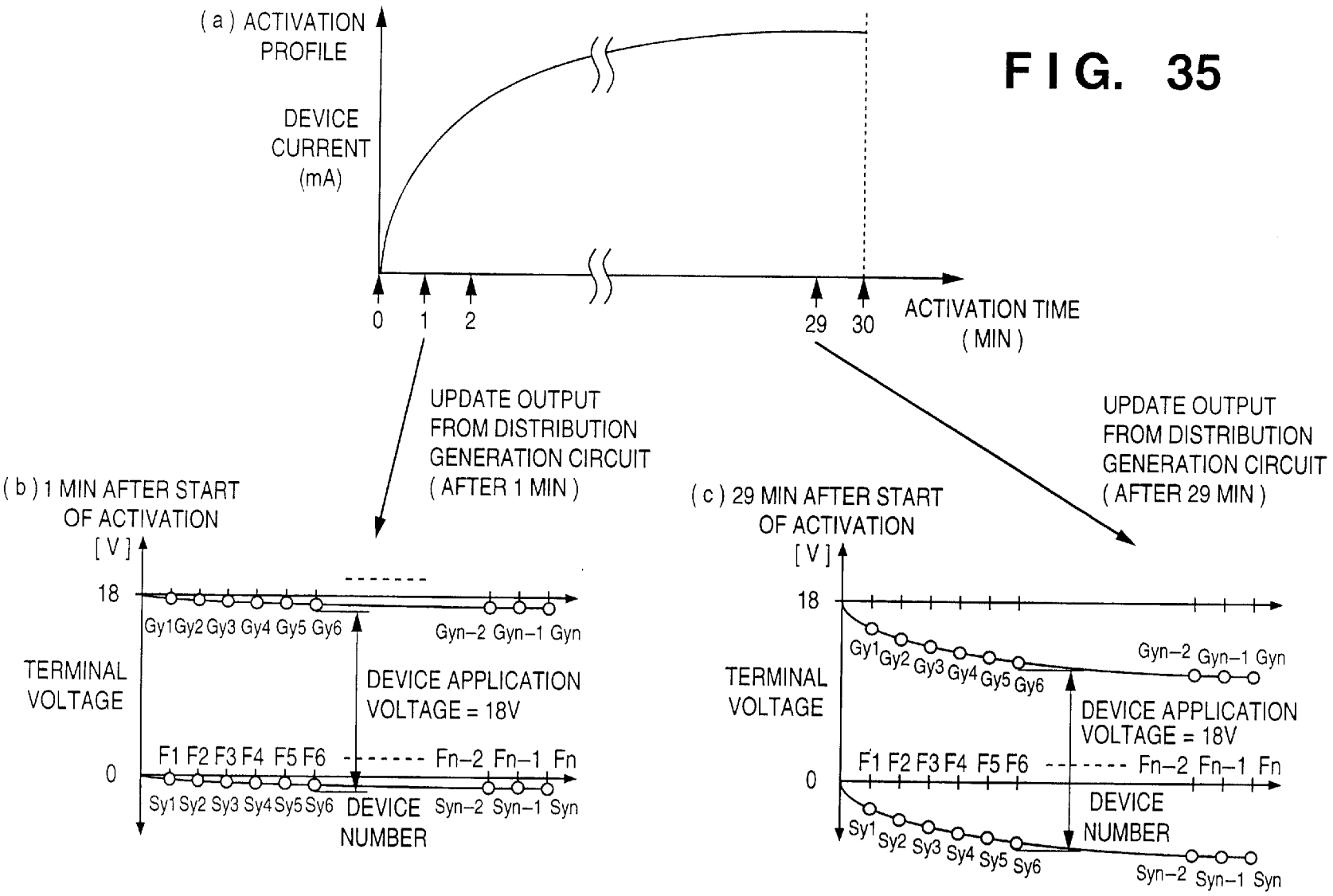
FIG. 35 is a graph for explaining the progress of activation in the eighth embodiment.
Figure 36:
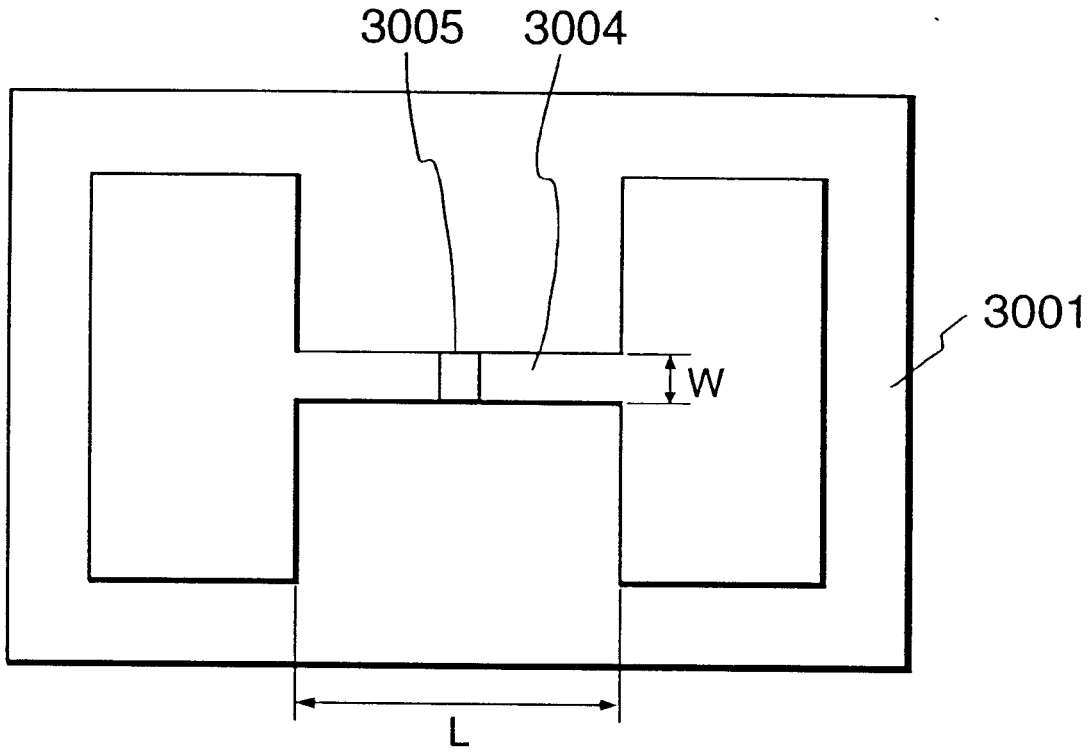
FIG. 36 is a plan view showing the prior art.

FIGS. 35(*a*), 35(*b*), and 35(*c*) show the distributions of potentials applied across devices $F_1$ to $F_n$ 1 min after the start of activation and after 29 min immediately before the end when activation is performed for 30 min. The abscissa in FIGS. 35(*b*) and 35(*c*) represents device numbers $F_1$ to $F_n$, which indicate device positions. The ordinate represents terminal voltages at the two terminals of each device. As shown in FIG. 35(*b*), currents flowing through respective devices are small immediately after the start of activation, as described above. Therefore, the activation potential Eac=18 V applied from a power source 704 is applied to terminals $G_{y1}$ to $G_{yn}$ of the devices. In addition, almost no activation current flows. Respective values in the distribution value correction memory 712 are almost 0 V, the current setting value of the potential distribution generation circuit 708 is also almost 0, and outputs $B_{y1}$ to $B_{yn}$ of the potential distribution generation circuit 708 and outputs $S_{y1}$ to $S_{yn}$ of a buffer amplifier 707 are also almost 0 V. With the lapse of the activation time of 29 min shown in FIG. 35C, respective values in the distribution value correction memory 712 generate the largest compensation potentials. Then, a predetermined application voltage up to 18 V is applied to respective devices to progress activation.

In the above description, compensation potential amounts are stored in the distribution value correction memory 712 every activation time t=1 min. However, since a change in activation current in the unit time is not always constant in the activation time vs. activation current profile, the interval of the activation time t for addressing the distribution value correction memory 712 can be adjusted in accordance with an actual profile. More specifically, in a time range in which a change in activation current in the unit time is large, the interval of the activation time t for addressing the distribution value correction memory 712 is set small. In a time range in which a change in activation current in the unit time is small, the interval of the activation time t for addressing the distribution value correction memory 712 is set large. With this setting, the memory capacity can be saved to realize potential compensation with high controllability.

According to the above embodiments, when a surface-conduction emission type electron-emitting device substrate on which surface-conduction emission type electron-emitting devices are arranged in a matrix is manufactured by activation, there can be realized activation which allows an electron source formed by arranging a large number of surface-conduction emission type electron-emitting devices in a simple matrix to obtain uniform electron-emitting characteristics by preventing variations in characteristics due to non-uniform voltages applied to the devices under the influence of a potential drop caused by the wiring resistance and activation current. This electron source substrate is used to realize a high-quality image display apparatus almost free from variations in luminance or density.

Further, the controllability can be improved by applying a predetermined non-selection potential to an inactivated line, and an increase in power consumption by application of voltages to devices on the unselected line can be reduced by making a potential applied to the unselected line closer to the potential of the column wiring.

Since output of the line selection pulse potential starts after a change in pulse output of the column wiring potential, and ends before a change in pulse output of the column wiring potential, the influence of variations in output (connection) timing of the potential can be avoided.

As has been described above, according to the present invention, a preferable electron-emitting device can be obtained.

The following embodiments are particularly effective when a plurality of lines are simultaneously selected to simultaneously electrify a plurality of devices connected to these lines will be described.

Ninth Embodiment

Figure 44:
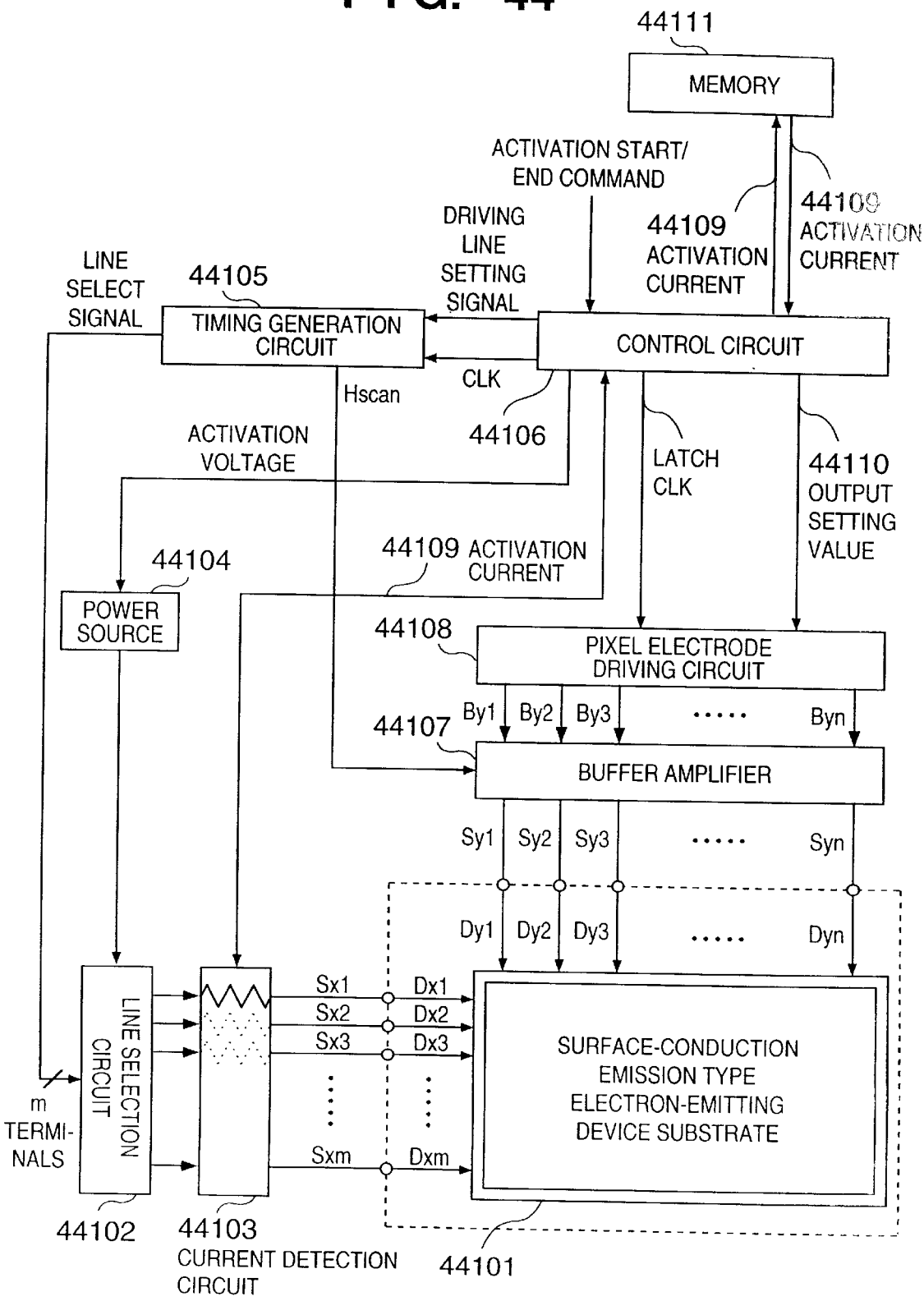
FIG. 44 is a block diagram showing the arrangement of an activation apparatus according to the ninth embodiment of the present invention.

FIG. 44 is a block diagram showing the arrangement of an activation apparatus for the surface-conduction emission type electron-emitting device in the ninth embodiment of the present invention.

In FIG. 44, reference numeral 44101 denotes a surface-conduction emission type electron-emitting device substrate to be activated (on the substrate 44101 in the ninth embodiment, a plurality of surface-conduction emission type electron-emitting devices are arranged in a matrix and have already under gone forming processing). The substrate 44101 is stored in a container connected to an evacuation device (not shown), and the container is evacuated to about $10^{-4}$ to $10^{-5}$ Torr. The substrate 44101 is further connected to an external electric circuit via row wiring terminals $D_{x1}$ to $D_{xm}$ and column wiring terminals $D_{y1}$ to $D_{yn}$. Reference numeral 44102 denotes a line selection circuit for selecting a row wiring to be activated on the substrate 44101. The line selection circuit 44102 simultaneously selects two or more row-direction wirings in accordance with a line select signal from a timing generation circuit 44105, and applies the potential of a power source 44104 to the selected row wirings. Reference numeral 44103 denotes a current detection circuit for individually monitoring currents flowing through respective selected row wirings upon applying the voltage to the selected row wirings. The current detection circuit 44103 is made up of a detection resistance $R_{mon}$, a sample/hold circuit for sampling/holding a voltage generated across the detection resistance, and a voltage measurement device for measuring the voltage generated across the detection resistance. With these components, the current detection circuit 44103 detects the currents $I_f$ flowing from the power source 44104 through the selected row wirings, and outputs the detected current values as activation current values 44109 to a control circuit 44106. The detection resistance $R_{mon}$ is set to a small resistance value enough not to influence the application voltage to the surface-conduction emission type electron-emitting device by a potential drop caused by the flowing current $I_f$. The power source 44104 generates a potential to be applied to the row wiring of the surface-conduction emission type electron-emitting device substrate 44101 in accordance with a command value from the control circuit 44106.

Reference numeral 44107 denotes a buffer amplifier circuit for applying the potential to the column wiring terminals $D_{y1}$ to $D_{yn}$ of the surface-conduction emission type electron-emitting device substrate 44101 at a timing synchronized with a control clock signal Hscan from the timing generation circuit 44105. An input value to the buffer amplifier circuit 44107, i.e., a potential value to be applied to the column wiring terminals $D_{y1}$ to $D_{yn}$ is determined by a pixel electrode driving circuit 44108.

In the ninth embodiment, the progress of activation is grasped by the current amount flowing upon activation (the activation current 44109 detected by the current detection circuit 44103). The control circuit 44106 starts activating the surface-conduction emission type electron-emitting devices of the substrate 44101 upon reception of an activation start command, and sequentially corrects the distribution of driving voltage values of devices in the column direction that change with the progress of activation, as will be described in detail later. That is, the control circuit 44106 calculates a potential value for compensating for the characteristics of each device during activation with reference to wiring resistance value data stored in a memory 44111 and the activation current value 44109 from the current detection circuit 44103, and sets this potential value as an output setting value 44110 in the pixel electrode driving circuit 44108. The pixel electrode driving circuit 44108 generates a driving potential corresponding to the output setting value 44110, and applies it to the column wiring of the substrate 44101 via the buffer amplifier 44107. Thus, the voltage distribution generated by device currents and wiring resistances on activated devices is corrected (the difference in voltage is suppressed) to always apply a constant voltage to the activated devices. The output setting value 44110 set in the pixel electrode driving circuit 44108 is sequentially updated with the progress of activation to correct the voltage distribution of devices on the activated row till the end of activation.

The control circuit 44106 monitors the progress of activation based on the activation current value 44109 detected by the current detection circuit 44103, and selects a row wiring to which the potential is applied from the power source 44104 via the line selection circuit 44102. This operation will also be described in detail later. The control circuit 44106 outputs a driving line setting signal to the timing generation circuit 44105 to set row wirings to be driven (activated). The timing generation circuit 44105 sets which of m row wirings is to be connected to the power source 44104 in accordance with a line select signal, and applies the potential of the power source 44104 to surface-conduction emission type electron-emitting devices to be activated on the surface-conduction emission type electron-emitting device substrate 44101. Note that an activation current value and wiring resistance value are stored in the memory 44111 in order to correct the driving voltage value distribution of devices in the column direction which changes with the progress of activation, and are referred to by the control circuit 44106 as needed.

Figure 45:
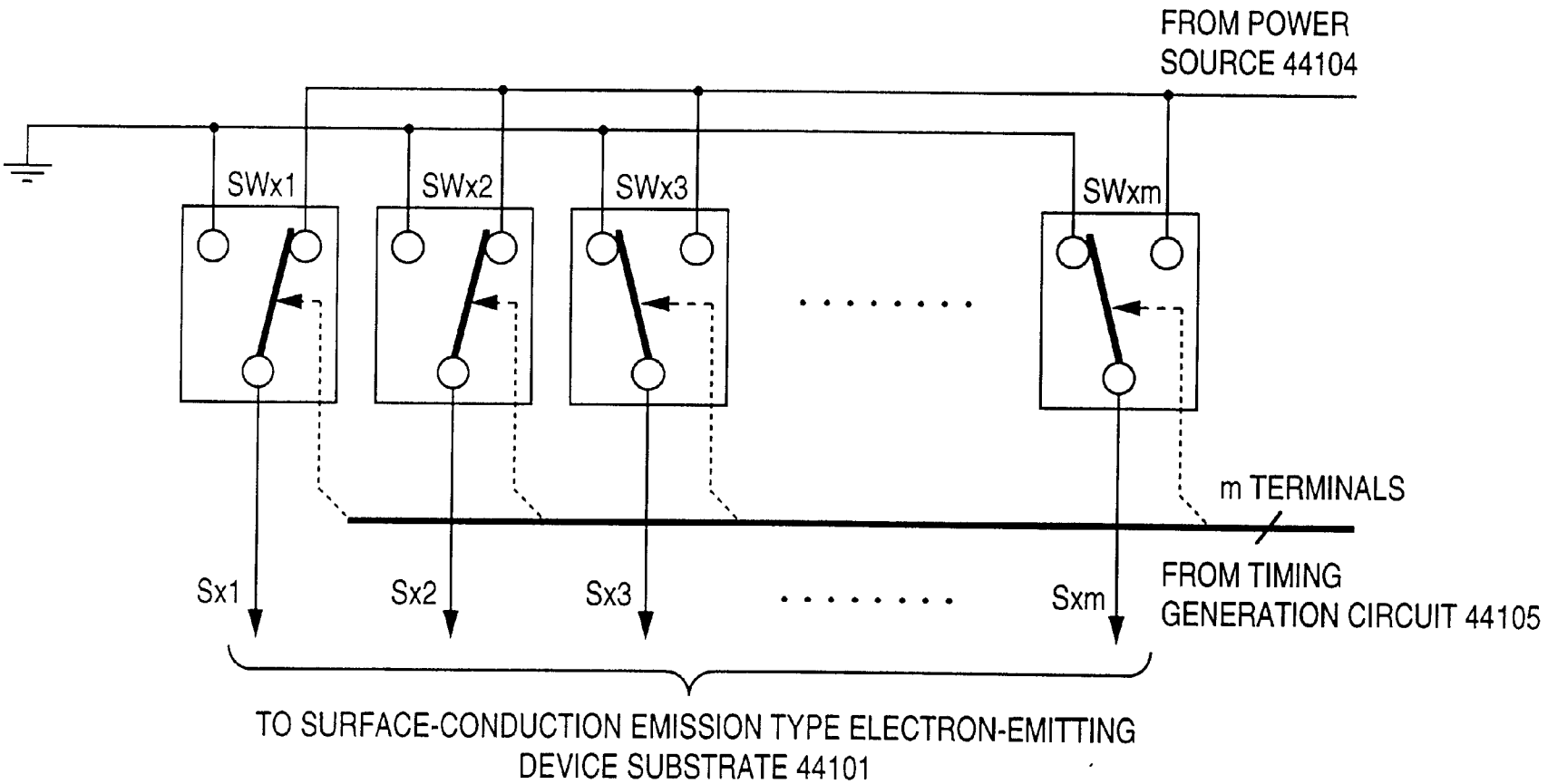
FIG. 45 is a circuit diagram showing the arrangement of a line selection circuit according to the ninth embodiment of the present invention.

The line selection circuit 44102 will be described with reference to FIG. 45.

The line selection circuit 44102 incorporates m switching elements ($SW_{x1}$ to $S_{xm}$) in accordance with the number m of row wirings on the substrate 44101. Each switching element selects either one of an output potential from the power source 44104 and 0 V (ground level) to apply the selected potential to the row wiring terminals $D_{x1}$ to $D_{xm}$ of the surface-conduction emission type electron-emitting device substrate 44101. Each switching element operates based on a line select signal output from the timing generation circuit 44105. The switching element can be easily constituted by a combination of switching elements such as FETs or relays. In FIG. 45, the first and second row wirings ($S_{x1}$) and ($S_{x2}$) are selected. Only the row wiring terminals $D_{x1}$ and $D_{x2}$ of the substrate 44101 receive an output potential from the power source 44104, while the remaining row wirings are grounded.

Figure 46:
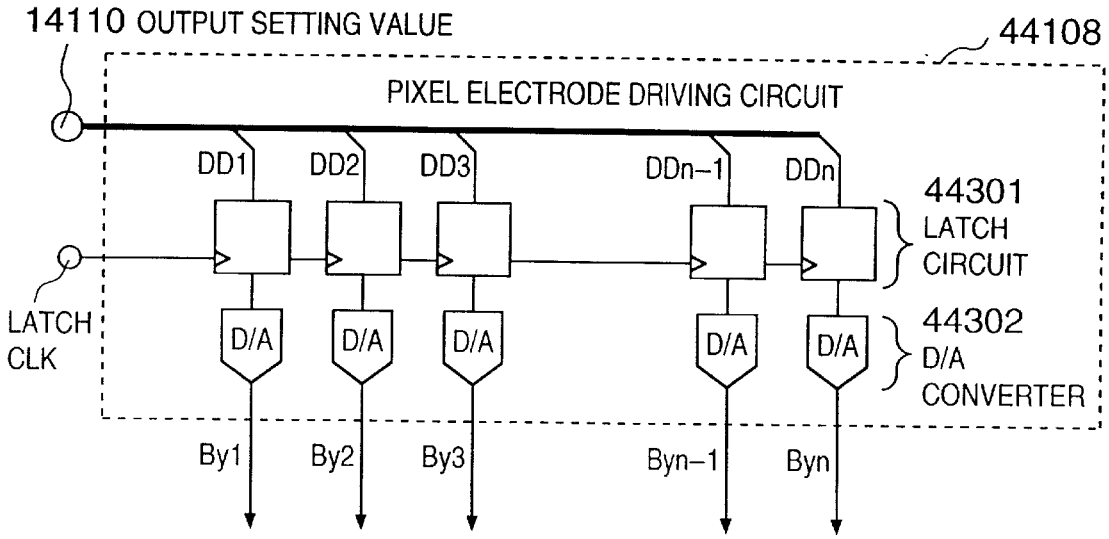
FIG. 46 is a block diagram showing the arrangement of a pixel electrode driving circuit according to the ninth embodiment.

FIG. 46 is a circuit diagram showing the arrangement of the pixel electrode driving circuit 44108.

The pixel electrode driving circuit 44108 comprises n latch circuits 44301 and n D/A converters 44302, and generates a driving signal for driving n column wirings on the surface-conduction emission type electron-emitting device substrate 44101. The control circuit 44106 sequentially updates the driving potential values $B_{y1}$ to $B_{yn}$ for driving respective column wirings on the basis of the activation current value 44109 by the following procedure. The control circuit 44106 transfers the output setting value 44110 ($DD_1$ to $DD_n$) corresponding to the driving potential to the latch circuits 44301 of the pixel electrode driving circuit 44108.

Upon completion of a series of operations: measurement of the activation current value 44109→calculation of the output setting value 44110→data transfer to the latch circuit 44301, the control circuit 44106 outputs a latch clock to all the latch circuits 44301 to update the driving potentials $B_{y1}$ to $B_{yn}$ output from the D/A converters 44302.

The procedure of activating the surface-conduction emission type electron-emitting device substrate 44101 using the apparatus of the ninth embodiment will be explained with reference to FIGS. 44, 47, 48A, and 48B.

Activation is performed to set the device currents $I_f$ of all devices to a target value. The target current value is determined by a necessary electron emission amount and the like. In the ninth embodiment, activation processing is done while monitoring an output from the current detection circuit 44103 so as to set the device currents of respective devices on the surface-conduction emission type electron-emitting device substrate 44101 to 2 mA at last.

The flow of activation processing will be described.

When the control circuit 44106 receives an activation start command, it controls the timing generation circuit 44105 and power source 44104 in order to activate the devices of the substrate 44101 in units of rows.

The control circuit 44106 sets the output setting value 44110 in the pixel electrode driving circuit 44108 so as to set the column wiring terminals $D_{y1}$ to $D_{yn}$ of the substrate 44101 to ground potential. The control circuit 44106 sequentially applies pulses (e.g., a pulse width of 1 msec and a pulse height of 18 V) of the activation potential Eac to the row wiring terminals $D_{x1}$ to $D_{xm}$. Then, the surface-conduction emission type electron-emitting device substrate 44101 sequentially receives the pulse voltage in units of rows to activate the devices of the substrate 44101 in units of rows. In the ninth embodiment, two rows are simultaneously activated as a unit in order to shorten the time, which will be described in detail later.

The following description is directed to a method used in the ninth embodiment in order to correct variations in device characteristics arising from the distance from the feeding terminal when electrification processing is done in units of rows. In the ninth embodiment, in simultaneously driving surface-conduction emission type electron-emitting devices connected to two row wirings of the two row wiring terminals $D_{x1}$ and $D_{x2}$ attention is paid to one of the two row wirings to activate n devices connected to the first row wiring connected to the row wiring terminal $D_{x1}$.

Figure 47:
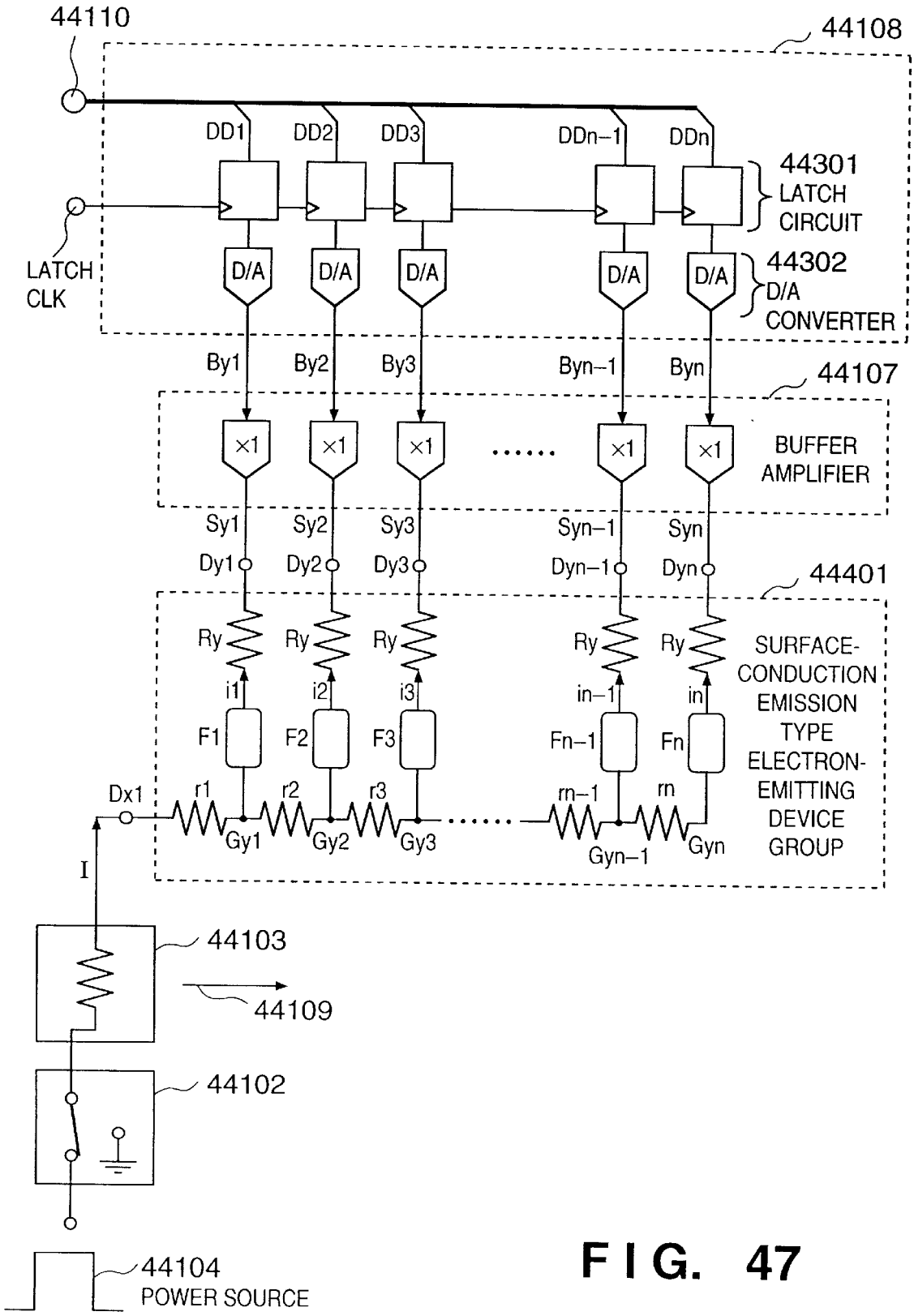
FIG. 47 is a circuit diagram showing the state of activating surface-conduction emission type electron-emitting devices connected to the first row wiring in the ninth embodiment.

Attention is given to a surface-conduction emission type device group connected to the first row wiring (terminal $D_{x1}$) to which the activation voltage is applied. FIG. 47 shows a surface-conduction emission type electron-emitting device group 44401 by a model including the wiring resistances of respective devices. The state of activating this device group will be explained with reference to FIG. 47.

In FIG. 47, reference symbols $F_1$ to $F_n$ denote surface-conduction emission type electron-emitting devices connected to the first row wiring connected to the row wiring terminal $D_{x1}$; r1 to rn, wiring resistances at respective portions on the first row wiring; and $R_y$, a wiring resistance from the feeding terminal (output terminal of the buffer amplifier 4107) of each of the column wirings $D_{y1}$ to $D_{yn}$ to a corresponding surface-conduction emission type electron-emitting device. Since the row wiring is designed to be formed with a constant line width, thickness, and material, the wiring resistances r1 to rn are considered to be almost equal except for variations in the manufacture. Since the column wirings are designed uniform, they are considered to have almost the same wiring resistance $R_y$ Although the equivalent resistance value of the surface-conduction emission type electron-emitting device changes (decreases) before and after activation the equivalent resistance of each device is much higher than the wiring resistance value $R_y$ of each column wiring. Even if two row wirings are simultaneously driven and activated as in the ninth embodiment, the voltage drop amount across the wiring resistance $R_y$ is small enough to neglect the influence by the wiring resistance $R_y$. The equivalent resistance values of the surface-conduction emission type electron-emitting devices $F_1$ to $F_n$ are designed higher than the wiring resistances r1 to rn on the row wiring.

To activate the surface-conduction emission type electron-emitting device group 44401 in FIG. 47, the control circuit 44106 controls the line selection circuit 44102 via the timing generation circuit 44105, and connects the power source 44104 for outputting the activation potential Eac and the current detection circuit 44103 to the row wiring terminal $D_{x1}$. Then, the activation potential Eac drives surface-conduction emission type electron-emitting devices connected to the first row wiring connected to the terminal $D_{x1}$.

On the other hand, the potential from the buffer amplifier 44107 is applied to the column wiring terminals $D_{y1}$ to $D_{yn}$ as other electrode terminals of devices on the row wiring connected to the row wiring terminal $D_{x1}$. The buffer amplifier 44107 operates to sink activation currents $i_1$ to $i_n$ from the devices $F_1$ to $F_n$. The output potential value is determined by the pixel electrode driving circuit 44108.

The driving voltage distribution to respective devices in activation will be described to explain a method of setting the output from the pixel electrode driving circuit 44108.

Figure 48A:
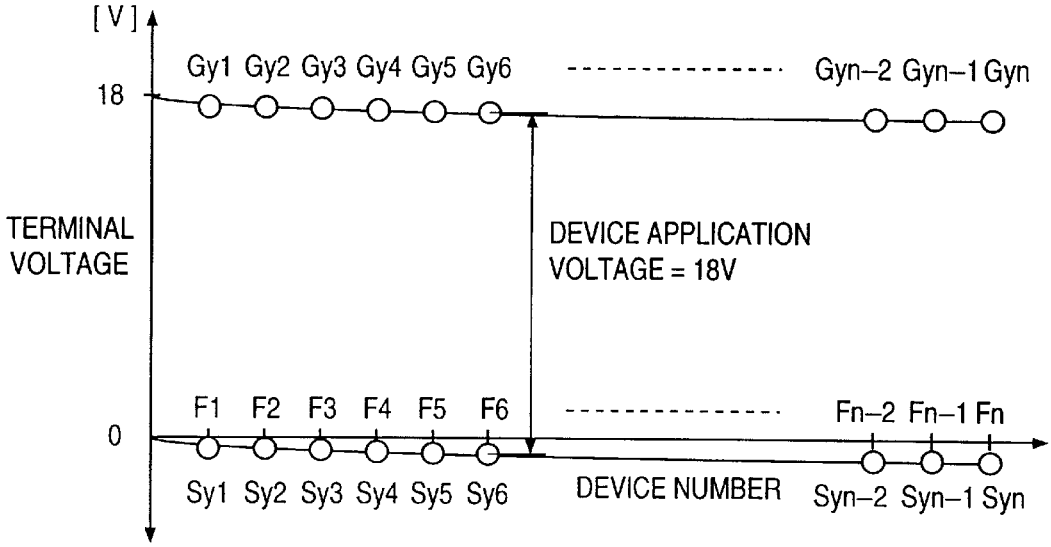
FIGS. 48A and 48B are graphs for explaining the driving voltage distribution of respective devices when the surface-conduction emission type electron-emitting devices connected to a given row wiring are activated in the ninth embodiment.
Figure 48B:
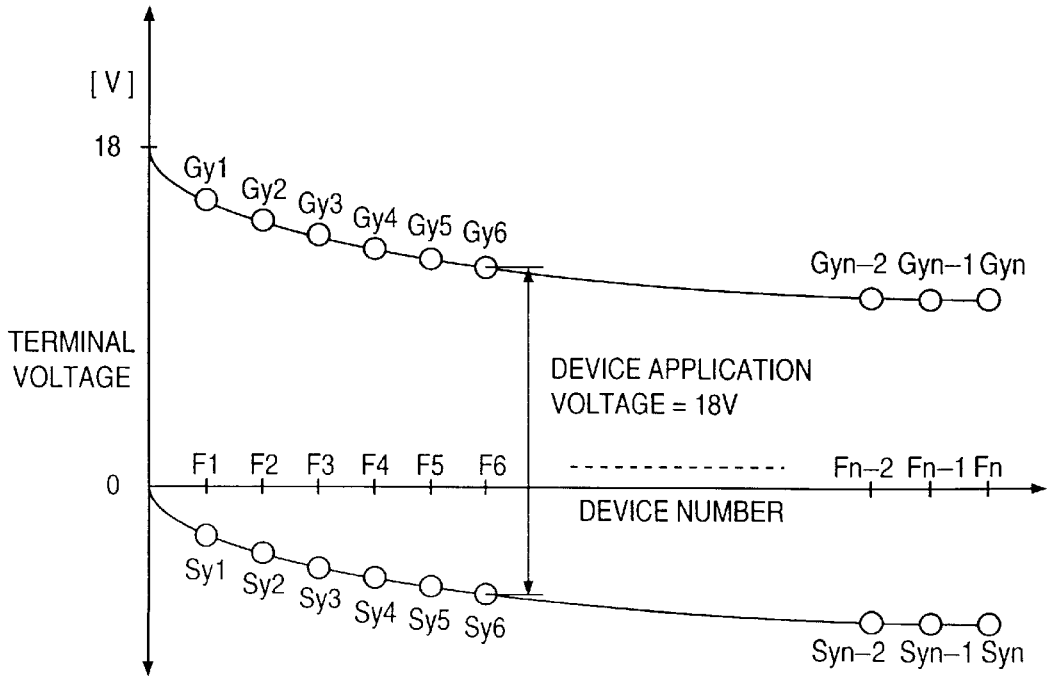

Inactivation, the device current flowing through each device changes as shown in FIG. 41. That is, the device current does not substantially flow at the start of activation, starts flowing with the lapse of electrification time, and saturates. At this time, the terminal potentials $G_{y1}$ to $G_{yn}$ respective devices connected to the first row wiring connected to the row wiring terminal $D_{x1}$ are monitored to find changes in terminal potentials $G_{y1}$ to $G_{yn}$ under the influence of the wiring resistances r1 to rn of the row wiring, as shown in FIGS. 48A and 48B. These terminal potentials more greatly change with the progress of activation of respective devices, and maximize at the end of activation. For example, for an activation current of 2 mA/device, the wiring resistances r1 to rn=10 mΩ, and the number n of devices=1000, a potential drop:

$$\Delta V=\{(½)\times 1000\times 1001\times 2\ \text{mA}\times 10\ \text{m}\Omega\}-2\ \text{mA}\times 1000\times 10\ \text{m}\Omega\approx 10\ \text{V}$$

occurs at the terminal potential $G_{yn}$ of the device $F_n$ farthest from the feeding terminal, compared to the most left device $F_1$.

To prevent this, the pixel electrode driving circuit 44108 generates a potential distribution identical to this potential drop distribution to drive the column wiring terminals $D_{y1}$ to $D_{yn}$ by driving signals $S_{y1}$ to $S_{yn}$ output from the buffer amplifier 44107 so as to cancel the potential differences generated at respective devices.

More specifically, the control circuit 44106 calculates the potential drop distribution generated at the terminal potentials $G_{y1}$ to $G_{yn}$ by activation currents flowing through the devices $F_1$ to $F_n$ and the wiring resistances r1 to rn along with the progress of activation. The latch circuits 44301 of the pixel electrode driving circuit 44108 latch output setting values for correcting this distribution to set the output values of the D/A converters 44302. In this way, the potential drop compensation distribution can be reproduced at the driving potentials $B_{y1}$to $B_{yn}$. Assuming that activation of the devices $F_1$ to $F_n$ substantially uniformly progresses, the device currents $i_1$ to $i_n$ flowing through respective devices are almost equal, and the current values can be given using a current amount I detected by the current detection circuit 44103:

$$i_{ave}=i_1=i_2=\ .\ .\ .\ =i_n=I/n$$

At this time, the potential drop distribution generated at the terminal potentials $G_{y1}$ to $G_{yn}$ by currents flowing through the devices $F_1$ to $F_n$ and the wiring resistances r1 to rn, i.e., the driving potentials $B_{y1}$ to $B_{yn}$ output from the pixel electrode driving circuit 44108, is calculated using the wiring resistance values r1 to rn and $i_{ave}$:

$$\begin{aligned} B_{y1} &= -r1\times n\times i_{ave} \\ B_{y2} &= -r2\times(n-1)\times i_{ave}+B_{y1} \\ &\vdots \\ B_{yn} &= -rn\times i_{ave}+B_{yn-1}+B_{yn-2}+\ \ldots\ +B_{y1} \end{aligned} \tag{3}$$

The control circuit 44106 measures the activation current which changes with the progress of activation of respective devices, sequentially calculates the output potentials $B_{y1}$ to $B_{yn}$ by equation (3) to obtain the output setting value 44110, and transfers it to the latch circuit 44301 of the pixel electrode driving circuit 44108 to latch the output setting value 44110. Upon completion of a series of operations: measurement of the activation current 44109→calculation of the output setting value 44110→transfer of the output setting value to the latch circuit 44301, the control circuit 44106 applies a latch clock to all the latch circuits 44301 to update D/A data. The pixel electrode driving circuit 44108 generates a potential distribution identical to the potential distribution generated at the terminals $G_{y1}$ to $G_{yn}$ of the devices $F_1$ to $F_n$. Accordingly, voltages applied between the terminals of the devices $F_1$ to $F_n$ can be made almost uniform regardless of the device position and the progress of activation.

FIGS. 48A and 48B show voltage distributions applied across the devices $F_1$ to $F_n$ at the start and end of activation, respectively.

FIG. 48A shows the voltage distribution immediately after the start of activation. In FIGS. 48A and 48B, the abscissa represents device numbers $F_1$ to $F_n$ which correspond to device positions. The ordinate represents the terminal voltage applied across the device. As described above, currents flowing through respective devices are small immediately after the start of activation shown in FIG. 48A. Therefore, the activation potential Eac=18 V is applied from the power source 44104 to the terminals $G_{y1}$ to $G_{yn}$ of respective devices. Since almost no activation current flows, the current setting value of the pixel electrode driving circuit 44108 is almost "0", and the driving output potentials $B_{y1}$ to $B_{yn}$ from the pixel electrode driving circuit 44108 and the outputs $S_{y1}$ to $S_{yn}$ from the buffer amplifier 44107 are also almost 0 V. For this reason, a predetermined voltage (about 18 V) is applied to respective devices to progress activation.

FIG. 48B shows the voltage distribution at the end of activation. At the end of activation, currents flowing through respective devices become almost 2 mA. The activation potential Eac=18 V applied from the power source 44104 decreases under the influence of a potential drop caused by the wiring resistance upon application to the terminals $G_{y1}$ to $G_{yn}$ of respective devices. At this time, by setting the output setting value of the pixel electrode driving circuit 44108 to 2 mA, the driving potentials $B_{y1}$ to $B_{yn}$ output from the pixel electrode driving circuit 44108 and the driving potentials $S_{y1}$ to $S_{yn}$ output from the buffer amplifier 44107 have the same distribution as the potential distribution at the terminals $G_{y1}$ to $G_{yn}$. As a result, an almost constant voltage (about 18 V) is applied to respective devices to activate them.

More specifically, when the device current increases with the progress of activation, the voltage distribution applied to devices always changes under the influence of the wiring resistance. At this time, the potential distribution amount is calculated and set as the output setting value 44110 of the pixel electrode driving circuit by 44108. The driving potentials $B_{y1}$ to $B_{yn}$ from the pixel electrode driving circuit 44108 are sequentially updated to activate all devices by a constant voltage from the start to end of activation. When the average device current $i_{ave}$ of respective devices reaches 2 mA, activation ends.

In the above description, devices on the first row wiring connected to the row wiring terminal $D_{x1}$ are activated. The ninth embodiment can be similarly applied to activation of devices connected to another row wiring. In the ninth embodiment, a plurality of rows are simultaneously activated while sequentially switching row wirings to be activated. In the ninth embodiment, since devices connected to two row wirings are simultaneously activated, selection of simultaneous activation row wirings must be considered. This will be explained.

To shorten the activation time, the ninth embodiment simultaneously selects and activates a plurality of row wirings. In other words, the ninth embodiment simultaneously selects and drives two row wirings while activating them.

As described above, the ninth embodiment compensates for non-uniform application voltages of respective devices generated by the activation current and wiring resistance by controlling the potential output from the pixel electrode driving circuit 44108. On the substrate 44101 of the ninth embodiment, a plurality of surface-conduction emission type electron-emitting devices are connected in a simple matrix. In simultaneously activating surface-conduction emission type electron-emitting devices on two lines, the pixel electrode driving circuit 44108 outputs a compensation potential common to the two row wirings to apply the same compensation voltage to these row wirings. If the surface-conduction emission type electron-emitting devices on the two lines exhibit the same activation characteristics, non-uniform voltages can be compensated for by applying the same compensation voltage. In practice, however, the wiring resistance values of respective row wirings vary due to variations in the manufacture, and the activation speed changes between respective row wirings. Hence, different compensation voltages must be applied to the two row wirings.

When surface-conduction emission type electron-emitting devices connected to a plurality of row wirings are simultaneously activated, the ninth embodiment sequentially changes simultaneous activation row wirings along with the progress of activation to simultaneously drive two row wirings having the same activation speed in order to cope with different compensation voltages to be applied. This will be explained in detail with reference to the flow chart in FIG. 49. For descriptive convenience, the number m of row wirings on the device substrate 44101 is "480".

Figure 49:
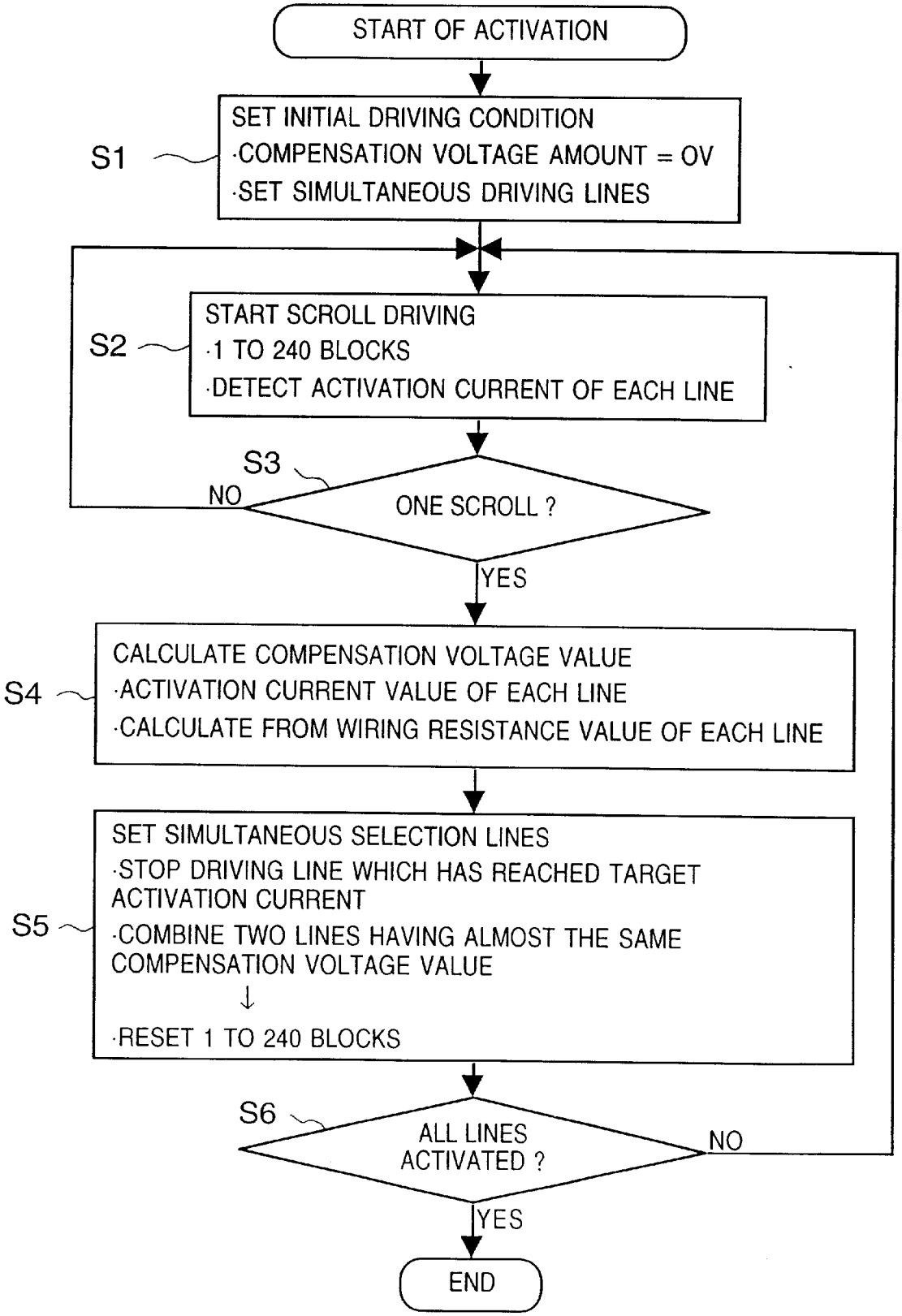
FIG. 49 is a flow chart showing activation processing in the ninth embodiment of the present invention.

FIG. 49 is a flow chart showing the control step of activation processing by the control circuit 44106 of the ninth embodiment.

In step S1, the control circuit 44106 starts activation processing upon reception of an activation start command. The control circuit 44106 sets initial driving conditions at the start of activation. Two items are set as initial driving conditions: setting of the output setting value 44110 to the pixel electrode driving circuit 44108, and setting of simultaneous driving row wirings designated to the timing generation circuit 44105.

The initial potential value of the pixel electrode driving circuit 44108 is set as follows. Since activation currents flowing through respective devices are not so much at the start of activation processing, no nonuniform application voltages are generated on the devices by the activation currents and wiring resistances. Therefore, all compensation potentials output from the pixel electrode driving circuit 44108 are set to 0 V. To simultaneously electrify two row wirings, the 480 row wirings are classified into 240 blocks as electrification units. Assignment of the 240 blocks is done by "setting of simultaneous driving lines". Note that any row wirings are at the same voltage at the start of activation processing, and thus any two row wirings can be combined. In step S1, a combination of row wirings is set as follows so as to uniformly apply power to the device substrate 44101 upon application of the activation voltage.

| | |
|---|---|
| Block 1: | first and 241st row wirings |
| Block 2: | second and 242nd row wirings |
| . | |
| . | |
| . | |
| Block 240: | 240th and 480th row wirings |

In step S2, driving conditions are set based on the settings in step S1 to start activation processing. In step S2, row wirings are driven in units of two. Driving row wirings are selected based on the simultaneous driving line setting value in step S1, and a driving line setting signal based on this setting value is output to the timing generation circuit 44105. The timing generation circuit 44105 outputs a line select signal to the line selection circuit 44102 based on the setting signal to simultaneously apply an output potential from the power source 44104 to two row wirings selected by the line selection circuit 44102. At this time, the progress of activation of devices connected to the selected row wirings on the substrate 44101 is monitored to calculate a compensation amount for a potential drop caused by the activation current of each device and the wiring resistance of each row wiring. For this purpose, the activation current value 44109 flowing through each row wiring that is detected by the current detection circuit 44103 is input and stored in the memory 44111.

The flow advances to step S3 to checks for the 240 blocks whether two row lines (one block) are activated and their currents are detected. If NO in step S3, the flow returns to step S2 to perform activation processing for the next block and current detection on each row wiring.

If YES in step S3, the flow advances to step S4 to calculate a compensation potential for a potential drop caused by the activation current and wiring resistance along with the progress of activation of each device. In step S4, the compensation potential value can be calculated by equation (3) from the activation current and wiring resistance of each row wiring. Since the wiring resistances r1 to rn on each row wiring can be considered to be almost equal, the wiring resistance value of each row wiring is measured in advance and stored in the memory 44111 in order to correct only variations on each row wiring. Even while two row wirings are simultaneously driven, the activation current of each row wiring is detected by the current detection circuit 44103 to calculate in step S2 the compensation potential value for each line using the activation current value and wiring resistance value of each line stored in the memory 44111.

The flow advances to step S5. Since the compensation potential value to be applied changes between row wirings along with the progress of activation, a combination of row wirings to be simultaneously selected to apply voltage must be sequentially updated. In step S4, a combination of row wirings to be simultaneously selected is set up. A row wiring flowing an activation current which has reached a target value (2 mA/device) has been activated and is excluded from row wirings to be selected next. To select row wirings to be activated next, row wirings are aligned in the order from a larger one of compensation potential values calculated in step S2, and row wirings having similar compensation potential values are simultaneously selected in units of two. If adjacent two row wirings are selected, power may concentrate at part of the surface-conduction emission type electron-emitting device substrate. To avoid this, the first to 240th row wirings out of the first to 480th row wirings are grouped as a block A, the 241st to 480th row wirings are grouped as a block B, and two simultaneous selection row wirings are respectively selected from the blocks A and B.

The flow advances to step S6 to check whether devices connected to all the row wirings on the substrate 44101 have been activated. If it is determined that current values flowing through respective row wirings have reached the target value to activate all devices, activation ends. If NO in step S6, the flow returns to step S2 to start scroll driving again. The values set in steps S3 and S4 are used for a combination of simultaneous selection row wirings and the compensation potential value from the pixel electrode driving circuit 44108.

In this manner, activation of devices on the substrate 44101 is complete. Since the outputs $B_{y1}$ to $B_{yn}$ from the pixel electrode driving circuit 44108 are sequentially updated to compensate for a potential drop caused by the activation current and wiring resistance, all devices can be uniformly activated by an almost constant voltage from the start to end of activation. Since two row wirings are simultaneously selected and driven, activation processing can be completed within half the processing time required to drive row wirings one by one.

In the ninth embodiment, the power source 44104 applies a positive output to flow the current from the row wiring terminal $D_{x1}$ to the column wiring terminals $D_{y1}$ to $D_{yn}$, thereby activating devices. Alternatively, the power source 44104 may apply a negative output to flow the current from the column wiring terminals $D_{y1}$ to $D_{yn}$ to the row wiring terminal $D_{x1}$, thereby activating devices. In this case, the potential distribution is also inverted, so that the buffer amplifier 44107 is constituted as an inverting buffer amplifier (Gain=−1) to source the current, thereby obtaining the same effects.

In the ninth embodiment, the pixel electrode driving circuit 44108 comprises D/A converters equal in.number to the number n of column wirings on the substrate 44101. Instead, the number of D/A converters may be decreased to define a potential value to be applied to the decreased number of column wiring terminals by resistance division because the compensation potential distribution changes gradually, as shown in FIGS. 48A and 488. A smaller number of D/A converters of the pixel electrode driving circuit 44108 lead to cost reduction.

If the number n of devices in the column wiring direction increases, a long time may be spent by a series of operations: current measurement by the current detection circuit 44103→calculation of the output setting value 44110→data transfer to the pixel electrode driving circuit 44108. However, the time can be shortened by parallel-processing respective devices or using a look-up table (LUT) storing data for generating the output setting value 44110 from the activation current value, wiring resistance value, and position of each device.

The update time interval of the output setting value 44110 may be appropriately set in accordance with the activation speed, without being set with every scroll timing in the ninth embodiment.

As described above, the activation apparatus of the ninth embodiment can make the electron-emitting characteristics of all devices uniform. This electron source substrate 44101 can be used to realize a high-quality image display apparatus almost free from variations in luminance or density.

10th Embodiment

Figure 50:
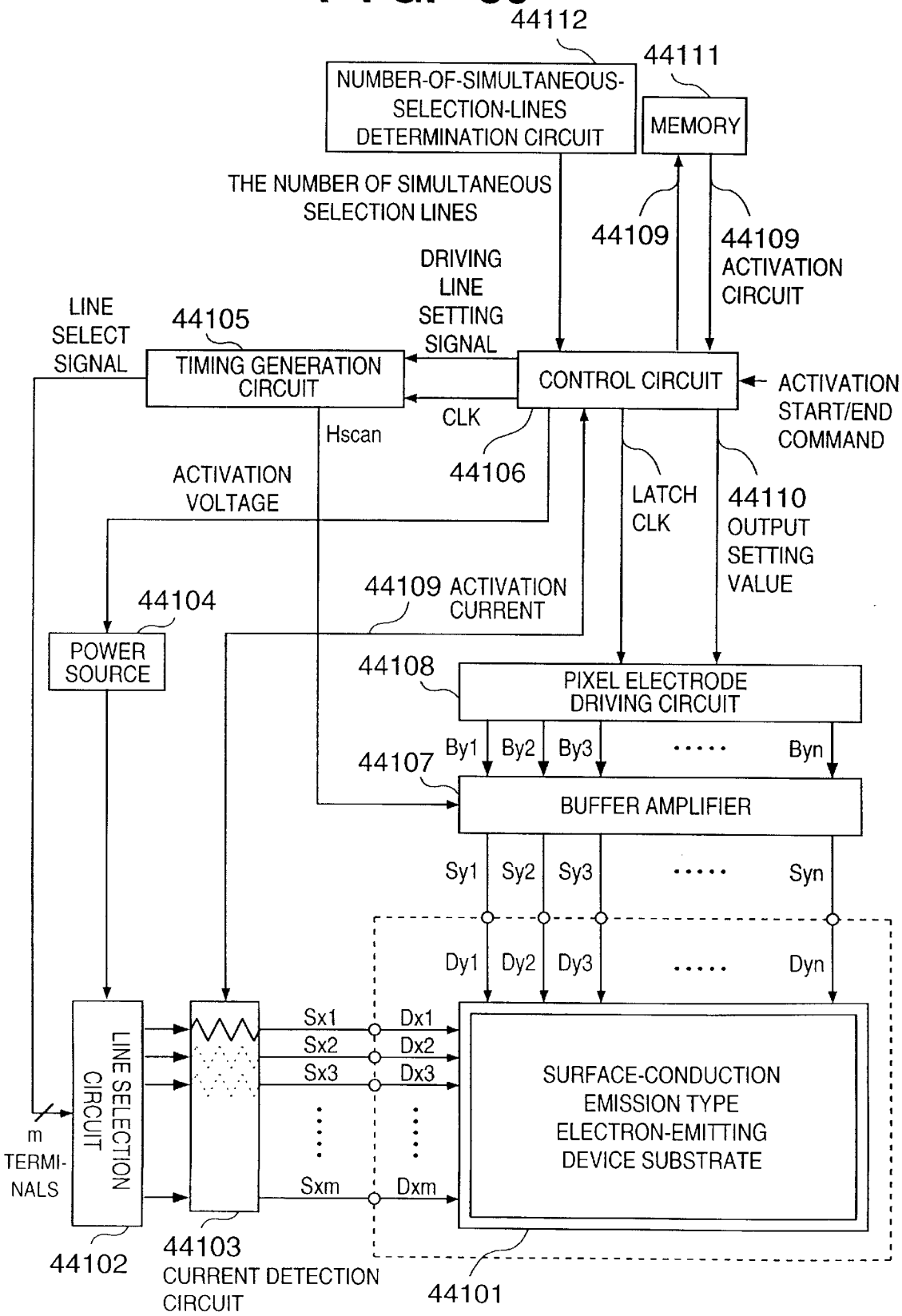
FIG. 50 is a block diagram showing the arrangement of an activation apparatus according to the 10th embodiment of the present invention.

FIG. 50 is a block diagram showing the arrangement of an activation apparatus for the surface-conduction emission type electron-emitting device in the 10th embodiment of the present invention. The same reference numerals as in the ninth embodiment denote the same parts, and a description thereof will be omitted. The 10th embodiment is different from the ninth embodiment by a method of selecting simultaneous electrification/driving row wirings in activation. This method can further shorten the electrification time, as will be described below.

In the 10th embodiment, the number of simultaneous electrification/driving row wirings is not constant but is sequentially changed from the start to end of activation processing. To realize this, the activation apparatus comprises a number-of-simultaneous-selection-lines determination circuit 44112. The electrification time can be shortened by increasing the number of simultaneous selection row wirings in activation. However, the number of simultaneous selection row wirings can only be increased with the following limitations.

(1) Influence of Potential Drop at Wiring Resistance $R_y$

In the equivalent circuit in FIG. 47, the influence of the wiring resistance $R_y$ of the column wiring is negligibly small. However, as the number of simultaneous electrification/driving row wirings increases, the influence of a potential drop at the wiring resistance $R_y$ increases to a non-negligible degree, impairing the above-described effect of compensating the potential drop.

(2) Application Power to Surface-Conduction Emission Type

Electron-Emitting Device Substrate

When a plurality of row wirings are simultaneously electrified and driven, a larger power is applied to a surface-conduction emission type electron-emitting device substrate 44101, compared to the case of driving row wirings one by one. In general, the surface-conduction emission type electron-emitting device substrate 44101 is made of a material having a low thermal conductivity such as glass. An excessively large amount of power may thermally destruct the surface-conduction emission type electron-emitting device substrate 44101.

Considering these limitations, the number-of-simultaneous-selection-lines determination circuit 44112 determines an optimum number of simultaneous selection row wirings in accordance with the progress of activation of each device.

In the 10th embodiment, since the limitation on application power is the severer, the number-of-simultaneous-selection-lines determination circuit 44112 changes the number of simultaneous selection row wirings between 10 at maximum and 2 at minimum along with the progress of activation on the basis of application power.

Figure 51:
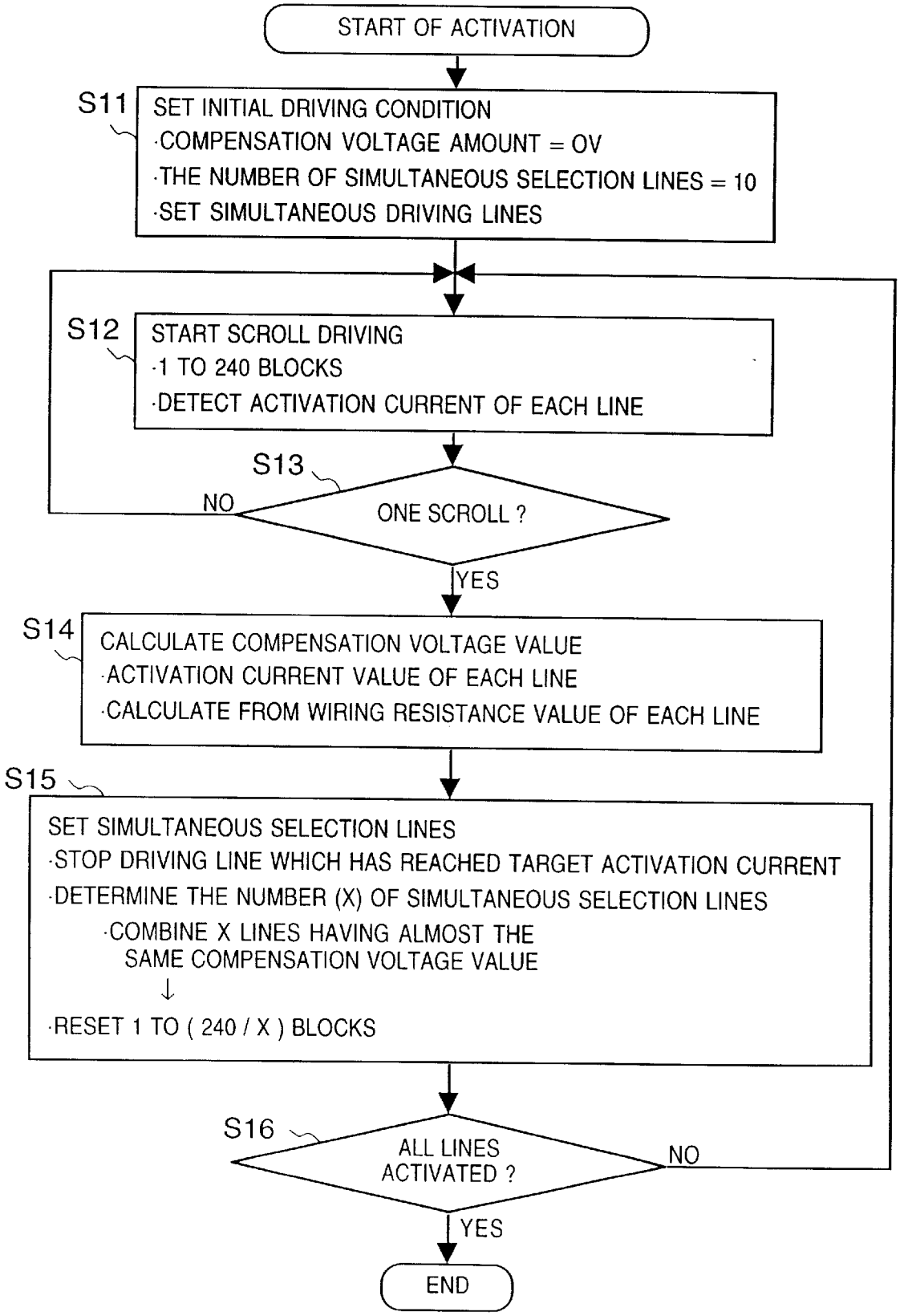
FIG. 51 is a flow chart showing activation processing in the 10th embodiment of the present invention.

This will be explained in detail with reference to the flow chart in FIG. 51. Fordescriptiveconvenience, the number m of row wirings on the surface-conduction emission type electron-emitting device substrate 44101 is 240.

In step S11, a control circuit 44106 starts activation upon reception of an activation start command. In step S11, the control circuit 44106 sets initial driving conditions at the start of activation. Two items are set as initial driving conditions: setting of an initial potential value to a pixel electrode driving circuit 44108, and setting of simultaneous selection/driving row wirings.

The initial potential value in the pixel electrode driving circuit 44108 is set as follows. Since no large activation currents flow at the start of driving, no nonuniform voltages applied to the devices are generated by the activation currents and wirinig resistances. Therefore, all compensation potentials output from the pixel electrode driving circuit

44108 are set to 0 V. Since 10 row wirings are simultaneously electrified, the 240 row wirings are classified into 24 blocks as electrification units in electrification processing. In step S11, a combination of row wirings is set as follows so as to uniformly apply power to the surface-conduction emission type electron-emitting device substrate 44101 upon application of the activation voltage.

| | |
|---|---|
| Block 1: | first, 25th, 49th, . . . , 217th row wirings |
| . | |
| . | |
| . | |
| Block 24: | 24th, 48th, 72nd, . . . , 240th row wirings |

The flow advances to step S12 to set driving conditions based on the settings in step S11, and starts activation. In step S12, row wirings determined by the number-of-simultaneous-selection-lines determination circuit 44112 are simultaneously selected and driven. Driving row wirings are selected based on the simultaneous driving line setting value set in step S11, and a driving line setting signal is output to a timing generation circuit 44105. The timing generation circuit 44105 outputs a line select signal in accordance with the line select setting signal to simultaneously apply the potential from a power source 44104 to the row wirings by a line selection circuit 44102. At this time, a current detection circuit 44103 monitors the progress of activation on the basis of a current value. In other words, the current detection circuit 44103 detects a current value flowing through each row wiring to store the detected value in a memory 44111. Based on the stored value, a compensation amount for a potential drop caused by the activation current and wiring resistance is calculated in step S14.

The flow advances to step S13 to perform activation processing for all blocks and current detection on each row wiring.

The flow advances to step S14 to calculate a compensation potential for a potential drop caused by the activation current and wiring resistance along with the progress of activation. In step S14, the compensation potential value can be calculated by equation (3) from the activation current and wiring resistance of each row wiring. Since the wiring resistances r1 to rn on each row wiring can be considered to be almost equal, the wiring resistance value of each row wiring is measured in advance and stored in the memory 44111 in order to correct only variations on each row wiring. Even while a plurality of row wirings are simultaneously driven, the activation current of each row wiring is detected by the current detection circuit 44103 to calculate in step S12 the compensation potential value for each row wiring using the activation current value and wiring resistance value of each row wiring stored in the memory 44111.

The flow advances to step S15. Since the compensation potential value to be applied changes between row wirings along with the progress of activation, a combination of simultaneous selection row wirings must be sequentially updated. Simultaneously driving row wirings are set. Since devices connected to a row wiring whose activation current has reached a target value (2 mA/device) have been activated, they need not be selected and are removed from selection row wirings. The number-of-simultaneous-selection-lines determination circuit 44112 determines the number (to be referred to as "X") of simultaneous driving row wirings between "2" and "10" on the basis of the panel application power amount. Row wirings to be activated next are aligned in the order from a larger one of compensation potential values calculated in step S12, and row wirings having similar compensation potential values are simultaneously selected in units of X.

The flow advances to step S16 to check whether the activation current values of all row wirings have reached the target value. If YES in step S16, activation ends; if NO in step S16, the flow returns to step S12 to start scroll driving again. "Scroll driving" means processing of applying the pulse potential to a given row wiring and (sequentially) to another row wiring before application of the next pulse in applying the pulse potential to row wirings. The values set in steps S13 and S14 are used for a combination of simultaneous selection row wirings and the compensation potential value from the pixel electrode driving circuit 44108.

In this way, activation of the surface-conduction emission type electron-emitting device substrate 44101 is complete. Since the output potentials $B_{y1}$ to $B_{yn}$ from the pixel electrode driving circuit 44108 are sequentially updated to compensate for a potential drop caused by the activation current and wiring resistance, all devices can be uniformly activated by an almost constant voltage from the start to end of activation. Since a plurality of row wirings are simultaneously selected and driven, activation processing can be completed within about ¼ or less of the processing time required to select and drive row wirings one by one.

In the 10th embodiment, the number of simultaneous selection/driving row wirings is changed between "2" and "10". However, the present invention is not limited to this, and the number of row wirings can be greatly changed within the above-mentioned range.

The above and other embodiments may be applied to a system constituted by a plurality of devices (e.g., a host computer, interface device, reader, and printer) or an apparatus comprising a single device (e.g., a copying machine or facsimile apparatus).

The object of the above and other embodiments is realized even by supplying a storage medium storing software program codes for realizing the functions of the above-described embodiments to a system or apparatus, and causing the computer (or a CPU or MPU) of the system or the apparatus to read out and execute the program codes stored in the storage medium.

In this case, the program codes read out from the storage medium realize the functions of the above-described embodiments by themselves, and the storage medium storing the program codes constitutes the present invention.

As a storage medium for supplying the program codes, a floppy disk, hard disk, optical disk, magnetooptical disk, CD-ROM, CD-R, magnetic tape, nonvolatile memory card, ROM, or the like can be used.

The functions of the above-described embodiments are realized not only when the readout program codes are executed by the computer but also when the OS (Operating System) running on the computer performs part or all of actual processing on the basis of the instructions of the program codes.

The functions of the above-described embodiments are also realized when the program codes read out from the storage medium are written in the memory of a function expansion board inserted into the computer or a function expansion unit connected to the computer, and the CPU of the function expansion board or function expansion unit performs part or all of actual processing on the basis of the instructions of the program codes.

In the 10th embodiment, a predetermined number of row wirings are selected from a plurality of rowwirings to apply a potential, a potential for correcting the potential distribution is applied to all column wirings, and current values flowing through the selected row wirings are detected. The present invention is not limited to this. The column and row wirings may be replaced with each other, and the potential may be applied to selected ones of the column wirings to correct the potential distribution by the potential applied to all row wirings.

The 10th embodiment prevents variations in characteristics by nonuniform voltages applied to devices under the influence of a potential drop caused by the wiring resistance and activation current upon activation in manufacturing by activation a surface-conduction emission type electron-emitting device substrate having surface-conduction emission type electron-emitting devices arranged in a matrix. This embodiment can realize activation which allows an electron source having many surface-conduction emission type electron-emitting devices arranged in a simple matrix to obtain uniform electron-emitting characteristics.

At the same time, this embodiment can shorten the processing time required to electrify a surface-conduction emission type electron-emitting device substrate having many devices, realizing a short processing time.

As described above, the 10th embodiment can make uniform the electron-emitting characteristics of an electron source having many electron-emitting devices arranged in a matrix, and can shorten the time necessary for activation.

The electron-emitting characteristics of respective electron-emitting devices can be made uniform without any influence of the resistance of a wiring connected to the electron-emitting devices and/or any influence of a current flowing through an activated device.

11th Embodiment

An activation apparatus in the 11th embodiment has the same arrangement as in the ninth embodiment.

The 11th embodiment is different by a method of selecting simultaneous driving lines in activation. This method can shorten the electrification time and can make the electron-emitting characteristics of the device more uniform, as will be described below.

The 11th embodiment optimizes the simultaneous driving line selection method to set the compensation potential so as to eliminate the influence of a potential drop caused by the column-direction wiring resistance Ry that is negligibly small in the ninth embodiment.

In the ninth embodiment, the influence of the wiring resistance $R_y$ is negligibly small in the equivalent circuit of FIG. 47. Strictly speaking, however, the influence of a potential drop across $R_y$ increases to a non-negligible degree depending on the simultaneous driving line selection method. The compensation potential value output from a buffer amplifier 44107 changes depending on the positions of simultaneous selection lines, impairing the potential drop compensation effect. The 11th embodiment relates to a driving example of minimizing the influence of the column-direction wiring resistance $R_y$.

The step of activating a surface-conduction emission type electron-emitting device substrate 44101 by the apparatus of this embodiment will be described. Also in the 11th embodiment, activation is performed to set the values $I_f$ of all devices to a target value. The target current value is determined by a necessary electron emission amount and the like. In the 11th embodiment, activation processing is done while monitoring an output from a current detection circuit 44103 so as to set the device currents of respective devices on the surface-conduction emission type electron-emitting device substrate 44101 to 2 mA at last. Similar to the ninth embodiment, activation is done by applying a waveform having a pulse width of 1 msec and a pulse height of 18 V. To shorten the time, activation is simultaneously performed in units of two lines.

The influence and reduction method of a potential drop by the column-direction wiring resistance in simultaneously selecting and activating a plurality of lines will be explained.

Figure 52:
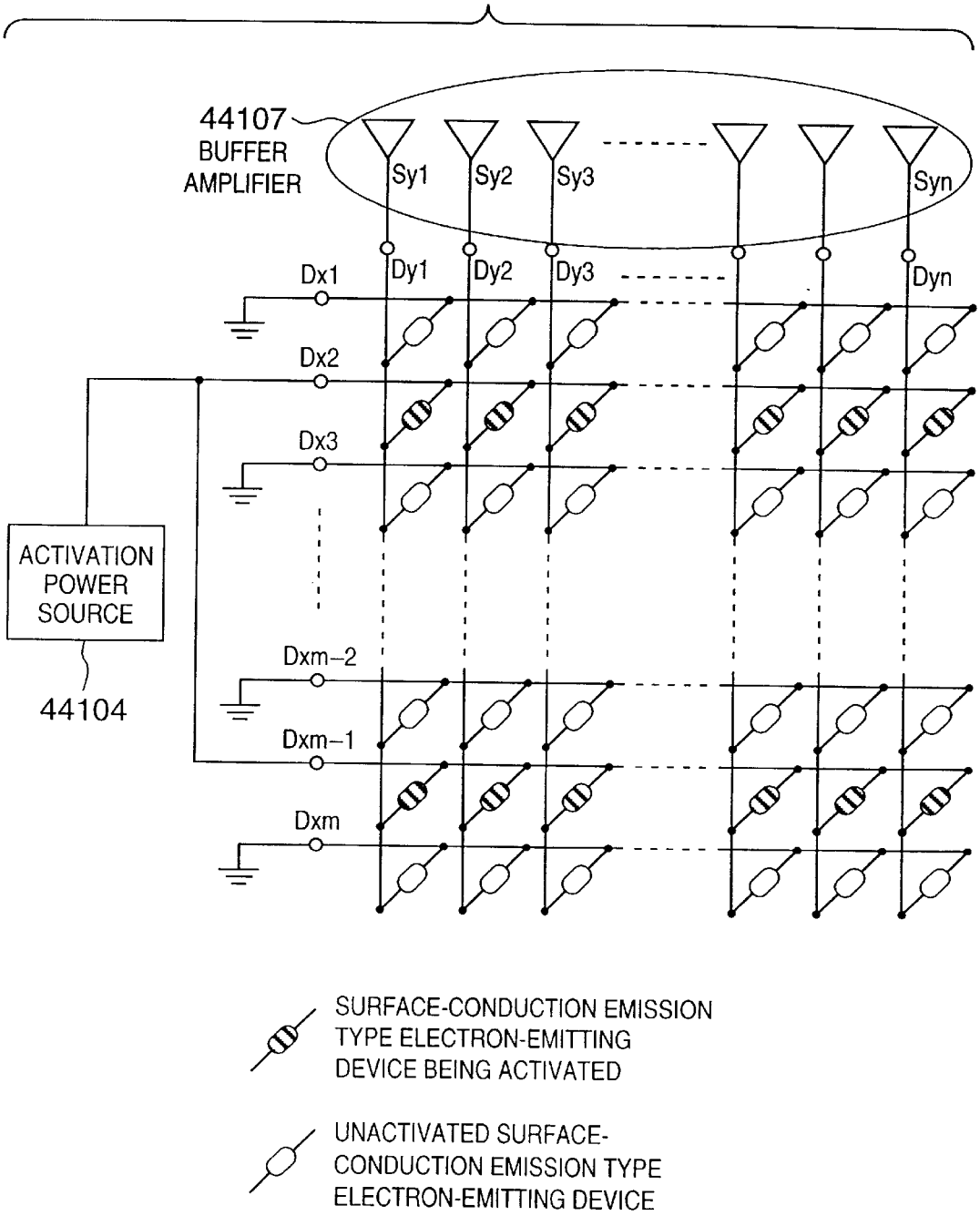
FIG. 52 is a circuit diagram showing a driving example of activating devices in the 11th embodiment.

FIG. 52 is a circuit diagram showing the state of simultaneously selecting and activating two lines of row-direction wiring terminals $D_{x2}$ and $D_{xm-1}$ on the surface-conduction emission type electron-emitting device substrate.

In this case, devices connected to the row-direction wiring terminals $D_{x2}$ and $D_{xm-1}$ exhibit almost the same potential drop distribution by the activation current and row-direction wiring resistance. Accordingly, the two wirings are simultaneously selected and driven by an activation power source 44104, and corresponding column-direction wiring terminals $D_{y1}$ to $D_{yn}$ receive a potential waveform for compensating for the potential drop from the buffer amplifier 44107 (driving waveform in FIG. 48B).

Figure 53:
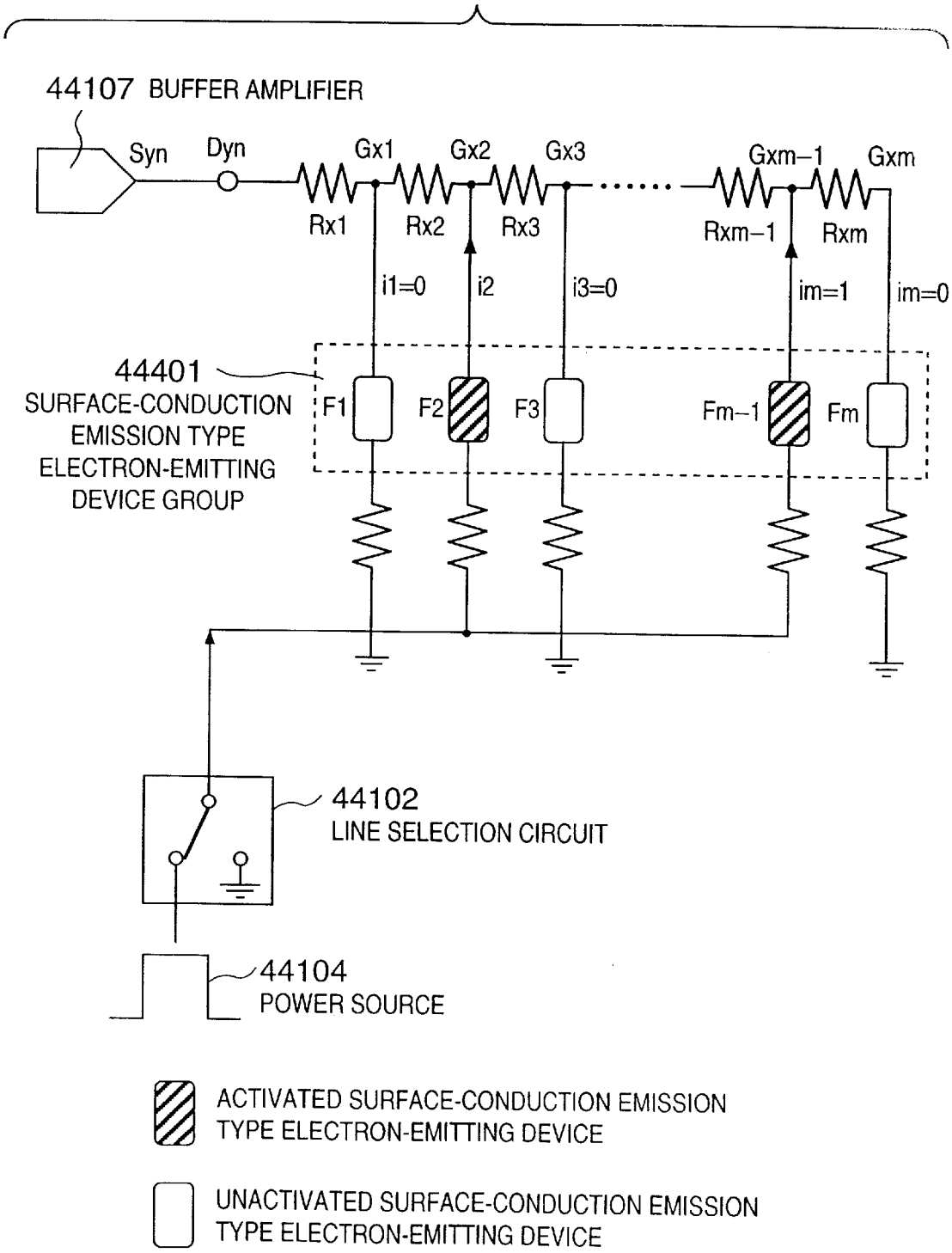
FIG. 53 is a circuit diagram for explaining the driving example of activating devices that also includes the wiring resistance in the 11th embodiment.

FIG. 53 shows a model of surface-conduction emission type electron-emitting devices connected to the nth column wiring that also includes the wiring resistance while paying attention to the output $S_{yn}$ of the buffer amplifier 44107 and the column-direction wiring terminal $D_{yn}$ in FIG. 52 in order to examine the influence of the column-direction wiring resistance. Estimation of a potential drop amount generated by the column-direction wiring resistance in simultaneously selecting and activating a plurality of lines, and the compensation method of the 11th embodiment will be described with reference to FIG. 53.

In FIG. 53, reference symbols $F_1$ to $F_m$ denote surface-conduction emission type electron-emitting devices on the line of the column-direction wiring terminal $D_{yn}$; and $R_{x1}$ to $R_{xm}$, wiring resistances at respective portions on a column wiring $D_{yn}$.

Devices connected to the row-direction wiring terminals $D_{x2}$ and $D_{xm-1}$ are activated in FIG. 52, whereas the devices $F_2$ and $F_{m-1}$ are activated in FIG. 53 and respectively flow activation currents $i_2$ and $i_{m-1}$. The remaining devices receive the output potential $S_{yn}$ from the buffer amplifier 44107 and GND potential. The difference between these potentials is generally small, and almost no current flows through the devices.

A potential drop generated at $G_{x1}$ to $G_{xm}$ on the column-direction wiring by the influence of the column wiring resistance is estimated. Using the potential $G_{xm}$ as a reference, $$G_{xm-1}\text{Potential} = G_{xm}\text{Potential} + R_{xm} \times i_{m-1} = G_{xm}\text{Potential} \quad (A_1)$$

$$G_{xm-2}\text{Potential} = G_{xm-1}\text{Potential} + R_{xm-1} \times i_m = G_{xm}\text{Potential} + R_{xm-1} \times i_{m-1} \quad (A_2)$$

$$G_{x2}\text{Potential} = G_{xm}\text{Potential} + (R_{xm-1} + R_{xm-2} + \ldots + R_{x3}) \times i_{m-1} \quad (A_{m-2})$$

$$G_{x1}\text{Potential} = G_{x2}\text{Potential} + R_{x2} \times (i_{m-1} + i_2) = G_{xm}\text{Potential} + (R_{xm-1} + R_{xm-2} + \ldots + R_{x3} + R_{x2}) \times i_{m-1} + R_{x2} \times i_2 \quad (A_{m-1})$$

-continued $$\text{Potential of Terminal } D_{yn} = G_{x1}\text{Potential} + R_{x1} \times (i_{m-1} + i_2) \quad (A_m)$$
$$= G_{xm}\text{Potential} + (R_{xm-1} + R_{xm-2} + \ldots + R_{x2} + R_{x1}) \times i_{m-1} + (R_{x2} + R_{x1}) \times i_2$$

From these results, the potential drop amounts Δ of the $G_{x2}$ and $G_{xm-1}$ potentials are given using the output potential $S_{yn}$ fromthebufferamplifier 44107 as a reference:

$$\Delta G_{x2}=(R_{x2}+R_{x1})\times(i_2+i_{m-1})$$

$$\Delta G_{xm-1}=(R_{xm-1}+R_{xm-2}+\ldots R_{x2}+R_{x1})\times i_{m-1}+(R_{x2}+R_{x1})\times i_2$$

These potential drop amounts are generated at $G_{x1}$ to $G_{xm}$ on the column-direction wiring by the influence of the column wiring resistance in simultaneously activating the row wiring terminals $D_{x2}$ and $D_{xm-1}$. The potential drop amount ΔV is determined by Column wiring resistance value Activation current amount Specific device selected on column wiring Of these conditions, a specific device selected on the column wiring substantially determines the influence of a potential drop generated at $G_{x1}$ to $G_{xm}$ on the column-direction wiring by the influence of the column wiring resistance because the column wiring resistance values $R_{x1}$ to $R_{xm}$ are almost equal and the activation current amount is almost constant.

That is, for $R_{x1}$ to $R_{xm}=R_x$ and $i_2=i_{m-1}=i$, $$\Delta G_{x2}'=4\cdot R_x\cdot i$$

$$\Delta G_{xm-1}'=(m-1)\cdot R_x\cdot i+2\cdot R_x\cdot i=(m+1)\cdot R_x\cdot i$$

From these results, ΔV is calculated by $$\Delta V=|G_{x2}'-G_{xm-1}'|=(m-3)\cdot R_x\cdot i \quad (B)$$

and defined as the influence evaluation amount of the column-direction wiring resistance.

ΔV is the difference between potential drop amounts generated at $G_{x2}$ and $G_{xm-1}$ by the column-direction wiring resistance.

In FIG. 53, the potential drop amount is estimated by paying attention to the output $S_{yn}$ from the buffer amplifier 44107. The relationship between $\Delta G_{x2}'$ and $\Delta G_{xm-1}'$ and the value ΔV are the same with any outputs $S_{y1}$ to $S_{yn}$ so long as the activation current value and wiring resistance value are kept unchanged.

More specifically. the influence of the column-direction wiring resistance can be calculated from ΔV. If ΔV is large, whether to simultaneously select two lines of $D_{x2}$ and $D_{xm-1}$ is determined. That is, ΔV is compared with a predetermined allowable setting voltage value, and if the allowable setting voltage value <ΔV, other lines are selected as a combination of simultaneous selection lines.

The influence of a potential drop generated at $G_{x1}$ to $G_{xm}$ on the column-direction wiring by the influence of the column wiring resistance can be reduced by adding an offset value $\Delta V_{offset}$ to an output from the buffer amplifier 44107.

In this case, the value:

$$\Delta V_{offset}=\tfrac{1}{2}(\Delta G_{x2}'+\Delta G_{xm-}1')=\tfrac{1}{2}(m+5)\cdot i. \quad (C)$$

is subtracted as an offset amount from the outputs $S_{y1}$ to $S_{yn}$ from the buffer amplifier 44107, thereby reducing the influence of a potential drop generated by the influence of the column wiring resistance in simultaneously activating devices connected to the row-direction wiring terminals $D_{x2}$ to $D_{xm-1}$.

In the 11th embodiment as well as the ninth embodiment, simultaneous driving lines are sequentially changed with the progress of activation, and two lines having the same activation speed are driven at once. At this time, the 11th embodiment considers the influence of the column-direction wiring resistance to select and drive two lines which minimize the influence.

Figure 54:
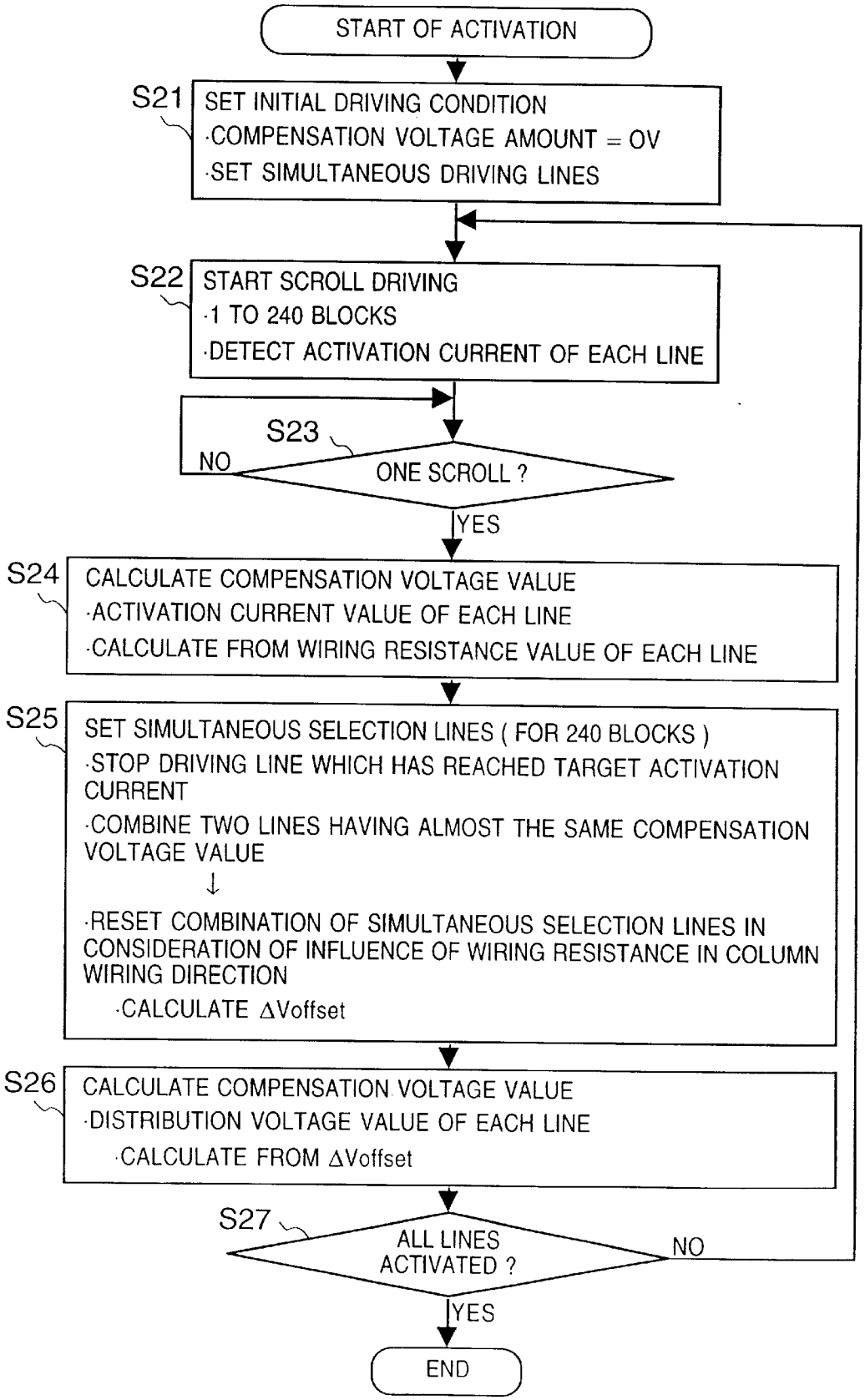
FIG. 54 is a flow chart showing activation in the 11th embodiment.

This will be explained in detail with reference to the flow chart in FIG. 54. For descriptive convenience, the number n of row-direction wirings in the surface-conduction emission type electron-emitting device substrate 44101 is 480.

(Step S21) Setting of Initial Driving Conditions

A control circuit 44106 starts activation upon reception of an activation start command. The control circuit 44106 sets initial driving conditions at the start of activation. Two items are set as initial driving conditions: setting of the initial potential value of an output potential from a pixel electrode driving circuit 44108, and setting of simultaneous selection lines.

The initial potential value of the pixel electrode driving circuit 44108 is set as follows. Since no large activation currents flow at the start of driving, no nonuniform device application voltages are generated by the activation currents and wiring resistances. Therefore, all compensation potential amounts applied by the pixel electrode driving circuit 44108 are set to 0 V. To simultaneously drive two lines, the 480 row-direction wirings are classified into 240 blocks as electrification units in electrification. Assignment of the 240 blocks is done by "setting of simultaneous selection lines". Any lines are at the same voltage at the start of activation, and thus any two lines can be combined. In step S21, a combination is set as follows so as to uniformly apply power to the surface-conduction emission type electron-emitting device substrate 44101 upon application of the activation voltage.

| | |
|---|---|
| Block 1: | row-direction wirings ch1 and ch241 |
| Block 2: | row-direction wirings ch2 and ch242 |
| . | |
| . | |
| . | |
| Block 240: | row-direction wirings ch240 and ch480 |

(Step S22) Start of Scroll Driving

Driving conditions are set based on the settings in step S21 to start activation. In step S22, row-direction wirings are driven in units of two. Driving lines are selected based on the simultaneous selection line setting value in step S21, and a driving line setting signal is output to a timing generation circuit 44105. The timing generation circuit 44105 outputs a line select signal, and a line selection circuit 44102 simultaneously drives the two lines by a power source 44104. At this time, the progress of activation is monitored to calculate a compensation amount for a potential drop caused by the activation current and row-direction wiring resistance. For this purpose, a current value flowing through each row-direction wiring is detected by the current detection circuit 44103 and stored in a memory 44111.

(Step S23) Detection of Completion of One Scroll

The flow waits for completion of activation processing for the 240 blocks and current detection on each line.

(Step S24) Calculation of Distribution Voltage Value

The potential drop generated by the activation current and wiring resistance along with the progress of activation is calculated. The potential distribution amount generated on the row-direction wiring resistance can be calculated by equation (3) in the ninth embodiment from the activation current and wiring resistance of each line. Since the wiring resistances r1 to rn on each line can be considered to be almost equal, the wiring resistance value of each line is measured in advance and stored in the memory 44111 in order to correct only variations on each line. Even while two lines are simultaneously driven, the activation current of each line is detected by the current detection circuit 44103 to calculate in step S22 the distributed potential value for each line using the activation current value and row-direction wiring resistance value of each line and store it in the memory 44111.

(Step S25) Setting of Simultaneous Selection Lines

Since the compensation potential value to be applied changes between lines along with the progress of activation, a combination of simultaneous selection lines must be sequentially updated. In step S24, simultaneous selection/driving lines are set. A line whose activation current has reached a target value (2 mA/device) has been activated and is removed from selection lines. Lines to be activated next are arranged in the order from a larger one of distributed potential values calculated in step S24, and lines having similar potential values are provisionally set as simultaneous selection lines in units of two.

If adjacent two lines are selected, power may concentrate at part of the surface-conduction emission type electron-emitting device substrate. To avoid this, the first to 480th row wirings are divided into a block A including the first to 240th lines and a block B including the 241st to 480th lines, and two simultaneous selection lines are respectively selected from the blocks A and B.

The influence of a potential drop by the column wiring resistance is evaluated in accordance with equations ($A_1$) to ($A_m$) and (B). As a result, if the influence amount $\Delta V$ of the potential drop by the column wiring resistance exceeds an allowable setting value of 100 mV, simultaneous selection lines are reset. In resetting lines, a combination is changed to select two close lines, and $\Delta V$ is calculated again in accordance with equations ($A_1$) to ($A_m$) and (B).

Simultaneous selection lines are set to make $\Delta V$ equal to or smaller than the allowable value or close to the allowable value for all the 240 blocks.

The offset value $\Delta V_{offset}$ that can minimize the influence $\Delta V$ is calculated for the 240 blocks in accordance with equation (C) and stored in the memory.

(Step S26) Calculation of Compensation Potential

The offset values $\Delta V_{offset}$ for the 240 blocks in step S25 are added to the distribution compensation potential calculated in step S24 to calculate compensation potential values and store them in the memory.

(Step S27) Determination of Completion of Activation

Whether the activation currents of all lines have reached the target value is checked. If YES in step S27, activation ends; if NO in step S27, the flow returns to step S22 to start scroll driving again. The values set in step S26 are used for a combination of simultaneous selection lines and the compensation potential value from the pixel electrode driving circuit 44108.

In this manner, activation of the surface-conduction emission type electron-emitting device substrate 44101 is complete. Since the outputs $B_{y1}$ to $B_{yn}$ from the pixel electrode driving circuit 44108 for compensating for a potential drop caused by the activation current and wiring resistance are sequentially updated, all devices can be uniformly activated by an almost constant voltage from the start to end of activation. Since two lines are simultaneously driven, activation processing can be completed within half the processing time required to drive row wirings one by one.

As described above, the activation apparatus of the 11th embodiment can make the electron-emitting characteristics of all devices uniform. This electron source substrate can be used to realize a high-quality image display apparatus almost free from variations in luminance or density.

12th Embodiment

An energization apparatus in the 12th embodiment has the same arrangement as in the ninth embodiment (FIG. 44). In this embodiment, the potential is not applied to the row wirings from one side, but is applied to them from the two sides, unlike in FIG. 44.

Figure 55:
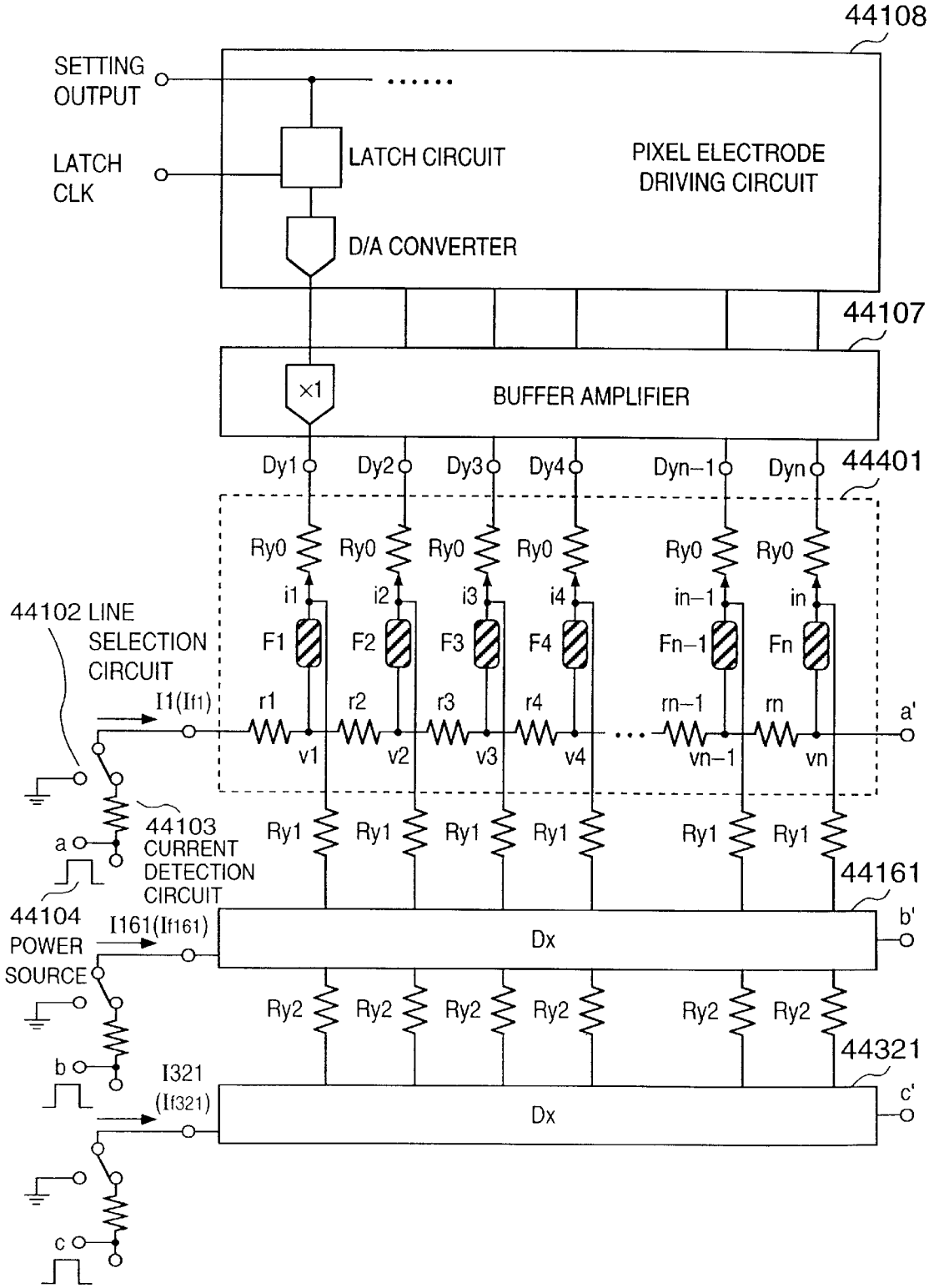
FIG. 55 is a block diagram showing the internal arrangement of part of the activation apparatus in FIG. 44.

FIG. 55 is a block diagram showing a model including the wiring resistance of each surface-conduction emission type electron-emitting device while paying attention to $D_{x1}$ of three row wirings ($D_{x1}$, $D_{x161}$, and $D_{x321}$) to which the activation voltage is applied. Activation of the surface-conduction emission type electron-emitting device group will be described.

In FIG. 55, reference symbols $F_1$ to $F_n$ denote surface-conduction emission type electron-emitting devices on the line of the row wiring terminal $D_{x1}$; r1 to rn, wiring resistances of the row wiring terminal $D_{x1}$; $R_{y0}$, wiring resistances from the feeding terminals of the column wirings $D_{y1}$ to $D_{yn}$ to corresponding surface-conduction emission type electron-emitting devices; $R_{y1}$, a column wiring resistance between the lines $D_{x1}$ and $D^{x161}$; and $R_{y2}$, a column wiring resistance between the lines $D_{x161}$ and $D_{x321}$.

Since both the row and column wirings are designed with the same line width, thickness, and material, r1 to are considered to be almost equal except for variations in the manufacture. In addition $R_{y0}$, $R_{y1}$, and $R_{y2}$ are also considered to be formed with almost the same resistance value.

Although the equivalent resistance value of the surface-conduction emission type electron-emitting device changes (decreases) before and after activation, the equivalent resistance of each surface-conduction emission type electron-emitting device is much higher than the values $R_{y0}$, $R_{y1}$, and $R_{y2}$, and the influence of a voltage drop by the column wiring is ignored. The equivalent resistance values of the surface-conduction emission type electron-emitting devices $F_1$ to $F_n$ are designed higher than r1 to rn.

A line selection circuit 44102 is controlled to simultaneously activate the three row wirings $D_{x1}$, $D_{x161}$, and $D_{x321}$. More specifically, a timing generation circuit 44105 (FIG. 44) generates a line select signal in response to a driving line setting signal and CLK signal output from a control circuit 44106 (FIG. 44). Upon reception of the line select signal, the line selection circuit 44102 connects a power source 44104 for outputting the activation potential Eac and a current detection circuit 44103 to the row wiring terminals $D_{x1}$, $D_{x161}$, and $D_{x321}$. Thus, these three lines are driven by the activation potential Eac.

A buffer amplifier 44107 operates to sink activation currents $i_1$ to $i_n$ from the devices $F_1$ to $F_n$ on the row wiring $D_{x1}$ and the activation currents of the lines $D_{x161}$ and $D_{x321}$. The amplification factor of the buffer amplifier 44107 is determined by the pixel electrode driving circuit 44108.

Figure 56:
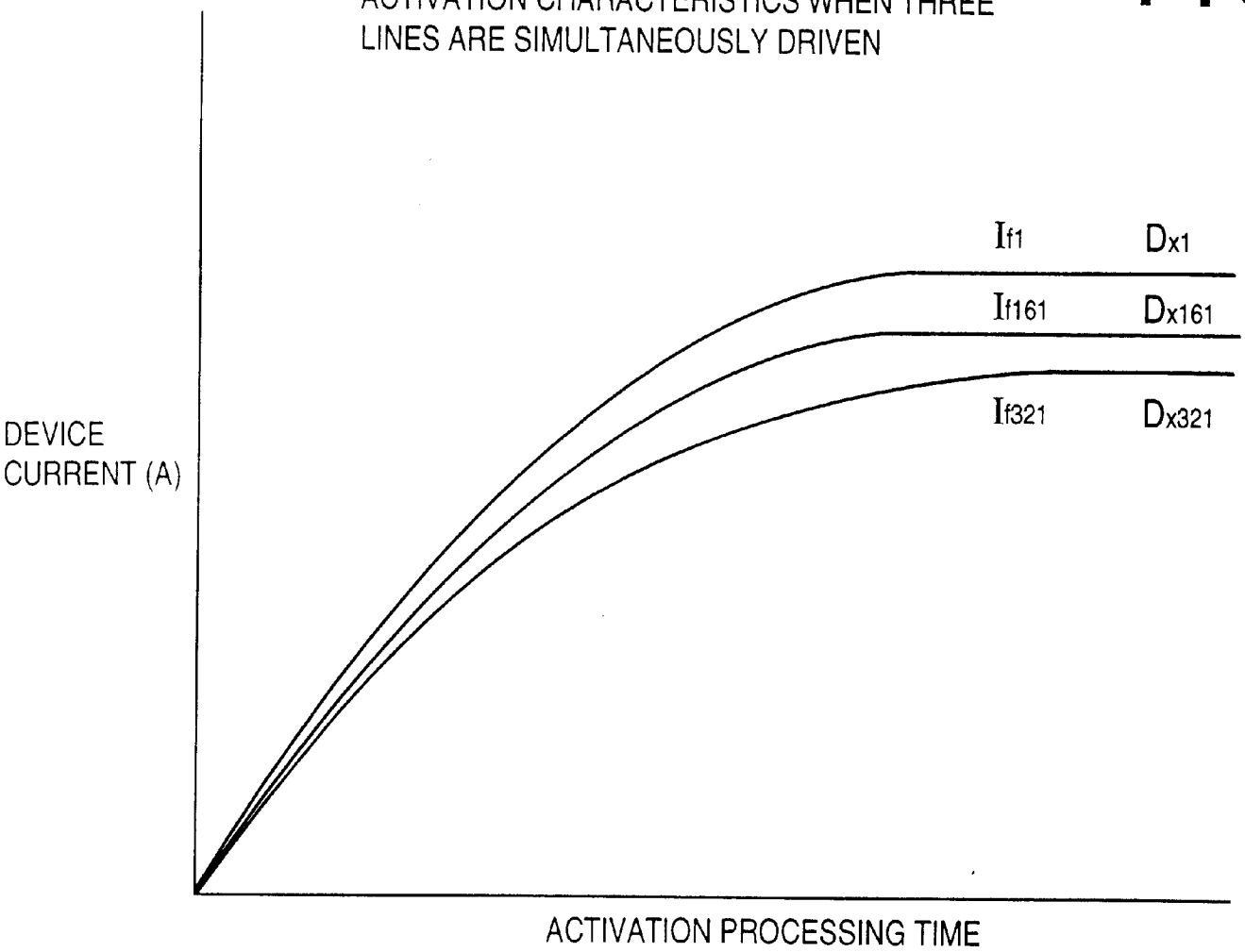
FIG. 56 is a graph showing the activation characteristics of each row wiring in simultaneously driving row wirings in the 12th embodiment.

FIG. 56 shows device currents $I_{f1}$, $I_{f161}$, and $I_{f321}$ respectively flowing through the row wirings $D_{x1}$, $D_{x161}$, and $D_{x321}$. As is apparent from FIG. 56, the three lines do not flow any currents in the initial state of activation, and gradually flow currents along with the progress of activation.

If activation progresses to a certain degree, the device currents $I_{f1}$, $I_{f161}$, and $I_{f321}$ exhibit different activation current values. Variations in activation current are caused by variations upon forming the to surface-conduction emission type electron-emitting devices with a larger substrate area, variations in fissures formed by forming processing, and the like.

Figure 57:
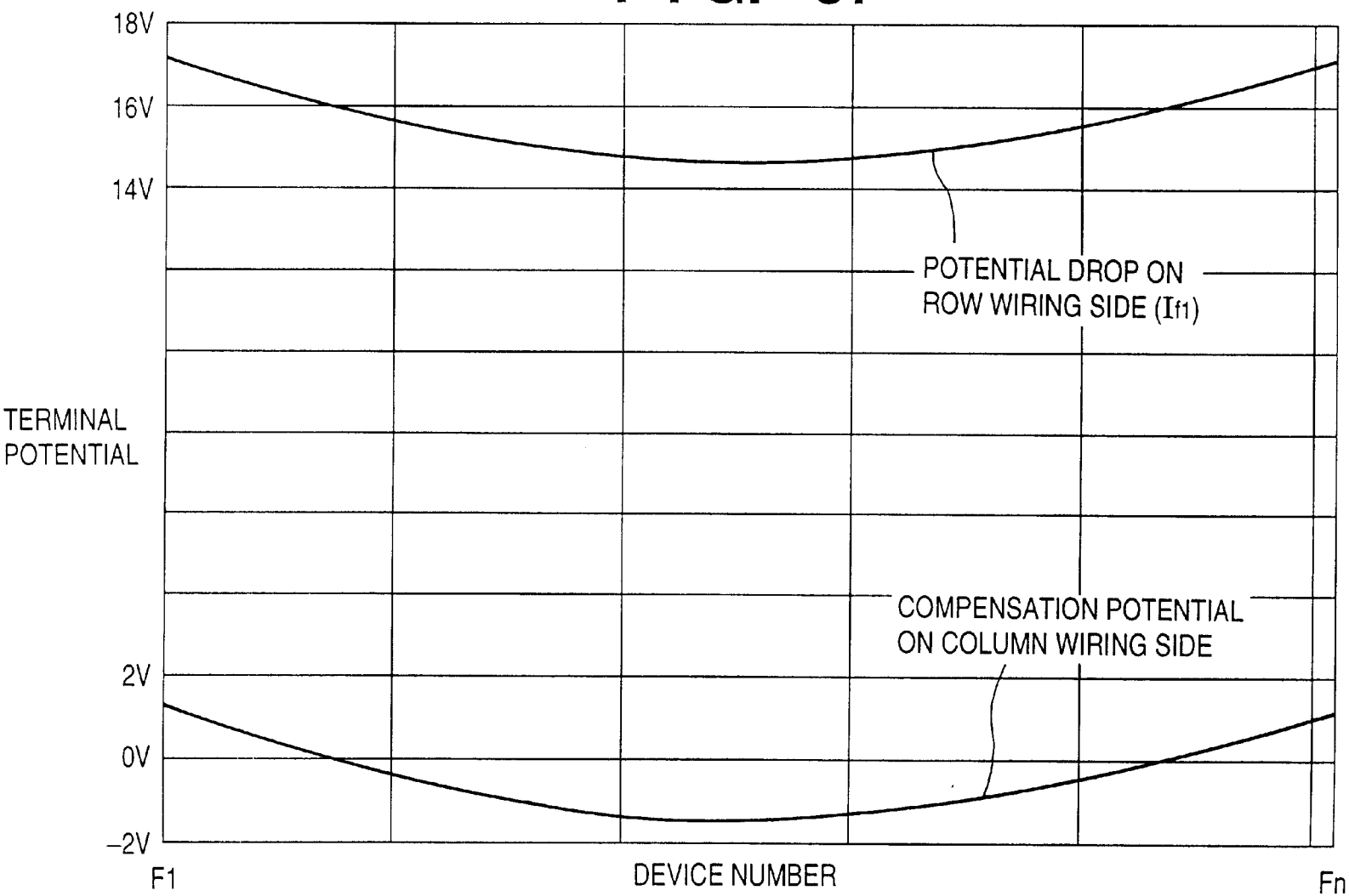
FIG. 57 is a graph showing the voltage distribution upon activation in the 12th embodiment.

FIG. 57 is a graph showing the voltage distribution in activating surface-conduction emission type electron-emitting devices on the row wiring $D_{x1}$. In FIG. 57, the ordinate represents the terminal potential across the device, and the abscissa represents the positions of the surface-conduction emission type electron-emitting devices $F_1$ to $F_n$. Note that the power source 44104 applies an activation potential Eac of, e.g., 16 V to the row wirings $D_{x1}$, $D_{x161}$, and $D_{321}$.

FIG. 57 shows the distribution when activation progresses to a certain degree. The voltages of surface-conduction emission type electron-emitting devices near the center drop on the row wiring side under the influence of the wiring resistance. Since no activation current flows in the initial state of activation, as shown in FIG. 56, the compensation voltage is set around 0 V.

Next, the procedure of activating the surface-conduction emission type electron-emitting device substrate 44101 by the activation apparatus of the 12th embodiment will be described with reference to FIGS. 44 and 55 to 57.

In the 12th embodiment, three row wirings are simultaneously electrified to shorten the activation time. Assuming that the number of row wiring lines on the surface-conduction emission type electron-emitting device substrate 44101 is 480, three row wiring terminals $D_{x1}$, $D_{x161}$, and $D_{x321}$ are used as start lines to be simultaneously driven, and the compensation potential to be applied to the column wiring is determined by the average of the activation currents of three lines.

As shown in FIG. 44, when the control circuit 44106 receives an activation start command from a user, it controls the timing generation circuit 44105, power source 44104, and pixel electrode driving circuit 44108 in order to perform electrification processing in units of rows. The control circuit 44106 sets an output setting value 44110 to set the column wiring terminals $D_{y1}$ to $D_{yn}$ to ground potential. The control circuit 44106 sequentially applies a pulse wave of the activation potential Eac having a pulse width of 1 msec and a pulse height of 18 V to the row wiring terminals $D_{x1}$ to $D_{xm}$. Then, the pulse voltage is sequentially applied to the surface-conduction emission type electron-emitting device substrate 44101 in units of row wirings to start activation in units of lines.

A method of setting the compensation potential output from the pixel electrode driving circuit 44108 will be explained.

In activation, the electrical characteristics of the device change as shown in FIG. 41. That is, the device current does not substantially flow at the start of activation, starts flowing with the lapse of electrification time, and saturates. At this time, the terminal potentials of surface-conduction emission type electron-emitting devices on the row wiring $D_{x1}$ are monitored to find changes in potentials $v_1$ to $v_n$ under the influence of the wiring resistances r1 to rn, as shown in FIG. 55. The potentials more greatly change with the progress of activation.

For example, for an activation current of 2 mA/device, r1 to rn=10 mΩ, and n=1000, when power is supplied from the power source 44104 from only one side ($F_1$ side), a potential drop of 10 V at maximum:

$$\Delta V = \tfrac{1}{2} \times 1000 \times 1001 \times 2\ \text{mA} \times 10\ \text{m}\Omega \tag{4}$$

occurs at the terminal $v_n$ of the surface-conduction emission type electron-emitting device $F_n$ farthest from the feeding terminal.

To prevent this, the pixel electrode driving circuit 44108 generates a potential distribution identical to this potential distribution to apply the potential to the terminals $D_{y1}$ to $D_{yn}$ via the buffer amplifier 44107 so as to cancel the potential distribution generated at respective surface-conduction emission type electron-emitting devices.

More specifically, the control circuit 44106 calculates a potential drop distribution generated at the terminals $v_1$ to $v_n$ by currents flowing through the surface-conduction emission type electron-emitting devices $F_1$ to $F_n$ and the wiring resistances r1 to rn along with the progress of activation. The output value of the D/A converter of the pixel electrode driving circuit 44108 is set to realize setting of the compensation potential for the potential drop on the column wiring side.

The 12th embodiment adopts a method (to be referred to multiline driving) of simultaneously selecting a plurality of row wirings and applying the potential. Three row wirings $D_{x1}$, $D_{x161}$, and $D_{x321}$ are simultaneously driven. The activation potential is applied to the row wiring from the two sides of the wiring for $F_1$ to $F_n$.

When a predetermined potential is applied from the power source 44104 to the two sides of each of row wirings selected by the line selection circuit 44102, the activation currents $I_{f1}$, $I_{f161}$, and $I_{f321}$ flow through the row wirings $D_{x1}$, $D_{x161}$, and $D_{x321}$.

The 12th embodiment employs a method of calculating the average activation current $I_{fave}$. of multiline-driven row wirings, and calculating and applying a corresponding compensation potential on the column wiring side. The average activation current $I_{fave}$ is calculated by the control circuit 44106 by sequentially detecting the current values of multiline-driven lines, and inputting the detected current values as activation currents 44109 from the current detection circuit 44103 to the control circuit 44106. The compensation potential is calculated from the calculated average activation current $I_{fave}$.

In the 12th embodiment, since the activation potential is applied to the row wiring from its two sides, a potential drop by the wiring resistance is maximized around the center. In applying the potential from the two sides of the row wiring, the power source 44104 shown in FIG. 55 is connected between a and a' for the row wiring $D_{x1}$, b and b' for the row wiring $D_{x161}$, and c and c' for the row wiring $D_{321}$.

By the above application method, the compensation potential output is obtained as follows. Letting $i_{ave}$ be the average of a device current flowing through one electron-emitting device, $i_{ave} = i_{fave}/n$.

$$D_{yn} = -\tfrac{1}{2} \times rn \times n \times (n+1) \times i_{ave} \tag{5}$$

$n = F_1$ to $F_{n/2}$

Note that $F_{n/2}$ and subsequent pixel numbers are $n = F_{n-n'}$(n' is calculated as a pixel number from $F_{n/2}$ up to $F_n$).

By this calculation method, the compensation potential on the column wiring side is determined on the basis of the average device current $I_f$ of activation current values flowing through multiline-driven row wirings. The compensation potential is output from the pixel electrode driving circuit 44108 to the terminals of the column wirings $D_{y1}$ to $D_{yn}$ via the buffer amplifier 44107. Setting of the compensation potential is continuously performed till the end of activation processing.

Activation ends when the average device current $I_f$ of each device reaches a predetermined value (for example, each device reaches 2 mA) from the activation current of each multiline-driven row wiring, or by controlling the time after the activation current flows to a certain degree.

As described above, the 12th embodiment simultaneously drives and activates three row wirings to shorten the processing time. In the 12th embodiment, since the surface-conduction emission type electron-emitting device substrate 44101 is formed by arranging surface-conduction emission type electron-emitting devices in a simple matrix, the compensation potential is common to multiline-driven row wirings.

However, activation characteristics (activation currents) flowing through respective row wirings are not always uniform and vary. Compensation potentials calculated for respective row wirings have potential differences. For this reason, setting of the potential applied to the column wiring side is important in multiline driving.

The compensation potential must be set to reduce variations in voltage applied to devices to be actually activated. If the compensation potential is set in accordance with the activation current of a specific row wiring, the application voltage may greatly vary.

In the 12th embodiment, to more uniformly activate devices against variations in characteristics of row wiring lines, the compensation potential output to the column wiring is calculated from the average activation current of multiline-driven row wirings, thereby minimizing variations in device characteristics between row wirings.

Figure 58:
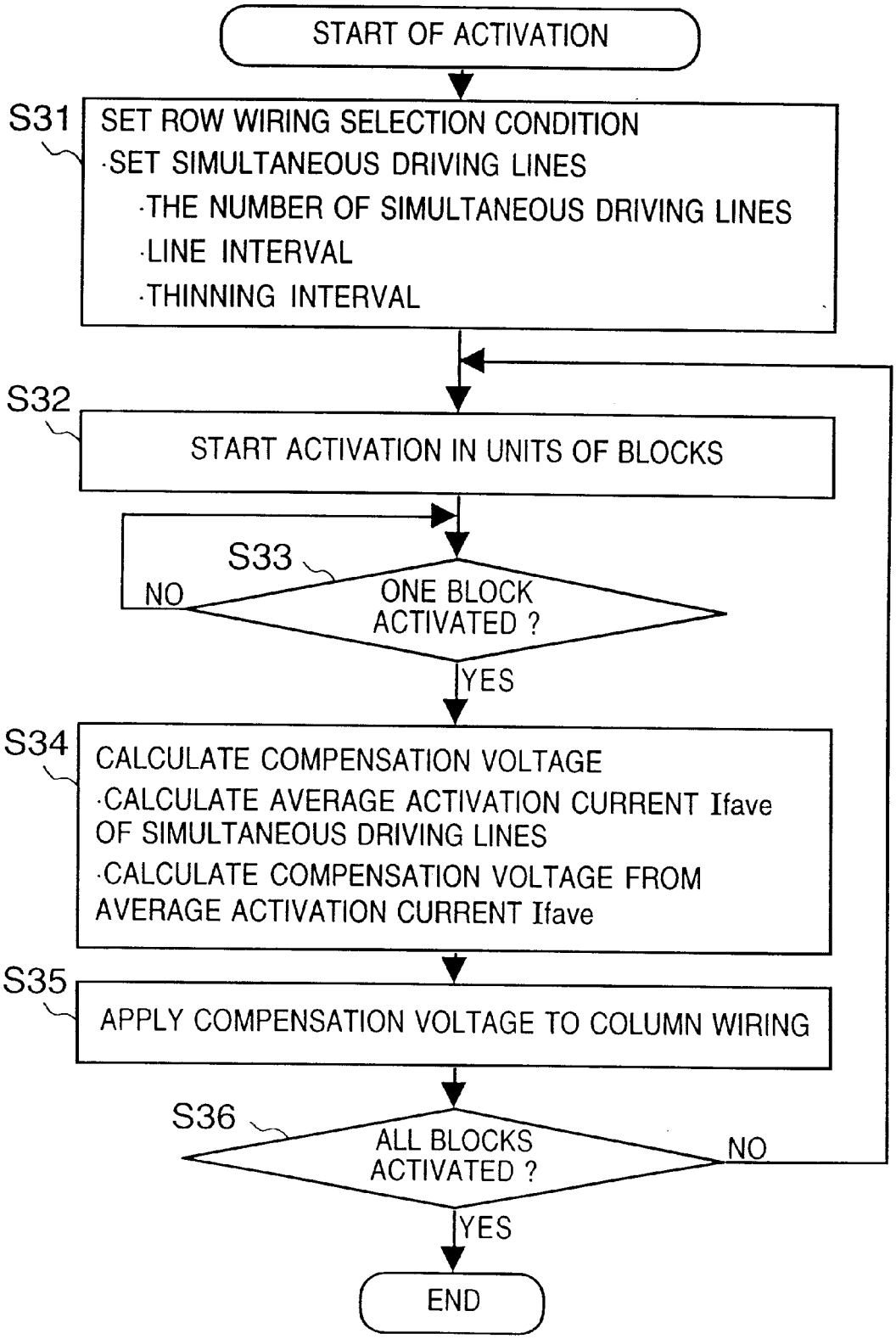
FIG. 58 is a flow chart showing activation processing in the 12th embodiment.

FIG. 58 is a flow chart for realizing activation. The flow for realizing activation will be described with reference to FIG. 58.

In step S31, when the user inputs an activation start command, the control circuit 44106 sets selection conditions of simultaneous driving row wirings at the start of activation. This setting includes three settings, i.e., the number of simultaneous driving row wirings in multiline driving, the line interval between driving row wirings, and the thinning interval. In multiline driving in the 12th embodiment, a plurality of selected row wirings are grouped as one block, and the voltage is sequentially applied in units of blocks.

In the 12th embodiment, the number of simultaneously driving row wirings is set to three, the line interval between simultaneous driving row wirings is set to 160 wirings, and the thinning interval is set to 10 wirings. The number of simultaneous driving row wirings is optimized in consideration of the power amount supplied to the surface-conduction emission type electron-emitting device substrate 44101 and heat generated upon electrification in driving in units of blocks.

The driving line interval means the interval between, e.g., the lines $D_{x1}$, $D_{x161}$, and $D_{x321}$ in simultaneously driving three row wirings. In the 12th embodiment, the driving line interval is set to 160 wirings, as described above. The driving line interval must be uniformly designated over the surface-conduction emission type electron-emitting device substrate 44101 in consideration of concentration of the heat distribution by electrification power on the surface-conduction emission type electron-emitting device substrate 44101.

The thinning interval means the interval between blocks in simultaneous driving. In the 12th embodiment, the row wirings $D_{x1}$, $D_{161}$, and $D_{x321}$ are first driven. Row wirings to be selected next are $D_{x11}$, $D_{x171}$, and $D_{331}$ because the thinning interval is set to 10 wirings. In other words, 3 wirings×10 units=30 wirings are set as one block, and activation is sequentially done for each unit from the first to 10th units. Line selection conditions set as one block are

| Unit | Selection Row Wirings | | |
|---|---|---|---|
| 1 | $D_{x1}$ | $D_{x161}$ | $D_{x321}$ |
| 2 | $D_{x11}$ | $D_{x171}$ | $D_{x331}$ |
| 3 | $D_{x21}$ | $D_{x181}$ | $D_{x341}$ |
| . | | . | |
| . | | . | |
| . | | . | |
| 10 | $D_{x91}$ | $D_{x251}$ | $D_{x411}$ |

Upon completion of these settings, the flow shifts to step S32.

In step S32, surface-conduction emission type electron-emitting devices are activated. To simultaneously drive. three row wirings in multiline driving, the control circuit 44106 sets a setting signal for setting the row wiring selection conditions in step S31 in the timing generation circuit 44105. The timing generation circuit 44105 recognizes driving row wirings, and outputs a line select signal to the line selection circuit 44102.

The line select signal turns on the FET relays of the predetermined row wirings to connect the row wirings to the power source 441047, thereby driving the selected row wirings. After activation starts in units of blocks, the current detection circuit 44103 detects the activation currents of the driven row wirings to store the current values in a memory 44111.

In step S33, it is checked whether activation of one block (30 wirings in the 12th embodiment) and detection of the activation current are completed. If YES in step S33, the flow shifts to step S34.

Instep S34, the compensation potential is calculated. The average activation current $I_{fave}$ is calculated from the activation currents stored in the memory 44111 in step S33. The average activation current $I_{fave}$ is calculated in units of multiline-driven row wirings.

Since selected row wirings are sequentially activated in units of blocks, and the thinning interval is set to 10 wirings. as described in step S31, the average activation current $I_{fave}$ from the first to 10th units can be calculated in simultaneously activating three row wirings. Sampling setting of current detection is done for the average activation current $I_{fave}$ during activation. By this setting, the currents of multiline-driven row wirings are detected every predetermined time to store the latest average activation current $I_{fave}$ in the memory 44111.

Then, the control circuit 44106 calculates the compensation potential on the column wiring side from the obtained average activation current $I_{fave}$. The compensation potential can be calculated using equation (5). The wiring resistances r1 to rn−1 of respective column wirings are measured in advance and stored in the memory 44111. The compensation potential is also measured every update of the average activation current $I_{fave}$. If necessary, the compensation potential value can also be stored in the memory 44111 because it changes with the progress of processing.

In step S35, the compensation potential value calculated every multiline driving in step S34 is sequentially applied to the column wirings by the pixel electrode driving circuit 44108 and buffer amplifier 44107. In the 12th embodiment, since multiline driving is performed in units of blocks, the number of lines for one activation processing is 30 lines.

In activation processing, setting for one processing unit is not limited to one block, and a plurality of blocks may be set in advance.

In step S36, it is checked whether activation processing progresses to complete activation of the multiline-driven lines. If NO in step S36, the flow returns to step S32 to perform activation in units of blocks again.

Activation ends when the activation current of each surface-conduction emission type electron-emitting device reaches a predetermined value while detecting the activation current, or by defining the end time from the start of activation. To complete activation when the current value of each surface-conduction emission type electron-emitting device reaches a predetermined value, the progress of activation must be grasped in units of row wirings by the control circuit 44106 or the like. If activation is controlled by the activation time, the time must be set to unify activation. In the 12th embodiment, activation ends under the latter condition.

In this manner, activation of the surface-conduction emission type electron-emitting device substrate 44101 is completed. By executing this procedure, activation can be completed within ⅓ the processing time required to drive row wirings one by one.

Note that in the 12th embodiment, three row wirings are multiline-driven. However, the number of simultaneous driving row wirings is not limited to this, and can be increased in consideration of heat generated within the surface-conduction emission type electron-emitting device substrate 44101 in order to further shorten the activation time.

Although the power source 44104 applies a positive output in the 12th embodiment, the application potential may be negative. In this case, the direction of current flowing through the column wiring is also inverted, so that the polarity of the compensation potential from the buffer amplifier 44107 is also inverted.

In addition, the pixel electrode driving circuit 44108 comprises D/A converters equal in number to the number of column wirings. However, since the compensation potential distribution changes gradually, as shown in FIG. 57, the number of D/A converters may be decreased to divide and define the application potential by the resistance or the like.

In activation processing, the compensation potential value need not be updated for each block, unlike in the 12th embodiment, but may be appropriately updated in accordance with the progress of activation.

As described above, the activation processing of the 12th embodiment can form relatively uniform surface-conduction emission type electron-emitting devices almost free from variations in electron-emitting characteristics. This surface-conduction emission type electron-emitting device substrate 44101 can be used to form a high-quality display panel almost free from variations. If the number of simultaneous driving lines in multiline driving is increased, the activation time can be greatly shortened.

13th Embodiment

The 13th embodiment will be described. The activation apparatus and circuit arrangement in activation processing of the 13th embodiment are the same as in FIG. 44.

Similar to the 12th embodiment, the 13th embodiment uses the average device current $I_f$ in order to calculate the compensation potential. Further, the 13th embodiment selects simultaneous driving row wirings having similar characteristics in order to increase the reliability of the average of the device current $I_f$ and the calculation precision of the compensation potential.

When a plurality of row wirings are driven by multiline driving, the activation current values $I_f$ of respective row wirings vary owing to the following factors.

As described in the 12th embodiment, the activation current values vary owing to variations in performing forming processing for surface-conduction emission type electron-emitting devices, variations in forming surface-conduction emission type electron-emitting devices, and physical defects (disconnection/short-circuiting) on the matrix wiring. In actually forming the panel, the activation current values vary owing to variations in characteristics of surface-conduction emission type electron-emitting devices.

If multiline-driven lines include a line having an activation current much larger or smaller than those of the remaining row wirings, the average of the device currents $I_f$ of the simultaneously driven row wirings is influenced by the row wiring having a larger or smaller activation current. As a result, the calculated compensation potential value cannot be optimized.

To solve this problem, in the 13th embodiment, the average activation current $I_{fave}$ is temporarily calculated after the activation current is obtained for respective multiline-driven row wirings. Then, the values MAX and MIN of the activation currents of these multiline-driven row wirings are obtained. Row wirings having corresponding values are extracted to obtain their differences from the average activation current $I_{fave}$ calculated in advance.

The differences between the average activation current $I_{fave}$, and the current values of the row wirings corresponding to the values MAX and MIN that are detected and extracted in step S32 are calculated to check based on the differences whether the extracted row wirings are suitable for target lines for calculating the compensation potential. After this processing, the average activation current $I_{fave}$ for calculating the compensation potential is newly obtained to calculate the compensation potential on the column wiring side.

Figure 59:
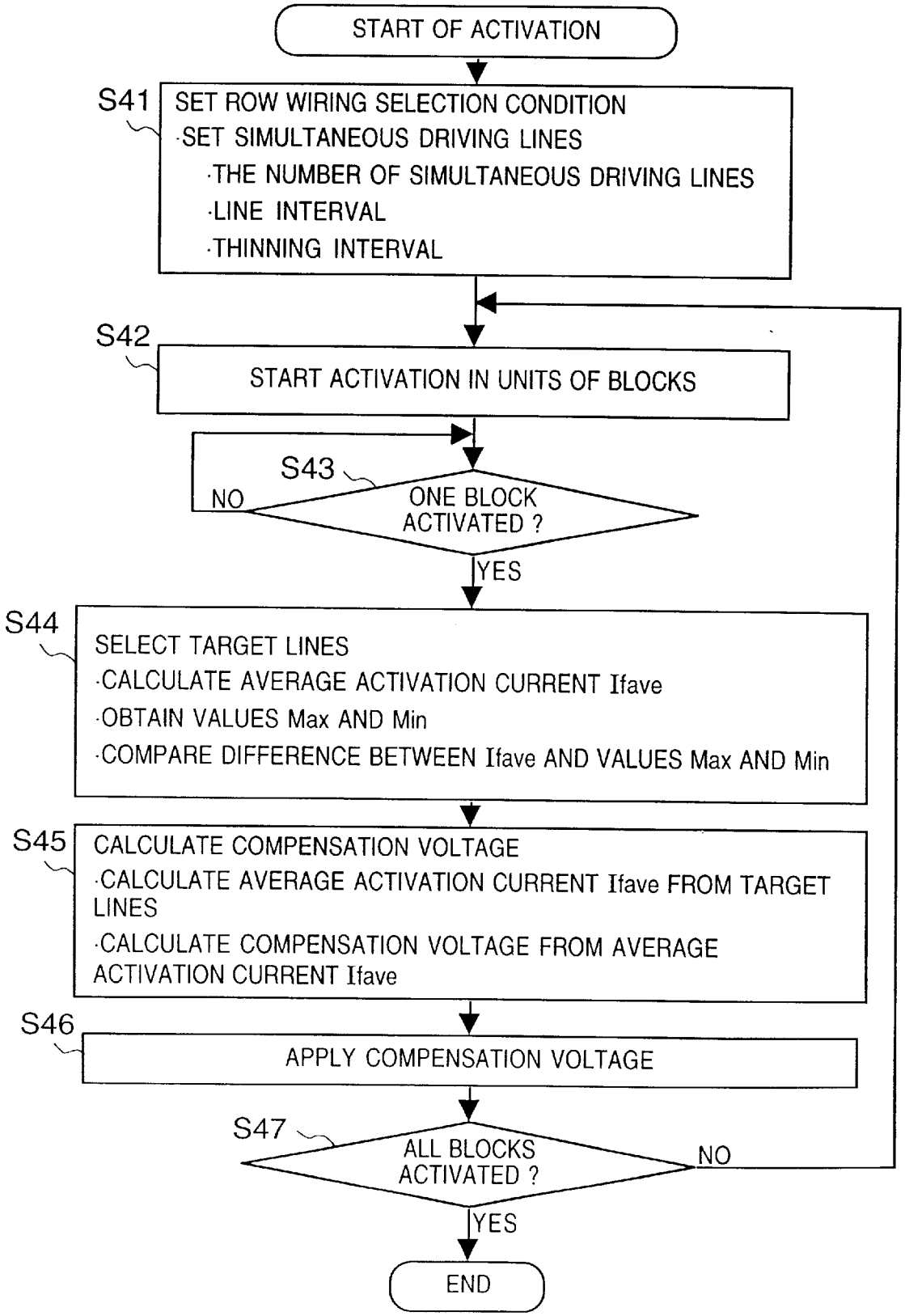
FIG. 59 is a flow chart showing activation processing in the 13th embodiment.

FIG. 59 is a flow chart for realizing activation in the 13th embodiment. Activation will be explained with reference to FIG. 59. For descriptive convenience, the number of row wirings on a surface-conduction emission type electron-emitting device substrate 44101 and multiline driving lines are the same as in the 12th embodiment.

In step S41, when the user inputs an activation start command, a control circuit 44106 sets row wiring selection conditions at the start of activation, similar to the 12th embodiment. This setting includes three settings, i.e., the number of simultaneous driving row wirings in multiline driving, the line interval between driving row wirings, and the thinning interval.

Activation performed in the 13th embodiment also employs a method of sequentially applying the potential to selected row wirings in units of blocks. Similar to the 12th embodiment, the thinning interval is set to 10 wirings. Three row wirings are simultaneously activated in units of blocks each including 3 wirings×10 units=30 wirings. The number of simultaneous driving wirings is optimized in consideration of the power amount supplied to the surface-conduction emission type electron-emitting device substrate 44101 and heat generated in driving in units of blocks.

Also in the 13th embodiment, the driving line interval is set to 160 wirings. Similar to the 12th embodiment, the driving line interval must be uniformly set over the surface-conduction emission type electron-emitting device substrate 44101 in consideration of concentration of the heat distribution by electrification power on the surface-conduction emission type electron-emitting device substrate 44101.

Similar to the 12th embodiment, the thinning interval is set to 10 wirings. Hence, the driving pattern of one block is the same as in the 12th embodiment. Upon completion of these settings, the flow proceeds to step S42.

In step S42, activation of surface-conduction emission type electron-emitting devices starts. To simultaneously drive three row wirings in multiline driving, the control circuit 44106 outputs a driving row wiring setting signal to a timing generation circuit 44105. The timing generation circuit 44105 recognizes driving row wirings, and outputs a line select signal to a line selection circuit 44102.

The line select signal turns on the FET relays of the predetermined row wirings to connect the row wirings to a power source 44104, thereby driving the selected row wirings. After activation starts in units of blocks, a current detection circuit 44103 detects the activation currents of the driven row wirings to store the current values in a memory 44111.

In step S43, it is checked whether activation of one block (30 wirings in the 13th embodiment) and detection of the activation current are completed. If YES in step S43, the flow shifts to step S44.

In step S44, the compensation potential is calculated. For this purpose. the control circuit 44106 selects a target line for calculating the compensation potential from multiline-driven row wirings.

As shown in FIG. 56, the average $I_{fave1}$ of the activation currents of row wirings $D_{x1}$, $D_{x161}$, and $D_{x321}$ is calculated from the activation current values stored in the memory 44111. The values MAX and MIN of the activation current values of these row wirings are detected. The current values to be detected are the latest values updated upon measurement. Since the 13th embodiment multiline-drives three row wirings, two of them are selected as the values MAX and MIN.

The following calculation is done for the selected values MAX and MIN on the basis of the average activation current $I_{fave1}$ calculated in advance:

$$\text{Value MAX}-I_{fave1}=\Delta I_{fa}$$

$$I_{fave1}-\text{Value MIN}=\Delta I_{fb}$$

Whether a row wiring having the extracted value MAX and a row wiring having the extracted value MIN correspond to target lines for calculating the compensation potential is checked from $\Delta I_{fa}$ and $\Delta I_{fb}$ obtained by this calculation. In this determination, $\Delta I_{fa}$ and $\Delta I_{fb}$ are compared with a predetermined allowable value in order to check whether characteristics are greatly different during multiline driving.

In the 13th embodiment, a current value serving as the allowable value is set to, e.g., 1 A, and a row wiring having a current difference of 1 A or more from the average activation current $I_{fave1}$ is excluded from target lines. By this procedure, variations in compensation potential by the above-described variations can be reduced. The 13th embodiment is effective for a relatively large number of multiline-driven lines, whereas the procedure described in the 12th embodiment is suitable for multiline driving of, e.g., two lines.

In the 13th embodiment, the number of lines to be multiline-driven is three. When the number of simultaneous driving lines is increased, if the current values of row wirings except for ones corresponding to the values MAX and MIN are equal to or more than the allowable value, Variations in compensation potential value can also be reduced for these row wirings by the following procedure.

Target lines for calculating the compensation potential are checked. For example, if a row wiring corresponding to the value MAX is excluded from target lines because an activation current value is equal to or more than the allowable value, a row wiring which flows the second largest activation current to the row wiring corresponding to the value MAX is extracted to check whether the current value of the activation current flowing through this row wiring is equal to or more than the allowable value.

If the current value is less than the allowable value, the row line is set as a target line. If the current value is equal to or more than the allowable line, a row wiring which flows the third largest activation current to the row wiring is selected to perform this determination. Determination for the value MIN is also similarly performed.

By repetitively executing this procedure, a target line can be selected even for a large number of simultaneous driving row wirings, similarly to a small number of simultaneous driving row wirings.

In step S45, the average activation current $I_{fave}$ for calculating the compensation potential is obtained upon completion of the above processing, and the compensation potential to be applied to the column wiring is calculated from the average activation current $I_{fave}$. Sampling setting of current detection is done for the average activation current $I_{fave}$ during activation to detect the currents of multiline-driven row wirings every predetermined time, and the latest average activation current $I_{fave}$ is stored in the memory 44111.

Then, the compensation potential on the column wiring side is calculated from the obtained average activation current $I_{fave}$. The compensation potential can be calculated using equation (5) described in the 12th embodiment. The wiring resistance r is stored in the memory 44111 by measuring the wiring resistance of each row wiring in advance. The compensation potential value is also updated every update of the average activation current $I_{fave}$, and if necessary, can also be stored in the memory 44111.

In step S46, it is checked whether activation processing progresses to complete activation of the multiline-driven lines. If NO in step S46, the flow returns to step S42 to perform activation in units of block again.

Similar to the 12th embodiment, activation ends when the activation current of each surface-conduction emission type electron-emitting device reaches a predetermined value while detecting the activation current, or by defining the end time from the start of activation. To complete activation when the current value of each surface-conduction emission type electron-emitting device reaches a predetermined value, the progress of activation must be grasped in units of row wirings by the control circuit 44106 or the like. If activation is controlled by the activation time, the activation time must be set to unify activation. In the 13th embodiment, activation is completed under the latter condition.

14th Embodiment

Figure 60:
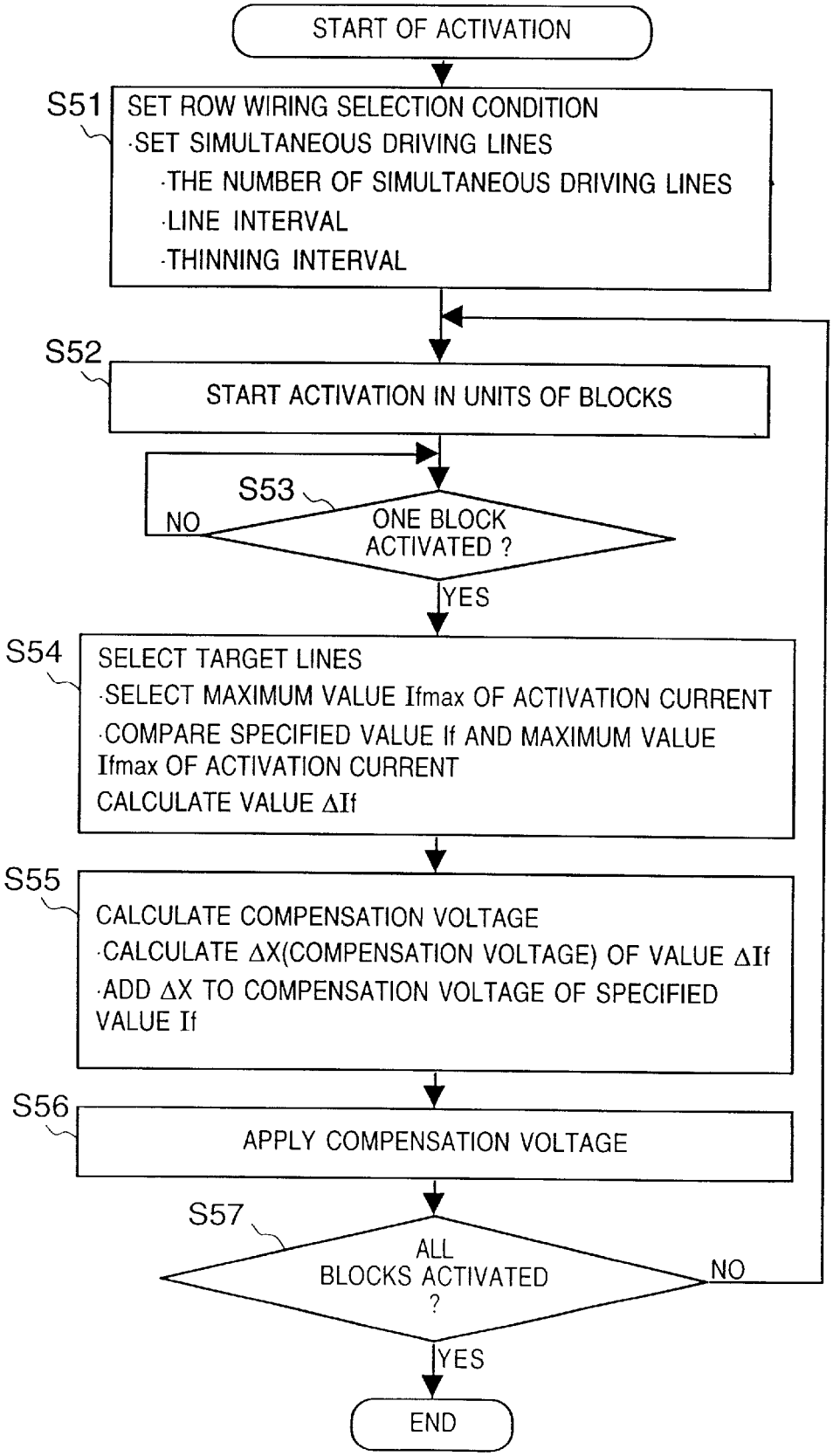
FIG. 60 is a flow chart showing activation processing in the 14th embodiment.

FIG. 60 is a flow chart for realizing activation in the 14th embodiment. In the 14th embodiment, the apparatus and driving circuit in activation processing and the structure of the surface-conduction emission type electron-emitting device substrate are the same as in the 12th embodiment.

In the 14th embodiment, the minimum value of the activation voltage applied to respective surface-conduction emission type electron-emitting devices is compensated for. That is, an activation potential equal to or higher than a predetermined minimum activation potential value is applied to surface-conduction emission type electron-emitting devices on all multiline-driven row wirings.

On a row wiring exhibiting the largest potential drop, since the potential drop is maximized at the center of the row wiring, the voltage value actually applied to surface-conduction emission type electron-emitting devices is low. Since the compensation potential is calculated from a plurality of average activation currents $I_f$, an activation voltage lower than an activation voltage which should be originally applied is applied to surface-conduction emission type electron-emitting devices on the row wiring exhibiting the largest potential drop.

For this reason, an activation voltage equal to or higher than the minimum activation voltage value is applied to surface-conduction emission type electron-emitting devices on all multiline-driven row wirings.

More specifically, a row wiring exhibiting the largest potential drop caused by the activation current $I_f$ flowing through the surface-conduction emission type electron-emitting device and the row wiring resistance is selected in activation processing, and the difference ($\Delta I_f$) of the device current $I_f$ of the row wiring from a predetermined threshold is calculated.

That is, $\Delta I_f$ is calculated when a row wiring having the largest activation current out of multiline-driven row wirings exceeds a predetermined threshold current. From $\Delta I_f$, the minimum value of an activation voltage to be compensated for is calculated.

The compensation potential value $\Delta X$ on the column wiring side is obtained from the calculated $\Delta I_f$, and added to the compensation potential of a line exhibiting the largest potential drop, thereby ensuring the activation voltage applied to surface-conduction emission type electron-emitting devices on the row wiring as the minimum activation voltage. In this way, an activation voltage equal to or higher than the minimum activation voltage value is applied to surface-conduction emission type electron-emitting devices.

When row wirings are driven one by one in processing steps subsequent to the activation step, a device voltage equal to or higher than the activation voltage maybe applied to surface-conduction emission type electron-emitting devices activated by a low activation voltage like the above-described one. In this case, no device characteristics are guaranteed by the activation step, resulting in a panel varying in characteristics between row wirings or surface-conduction emission type electron-emitting devices.

To solve this problem. in the 14th embodiment, a row wiring corresponding to the value MAX of multiline-driven row wirings is selected, and the compensation potential on the column wiring side is determined to compensate for the minimum activation voltage using the selected row wiring as a reference.

This will be explained with reference to the flow chart in FIG. 60.

In step S51, row wiring selection conditions are set similarly to the 12th embodiment. When the user inputs an activation start command, a control circuit 44106 starts activation. First, the control circuit 44106 sets simultaneous driving row wirings at the start of activation. This setting includes setting of the number of simultaneous driving wirings in multiline driving, setting of the line interval between driving row wirings, and setting of the thinning interval.

Activation performed in the 14th embodiment also employs a method of sequentially applying the potential to row wirings in units of blocks. Similar to the 12th embodiment, the thinning interval is set to 10 wirings, and three row wirings are simultaneously activated in units of blocks each including 3 wirings×10 units=30 wirings. The number of simultaneous driving wirings is optimized in consideration of the power amount supplied to a surface-conduction emission type electron-emitting device substrate 44101 and heat generated in driving in units of blocks.

Also in the 14th embodiment, the driving line interval is set to 160 wirings. Similar to the 12th embodiment, the driving line interval must be uniformly designated over the surface-conduction emission type electron-emitting device substrate 44101 in consideration of concentration of the heat distribution by electrification power on the surface-conduction emission type electron-emitting device substrate 44101.

Similar to the 12th embodiment, the thinning interval is set to 10 wirings. Hence, the driving pattern of one block is the same as in the 12th embodiment. Upon completion of these settings, the flow shifts to step S52.

In step S52, activation of surface-conduction emission type electron-emitting devices starts. To simultaneously drive three row wirings in multiline driving, the control circuit 44106 outputs a driving row wiring setting signal to a timing generation circuit 44105. The timing generation circuit 44105 recognizes driving row wirings, and outputs a line select signal to a line selection circuit 44102.

The line select signal turns on the FET relays of the predetermined row wirings to connect the row wirings to a power source 44104. After activation starts, a current detection circuit 44103 detects the activation currents of the driven row wirings to store the current values in a memory 44111.

In step S53, it is checked whether driving of one block (30 wirings in the 14th embodiment) and detection of the activation current are completed. If YES in step S53, the flow proceeds to step S54.

In step S54, target lines are selected from the multiline-driven row wirings in order to ensure the minimum activation voltage. In FIG. 56, activation currents $I_{f1}$, $I_{fa61}$ and $I_{f132}$ are obtained for row wirings $D_{x1}$, $D_{x161}$, and $D_{x321}$ and stored in the memory 44111.

Then, the value MAX is detected from the activation current values stored in the memory 44111. The current values to be detected are the latest values updated upon measurement.

As shown in FIG. 56, $I_{fmax}$ for simultaneously activating three row wirings selects the row wiring $D_{x1}$. The device current $I_f$ of the selected row wiring $D_{x1}$ is compared with a specified value for compensating for the activation potential.

This specified value is a line current criterion value for checking whether the application voltage value is compensated for the minimum activation voltage or more when the activation voltage to the device decreases owing to the potential drop of the wiring resistance by $I_{fmax}$. Therefore, the minimum activation potential is set lower than the activation potential applied when a potential drop occurs due to the wiring resistance and individual device current of the row wiring.

More specifically, assuming that Va is the minimum activation voltage, and the difference Eac−Va=ΔVd upon application of the activation voltage Eac is the maximum voltage drop value, the individual device current $I_{fn}$ is given by $$\Delta Vd = \tfrac{1}{2} \times n \times (n+1) \times rn \times I_{fn} \quad (6)$$

(where rn is the wiring resistance value between devices, $I_{fn}$ is the individual device current, and n is the number of devices)

$I_{fm \times n}$ (individual current×the number of devices) is to calculated and determined as a specified value serving as to a line current criterion value.

If $\Delta I_f>0$ for $I_{fmax}$–specified value $I_f=\Delta I_f$, surface-conduction emission type electron-emitting devices on the row wiring $D_{x1}$ are determined not to reach the minimum activation voltage owing to a voltage drop or the like. If $\Delta I_f>0$, at least the minimum activation voltage is determined to be applied.

In the 14th embodiment, since activation currents flowing through respective row wirings are sequentially detected by the current detection circuit 44103 during the activation step, the minimum activation voltage Va is changed every detection period to change the specified value in accordance with the progress of activation. In particular, since almost no activation current flows at an initial activation value (FIG. 41), the influence of voltage attenuation by a potential drop can be substantially ignored, and the minimum activation voltage Va becomes almost equal to the activation voltage Eac/2.

In setting the specified value, the factor of the potential drop is considered as a change in device current, and the wiring resistance values of respective row wirings within the panel are desirably the same. Since the potential drop of the row wiring is determined by equation (6), $I_{fn}$ is dominant in the potential drop so long as respective row wirings have the same rn.

If the wiring resistance values vary between row wirings, the specified value must be individually set every multiline driving. In this case, the wiring resistance value is set in the memory 44111 in advance for each multiline-driving row wiring. The wiring resistance value of a row wiring having the activation current $I_{fmax}$ that is selected in multiline driving is read out from the memory 44111 to determine the specified value using the readout value.

In step S54, it is checked whether the value $\Delta I_f$ is calculated and the minimum activation voltage is ensured from the value $\Delta I_f$.

In step S55, the compensation potential is calculated. The compensation potential value changes depending on the determination result of $\Delta I_f$ in step S54. For $\Delta I_f>0$, no minimum voltage is determined to be applied. Thus, the compensation voltage $\Delta X$ for $\Delta I_f$ is calculated. $\Delta X$ is calculated by the same method as in the 12th embodiment.

Then, the compensation potential for a predetermined specified value is calculated. The compensation potential for the specified value may be calculated in advance. In this case, the compensation potential value is stored in the memory 44111.

The calculated compensation voltage $\Delta X$ is added to the compensation potential for the specified value. The compensation potential obtained by this processing can set the application potential from the column wiring side for ensuring the minimum activation voltage for the line of the activation current $I_{fmax}$ in multiline driving.

The remaining row wirings ($D_{x161}$ and $D_{x321}$ shown in FIG. 56) flow smaller activation currents than the row wiring $D_{x1}$. By applying the obtained compensation potential, a voltage equal to or higher than the minimum activation voltage is applied to these row wirings with a sufficient voltage value.

For $\Delta I_f>0$, at least a potential necessary for the minimum activation voltage is determined to be applied to the line of the activation current $I_{fmax}$. Thus, no processing for $\Delta I_f>0$ is required. The compensation potential on the column wiring side may be calculated by obtaining the average device current of multiline-driven row wirings.

Also in this case, the compensation voltage value determined by the average device current can ensure a satisfactory activation voltage for the $I_{fmax}$ line.

In step S56, the compensation potential value calculated every multiline driving in step S55 is sequentially applied to column wirings by a pixel electrode driving circuit 44108 and buffer amplifier 44107. Since the 14th embodiment performs multiline driving in units of blocks, the number of lines in one activation processing is 30.

In activation processing, setting for one processing unit is not limited to one block, and a plurality of blocks may be set in advance.

In step S57, it is checked whether activation processing progresses to complete activation of the multiline-driven lines. If NO in step S57, the flow returns to step S52 to perform activation in units of blocks again.

Activation ends when the activation current of each surface-conduction emission type electron-emitting device reaches a predetermined value while detecting the activation current, or by defining the end time from the start of activation. To complete activation when the current value of each surface-conduction emission type electron-emitting device reaches a predetermined value, the progress of activation must be grasped in units of row wirings by the control circuit 44106 or the like. If activation is controlled by the activation time, the activation time must be set to unify activation. In the 14th embodiment as well as the 12th embodiment, activation is completed by setting the activation time.

As described above, by performing the activation step described in the 14th embodiment, the minimum activation voltage can be applied to all surface-conduction emission type electron-emitting devices to ensure the voltage of a specified value. Consequently, a panel in which characteristics are relatively compensated for by suppressing changes in characteristics of the surface-conduction emission type electron-emitting devices by the to compensation voltage applied in the driving step subsequent to the activation step can be formed.

Also in the 14th embodiment, three row wirings are multiline-driven. However, the number of simultaneous driving row wirings is not limited to this, and can be increased in consideration of heat generated within the surface-conduction emission type electron-emitting device substrate 44101 in order to further shorten the activation time.

Although the power source 44104 applies a positive output similarly to the 12th embodiment, the application potential may be negative. In this case, the direction of current flowing through the column wiring is also inverted, so that the polarity of the compensation potential from the buffer amplifier 44107 is also inverted.

In addition, the pixel electrode driving circuit 44108 comprises D/A converters equal in number to the number of column wirings. However, since the compensation potential distribution changes gradually, as shown in FIG. 57, the number of D/A converters may be decreased to divide and define the application potential by the resistance or the like.

According to the 14th embodiment, a plurality of electron-emitting devices are arranged in a matrix, and a plurality of predetermined row wirings are selected from a plurality of row wirings. The current values of activation currents flowing through the selected row wirings are detected in units of row wirings. The potential value of a compensation potential to be applied to a plurality of column wirings is calculated from the current values of the activation currents and the resistance values of the respective row wirings. Then, the calculated potential value is applied.

In the electron-emitting device activation step, the voltage applied to electron-emitting devices can be unified by the influence of a potential drop by the wiring resistance and activation current of the row wiring. As a result, electron-emitting devices having uniform electron-emitting device characteristics can be provided.

15th Embodiment

Figure 61:
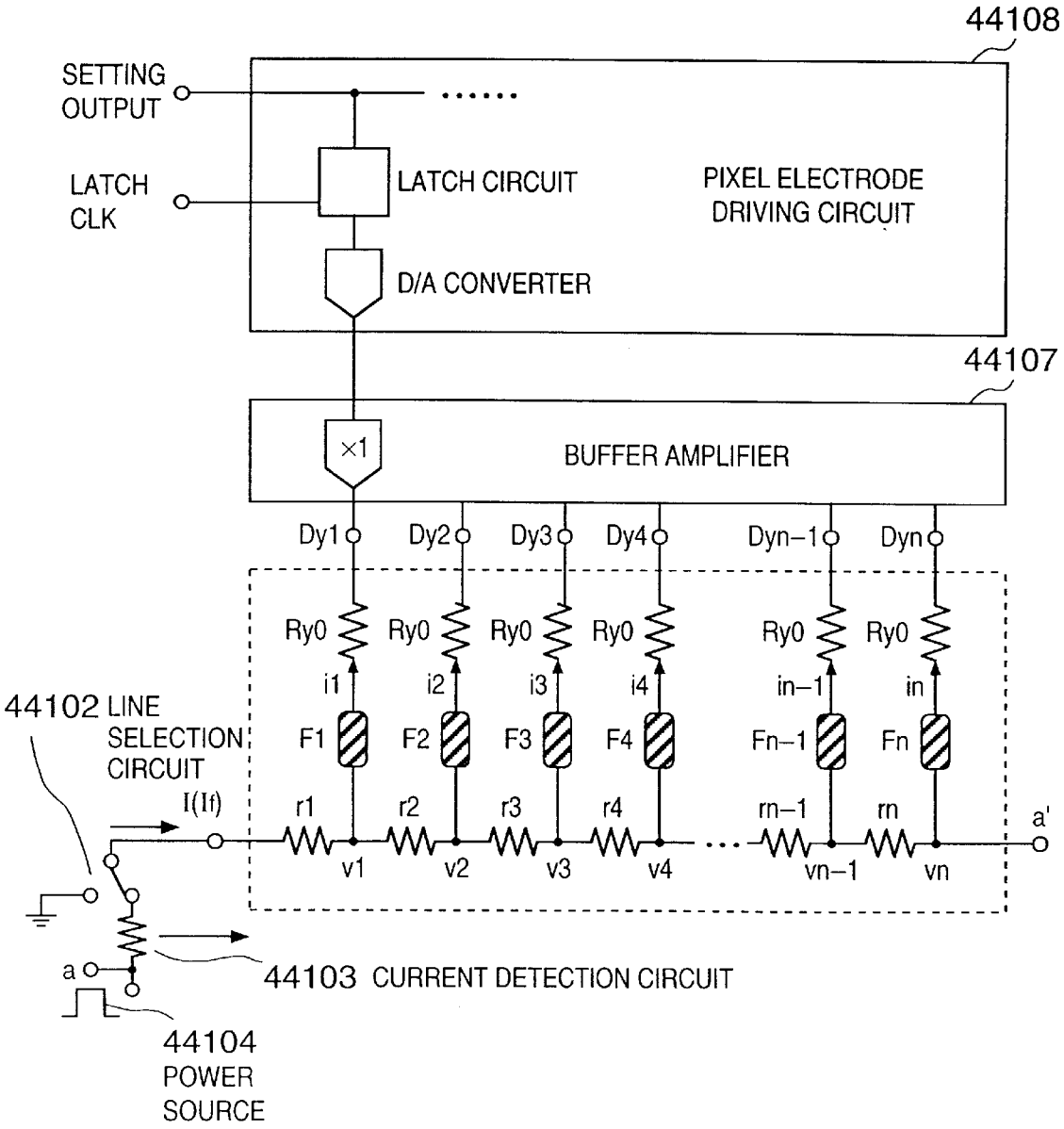
FIG. 61 is a block diagram showing the internal arrangement of an electrification apparatus in the 15th embodiment.

In the 15th embodiment, the whole electrification apparatus has the same arrangement as in the ninth and 12th embodiments except that the positions of a line selection circuit 44102 and current detection circuit 44103 are replaced with each other, as shown in FIG. 61 corresponding to FIG. 47.

In addition, the 15th embodiment employs an arrangement of applying the potential to the row wiring from its two sides.

A method of setting the compensation potential output from a pixel electrode driving circuit 44108 in the 15th embodiment will be explained.

In activation, the electrical characteristics of the device change as shown in FIG. 41. That is, the device current does not substantially flow at the start of activation, starts flowing with the lapse of electrification time, and saturates. At this time, the terminal potentials of surface-conduction emission type electron-emitting devices on the row wiring $D_{x1}$ are monitored to find changes in potentials $v_1$ to $v_n$ under the influence of the wiring resistances r1 to rn, as shown in FIG. 61. The potentials more greatly change with the progress of activation.

For example, for an activation current of 2 mA/device, r1 to rn=10 mΩ, and n=1000, when power is supplied from a power source 44104 from only one side ($F_1$ side), a potential drop of 10 V at maximum:

$$\Delta V = \tfrac{1}{2} \times 1000 \times 1001 \times 2\ \text{mA} \times 10\ \text{m}\Omega \tag{7}$$

occurs at the terminal $v_n$ of the surface-conduction emission type electron-emitting device $F_n$ farthest from the feeding terminal.

To prevent this, the pixel electrode driving circuit 44108 generates a potential distribution identical to this potential distribution to apply the voltage to the terminals $D_{y1}$ to $D_{yn}$ via a buffer amplifier 44107 so as to cancel the potential distribution generated at respective surface-conduction emission type electron-emitting devices.

More specifically, a control circuit 44106 calculates a potential drop distribution generated at the terminals $v_1$ to $v_n$ by currents flowing through the surface-conduction emission type electron-emitting devices $F_1$ to $F_n$ and the wiring resistances r1 to rn along with the progress of activation. The output value of the D/A converter of the pixel electrode driving circuit 44108 is set to realize setting of the compensation potential for the potential drop on the column wiring side.

Figure 70:
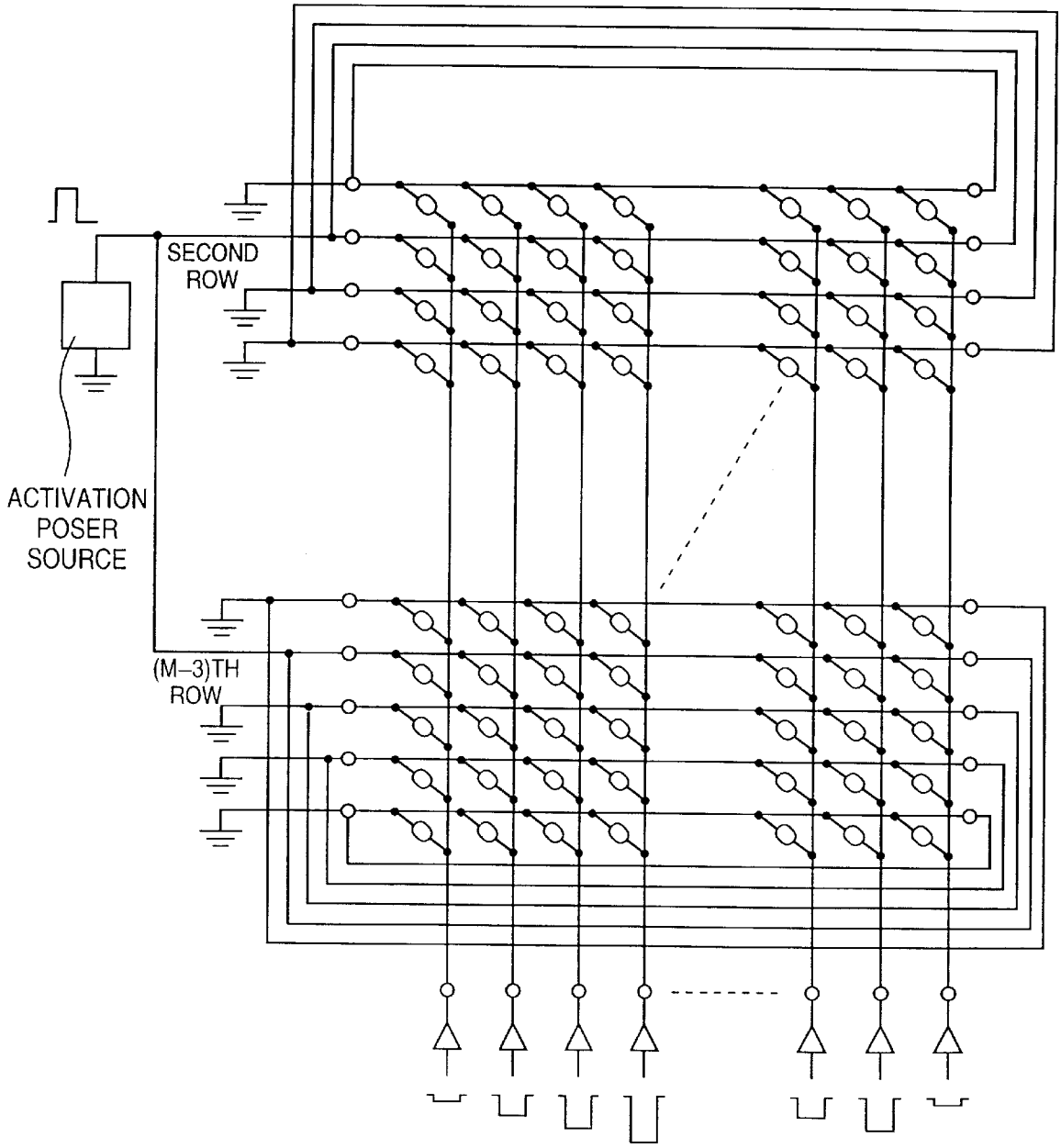
FIG. 70 is a circuit diagram showing the state of applying the activation voltage while simultaneously compensating for the potentials of two lines from the column wiring.

The 15th embodiment adopts a method (to be referred to multiline driving) of simultaneously driving a plurality of row wirings. The activation potential is applied to the row wiring from the two sides of the wiring for $F_1$ to $F_n$, as shown in FIG. 70. When a predetermined potential is applied from the power source 44104 to the two sides of a row wiring selected by the line selection circuit 44102, the activation current $I_f$ flows through an arbitrary row wiring. As shown in FIG. 41, the current $I_f$ does not flow in the initial state of activation, and gradually increases with the progress of activation.

As a method of calculating the compensation potential on the column wiring side, the 15th embodiment employs a method of calculating the average activation current $I_{fave}$ of multiline-driven row wirings and calculating a corresponding compensation potential on the column wiring side, or a method of giving attention to a specific one of multiline-driven row wirings and calculating the compensation potential on the column wiring side using the average activation current $I_{fave}$ of the target row, The average activation current $I_{fave}$ is calculated by the control circuit 44106 by sequentially detecting the current values of multiline-driven lines, and inputting the detected current values as activation currents 44109 from the current detection circuit 44103 to the control circuit 44106. The compensation potential is calculated from the calculated average activation current $I_{fave}$.

In the 15th embodiment, since the activation potential is applied to the row wiring from its two sides, a potential drop by the wiring resistance is maximized around the center. In applying the potential from the two sides of the row wiring, the power source 44104 shown in FIG. 61 is connected between a and a'.

By applying the compensation potential calculated by the above calculation method, the compensation potential output using the average activation current $I_{fave}$ is obtained as follows. Letting $i_{ave}$ be the average of a device current flowing through one electron-emitting device, $$D_{yn} = \tfrac{1}{2} \times rn \times n \times (n+1) \times i_{ave} \tag{8}$$

n=$F_1$ to $F_{n/2}$

Note that $F_{n/2}$ and subsequent pixel numbers are n=$F_{n-n'}$(n' is calculated as a pixel number from $F_{n/2}$ up to $F_n$).

By this calculation method, the compensation potential on the column wiring side is determined on the basis of the average device current $I_{fave}$ of activation current values flowing through multiline-driven row wirings. The compensation potential is output from the pixel electrode. driving circuit 44108 to the terminals of the column wirings $D_{y1}$ to $D_{yn}$ via the buffer amplifier 44107. Setting of the compensation potential is continuously performed till the end of activation processing.

Activation ends when the average device current $I_f$ of each device reaches a predetermined value (for example, each device reaches 2 mA) from the activation current of each multiline-driven row wiring, or by controlling the time after the activation current flows to a certain degree. The basic compensation potential application method in multiline driving has been described.

In the 15th embodiment, a plurality of multiline-driving row wirings are selected from the row wirings $D_{x1}$ to $D_{xm}$, and sequentially driven as one unit.

Figure 62:
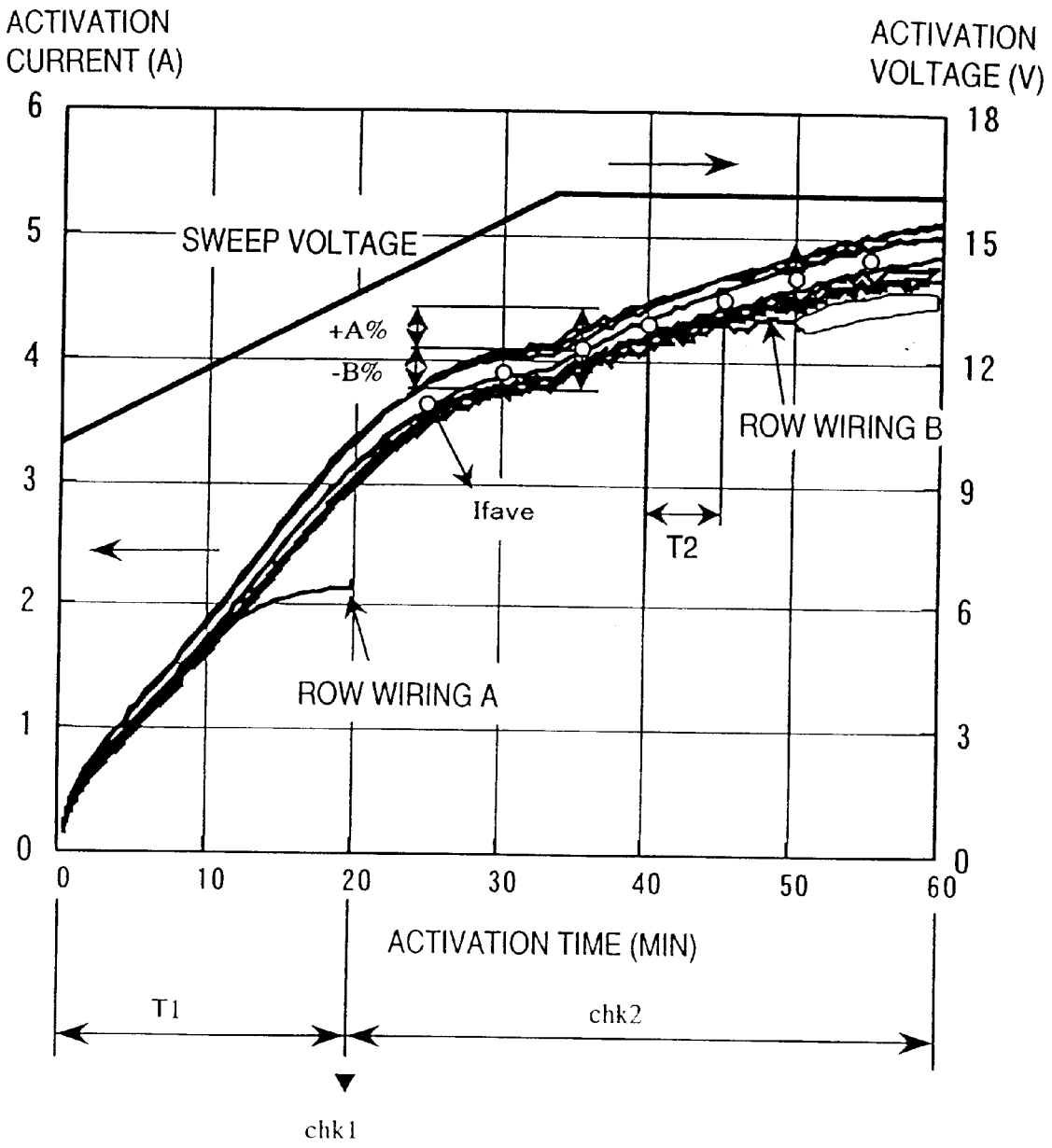
FIG. 62 is a graph showing the activation current in the 15th embodiment.

FIG. 62 is a graph showing a change in activation current with respect to the activation time of a plurality of multiline-driven row wirings as one unit.

Of all row wirings multiline-driven during the activation step, driving of a row wiring A having a greatly different activation current from those of the remaining multiline-driven row wirings in FIG. 62 is stopped (chk1).

At a time interval of 25 min to 5 min (T2), the average of the activation current value is calculated to specify a row wiring subjected to driving stop out of a plurality of multiline-driven row wirings (chk2).

The activation voltage is set to rise from about 10 V to 16 V. The activation voltage is set to rise to 16 V about 30 min after the start of activation, and to keep a constant value.

Whether the row wiring meets conditions during the activation step is determined by executing a check (chk1) T1=20 min after the start of activation. chk1 means to specify a row wiring having a greatly different activation current from those of the remaining multiline-driven row wirings and to stop driving the specified row wiring. chk1 is done to exclude degraded surface-conduction emission type electron-emitting devices and the like from the activation step in advance.

More specifically, the activation current values and average of all the multiline-driven row wirings $D_{x1}$ to $D_{xm}$ are obtained. Driving of a row wiring whose activation current value is different from the average by a predetermined threshold or more is stopped.

In the activation step performed in the 15th embodiment, the compensation potential is calculated from the current value of the average device current $I_{fave}$ of multiline-driven row wirings. The current value of the average device current $I_{fave}$ desirably falls within a predetermined range. In chk1, if a given row wiring has a greatly different current value of the activation current from the current values of the activation currents flowing through the remaining row wirings, the current value of the activation current flowing through the given row wiring is not used to calculate the average.

The time T1 is desirably set when activation progresses to a certain degree. In the 15th embodiment, the time T1 is determined in consideration of a time required for the activation current to reach about several A on each line with an activation time of 60 min and a voltage rise ratio. Therefore, the time T1 is not particularly limited.

Figure 63:
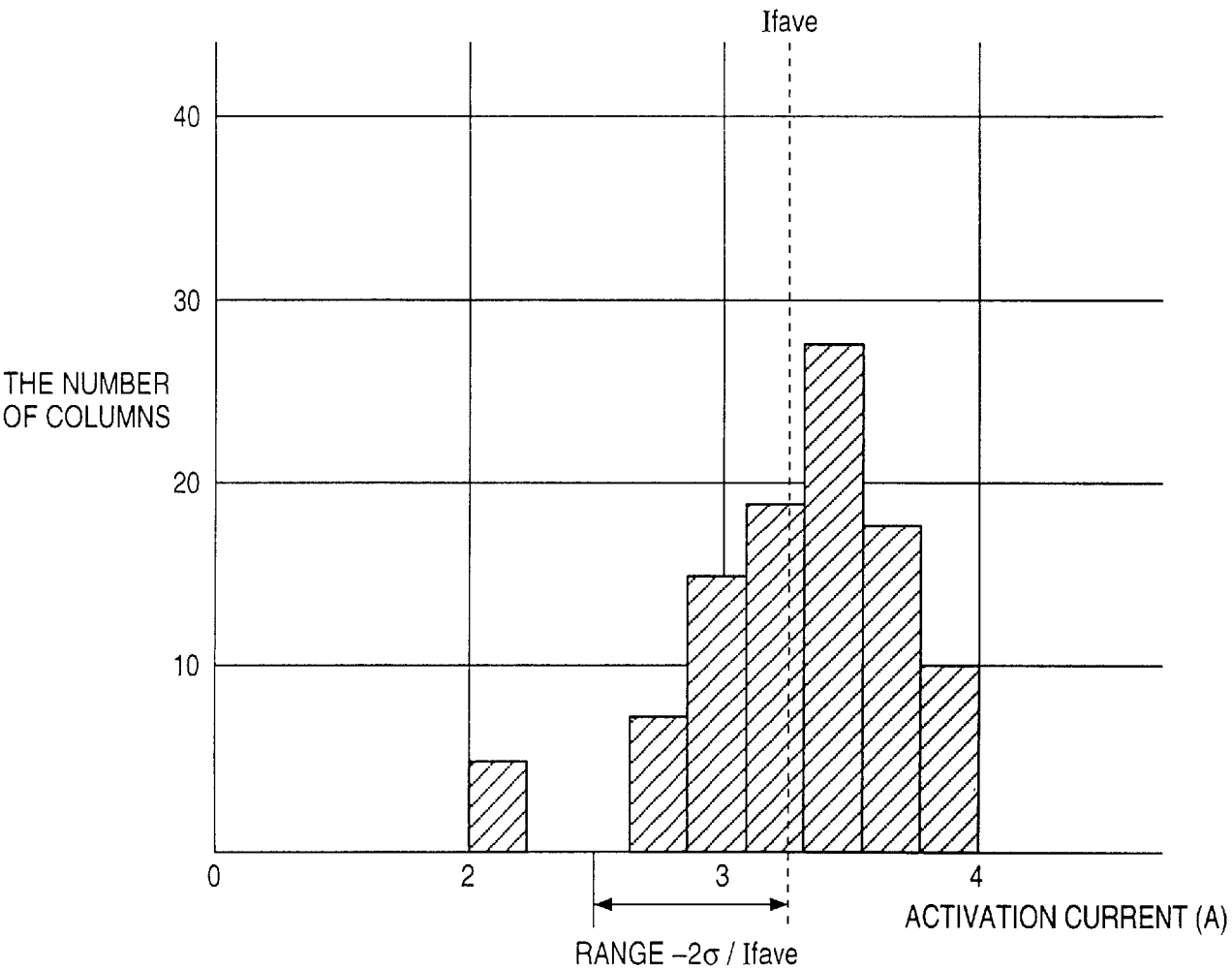
FIG. 63 is a histogram showing the activation current in the 15th embodiment.

FIG. 63 is a histogram showing the activation currents of all the multiline-driving row wirings $D_{x1}$ to $D_{xm}$. The total number of row wirings is 100.

The activation current values, average, and standard deviation of all the multiline-driven row wirings $D_{x1}$ to $D_{xm}$ are calculated. In chk1, driving of a row wiring which does not meet the following condition is stopped. The condition is to stop driving a row wiring which flows a current value falling outside the range double the reference value $\sigma/I_{fave}$ calculated from the average current value $I_{fave}$ and standard deviation $\sigma$ of the activation currents flowing through all the multiline-driven row wirings $D_{x1}$ to $D_{xm}$.

Since the stop condition is based on the reference value $\sigma/I_{fave}$, the reference is set for a row wiring whose driving is to be stopped, every surface-conduction emission type electron-emitting device substrate. The stop condition range is set double the reference value in order to roughly exclude degraded surface-conduction emission type electron-emitting devices.

From histogram data shown in FIG. 63, the average activation current $I_{fave}$ is 3.54 A, the standard deviation is 1.48, and the reference value is 0.42. Accordingly, an activation current value corresponding to the stop condition in chk1 is 0.42×2=0.84 A. A row wiring having an activation current of 2.7 A or less or 4.38 A or more, which falls outside the range of ±0.84 A for the average activation current value $I_{ave}$ is defined as a driving stop line.

From the histogram in FIG. 63, there are lines which fall outside the range of $-2\times\sigma/I_{fave}$. From FIG. 62, of multiline-driven lines, the row wiring A has $I_f$=2.2 A which exceeds the threshold of the range calculated in chk1, and thus is defined as a driving stop line.

Upon completion of chk1, chk2 is executed. chk2 is done to further match the average current value of the activation current after activation progresses to a certain degree. chk2 can further optimize the compensation potential value applied to the column wiring. In chk2, before the activation step ends after the execution time T1, the current allowable values of the upper and lower limits are set for the average activation current $I_{fave}$ of multiline-driven row wirings, and a row wiring falling outside the range is defined as a driving stop line.

More specifically, as shown in FIG. 62, the current value of the average activation current $I_{fave}$ of multiline-driven row wirings is calculated every execution time T2. The calculated values are represented by ○. The potential applied to a plurality of row wirings selected for multiline driving has a waveform with a pulse width of 1 msec and a duty of 10%.

The threshold is set to, e.g., ±10% for the average activation current $I_{fave}$. If there is a row wiring having an activation current exceeding the range of ±10% as the threshold from the average activation current $I_{fave}$ calculated by multiline driving every 5 min (T2), driving of the row wiring is immediately stopped. For example, at an activation time of 50 min, an activation current flowing through a row wiring B is smaller than an average activation current $I_{fave}$ of −10%, and thus driving of the row wiring B is immediately stopped.

If the threshold is set low, activation currents flowing through row wirings can be unified, but the number of row wirings subjected to driving stop increases. In the 15th embodiment, since the threshold is set to ±10%, variations in compensation potential value do not greatly influence variations in activation current.

In the 15th embodiment, the execution time T2 is set to 5 min. However, the execution time is not limited to T2, and suffices to be longer than the application cycle of the compensation potential. The application timing of the compensation potential can be set separately from the execution time T2. The current values of a plurality of multiline-driven row wirings and the current value of the average activation current $I_{fave}$ are obtained to set the application cycle of the compensation potential in units of several sec.

In the 15th embodiment, the activation time is set to 60 min. For an activation time of 60 min, the activation current is about 5 A. The activation step may be completed when the activation current reaches a desired current value without setting any activation time. In this case, the activation time changes for each row wiring. The activation method of the 15th embodiment has been explained with reference to FIGS. 62 and 63.

The execution time T1 and threshold are set in the control circuit 44106 in advance before multiline driving. An activation current flowing through each multiline-driven row wiring is output from the control circuit 44106 to a memory 44111.

Figure 64:
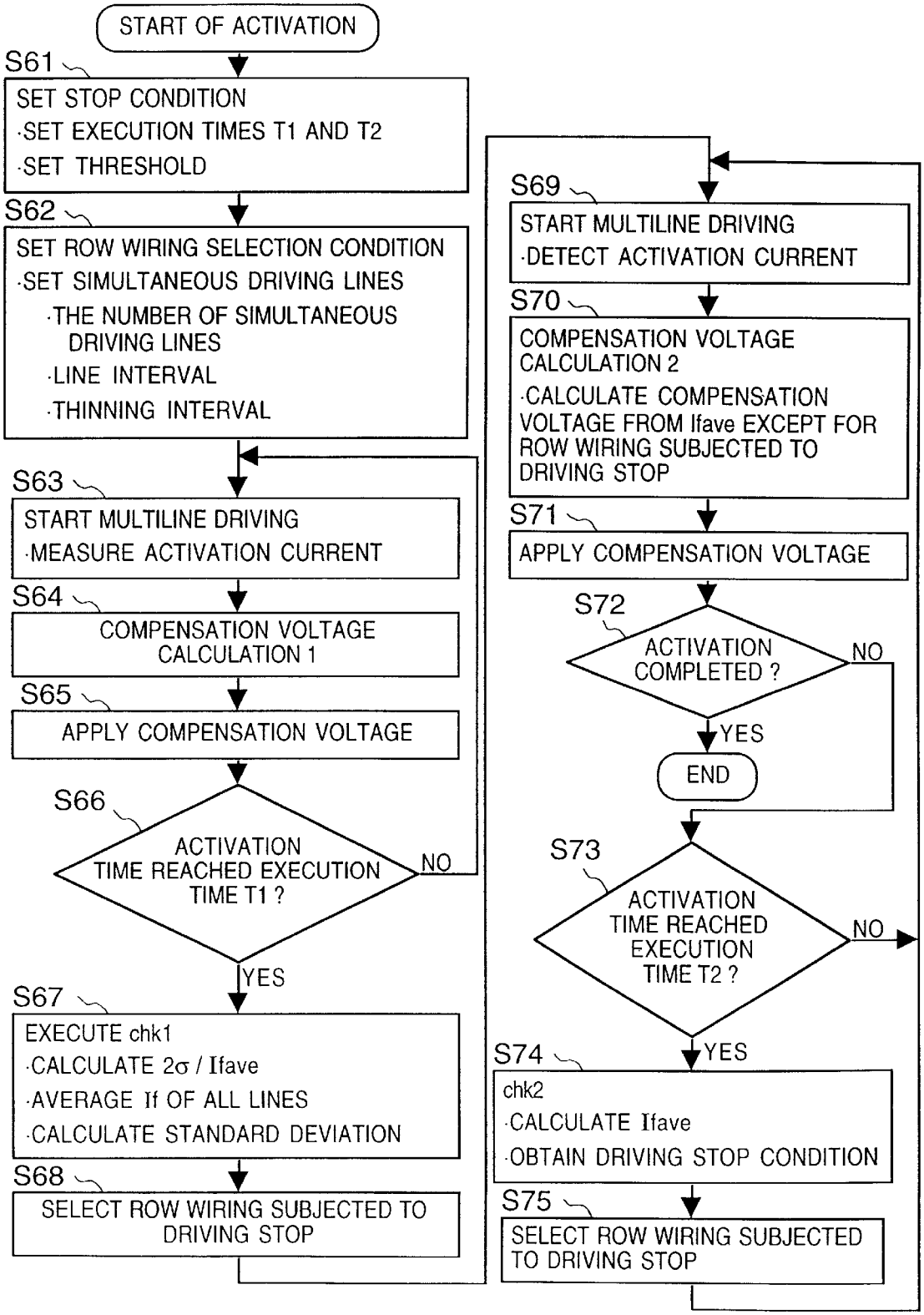
FIG. 64 is a flow chart showing the activation step in the 15th embodiment.

FIG. 64 is a flow chart showing the procedure of the activation step in the 15th embodiment. The procedure of the activation step in the 15th embodiment will be described with reference to FIG. 64.

In step S61, when the user inputs an activation start command, the control circuit 44106 starts activation. The control circuit 44106 sets conditions for specifying a row wiring subjected to driving stop out of a plurality of multiline-driven row wirings. As described above, the stop conditions are the execution time T1 and threshold in chk1 and the execution time T2 in chk2.

In step S62, the control circuit 44106 sets selection conditions of simultaneous driving row wirings. This setting includes three settings, i.e., the number of simultaneous driving row wirings in multiline driving, the line interval between driving row wirings, and the thinning interval. In multiline driving in the 15th embodiment, a plurality of selected row wirings are grouped as one unit, and the potential is sequentially applied for respective units.

As described above, in the 15th embodiment, the thinning interval is set to 10 wirings. The number of simultaneous driving row wirings is optimized in consideration of the power amount supplied to a surface-conduction emission type electron-emitting device substrate 44101 and heat generated upon electrification in driving for each unit.

In the 15th embodiment, the line interval is desirably set to uniformly divide the number of multiline-driven row wirings for all the row wirings $D_{x1}$ to $D_{xm}$, thereby unifying to heat generated upon electrification within the substrate.

In step S63, surface-conduction emission type electron-emitting devices are activated. To perform multiline driving, the control circuit 44106 sets a setting signal for setting the row wiring selection conditions in step S62 in a timing generation circuit 44105. The timing generation circuit 44105 recognizes driving row wirings, and outputs a line select signal to the line selection circuit 44102.

The line select signal turns on the FET relays of the predetermined row wirings to connect the row wirings to the power source 44104, thereby driving the selected row wirings. After activation starts in units of blocks, the current detection circuit 44103 detects the activation currents of the driven row wirings to store the current values in the memory 44111.

Instep S64, the compensation potential is calculated. The average activation current $I_{fave}$ is calculated from the activation currents stored in the memory 44111 in step S63. The average activation current $I_{fave}$ is calculated in units of multiline-driven row wirings.

Sampling setting of current detection is done for the average activation current $I_{fave}$ along with the progress of the activation step. By this setting, the currents of multiline-driven row wirings are detected every to predetermined time to store the latest average activation current $I_{fave}$ in the memory 44111.

Then, the control circuit 44106 calculates the compensation potential on the column wiring side from the obtained average activation current $I_{fave}$. The compensation potential can be calculated using equation (8). The wiring resistance on the row wiring side is measured in advance and stored in the memory 44111. The compensation potential is also measured every update of the average activation current $I_{fave}$. If necessary, the compensation potential value can also be stored in the memory 44111 because it changes with the progress of the activation step.

In step S65, the compensation potential value calculated every multiline driving in step S64 is sequentially applied to the column wirings by the pixel electrode driving circuit 44108 and buffer amplifier 44107.

In step S66, whether the activation time has reached the execution time T1 is checked. In the 15th embodiment, the time T1 for executing chk1 is set to 20 min. If YES in step S66, the flow shifts to step S67; if NO in step 566, returns to step S63.

In step S67, if the activation time has reached the execution time, chk1 is executed for all multiline-driven row wirings. First, the control circuit 44106 reads out the activation current values of all multiline-driven row wirings from the memory 44111. The control circuit 44106 calculates the following values from the activation current values:

1. Current value $I_{fave}$ of average activation current
2. Standard deviation from current value $I_{fave}$ of average activation current
3. Reference value $\sigma/I_{fave}$ from current value $I_{fave}$ of average activation current and standard deviation $\sigma$ From the calculated values, the control circuit 44106 calculates $2\sigma/I_{fave}$ serving as a condition for stopping driving in chk1.

In step S68, the control circuit 44106 checks which of a plurality of multiline-driven row wirings meets the driving stop condition. If there is a row wiring which meets the stop condition, the control circuit 44106 outputs a stop signal to the timing generation circuit 44105 so as to stop driving the row wiring.

The timing generation circuit 44105 outputs a line select signal to the line selection circuit 44102 in accordance with the stop signal. This line select signal is a signal for stopping supply of potential for progressing activation that is applied to the row wiring subjected to driving stop. By steps S66 to S68, chk1 is executed to stop driving the row wiring which meets the stop condition, and then the activation step starts again.

In step S69, selected row wirings are activated by the same procedure as in step S63. The current values of the activation currents of a plurality of multiline-driven row wirings are detected and stored in the memory 44111.

In step S70, the potential value of the compensation potential is calculated. To execute chk2, the current value $I_{fave}$ of the average activation current of a plurality of multiline-driven row wirings is calculated. The current value $I_{fave}$ of the average activation current is calculated by the same procedure as in step S64.

In step S71, the compensation potential value calculated every multiline driving in step S70 is sequentially applied to column wirings by the pixel electrode driving circuit 44108 and buffer amplifier 44107 via the control circuit 44106.

In step S72, if activation has reached end conditions, it ends. If NO in step S72, the flow shifts to step S73.

In step S73, to execute chk2, whether the activation time has reached the execution time T2 after the execution time T1 is checked. If YES in step S73, the flow shifts to step S74; if NO in step S73, returns to S69.

In step S74, chk2 is executed. As described above, chk2 is executed after activation progresses to a certain degree. More specifically, if the activation time has reached the execution time T2 (5 min) after the execution time T1 (20 min), the current value $I_{fave}$ of the surface-conduction emission type electron-emitting device current of multiline-driven row wirings is calculated. The average activation current value $I_{fave}$ is calculated from the activation currents of respective row wirings stored in the memory 44111. The current values of multiline-driven lines are read out to perform the following processing.

The current values of multiline-driven row wirings are compared one by one to obtain the stop condition from the calculated average activation current value $I_{fave}$ and a threshold of ±10% set in the control circuit 44106 in advance. Note that the stop condition is $I_{fave}$ ±10%, as described above.

In step S75, whether the activation current values of a plurality of multiline-driven row wirings fall within the stop condition range obtained in step S74 is checked. If no activation current value meets the stop condition, the activation step continues. If an activation current value meets the stop condition, activation of a corresponding row wiring is stopped by the same procedure as in step S68.

By executing the procedure from steps S61 to S75, the current value of the activation current for calculating the potential value of the compensation potential becomes close to an activation current value which should be originally detected. Consequently, a uniform compensation voltage can be applied to surface-conduction emission type electron-emitting devices.

Figure 65:
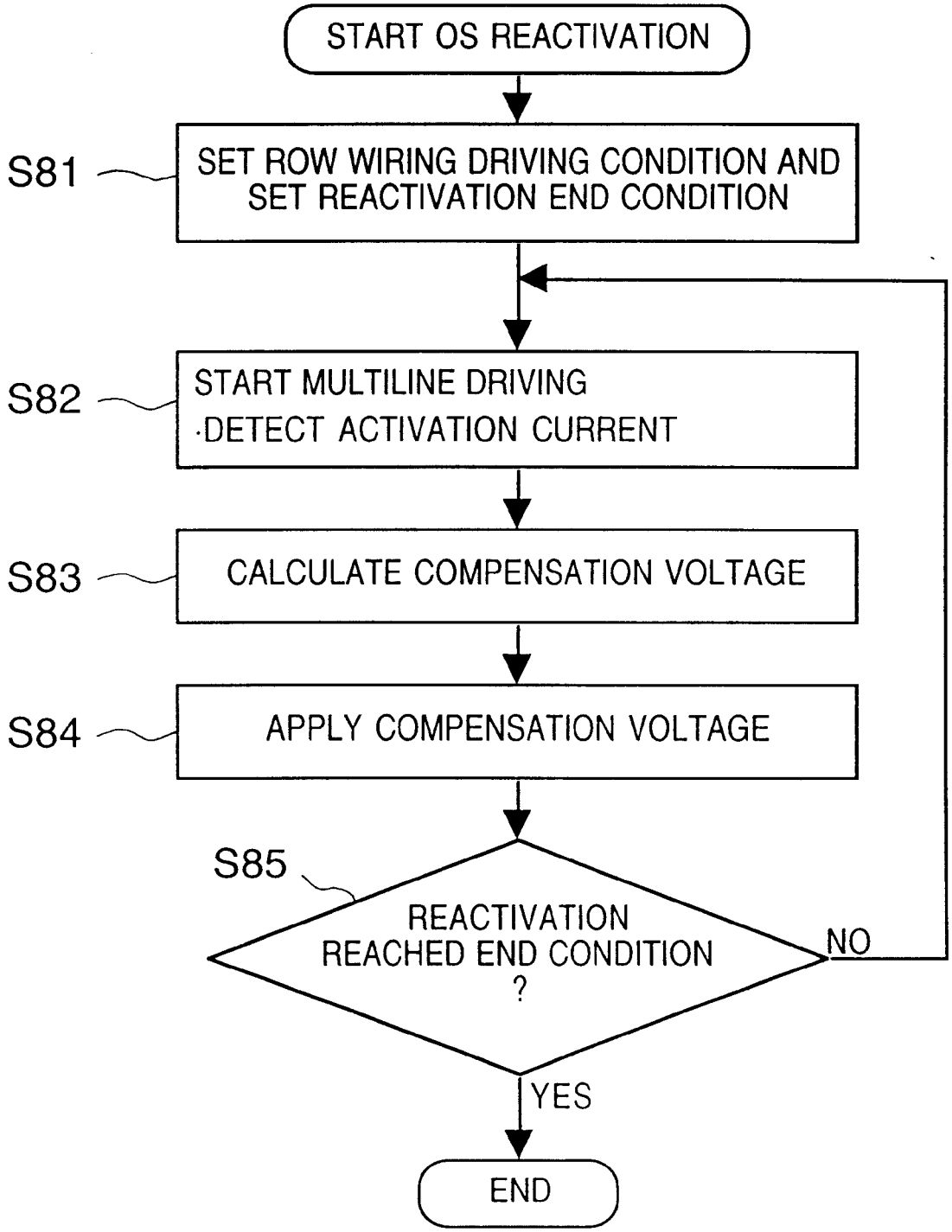
FIG. 65 is a flow chart showing the reactivation step in the 15th embodiment.

FIG. 65 is a flow chart showing the procedure of reactivating a row wiring which has stopped activating. The procedure of reactivating a row wiring which has stopped ractivating by chk1 or chk2 will be explained with reference tn to FIG. 65.

In step S81, conditions for driving a row wiring to be reactivated, and conditions for completing the reactivation step are set before reactivation.

The driving conditions will be explained. The driving conditions mean whether the reactivation step is done by multiline driving or for each row wiring. The driving conditions are determined by the number of row wirings which have stopped driving and their positions in the control circuit 44106.

For example, assume that row wirings which have stopped driving concentrate at a point on the surface-conduction emission type electron-emitting device substrate 44101. If these row wirings are multiline-driven, currents flowing through them concentrate at the point on the substrate 44101 to locally generate heat or destruct the surface-conduction emission type electron-emitting device substrate 44101 by the generated heat.

Hence, these row wirings are desirably driven one by one to avoid this problem. In multiline driving, the number of simultaneous driving row wirings, the driving line interval, the thinning interval, and the like are set.

In driving row wirings one by one, the driving interval and thinning interval are set equal to those in multiline driving. Therefore, in driving row wirings one by one, concentration of the current on the surface-conduction emission type electron-emitting device substrate 44101 can be reduced to avoid the problem such as heat generation.

If row wirings which have stopped driving are distributed over the surface-conduction emission type electron-emitting device substrate 44101, they are desirably multiline-driven to shorten the reactivation time spent for the reactivation step.

The end conditions of the reactivation step will be explained. Reactivation ends when the activation current reaches an activation current value set as an end condition in order to obtain an activation current almost equal to that of a line which has normally activated, or at an activation time set in advance. This determination may be done by checking which of chk1 and chk2 stops driving a row wiring.

For example, since a row wiring (row wiring A shown in FIG. 62) which has stopped driving as a result of execution of chk1 has a low increase rate of the activation current value with respect to the activation time, this row wiring is determined to be difficult to obtain even by reactivation an activation current value equal to that of a line which has normally activated. Therefore, if the row wiring which has stopped driving by execution of chk1 reaches a set activation time, the reactivation step ends. The final fat activation current value is determined at the end of the activation time.

On the other hand, since a row wiring (row wiring B shown in FIG. 62) which has stopped activation as a result of execution of chk2 flows the activation current to a certain degree, this row wiring is determined to reach by reactivation processing an activation current value almost equal to that of a line which has normally activated. Therefore, the row wiring which has stopped activation by execution of chk2 is reactivated until the activation current reaches a desired activation current value.

In step S82, the reactivation step starts to drive row wirings selected by the above driving conditions. Also in the reactivation step, the current values of activation currents flowing through a plurality of multiline-driven row wirings are detected by the current detection circuit 44103. The detected values are output to the memory 44111 via the control circuit 44106.

In step S83, the potential value of the compensation potential to be applied is calculated. Also in the reactivation step, the compensation potential is calculated based on the average activation current value $I_{fave}$ as the average of activation currents flowing through a plurality of multiline-driven row wirings. The average activation current value $I_{fave}$ is obtained by outputting the activation current values of respective row wirings stored in the memory 44111 and performing a predetermined calculation by the control circuit 44106.

When row wirings are reactivated one by one in accordance with the driving conditions of the reactivation step, the activation current values of selected row wirings are directly used to calculate the potential value of the compensation potential.

In step S84, the compensation potential value calculated by the control circuit 44106 is sequentially applied to column wirings on the surface-conduction emission type electron-emitting device substrate 44101 via the pixel electrode driving circuit 44108 and buffer amplifier 44107.

In step S85, whether the reactivation step meets the end conditions is checked. If YES in step S85, the reactivation step ends; if NO in step S85, the flow returns to step S82.

In this way, activation of the surface-conduction emission type electron-emitting device substrate 44101 is completed. By this procedure, activation can be completed within a fraction of the time required to drive row wirings one by one.

By executing chk1 and chk2, the average activation current value for calculating the compensation potential value can be unified to drive row wirings with a compensation potential value close to the optimum value.

In multiline driving in the 15th embodiment, the number of simultaneous driving row wirings can be increased in consideration of heat generated within the surface-conduction emission type electron-emitting device substrate 44101 in order to further shorten the activation time.

Although the power source 44104 applies a positive output potential in the 15th embodiment, the application potential may be negative. In this case, the direction of current flowing through the column wiring is also inverted, so that the polarity of the compensation potential from the buffer amplifier 44107 is also inverted.

In addition, the pixel electrode driving circuit 44108 comprises D/A converters equal in number to the number of column wirings. However, since the compensation potential distribution changes gradually, as shown in FIG. 62, the number of D/A converters may be decreased to divide and define the application potential by the resistance or the like.

In the activation step, the compensation potential value need not be updated for each unit, unlike in the 15th embodiment, but may be appropriately updated in accordance with the progress of the activation step.

As described above, the activation step described in the 15th embodiment can reduce variations in electron-emitting characteristics of surface-conduction emission type electron-emitting devices. A display panel can be formed using the surface-conduction emission type electron-emitting device substrate 44101 to realize a high-quality image display apparatus almost free from variations.

If the number of simultaneous driving row wirings in multiline driving is increased, the activation time can be greatly shortened.

16th Embodiment

Figure 66:
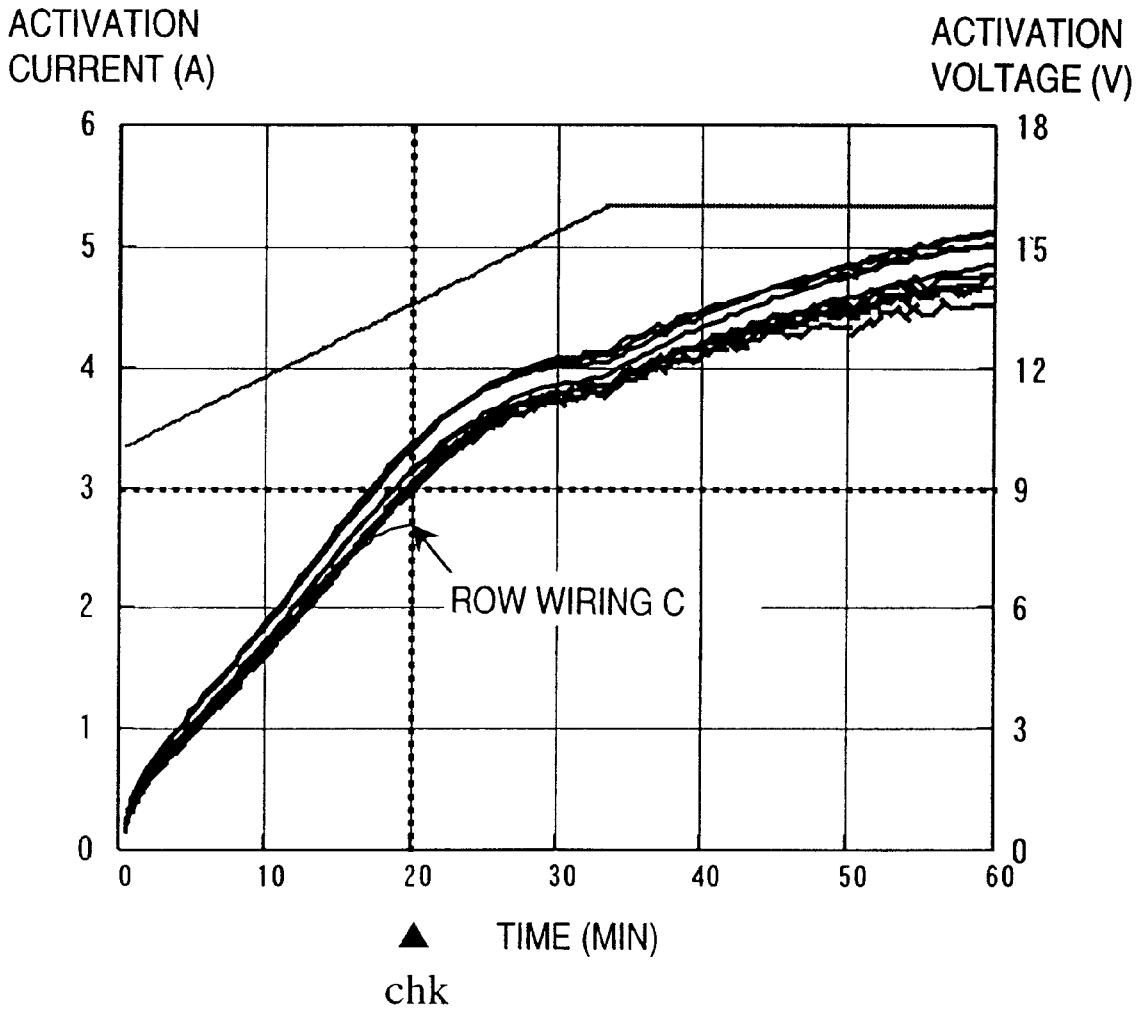
FIG. 66 is a graph showing the activation current in the 16th embodiment.

FIG. 66 is a graph showing a change in activation current with respect to the activation time of a plurality of multiline-driven row wirings. The apparatus and driving circuit used in the activation step of the 16th embodiment, and the surface-conduction emission type electron-emitting device substrate are the same as shown in FIG. 44.

The 16th embodiment steps driving a row wiring which does not flow any predetermined activation current during a predetermined activation time. More specifically, chk3 is executed 20 min after the start of activation, as shown in FIG. 66. In chk3, whether the activation current value of each of multiline-driven row wirings has reached 3 A is checked. Driving of a row wiring C which has not reached 3 A is stopped.

Figure 67:
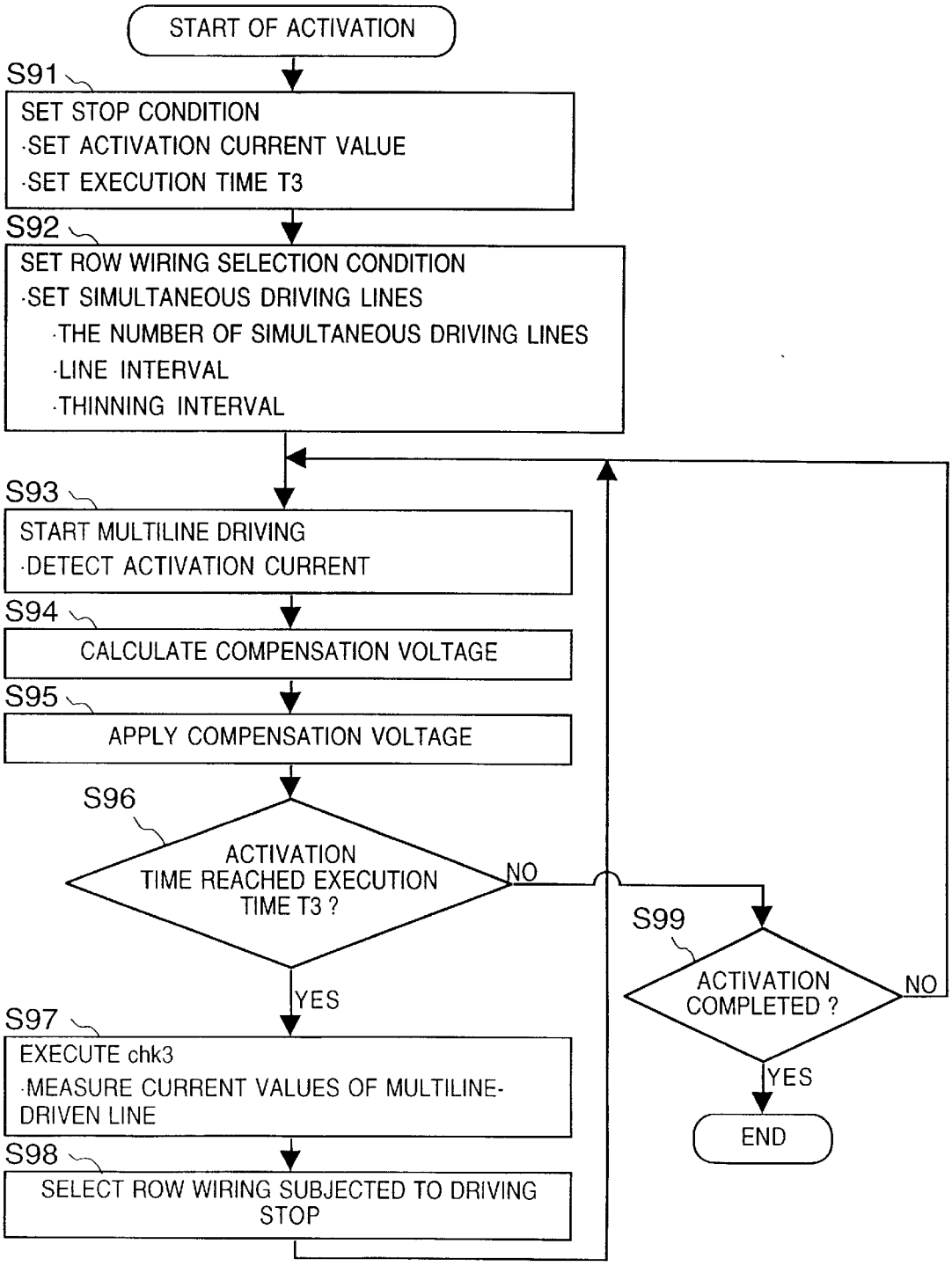
FIG. 67 is a flow chart showing the activation step in the 16th embodiment.

FIG. 67 is a flow chart showing the procedure of the activation step in the 16th embodiment. The procedure of the activation step in the 16th embodiment will be described with reference to FIG. 67.

Before executing activation in step S91, conditions for specifying a row wiring subjected to driving stop out of a plurality of multiline-driven row wirings are set. As the stop conditions, the execution time T3 and activation current value in chk3 are set in a control circuit 44106 in order to execute chk3.

In step S92, when the user inputs an activation start command, the control circuit 44106 starts activation. Similar to the 15th embodiment, the control circuit 44106 sets selection conditions of simultaneous driving row wirings.

This setting includes three settings, i.e., the number of simultaneous driving row wirings in multiline driving, the line interval between driving row wirings, and the thinning interval. Also in inultiline driving in the 16th embodiment, a plurality of selected row wirings are grouped as one unit, and the activation potential is sequentially applied for respective units.

In the 16th embodiment as well as the 15th embodiment, the thinning interval is set to 10 wirings. The number of simultaneous driving row wirings is optimized in consideration of the power amount supplied to a surface-conduction emission type electron-emitting device substrate 44101 and heat generated upon electrification in driving for each unit.

In the 16th embodiment, the line interval is desirably set to uniformly divide the number of multiline-driven row In wirings for all the row wirings $D_{x1}$ to $D_{xm}$, thereby unifying heat generated upon electrification within the substrate.

These settings are performed by the control circuit 44106 and set in a line selection circuit 44102.

In step S93, surface-conduction emission type electron-emitting devices are activated. To perform multiline driving, the control circuit 44106 sets a setting signal for setting the row wiring selection conditions in step S92 in a timing generation circuit 44105. The timing generation circuit 44105 recognizes driving row wirings, and outputs a line select signal to the line selection circuit 44102.

The line select signal turns on the FET relays of the predetermined row wirings to connect the row wirings to a power source 44104, thereby driving the selected row wirings. After activation starts for each unit, a current detection circuit 44103 detects the activation currents of the driven row wirings to store the current values in a memory 44111.

Instep S94, the compensation potential is calculated. The average activation current $I_{fave}$ is calculated from the in activation currents stored in the memory 44111 in step S93. The average activation current $I_{fave}$ is calculated in units of multiline-driven row wirings.

Sampling setting of current detection is done for the average activation current $I_{fave}$ along with the progress of tn activation. By this setting, the currents of multiline-driven row wirings are detected every predetermined time Bed to store the latest average activation current $I_{fave}$ in the memory 44111.

Then, the control circuit 44106 calculates the compensation potential on the column wiring side from the obtained average activation current $I_{fave}$. The compensation potential can be calculated using equation (8). The wiring resistance of each row wiring is measured in advance and stored in the memory 44111. The compensation potential is also measured every update of the average activation current $I_{fave}$. If necessary, the compensation potential value can also be stored in the memory 44111 because it changes with the progress of the activation step.

In step 595, the compensation potential value calculated every multiline driving in step S94 is sequentially applied to the column wirings by a pixel electrode driving circuit 44108 and buffer amplifier 44107. Since the 16th embodiment performs multiline driving for each unit, the number of activation row wirings in one activation step is 10.

In the activation step, setting for one processing unit is not limited to one unit, and a plurality of units may be set in advance.

In step S96, whether the activation time has reached the execution time T3 is checked. In the 16th embodiment, the time T3 for executing chk3 is set to 20 min. If YES in step S96, the flow shifts to step S97; if NO in step S96, a returns to step S93.

In step S97, chk3 is executed for a plurality of multiline-driven row wirings. The control circuit 44106 receives the latest current value for chk3 from the memory 44111 and compares it with the set current value.

In step S98, the control circuit 44106 detects a row wiring having an activation current value which has not reached the set current value, and outputs a stop signal to the timing generation circuit 44105 so as to stop driving the row wiring.

The timing generation circuit 44105 outputs a line select signal to the line selection circuit 44102 in accordance with the stop signal. This line select signal is a signal for stopping application of the voltage to the row wiring subjected to driving stop.

In step S99, if activation has reached end conditions, it ends. If NO in step S99, the flow shifts to step S93. Activation ends when the device current of each surface-conduction emission type electron-emitting device tn reaches a predetermined value while detecting the activation current, or by setting the activation time.

To complete activation when the current value of each surface-conduction emission type electron-emitting device reaches a predetermined value, the progress of activation tn must be grasped in units of row wirings by the control circuit 44106 or the like. If activation is controlled by the activation time, the time must be set to unify activation. In the 16th embodiment, activation ends by setting the activation time.

After that, row wirings which have stopped driving are reactivated. The reactivation step is the same as in the 15th embodiment.

In this way, activation of the surface-conduction emission type electron-emitting device substrate 44101 is completed. By this procedure, activation can be completed within a fraction of the time required to drive row wirings one by one.

By executing chk3, the average activation current value for calculating the compensation potential value can be unified to drive row wirings with a compensation potential value close to the optimum value.

In multiline driving in the 16th embodiment, the number of simultaneous driving row wirings can be increased in consideration of heat generated within the surface-conduction emission type electron-emitting device substrate 44101 in order to further shorten the activation time.

17th Embodiment

Figure 68:
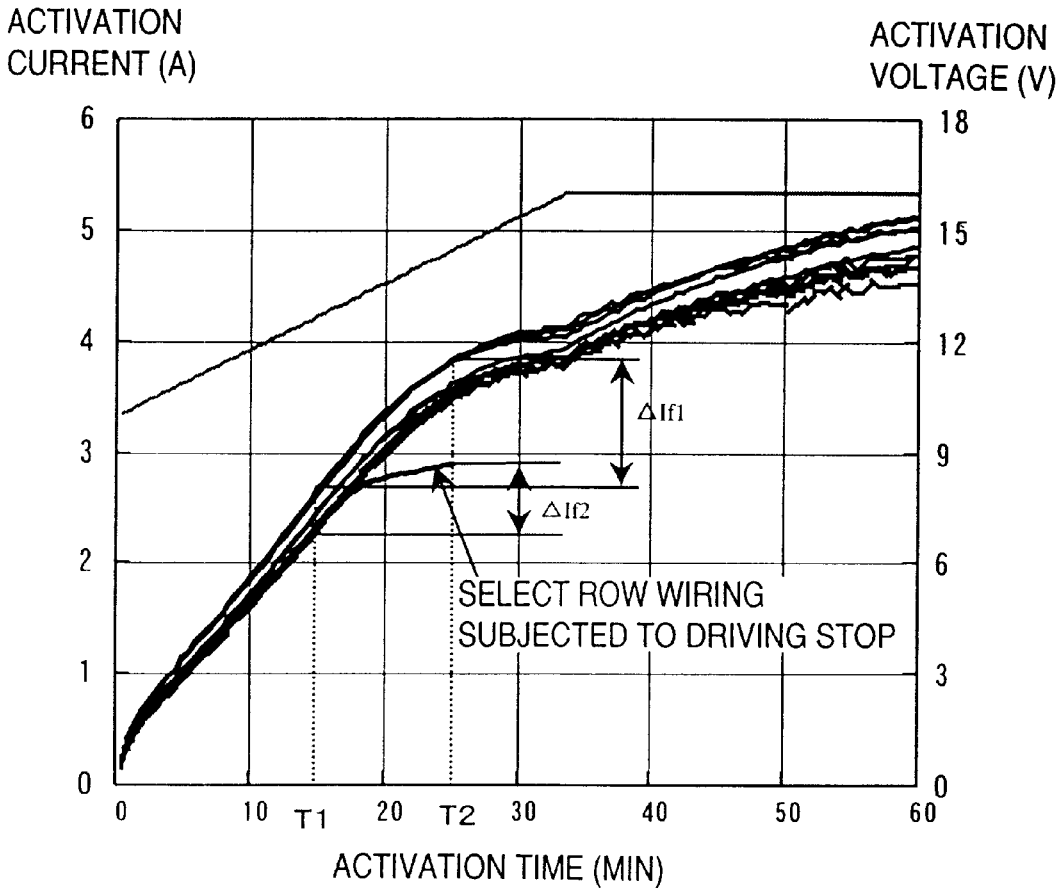
FIG. 68 is a graph showing the activation current in the 17th embodiment.

FIG. 68 is a graph showing a change in activation current with respect to the activation time of a plurality of multiline-driven row wirings. The apparatus and driving circuit used in the activation step of the 17th embodiment, and the surface-conduction emission type electron-emitting device substrate are the same as shown in FIG. 44. In the 17th embodiment, the activation current value is detected at two arbitrary times within the activation time. The change amount of the detection time and the change amount of the activation current value are calculated to obtain Change Amount of Activation Current Value/Change Amount of Activation Time If the result does not exceed a predetermined threshold, driving of the row wiring is stopped.

More specifically, when the activation time reaches the detection time T4, the activation current values of multiline-driven row wirings are detected. Before the detection time T5, normal activation driving is done. The difference between detected activation current values is obtained to calculate the change amount of the detection time and the change amount of the activation current amount, thereby calculating Change Amount of Activation Current Value/Detection Time T5−Detection Time T4

The change amount of the activation current value is desirably detected while the activation voltage rises. This is because the activation current value typically changes, like $\Delta I_{f1}$ in FIG. 68, and is suitable for determining the activation state. In the 17th embodiment, therefore, the detection times T4 and T5 are set at relatively earlier times after the start of the activation step.

The current change amount serving as a driving stop condition may be set as a fixed value in advance. In practice, the current change amounts of respective row wirings may be calculated by multiline driving, and driving of a row wiring having a greatly small current change amount out of these row wirings may be stopped.

For example, the driving stop conditions may be set on the basis of the average of the current change amounts of a plurality of multiline-driven row wirings, or on the basis of the change amount of a specific row wiring.

In the 17th embodiment, the threshold for stopping driving the row wiring is set to 1 A from the average of the current change amounts of a plurality of multiline-driven row wirings. Driving of a row wiring having a current change amount of 1 A or less is stopped.

As for the row wiring designated to driving stop, the change amount of the activation current value between the measurement times T5 and T4 is compared with the set value of 1 A. Then, $\Delta I_{f1}$ exhibits an increase of 1 A or more, whereas a row wiring corresponding to $\Delta I_{f2}$ is defined as a driving stop line.

Figure 69:
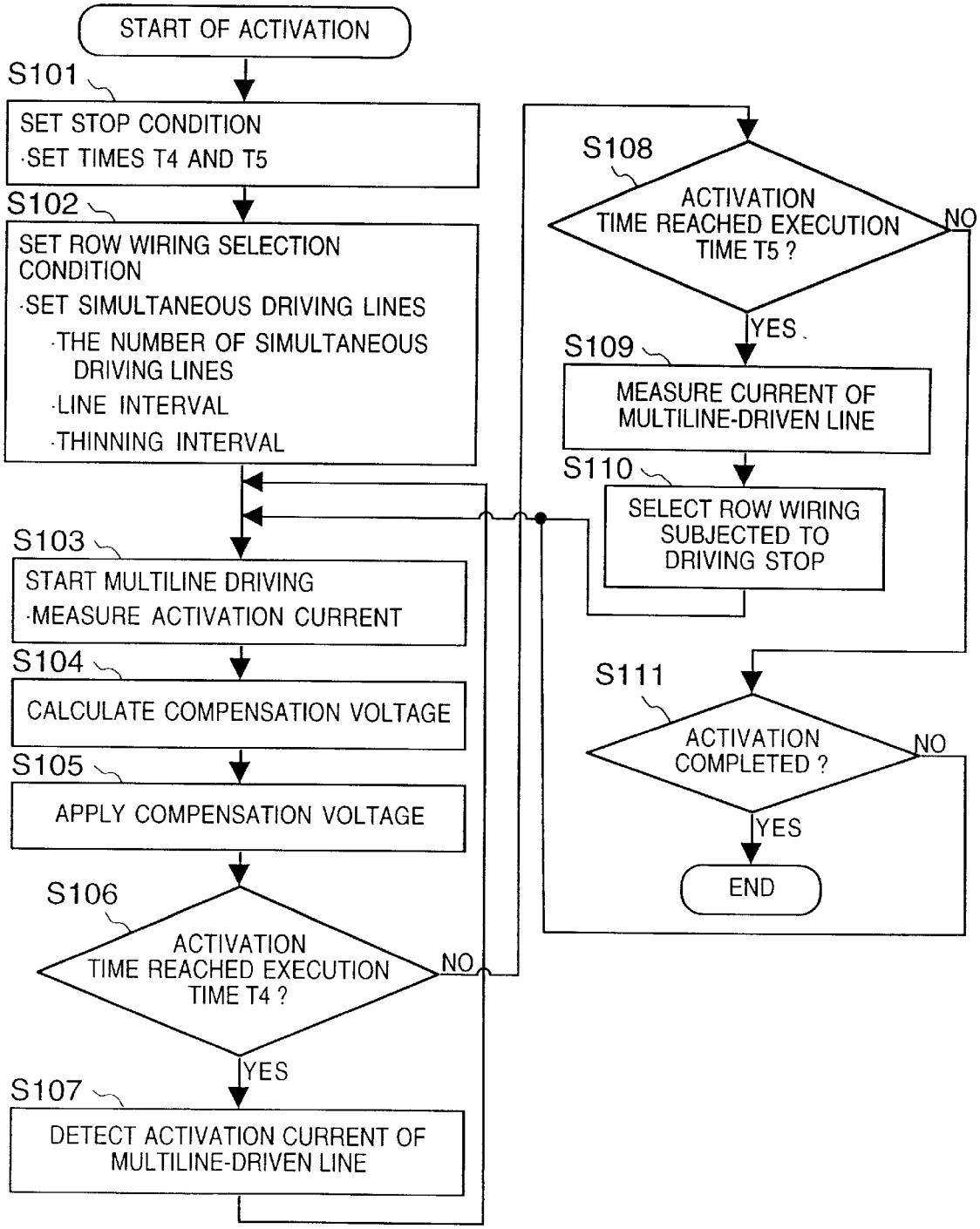
FIG. 69 is a flow chart showing the activation step in the 17th embodiment.

FIG. 69 is a flow chart showing the procedure of the activation step in the 17th embodiment. The procedure of the activation step in the 17th embodiment will be described with reference to FIG. 69.

Before the activation step in step S101, driving stop conditions are set for a plurality of multiline-driven row wirings. As described above, the stop conditions are the detection times T4 and t5, and the change amount of the detection time vs. the change amount of the activation current value. The settings are done for a control circuit 44106.

In step S102, when the user inputs an activation start command, the control circuit 44106 starts activation. Similar to the 15th embodiment, the control circuit 44106 sets selection conditions of simultaneous driving row wirings.

This setting includes three settings, i.e., the number of simultaneous driving row wirings in multiline driving, the line interval between driving row wirings, and the thinning interval. Also in multiline driving in the 17th embodiment, a plurality of selected row wirings are grouped as one unit, and the activation potential is sequentially applied for respective units.

In the 17th embodiment as in the 15th embodiment, the thinning interval is set to 10 wirings. The number of simultaneous driving row wirings is optimized in consideration of the power amount supplied to a surface-conduction emission type electron-emitting device substrate 44101 and heat generated upon electrification in driving for each unit.

In the 17th embodiment, the line interval is desirably set to uniformly divide the number of multiline-driven row wirings which simultaneously receive the activation potential for all the row wirings $D_{x1}$ to $D_{xm}$, thereby unifying heat generated upon electrification within the substrate.

These settings are performed by the control circuit 44106 and set in a line selection circuit 44102.

In step S103, surface-conduction emission type electron-emitting devices are activated. To perform multiline driving, the control circuit 44106 sets a setting signal for setting the row wiring selection conditions in step S102 in a timing generation circuit 44105. The timing generation circuit 44105 recognizes driving row wirings, and outputs a line select signal to the line selection circuit 44102.

The line select signal turns on the FET relays of the predetermined row wirings to connect the row wirings to a power source 44104, thereby driving the selected row wirings. After activation starts in units of blocks, a current detection circuit 44103 detects the activation currents of the driven row wirings to store the current values in a memory 44111.

In step S104, the compensation potential is calculated. The average activation current $I_{fave}$ is calculated from the activation currents stored in the memory 44111 in step 5103. The average activation current $I_{fave}$ is calculated in units of multiline-driven row wirings.

Sampling setting of current detection is done for the average activation current $I_{fave}$ along with the progress of activation. By this setting, the currents of multiline-driven row wirings are detected every predetermined time to store the latest average activation current $I_{fave}$ in the memory 44111.

Then, the control circuit 44106 calculates the compensation potential on the column wiring side from the obtained average activation current $I_{fave}$. The compensation potential can be calculated using equation (8). The wiring resistance of each row wiring is measured in advance and stored in the memory 44111. The compensation potential is also measured every update of the average activation current $I_{fave}$. If necessary, the compensation potential value can also be stored in the memory 44111 because it changes with the progress of the activation step.

In step S105, the compensation potential value calculated every multiline driving in step S104 is sequentially applied to the column wirings by a pixel electrode driving circuit 44108 and buffer amplifier 44107. Since the 17th embodiment performs multiline driving in units of blocks, the number of activation row wirings in one activation step is 10.

In the activation step, setting for one unit is not limited to one unit, and a plurality of units may be set in advance.

In step S106, whether the activation time has reached the detection time T4 is checked. If YES in step S106, the flow shifts to step S107; if NO in step S106, returns to step S108.

In step S107, the activation current of a row wiring driven in the activation step is detected. Similar to step S103, the activation current value of a row wiring selected by the line selection circuit 44102 is detected by the current detection circuit 44103. The detected value is stored in the memory 44111. After detecting the activation current, the flow returns to step S103.

In step S108, whether the activation time has reached the detection time T5 is checked. If YES in step S108, the flow proceeds to step S109; if NO in step S108, returns to step S111.

In step S109, the activation current value of a row wiring driven in the activation step is detected. Similar to step S107, the activation current value of a row wiring selected by the line selection circuit 44102 is detected by the current detection circuit 44103. The detected value to is stored in the memory 44111. After detecting the activation current value, the flow returns to step S110.

In step S110, the control circuit 44106 reads out the activation current values detected at the detection times T4 and T5 from the memory 44111, and calculates the change amount between the activation current values. Of a plurality of multiline-driven row wirings, driving of a row wiring which has not reached a predetermined current change amount (increase amount) is stopped. More specifically, the timing generation circuit 44105 outputs a line select signal to the line selection circuit 44102 to specify a row wiring subjected to driving stop. After specifying the row wiring subjected to driving stop, the flow returns to step S103.

By the procedure from steps S105 to S110, if the activation step has reached end conditions, it ends. If NO in step S111, the flow proceeds to step S103. Activation ends when the device current of each surface-conduction emission type electron-emitting device reaches a predetermined value while detecting the activation current, or by setting the activation time.

To complete activation when the current value of each surface-conduction emission type electron-emitting device reaches a predetermined value, the progress of activation must be grasped in units of row wirings by the control circuit 44106 or the like. If activation is controlled by the activation time, the time must be set to unify activation. In the 17th embodiment, activation ends by setting the activation time.

After that, row wirings which have stopped activating are reactivated. The reactivation step is the same as in the 15th embodiment.

In this fashion, activation of the surface-conduction emission type electron-emitting device substrate 44101 is completed. By this procedure, activation can be completed within a fraction of the time required to drive row wirings one by one.

By calculating the change amount of the activation current value, the average activation current value for calculating the compensation potential value can be unified to drive row wirings with a compensation potential value close to the optimum value.

In multiline driving in the 17th embodiment, the number of simultaneous driving row wirings is not limited to 5, and can be increased in consideration of heat generated within the surface-conduction emission type electron-emitting device substrate 44101 in order to further shorten the activation time.

According to the present invention, a plurality of electron-emitting devices are arranged in a matrix. A predetermined number of row wirings are selected from a plurality of row wirings, and the current values of activation currents flowing through the selected row wirings are detected for respective row wirings. Of the selected row wirings, activation of a row wiring which cannot attain a desired activation current is stopped.

The potential value of the compensation potential applied to a plurality of column wirings is calculated from the current values of the activation currents of row wirings not subjected to activation stop, and the resistance values of the respective row wirings. The calculated potential value of the compensation potential is applied.

For this reason, even if a potential drop occurs owing to the wiring resistance and activation current of the row wiring in the electron-emitting device activation step, a uniform compensation potential can be applied to electron-emitting devices. Therefore, electron-emitting devices having uniform electron-emitting device characteristics can be provided.

18th Embodiment

The following embodiments adopt an arrangement partially different from that in each of the above-described embodiments. Prior to a description of the 18th embodiment, problems which may arise in simultaneously selecting a plurality of row wirings and applying voltage will be explained.

Figure 71:
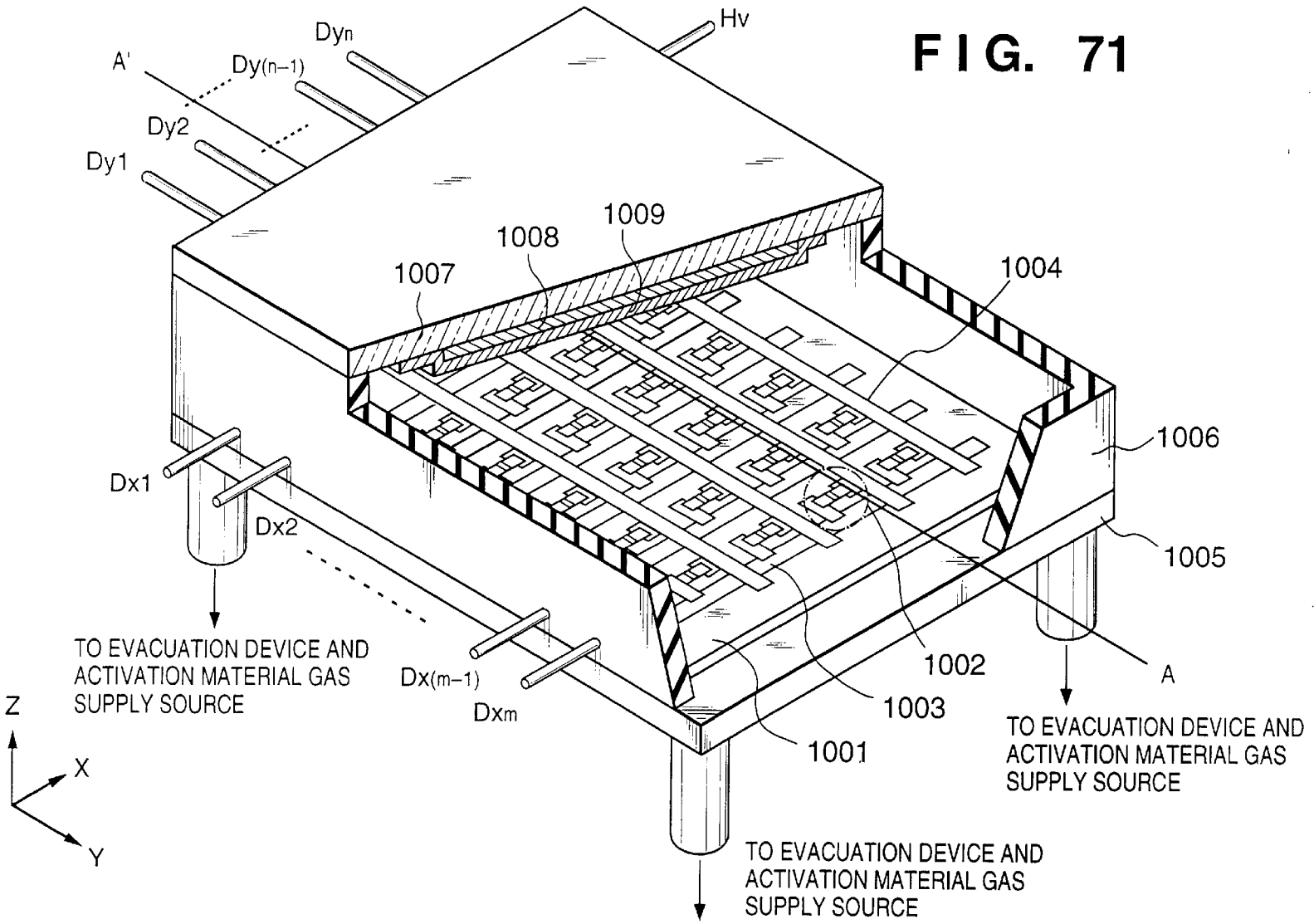
FIG. 71 is a partially cutaway perspective view showing a display apparatus.
Figure 72:
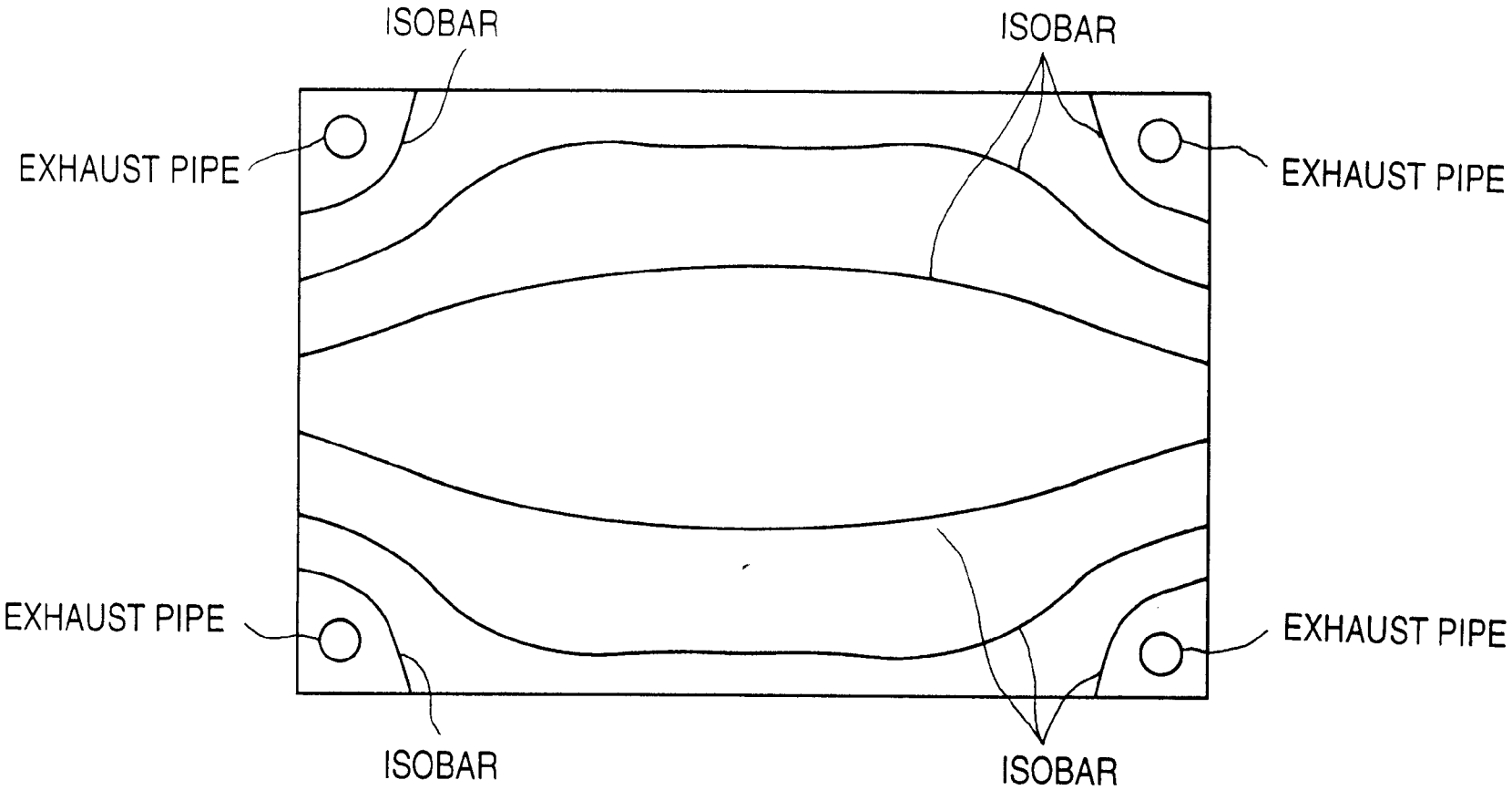
FIG. 72 is a view showing the distribution of activation material gas caused by the structural factor of an airtight container in FIG. 71.
Figure 73A:
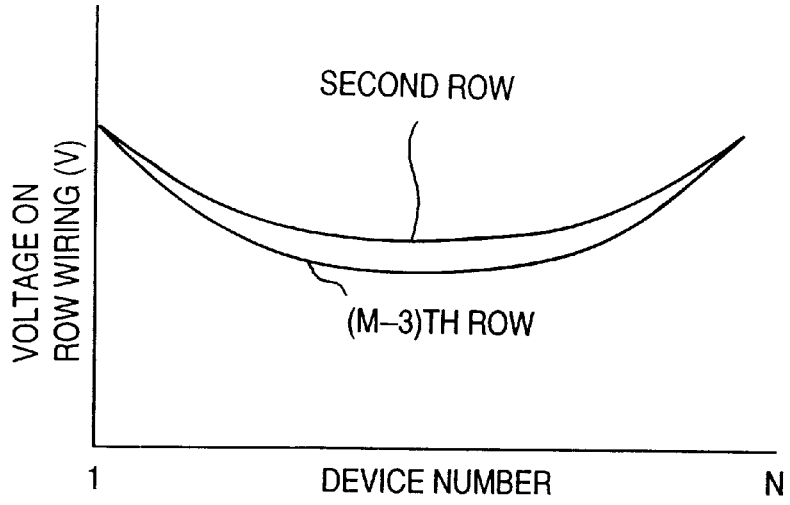
FIGS. 73A, 73B, and 73C are graphs, respectively, showing a potential distribution on the row wiring, a potential distribution applied from the column wiring side, and a voltage distribution of the device when the activation voltage is applied while simultaneously compensating for the potentials of two lines from the column wiring side.
Figure 73B:
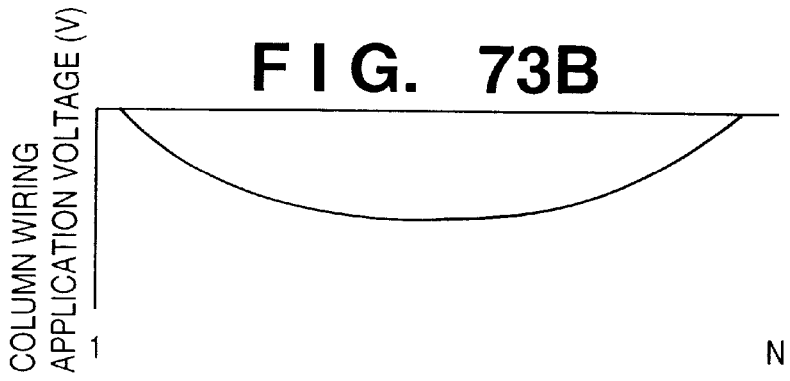
Figure 73C:
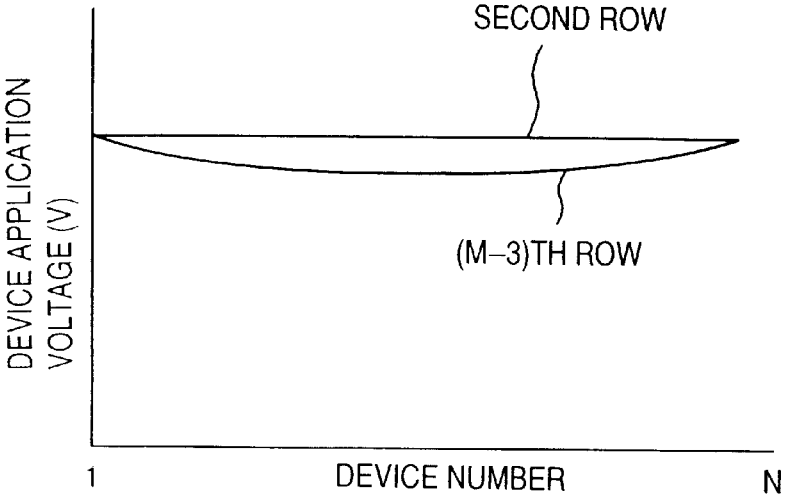

The following description concerns the case in which the extraction wiring is connected from two sides. FIG. 70 schematically shows the state of applying the activation voltage while simultaneously compensating for the voltages of two lines from the column wiring. In this case, the second and (M−3)th row wirings are selected and receive the compensation voltage from the column wiring. The first example of the voltage distribution on the row wiring will be explained with reference to FIGS. 73A to 73C. As shown in FIG. 73A, the potential distribution on the row wiring is different between the second and (M−3)th rows. This is because the potential drop changes due to the difference in wiring resistance, and particularly, row wiring resistance, variations in fissures formed by forming processing, the difference in generated activation current, and the like. When an airtight container like the one shown in FIG. 71 is used (the arrangement, manufacturing method, reference numerals in FIG. 71 will be described below), activation material gas exhibits a distribution as shown in FIG. 72 because of a structural factor. Thus, the activation current changes, resulting in different potential drops. A voltage distribution applied from the column wiring side is adjusted to the potential distribution on the second row, as shown in FIG. 73B. In this case, the voltage distribution applied to devices becomes uniform for devices on the second row, as shown in FIG. 73C. However, the voltage drops at the center on the (M−3)th row, which distributes device characteristics. Although not shown, if to the compensation potential on the column wiring side is determined based on the (M−3)th row, the voltage rises at the center on devices on the second row, which also distributes device characteristics.

Figure 74A:
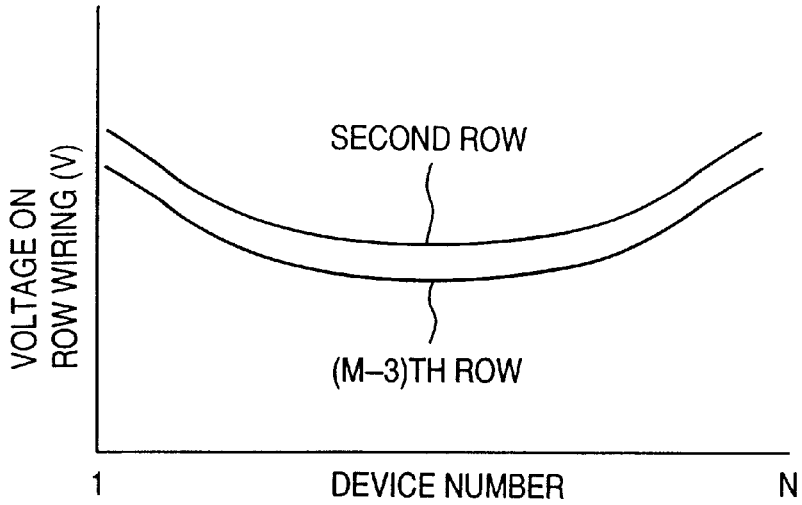
FIGS. 74A, 74B, and 74C are graphs, respectively, showing a potential distribution on the row wiring, a potential distribution of the column wiring side, and a voltage distribution of the device when the activation potential is simultaneously applied to two lines.
Figure 74B:
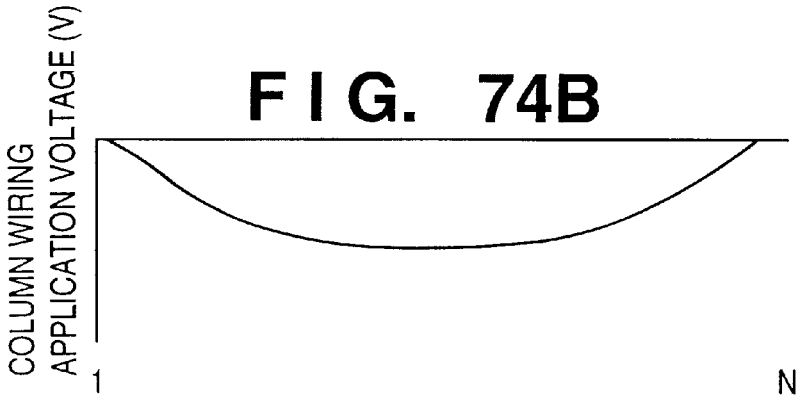
Figure 74C:
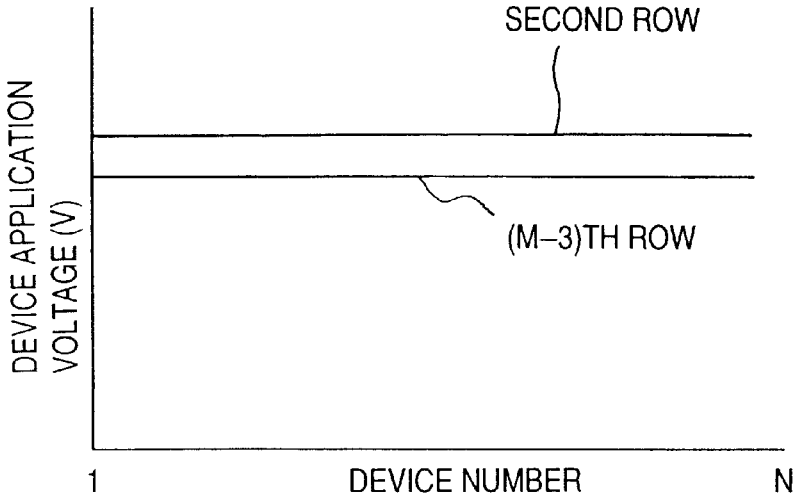

The second example of the voltage distribution will be explained with reference to FIGS. 74A to 74C. As shown in FIG. 74A, the potential distributions on the second and (M−3)th row wirings have the same shape but offset from each other. This is because the extraction wiring resistance is different between respective rows to change the potential drop amount on the extraction wiring. If a potential distribution applied from the column wiring side is adjusted to the potential drop on the second row, a voltage as shown in FIG.

74B can be attained. A voltage distribution applied to devices at this time is shown in FIG. 74C. The voltage is lower as a whole than the voltage to devices on the second row. Consequently, the second and (M−3)th rows exhibit different characteristics, resulting in a lateral-striped image.

The influence of the difference in potential drop between extraction wirings arranged for respective row wirings to connect them to an external circuit will be described.

Figure 86:
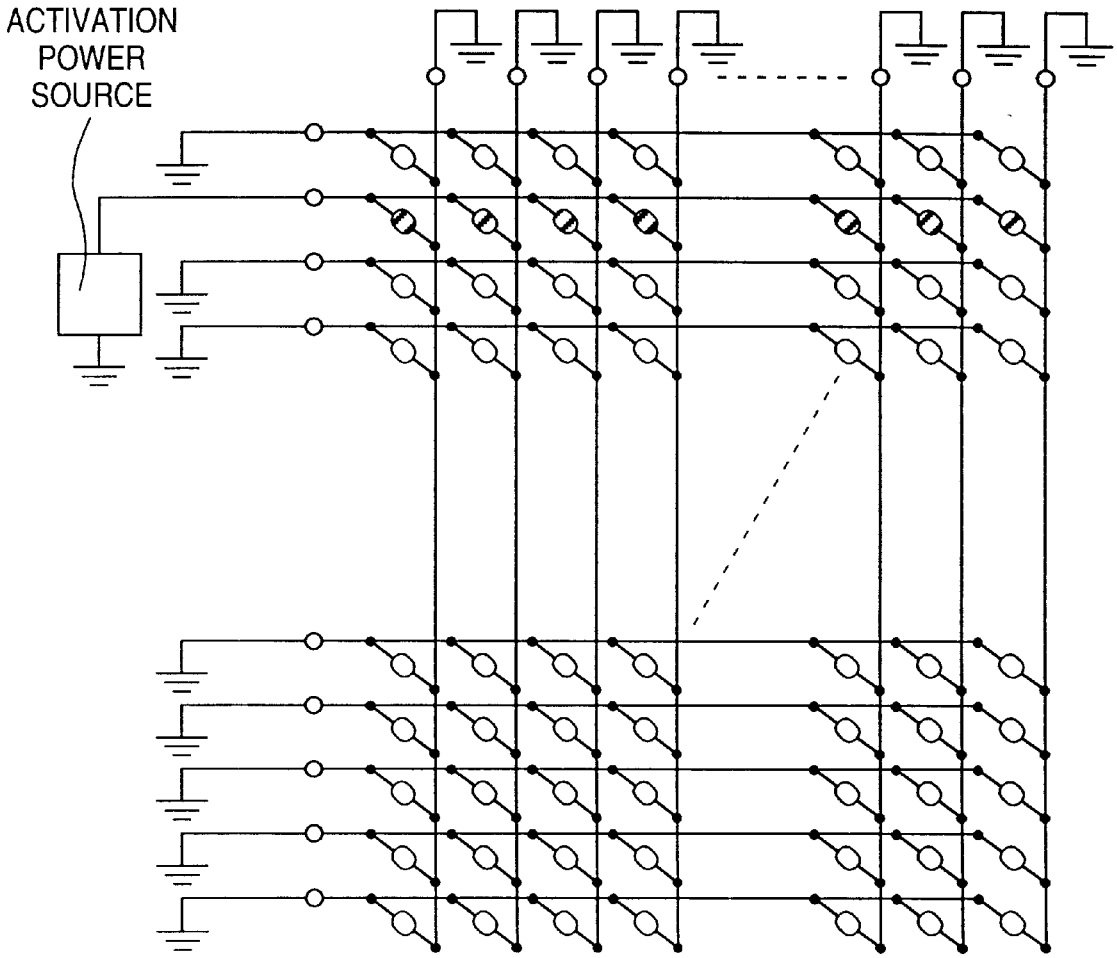
FIG. 86 is an equivalent circuit diagram when the activation voltage is applied to surface-conduction emission type electron-emitting devices on the second row.
Figure 87A:
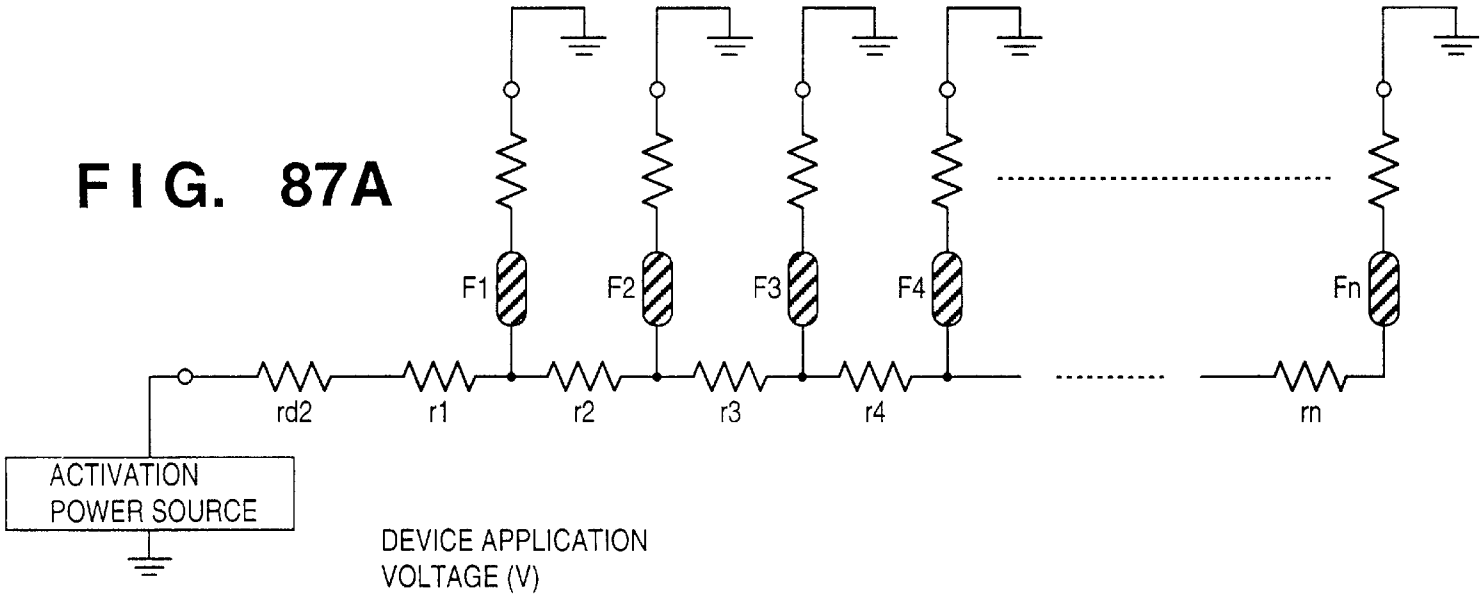
FIGS. 87A and 87B are an equivalent circuit diagram in activating the second row in FIG. 86, and a graph showing changes in device application voltage during activation, respectively.
Figure 87B:
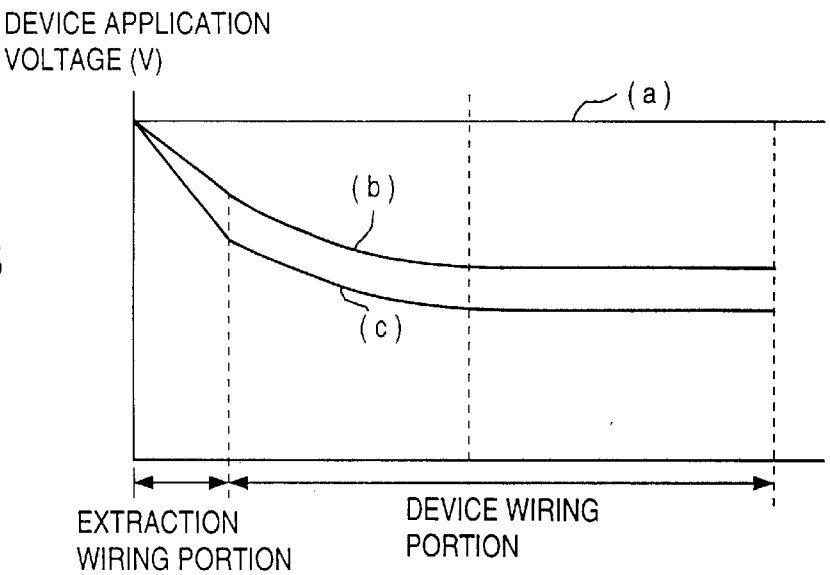
Figure 88:
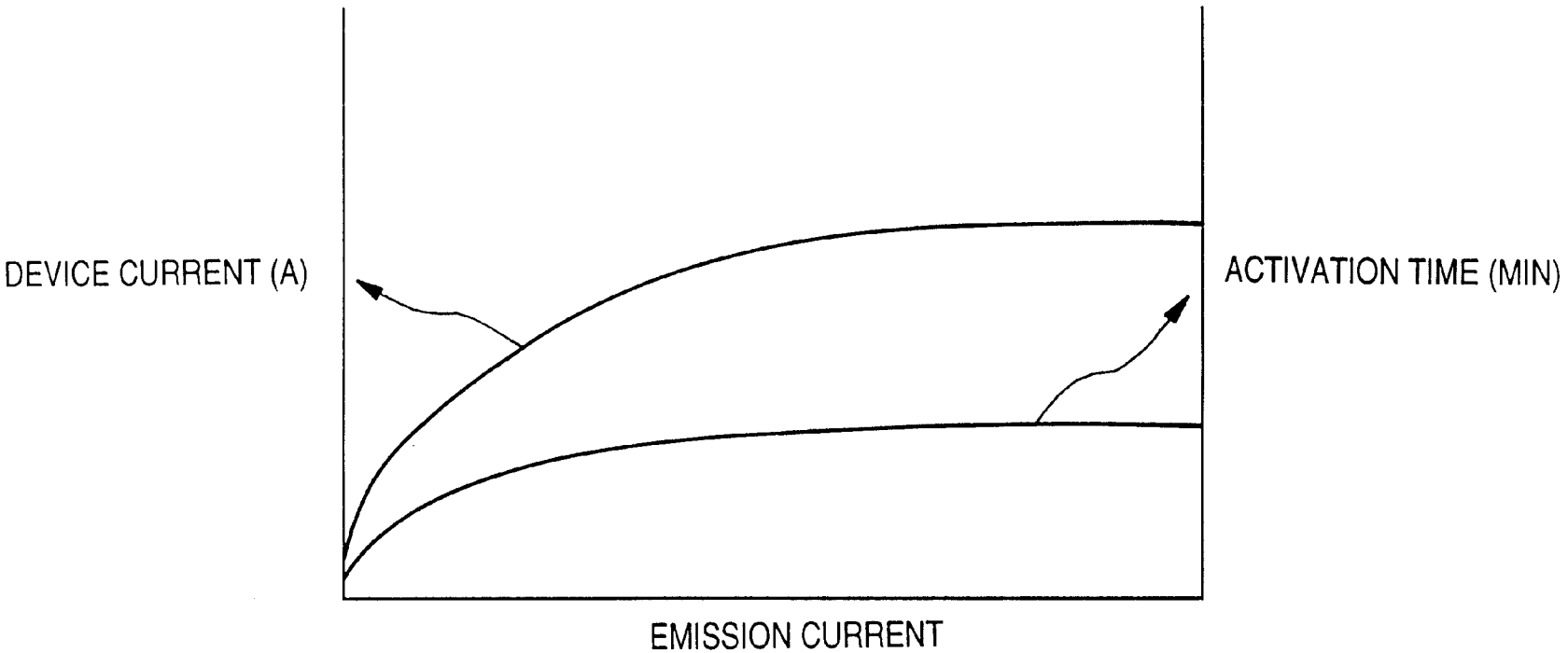
FIG. 88 is a graph showing the device current $I_f$ and emission current $I_e$ during activation.

FIG. 86 shows an equivalent circuit when the second row is activated in the activation step for m×n surface-conduction emission type electron-emitting devices arranged in a simple matrix. FIG. 87A shows an equivalent circuit when attention is paid to only the second row to which the voltage is applied. In a simple matrix arrangement, as shown in FIGS. 86 and 87A, wiring resistances r1 to rn≦1 exist between devices, and an extraction wiring resistance rd2 for feeding each row wiring is connected to the wiring resistances r1 to rn−1. FIG. 88 shows the device current $I_f$ and emission current $I_e$ which increase with the progress of activation of the second row. As shown in FIG. 88, both the current value $I_f$ flowing through one row and the emission current $I_e$ increase upon activation. That is, almost no $I_e$ flows in the initial state of activation, so almost no potential drop occurs. Therefore, the voltage distribution applied to devices on one row has a shape (a) shown in FIG. 87B. However, $I_f$ starts flowing with the progress of activation to cause a potential drop, and the voltage distribution changes to a shape (b) shown in FIG. 87B at the end of activation. This potential drop is caused by the extraction wiring or device wiring. In many cases, the extraction wiring pattern is flexibly designed in accordance with the wiring to be connected, the pitch of, e.g., the probe, the shape, and the like, and changes for each row number. This becomes more prominent in higher-precision image forming apparatuses having a larger number of pixels, so that rd1, rd2, . . . , rdm have different values. In this case, a line having an extraction wiring resistance larger than rd2 exhibits a voltage distribution (c) shown in FIG. 87B at the end of activation. The device application voltage upon activation becomes different between respective lines (rows) owing to different extraction wiring resistances, and thus lines have different device characteristics at the end of activation. This causes variations in luminance between lines.

As described above, a plurality of lines are simultaneously selected and activated when the potential distribution on the row wiring is compensated for from the column wiring. If the simultaneously driven lines exhibit different potential distributions, the activation voltage shifts from a target value to distribute the device characteristics or generate the difference between lines.

In this description of the potential distribution, the potential is supplied from the two sides of the row. Even if the potential is supplied from one side, the same problems arise (though the potential only drops toward one side).

In the following embodiments, electron-emitting devices are arranged in a matrix by a plurality of row wirings and a plurality of column wirings perpendicular to them, and activated by selecting predetermined row wirings from the plurality of row wirings and applying compensation potentials corresponding to the potential distributions of the selected row wirings from the column wirings perpendicular to the selected row wirings. Selection row wirings are determined in accordance with the resistance values of wiring resistances obtained by measuring the wiring resistances of the respective row wirings before arranging the electron-emitting devices.

Further, electron-emitting devices are arranged in a matrix by a plurality of row wirings and a plurality of column wirings perpendicular to them, and activated by selecting predetermined row wirings from the plurality of row wirings and applying compensation potentials corresponding to the potential distributions of the selected row wirings from the column wirings perpendicular to the selected row wirings. Selection row wirings are determined in accordance with the resistance values obtained by measuring the wiring resistances of respective conductive films before performing forming processing for the conductive films after forming a plurality of conductive films constituting part of the electron-emitting devices.

An apparatus for manufacturing a plurality of electron-emitting devices arranged in a matrix by a plurality of row wirings and a plurality of column wirings perpendicular to them comprises a selection means for selecting predetermined row wirings from the plurality of row wirings, a power supply means for applying a potential for activating the electron-emitting devices to the plurality of row wirings, a detection means for detecting the first current values of currents flowing through the plurality of row wirings in units of row wirings, a driving means for applying the compensation potential to the plurality of column wirings on the basis of the first current values, and a memory means for storing the selected row wirings. The power supply means applies the potential to each row wiring before arranging the electron-emitting devices. The detection means detects the second current values of currents flowing through the plurality of row wirings in units of row wirings. The selection means selects a plurality of row wirings in accordance with the second current values.

An apparatus for manufacturing a plurality of electron-emitting devices arranged in a matrix by a plurality of row wirings and a plurality of column wirings perpendicular to them comprises a selection means for selecting predetermined row wirings from the plurality of row wirings, a power supply means for applying a potential for activating the electron-emitting devices to the plurality of row wirings, a detection means for detecting the first current values of currents flowing through the plurality of row wirings in units of row wirings, a driving means for applying the compensation potential to the plurality of column wirings on the basis of the first current CD values, and a memory means for storing the selected row wirings. The power supply means applies the potential to each row wiring before performing forming processing for conductive films after forming a plurality of conductive films constituting part of the electron-emitting devices. The detection means detects the third current values of currents flowing through the plurality of row wirings in units of row wirings. The selection means selects a plurality of row wirings in accordance with the third current values.

In a method of manufacturing electron-emitting devices which are arranged in a matrix by a plurality of row wirings and a plurality of column wirings perpendicular to them, and activated by selecting predetermined row wirings from the plurality of row wirings and applying compensation potentials corresponding to the potential distributions of the selected row wirings from the column wirings perpendicular to the selected row wirings, selection row wirings are determined in accordance with the resistance values of wiring resistances obtained by measuring the wiring resistances of the respective row wirings before arranging the electron-emitting devices.

An image forming apparatus comprises the above electron-emitting devices, and a fluorescent substance which emits light by electrons emitted from the electron-emitting devices.

Moreover, a method of manufacturing an electron source having a plurality of row wirings and electron-emitting devices connected to the plurality of row wirings comprises the step of selecting predetermined row wirings from the plurality of row wirings to apply the potential to the selected row wirings. This step selects row wirings in accordance with device resistance values in units of rows.

The 18th embodiment will be described in more detail.

Figure 75:
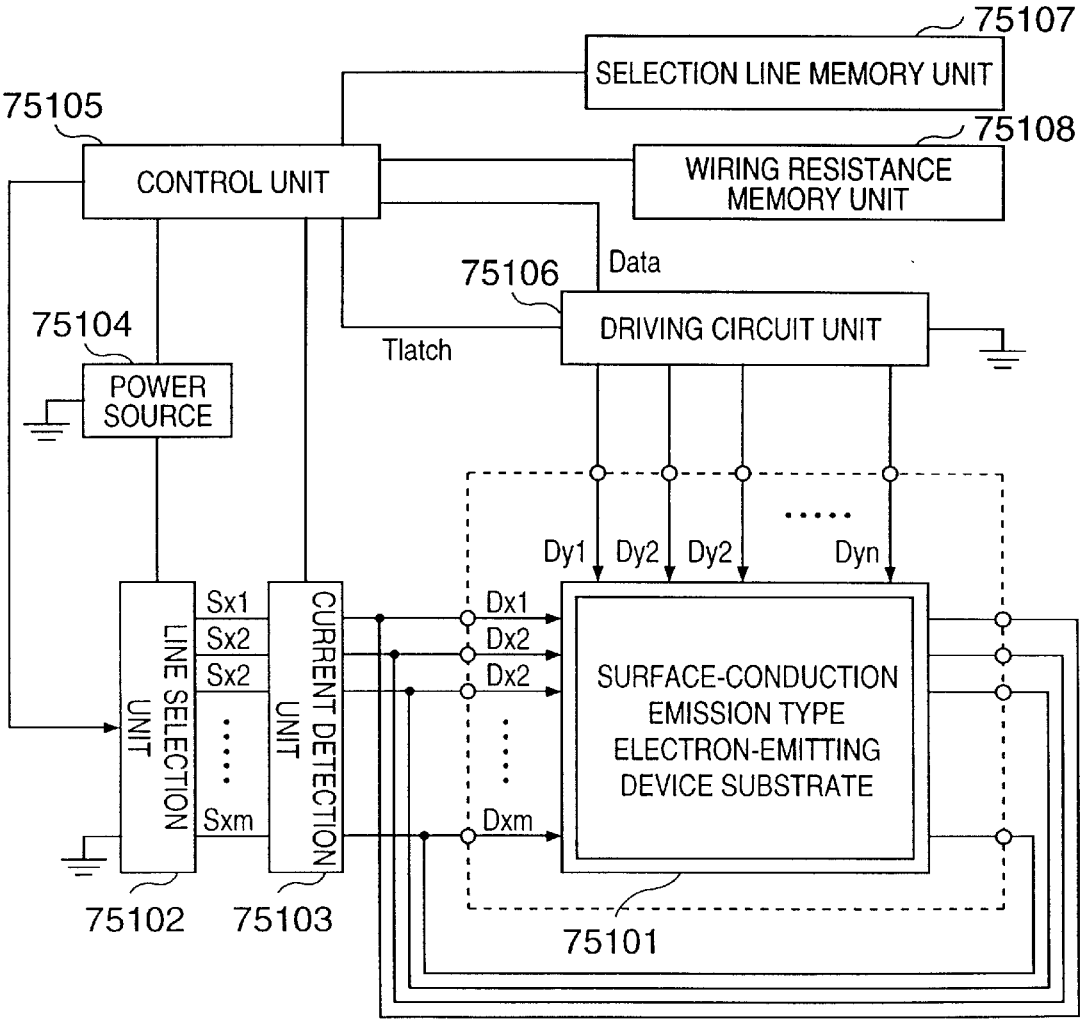
FIG. 75 is a block diagram showing the arrangement of an activation apparatus according to the 18th embodiment of the present invention.

FIG. 75 is a block diagram showing an activation apparatus for the surface-conduction emission type electron-emitting device in the 18th embodiment of the present invention.

In FIG. 75, reference numeral 75101 denotes a surface-conduction emission type electron-emitting device substrate to be activated. On the substrate 75101 in the 18th embodiment, a plurality of surface-conduction emission type electron-emitting devices are arranged in a matrix and have already undergone forming processing. The surface-conduction emission type electron-emitting device substrate 75101 is connected to an evacuation device (not shown), and evacuated to about $10^{-4}$ to $10^{-5}$ Torr. The substrate 75101 is further connected to an external electric circuit via row wiring terminals $D_{x1}$ to $D_{xm}$ and column wiring terminals $D_{y1 \text{ to } Dyn}$.

Reference numeral 75102 denotes a line selection unit for selecting a row to be activated. The line selection unit 75102 simultaneously selects two or more row wirings in accordance with a command output from a control unit 75105 on the basis of information stored in a selection line memory unit 75107. The selected row wirings receive a potential output from a power source 75104. Reference numeral 75103 denotes a current detection unit for individually monitoring currents $I_f$ flowing through selected rows upon applying the potential to the selected row wirings.

As will be described below, the current detection unit 75103 is made up of a detection resistance $R_{mon}$, and a measurement amplifier for measuring a voltage generated across the detection resistance. With these components, the current detection unit 75103 detects currents flowing through the selected row wirings, and outputs the detected current values as activation currents to a control unit 75105. The detection resistance $R_{mon}$ is set to a small resistance value enough to suppress a potential drop caused by the device current flowing through each selected line. The power source 75104 generates a potential to be applied to the row wiring terminal of the surface-conduction emission type electron-emitting device substrate 75101 in accordance with a command value output from the control unit 75105.

Reference numeral 75106 denotes a driving circuit unit for applying the potential to the column wiring terminals $D_{y1}$ to $D_{yn}$ of the surface-conduction emission type electron-emitting device substrate 75101 at a timing synchronized with a control clock signal $H_{scan}$ output from the control unit 75105.

In the 18th embodiment, the progress of activation is grasped by the current amount flowing upon activation, e.g., the activation current value. The control unit 75105 starts activating the surface-conduction emission type electron-emitting devices of the substrate upon reception of an activation start command input from the user. Although not described in detail, the control unit 75105 sequentially corrects the driving voltage values of surface-conduction emission type electron-emitting devices on the column that change with the progress of activation.

That is, the control unit 75105 calculates a potential amount for compensating for the voltage applied to each surface-conduction emission type electron-emitting device with reference to wiring resistance value data stored in a wiring resistance memory unit 75108 and an output current from the current detection unit 75103, and stores this potential amount as an output setting value in the latch circuit of the driving circuit unit 75106.

The driving circuit unit 75106 generates a driving potential corresponding to the output setting value and applies it to the column wiring terminals $D_{y1}$ to $D_{yn}$ of surface-conduction emission type electron-emitting devices. Thus, the potential distribution generated by device currents and wiring resistances on surface-conduction emission type electron-emitting devices is Try compensated for to always apply a constant voltage to respective surface-conduction emission type electron-emitting devices. The driving potential value of the driving circuit unit 75106 is sequentially updated with the progress of activation to correct the voltage distribution till the end of activation.

The control unit 75105 monitors the progress of activation based on the activation current value, and outputs a driving line setting signal for determining a driving line to the line selection unit 75102. Then, the line selection unit 75102 sets a row wiring. The control unit 75105 sequentially updates driving potential values $B_{y1}$ to $B_{yn}$ applied to respective column wirings, and outputs digital output data (Data) corresponding to these driving potential values to the driving circuit unit 75106.

Figure 76:
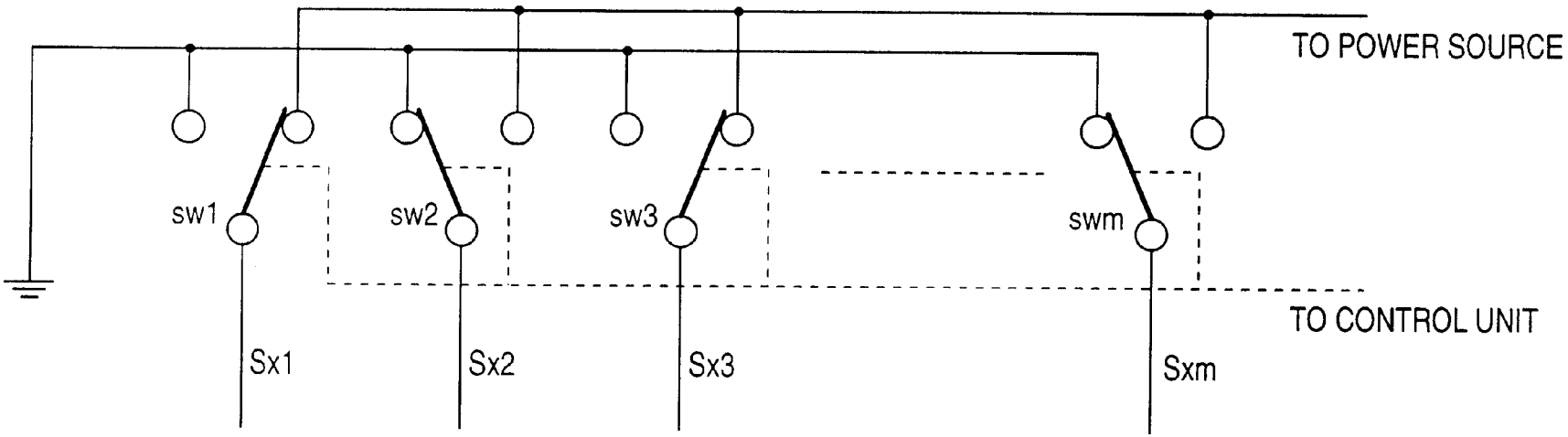
FIG. 76 is a circuit diagram showing a line selection unit in FIG. 75.

FIG. 76 is a circuit diagram showing the arrangement of the line selection unit 75102. The line selection unit 75102 incorporates m switching elements ($SW_1$ to $SW_n$). Each of the switching elements $SW_1$ to $SW_m$ selects either one of an output voltage from the power source 75104 and 0 V (ground level) to select whether to electrically connect the terminals $D_{x1}$ to $D_{xm}$ of the surface-conduction emission type electron-emitting device substrate 75101.

The switching elements $SW_1$ to $SW_m$ operate based on a if control signal output from the control unit 75105. The switching elements can be easily constituted by a combination of switching elements such as FETs or relays. In FIG. 76, the first ($S_{x1}$) and third ($S_{x3}$) lines are selected. Only the row wiring terminals $D_{x1}$ and $D_{x3}$ receive an output potential from the power source 75104, while the remaining row wirings are connected to ground as a non-selection potential.

Figure 77:
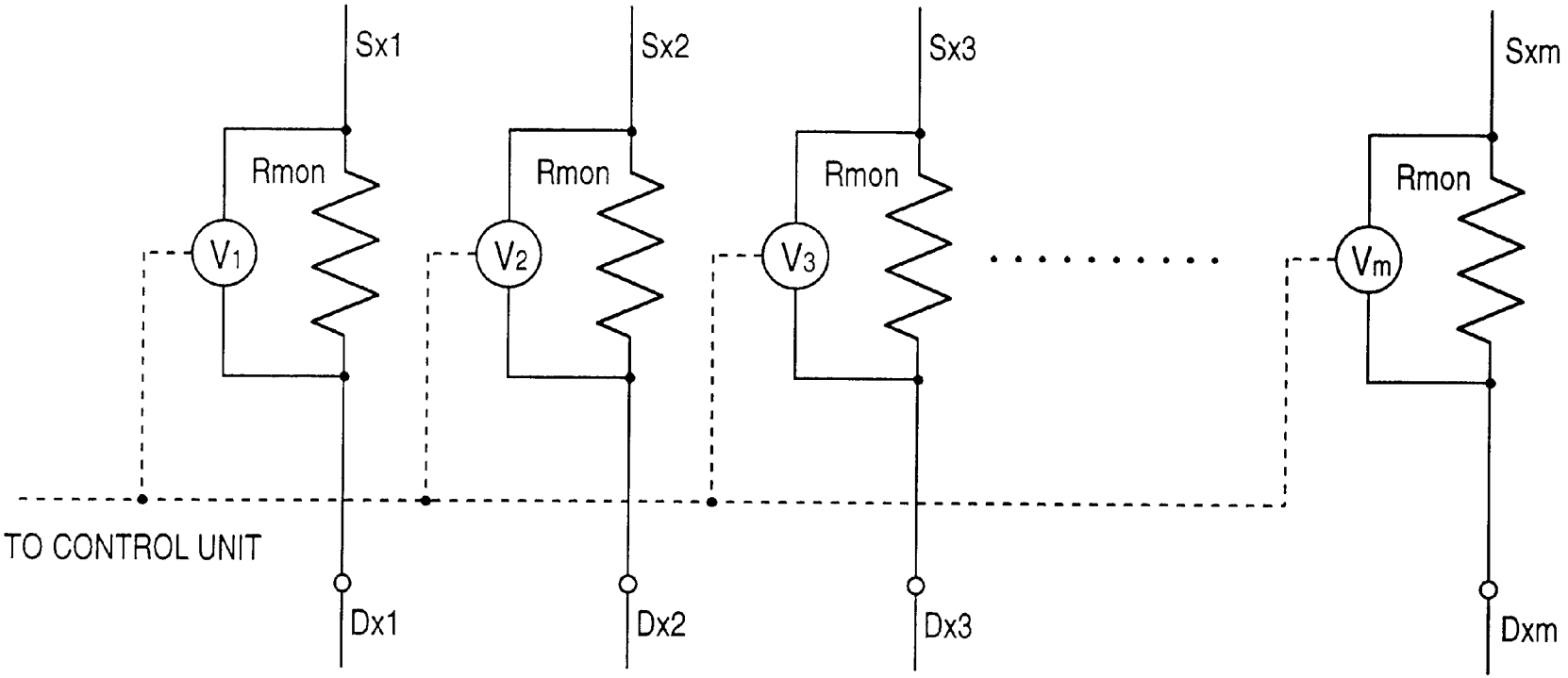
FIG. 77 is a circuit diagram showing a current detection unit in FIG. 75.

FIG. 77 is a circuit diagram showing the arrangement of the current detection unit 75103. The current detection unit 75103 receives an activation potential output from the line selection unit 75102 via the wirings $S_{x1}$ to $S_{xm}$. The current detection unit 75103 is made up of the detection resistance $R_{mon}$ and a voltmeter for measuring the voltage across the resistance $R_{mon}$. As shown in FIG. 76, when the first and third row wirings are selected, no current flows through the remaining row wirings.

Currents flowing through the first and third row wirings can be calculated by $$I1-V1/R_{mon}$$

$$I3-V3/R_{mon}$$

$R_{mon}$ is set to a small resistance value enough not to influence the application voltage to the surface-conduction emission type electron-emitting device substrate 75101 by a potential drop caused by the flowing current $I_f$. The voltmeter can output a detected value to the control unit via an A/D converter.

Figure 78:
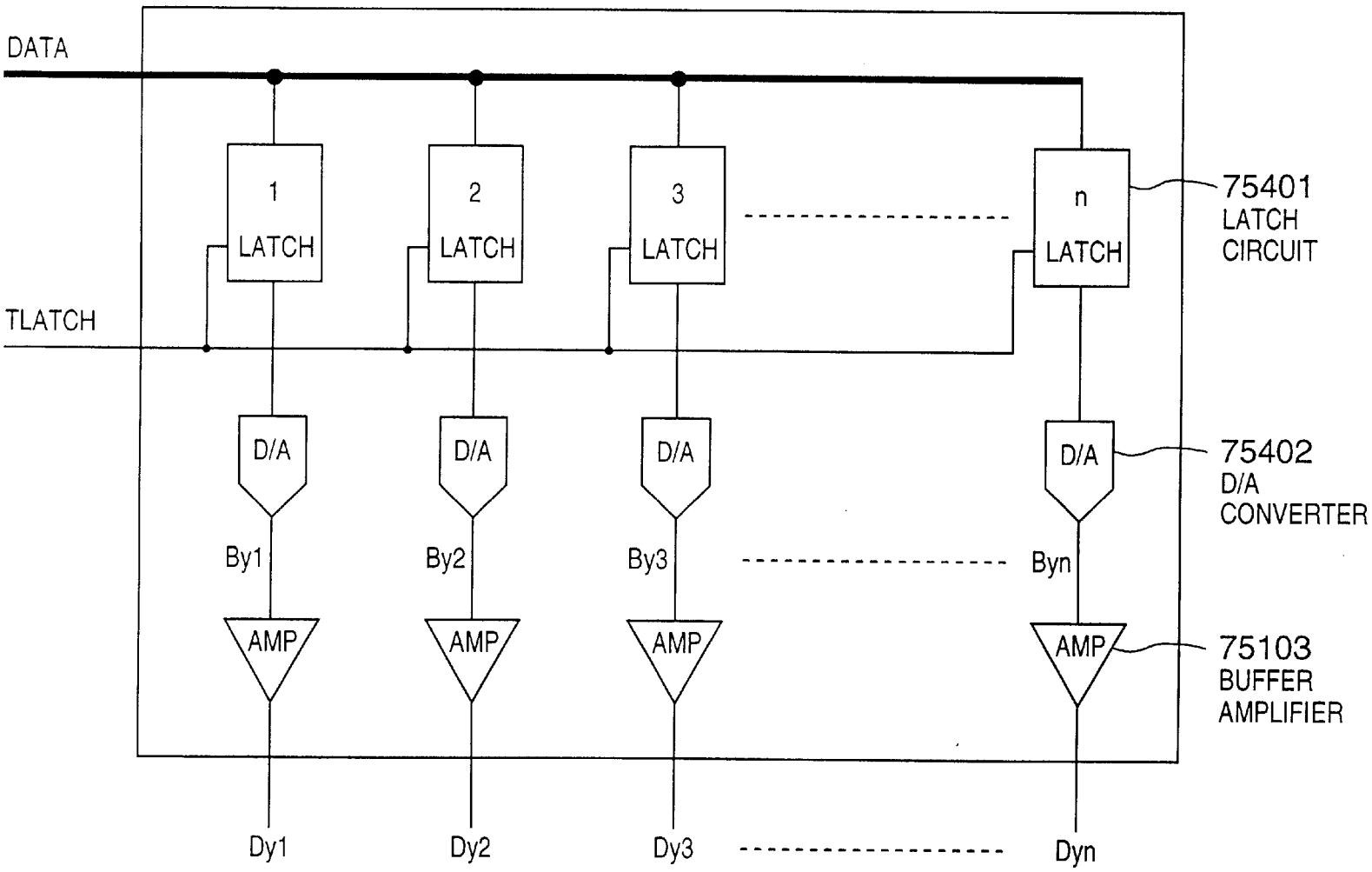
FIG. 78 is a circuit diagram showing a driving circuit unit in FIG. 75.

FIG. 78 is a circuit diagram showing the arrangement of the driving circuit unit 75106. The driving circuit unit 75106 comprises n latch (Latch) circuits 75401, n D/A converters 75402, and n buffer amplifiers 75403. The driving circuit unit 75106 generates a driving signal for driving n column wirings $D_{y1}$ to $D_{yn}$ on the surface-conduction emission type electron-emitting device substrate 75101.

The driving circuit unit 75106 inputs digital output data (Data) output from the control unit 75105 to the latch circuits 75401. Upon completion of a series of operations: measurement of the activation current→ calculation of output data→data transfer to the latch circuit 75401, the control unit 75105 applies a latch clock ($T_{latch}$) for updating output data from the D/A converters 75402 to all the latch circuits 75401. Accordingly, the latch circuits 75401 update data in synchronism with the latch clock.

Figure 79:
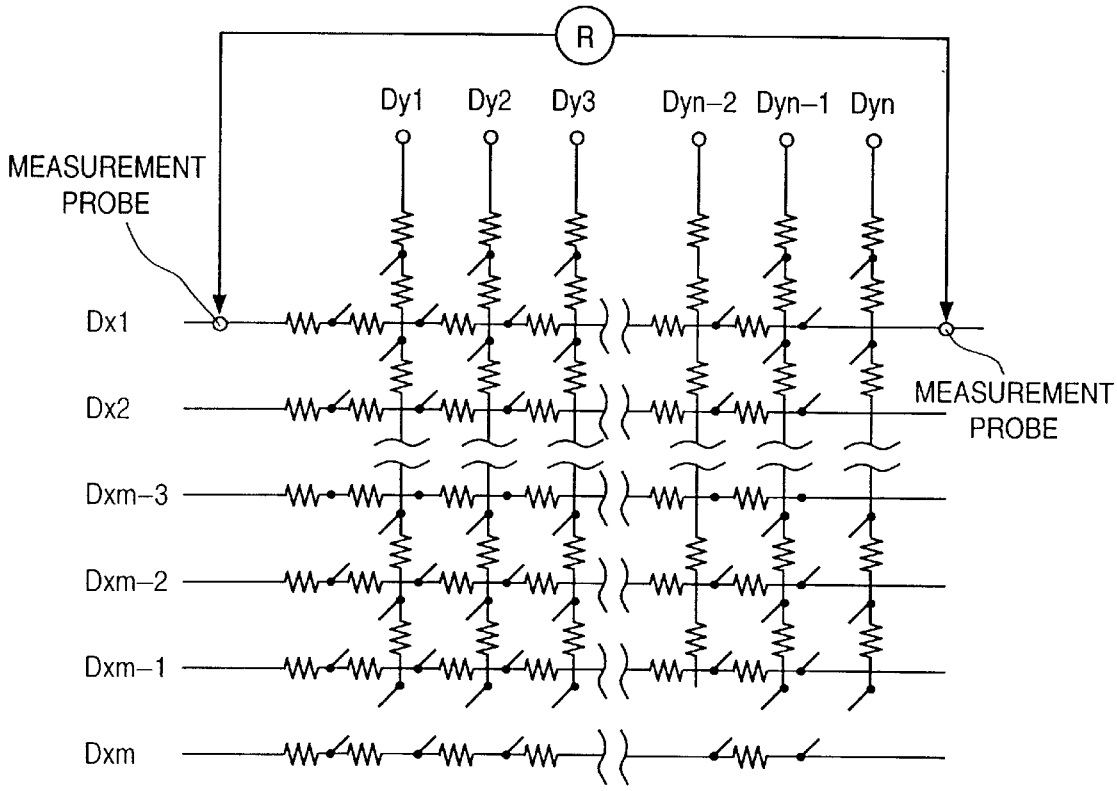
FIG. 79 is a circuit diagram for explaining measurement of the wiring resistance.
Figure 80:
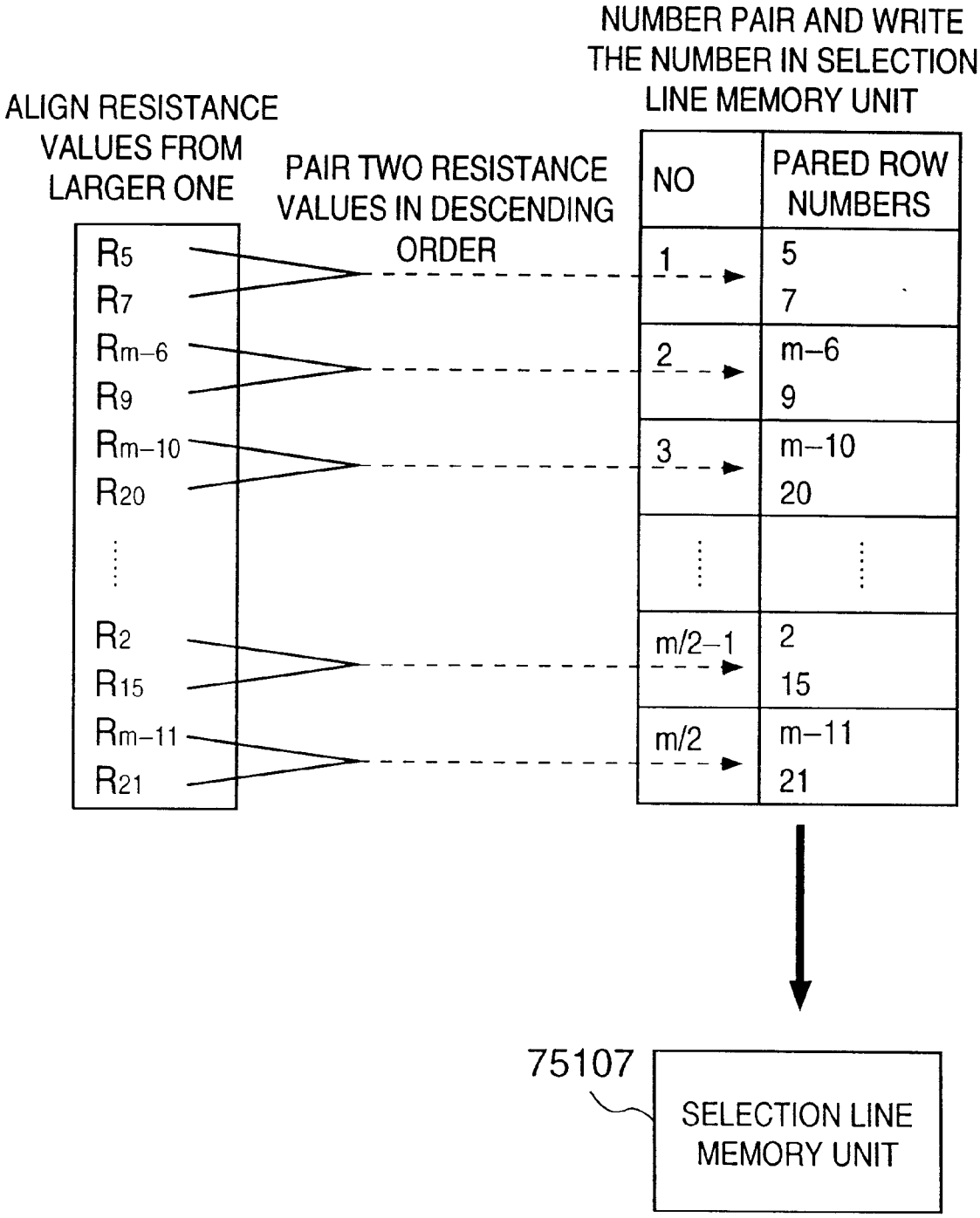
FIG. 80 is a view for explaining a method of combining simultaneous selection lines in the 18th embodiment.

FIG. 79 is an equivalent circuit diagram showing a substrate having m×n surface-conduction emission type electron-emitting devices when the wiring resistance of the row wiring is measured. FIG. 80 is a view for explaining a method of pairing simultaneously selection lines on the basis of measured wiring resistance values $R_1, R_2, R_3, \ldots, R_m$. The method of determining selection lines will be explained with reference to FIGS. 79 and 80. In the 18th embodiment, two lines are simultaneously selected. One of causes of the difference in potential drop during activation is variations in wiring resistance. The 18th embodiment relates to a method of reducing these variations.

The wiring resistances of row wirings on the surface-conduction emission type electron-emitting device substrate are measured. Since activation is done in units of row wirings in the 18th embodiment, the wiring resistances of row wirings are measured. The wiring resistance is desirably measured before conductive thin films for forming surface-conduction emission type electron-emitting devices are formed on the surface-conduction emission type electron-emitting device substrate. This is because,after forming the conductive thin films, a current for measuring the wiring resistance leaks to the conductive thin films, failing in accurate measurement.

The wiring resistance is measured by connecting a measurement probe to the two ends of the row wiring $D_{x1}$, as shown in FIG. 79. The wiring resistance is sequentially measured up to the mth row wiring. The measured wiring resistance values are directly stored as $R_1, R_2, R_3, \ldots, R_m$ in the wiring resistance memory unit.

In the wiring resistance memory unit 75108, the wiring resistance values are aligned in the order from a larger one, as shown in FIG. 80. Pairs of row wirings are formed in the aligned order. Each pair is numbered and stored in the selection line memory unit 75107. This method can combine the first to mth row wirings into m/2 pairs each having similar wiring resistances. In this way, a pair of selection lines are determined.

The procedure of activating surface-conduction emission type electron-emitting devices will be described with reference to FIGS. 75, 78, and 79. Activation is performed to set the current values of currents flowing through all surface-conduction emission type electron-emitting devices to a target value. The target current value is determined by a necessary electron emission amount and the like. In the 18th embodiment, activation processing is done while monitoring an output from the current detection unit 75103 so as to set the device currents of respective surface-conduction emission type electron-emitting devices on the surface-conduction emission type electron-emitting device substrate 75101 to 2 mA at last.

When the control unit 75105 receives an activation start command from the user, it controls the line select unit 75102 and power source 75104 in order to perform electrification processing in units of rows.

The control unit 75105 sets the output setting value of the driving circuit unit 75106 so as to set the column wiring terminals $D_{y1}$ to $D_{yn}$ to the ground potential. The control unit 75105 sequentially applies pulses of the activation potential Eac to the row wiring terminals $D_{x1}$ to $D_{xm}$.

The activation potential Eac has a pulse waveform with, e.g., a pulse width of 1 msec and a pulse height of 18 V. Then, the surface-conduction emission type electron-emitting device substrate 75101 sequentially receives the pulse potential in units of rows to start activation in units of lines. Note that two lines are simultaneously activated as a unit based on the pairs stored in the selection line memory unit 75107 in order to shorten the time.

The following description is directed to a method for correcting variations in device characteristics arising from the distance from the feeding terminal when electrification processing is done in units of lines. In the 18th embodiment, in simultaneously driving the two row wiring terminals $D_{x1}$ and $D_{x241}$, attention is paid to one of the two row wirings to activate n devices on the line of the row wiring terminal $D_{x1}$.

Figure 81:
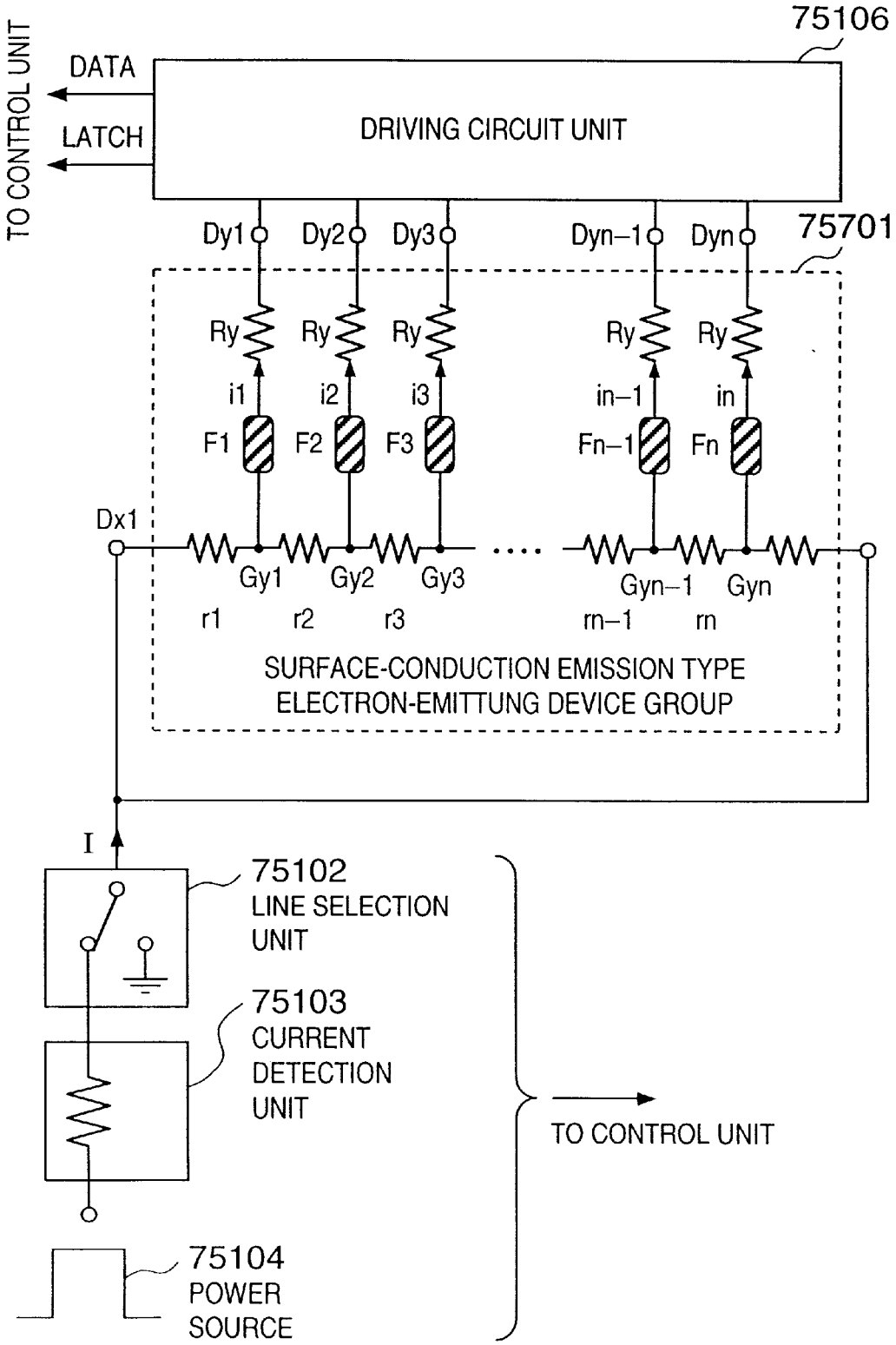
FIG. 81 is a block diagram showing the state of correcting the potential distribution by the driving circuit unit.

FIG. 81 is a block diagram showing the state of activating a surface-conduction emission type electron-emitting device group 75701 on the first row ($D_{x1}$ line). In FIG. 81, reference symbols $F_1$ to $F_n$ denote surface-conduction emission type electron-emitting devices connected to the row wiring terminal $D_{x1}$; r1 to rn, wiring resistances on the row wiring $D_{x1}$; and $R_y$, a wiring resistance from the feeding terminal (output terminal of the buffer amplifier 4107) of each of the column wirings $D_{y1}$ to $D_{yn}$ to a corresponding one of the surface-conduction emission type electron-emitting devices $F_1$ to $F_n$.

Since the row wiring is designed to be formed with a constant line width, thickness, and material, r1 to rn are considered to be almost equal except for variations in the manufacture. Since the column wirings are designed uniform, they are considered to have the same $R_y$.

Although the equivalent resistance values of the surface-conduction emission type electron-emitting devices $F_1$ to $F_n$ change (decrease) before and after activation, the equivalent resistance of each surface conduction emission type electron-emitting device is much higher than the value $R_y$. Even if two lines are simultaneously driven as in the 18th embodiment, the potential drop amount across $R_y$ is small to a negligible degree. The equivalent resistance values of the surface-conduction emission type electron-emitting devices $F_1$ to $F_n$ are designed higher than r1 to rn.

To activate the surface-conduction emission type electron-emitting device group 75701, the control unit 75105 controls the line selection unit 75102 to connect the power source 75104 for outputting the activation potential Eac and the current detection unit 75103 to the row wiring terminal $D_{x1}$, thereby applying the activation potential Eac to the terminal $D_{x1}$.

On the other hand, the voltage from the driving circuit unit 75106 is applied to the column wiring terminals $D_{y1}$ to $D_{yn}$ of surface-conduction emission type electron-emitting devices on the row wiring $D_{x1}$. The driving circuit unit 75106 operates to sink activation currents $i_1$ to $i_n$ from the surface-conduction emission type electron-emitting devices $F_1$ to $F_n$.

The driving voltage distribution to respective devices in activation will be described to explain a method of setting the output voltage value of the driving circuit unit 75106.

In activation, the electrical characteristics of the surface-conduction emission type electron-emitting device change as shown in FIG. 41. That is, the device current does not substantially flow at the start of activation, starts flowing along with the progress of electrification, and saturates. At this time, the potentials of the surface-conduction emission type electron-emitting device group on the row wiring $D_{x1}$ are monitored to find changes in potentials $G_{y1}$ to $G_{yn}$ under the influence of the wiring resistances r1 to rn. The potential difference increases with the progress of activation and maximizes at the end of activation. For example, for an activation current of 2 mA/device, r1 to rn=10 mΩ, and n=1000, a potential drop up to about 2.5 V:

$$\Delta V = \tfrac{1}{2} \times 500 \times 501 \times 2\ \text{mA} \times 10\ \text{m}\Omega$$

occurs at the terminal $G_{yn}$ of the device $F_{n/2}$ farthest from the feeding terminal.

To prevent this, the driving circuit unit 75106 generates a potential distribution identical to this potential drop distribution to apply the potential to the terminals $D_{y1}$ to $D_{yn}$ so as to cancel the potential distribution generated on respective surface-conduction emission type electron-emitting devices. More specifically, the control unit 75105 calculates the potential drop distribution generated at the terminals $G_{y1}$ to $G_{yn}$ by currents flowing through the surface-conduction emission type electron-emitting devices $F_1$ to $F_n$ and the wiring resistances r1 to along with the progress of activation. In this way, the output value of the D/A converter 75402 of the driving circuit unit 75106 is set to reproduce the potential drop distribution at output voltages $B_{y1}$ to $B_{yn}$.

Assuming that activation of the devices $F_1$ to $F_n$ substantially uniformly progresses, the device currents $i_1$ to $i_n$ flowing through respective surface-conduction emission type electron-emitting devices are almost equal, and the current values can be given using a current amount I detected by the current detection unit 75103:

$$i_{ave} = (i_1 = i_2 = \ldots = i_n) = I/n$$

At this time, the potential drop distribution generated at the terminals $G_{y1}$ to $G_{yn}$ by currents flowing through the surface-conduction emission type electron-emitting devices $F_1$ to $F_n$ and the wiring resistances r1 to rn, i.e., the voltage values $B_{y1}$ to $B_{yn}$ to be output to the output terminals of the driving circuit unit 75106 are calculated using the wiring resistance values r1 to rn and $i_{ave}$:

$$B_{y1} = -\mathbf{r1} \times n \times i_{ave}\quad B_{y2} = -\mathbf{r2} \times (n-1) \times i_{ave} + B_{y1}\quad B_{yn/2} = -rn/2 \times i_{ave} + B_{yn-1} + B_{yn-2} + B_{y1} \tag{9}$$

Since the wiring resistances r1 to rn are designed to the same value and actually have almost the same value, $r = R_1/n$ is effective ($R_1$ is the row wiring resistance value of the first row measured in advance). Equation (9) is generalized into $$B_{yk} = -\sum \cdot r \times i_{ave} \times (n/2 - k + 1) \tag{10}$$

(where $k < n/2$, and $\sum$ shows the sum of $k = 1$ to $k$)

$$= \sum \cdot r \times i_{ave} \times (k - n/2) \tag{11}$$

(where $k = n/2$ or $> n/2$, and $\sum$ shows the sum of $k = n$ to $k$)

The control unit 75105 measures the activation current which changes with the progress of activation, sequentially calculates the output voltage values $B_{y1}$ to $B_{yn}$ by equation (11), and outputs digital output data to the latch circuit 75401 of the driving circuit unit 75106. Upon completion of a series of operations: current measurement→calculation of output data→output of digital output data to the latch circuit 75401, the control unit 75105 applies a latch clock to all the latch circuits 75401 to update D/A data.

The latch circuits 75401 update data in synchronism with the latch clock. Then, the driving circuit unit 75106 generates a potential distribution identical to the potential distribution amount generated at the terminals $G_{y1}$ to $G_{yn}$ of the surface-conduction emission type electron-emitting devices $F_1$ to $F_n$. Accordingly, voltages applied between the terminals of the surface-conduction emission type electron-emitting devices $F_1$ to $F_n$ can be made uniform regardless of the device number and the progress of activation.

Figure 82A:
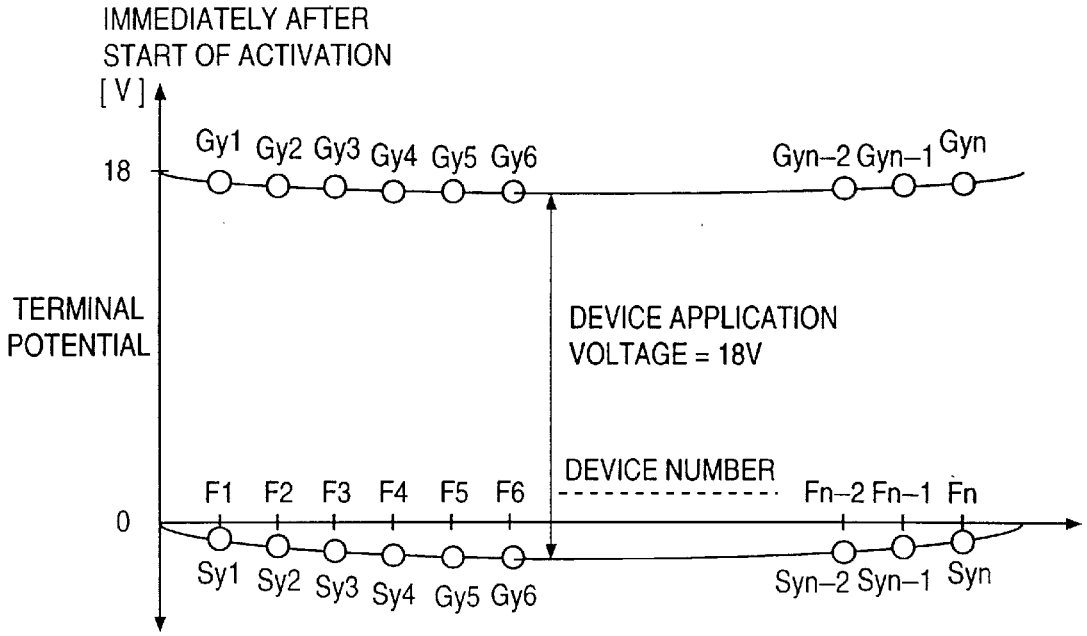
FIGS. 82A and 82B are graphs each showing the potential distribution which changes during activation processing.

FIG. 82A is a graph showing the voltage distribution immediately after the start of activation. The abscissa represents the positions of surface-conduction emission type electron-emitting devices. The ordinate represents the device potential across the surface-conduction emission type electron-emitting device.

The activation potential Eac=18 V is applied from the power source 75104. Since almost no activation current f lows, the current setting value of the driving circuit unit 75106 is almost "0", and the output voltage values $B_{y1}$ to $B_{yn}$ from the driving circuit unit 75106 and the output potentials $S_{y1}$ to $S_{yn}$ from the buffer amplifier 75403 (FIG. 78) are also almost 0 V. For this reason, a predetermined application voltage of 18 V is applied to respective surface-conduction emission type electron-emitting devices to progress activation.

Figure 82B:
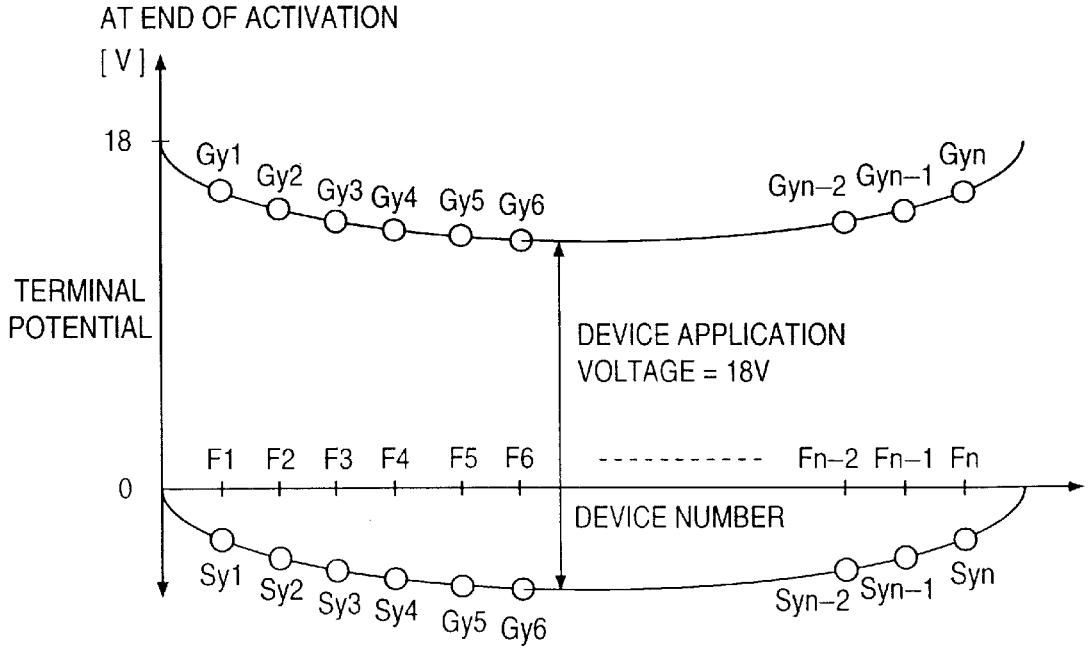

FIG. 82B is a graph showing the potential distribution at the end of activation. At the end of activation, currents flowing through respective surface-conduction emission type electron-emitting devices become almost 2 mA. The activation potential Eac=18 V applied from the power source 75104 decreases under the influence of a potential drop by the wiring resistance during application to the terminals $G_{y1}$ to $G_{yn}$ of respective surface-conduction emission type electron-emitting devices.

At this time, if the current setting value of the driving circuit unit 75106 is set to 2 mA, the output voltage values $B_{y1}$ to $B_{yn}$ from the driving circuit unit 75106 and the output voltages $S_{y1}$ to $S_{yn}$ from the buffer amplifier 75403 have the same distribution as that of $G_{y1}$ to $G_{yn}$. As a result, a constant application voltage of 18 V is applied to respective surface-conduction emission type electron-emitting devices to activate them.

More specifically, when the device current increases with the progress of activation, the voltage distribution applied to surface-conduction emission type electron-emitting devices always changes under the influence of the wiring resistance. At this time, the voltage distribution amount is calculated and set as the output setting value of the driving circuit unit 75106. The output potential values $B_{y1}$ to $B_{yn}$ from the driving circuit unit 75106 are sequentially updated to activate all devices by a constant voltage from the start to end of activation. When the to average device current $i_{ave}$ of respective surface-conduction emission type electron-emitting devices reaches 2 mA, activation ends.

In the above description, surface-conduction emission type electron-emitting devices on the row wiring $D_{x1}$ are activated. The 18th embodiment can be similarly applied to activation of surface-conduction emission type electron-emitting devices on another line. In the 18th embodiment, a plurality of activation lines are simultaneously activated while sequentially switching them.

In the 18th embodiment, since two lines are simultaneously activated, selection of simultaneous activation lines must be considered. However, wirings having paired row numbers stored in the selection line memory unit 75107 in advance are selected, as described above. These wirings have similar potential drop amounts (i.e., similar potential distribution amounts in the driving circuit unit 75106), and no shift in device application voltage by simultaneous driving occurs.

In this manner, activation of the surface-conduction emission type electron-emitting device substrate 75101 is complete. Since the output potential values $B_{y1}$, to By from the driving circuit unit 75106 are sequentially updated to compensate for a potential drop caused by the activation current and wiring resistance, all surface-conduction emission type electron-emitting devices can be uniformly activated by a constant potential from the start to end of activation. Since two lines are simultaneously driven, activation processing can be completed within half the processing time required to drive lines one by one.

In the 18th embodiment, the power source 75104 applies a positive output to flow the current from the $D_{x1}$ to the terminals $D_{y1}$ to $D_{yn}$, thereby activating devices. Alternatively, the power source 75104 may apply a negative output to flow the current from the terminals $D_{y1}$ to $D_{yn}$ to the terminal $D_{x1}$, thereby activating devices. In this case, the potential distribution is also inverted, so that the buffer amplifier 75403 is constituted as a (−1)-time inverting buffer amplifier to source the current, thereby obtaining the same effects.

In the 18th embodiment, the driving circuit unit 75106 is made up of the D/A converters 75402 equal in number to the number n of column wirings on the surface-conduction emission type electron-emitting device substrate 75101. Instead, the number of D/A converters 75402 may be decreased to define the potential value applied to the decreased number of column wiring terminals by resistance division because the compensation voltage distribution changes gradually, as shown in FIGS. 82A and 82B. A smaller number of D/A converters 75402 lead to cost reduction.

If the number n of surface-conduction emission type electron-emitting devices on the column wiring increases, a long time may be spent by a series of operations: measurement of the device current→calculation of output In data→data transfer. However, the time can be shortened by parallel-processing respective surface-conduction emission type electron-emitting devices or using a look-up table (LUT) for generating a compensation potential value from the current value, wiring resistance value, and position on the column wiring.

As described above, the activation apparatus described in the 18th embodiment can make the electron-emitting characteristics of all devices uniform. The electron source substrate can be used to realize a high-quality image display apparatus almost free from variations in luminance or density.

19th Embodiment

An activation apparatus according to the 19th embodiment has the same arrangement as in the 18th embodiment. The 19th embodiment is difference from the 18th embodiment by the number of simultaneous selection row wirings and a combination of selection row wirings.

As described above, when simultaneous selection rows have different activation currents in units of activation rows, the device application voltage shifts to vary device characteristics. Different activation currents arise from variations in fissures formed by forming processing. The variations may result from variations in resistances of the to conductive thin films before forming processing, i.e., the correlation between the thin film resistance value and the activation current.

In the 19th embodiment, the thin film resistance value is measured for respective row wirings in advance, and simultaneous driving lines in activation are grouped based on the measured values.

Figure 83:
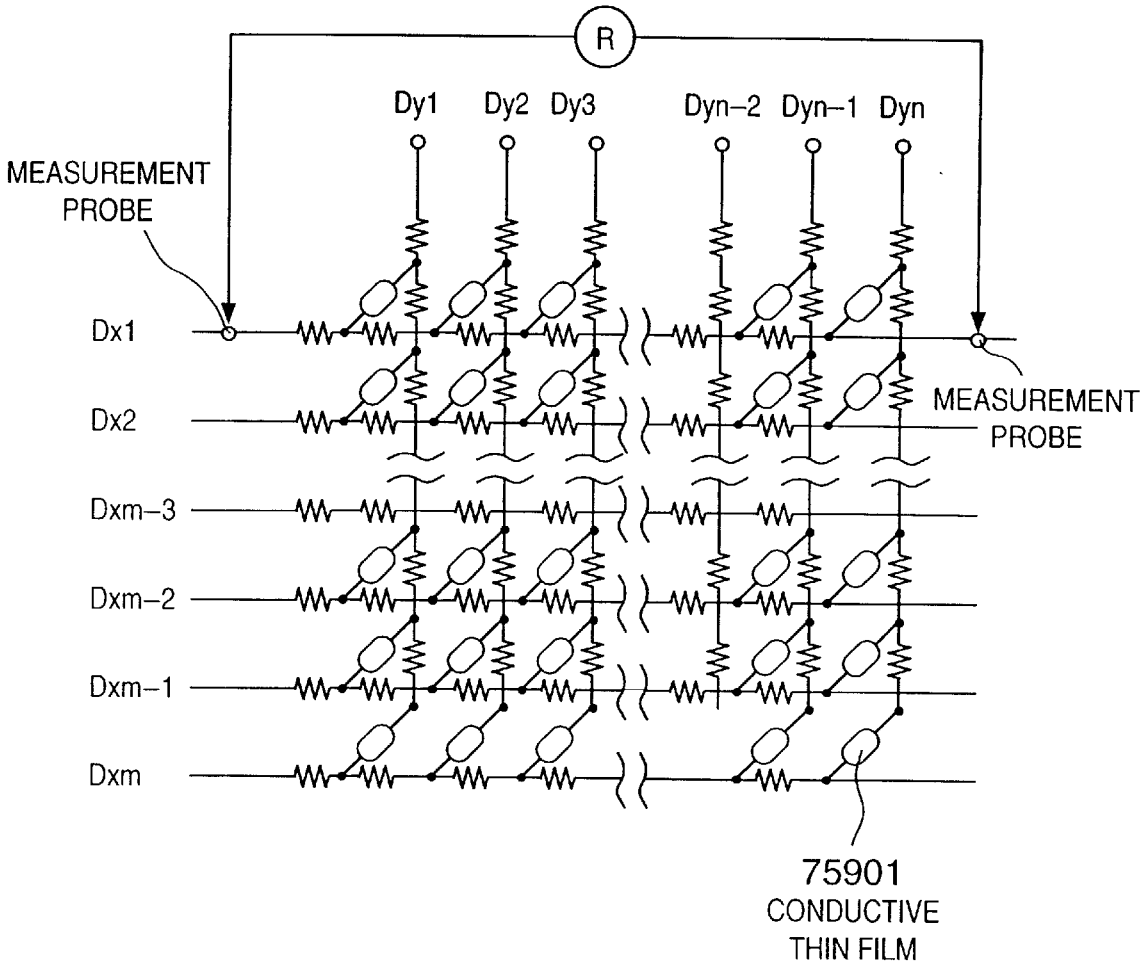
FIG. 83 is a circuit diagram for explaining measurement of the conductive film resistance in units of rows before forming processing.

FIG. 83 is an equivalent circuit diagram showing a surface-conduction emission type electron-emitting device substrate when the conductive thin film resistance is measured for respective row wirings. In FIG. 83, reference numeral 75901 denotes a conductive thin film before forming processing. This conductive thin film has a resistance of several hundred Ω to several kΩ per device. If the number n of columns is several hundred to several thousand as in the 19th embodiment, the resistance of the conductive thin film is influenced by the wiring resistance and cannot be accurately measured.

However, this does not pose any problem because the 19th embodiment groups row wirings having not accurate absolute values but relatively similar values. The resistance values measured for the row wirings $D_{x1}$ to $D_{xm}$ are defined as $R_{s1}$ to $R_{sm}$. Note that the wiring resistance is measured by the same method as in the 18th embodiment.

Figure 84:
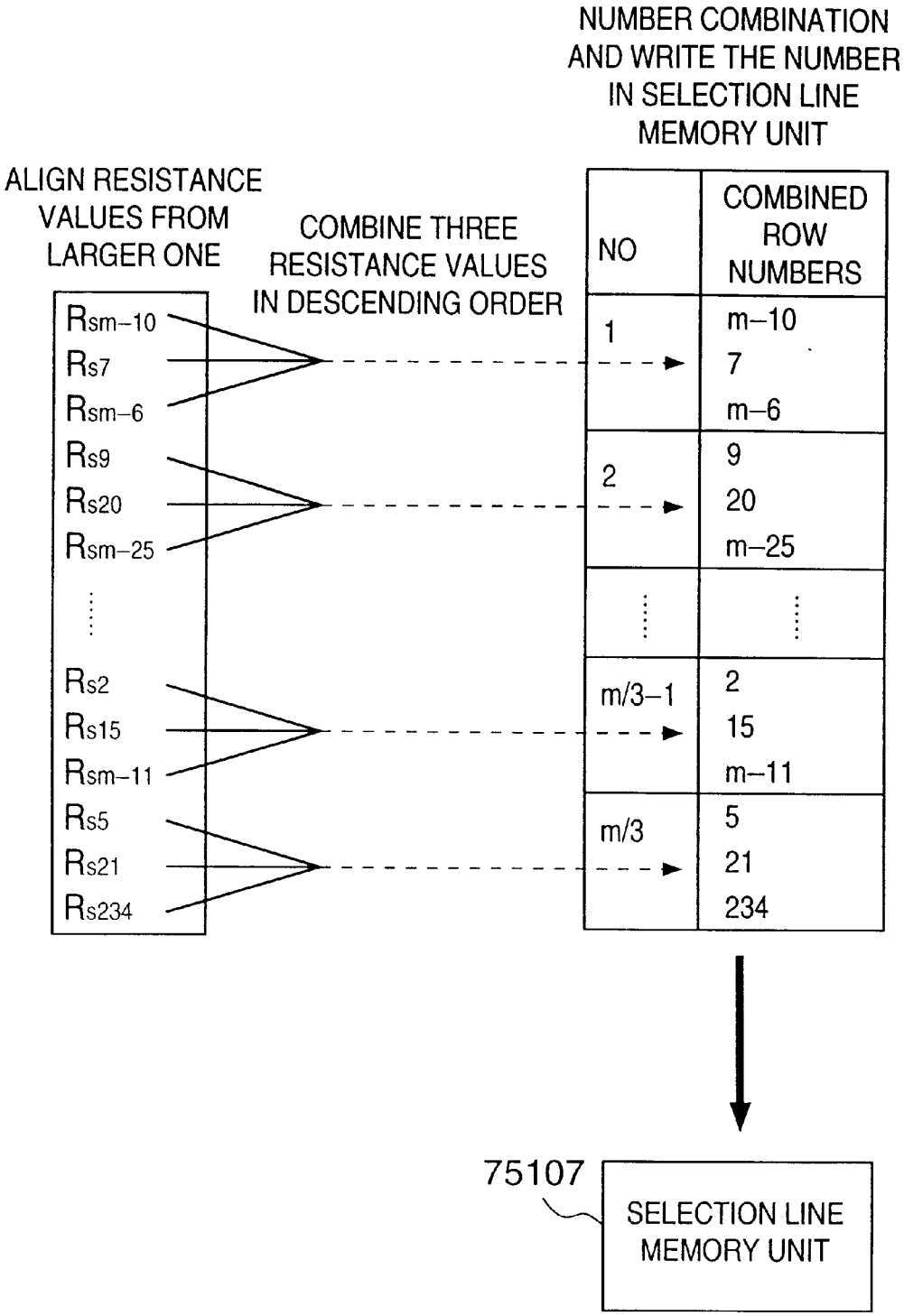
FIG. 84 is a view for explaining a method of combining simultaneous selection lines in the 19th embodiment.

FIG. 84 is a view for explaining a combination of selected row wirings. The measured resistance values $R_{s1}$ to $R_{sm}$ are aligned in the order from a larger one, and three each of them are combined. Each combination is numbered and stored in a selection line memory unit 75107. As a result, m/3 groups each including three row wirings are formed.

The numbers of the grouped row wirings are simultaneously selected and activated. The activation apparatus according to the 19th embodiment can make the electron-emitting characteristics of all devices uniform. The electron source substrate can be used to realize a high-quality image display apparatus almost free from variations in luminance or density.

20th Embodiment

An activation apparatus according to the 20th embodiment has the same arrangement as in the 18th embodiment. The 20th embodiment is difference from the 18th embodiment in a combination of selected row wirings.

Figure 85:
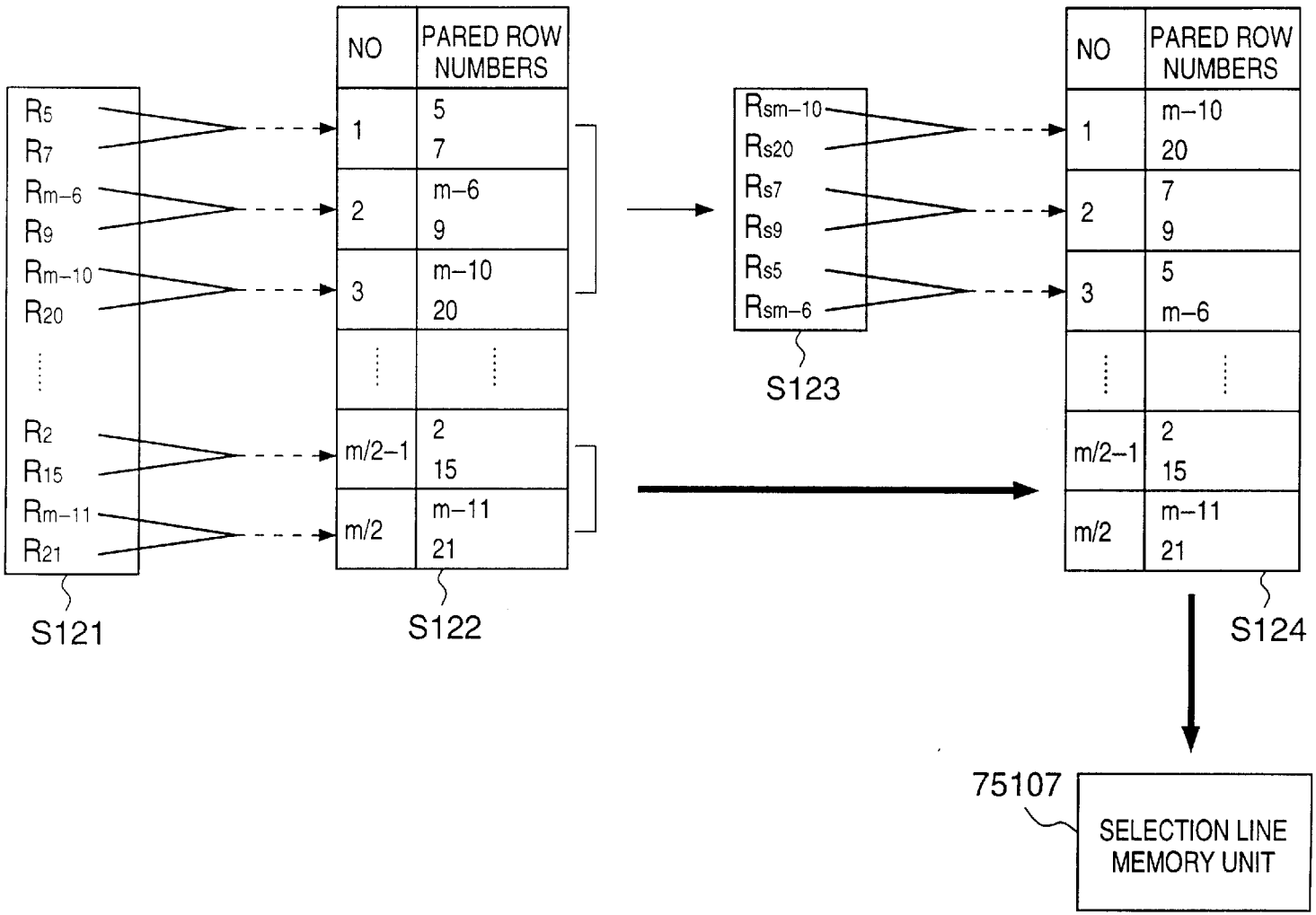
FIG. 85 is a view for explaining a method of combining simultaneous selection lines in the 20th embodiment.

FIG. 85 is a view for explaining a combination of simultaneously selected lines. Similar to the 18th embodiment, row wiring resistances are measured and defined as $R_1$ to $R_m$. After conductive thin films 75901 are formed similarly to the 19th embodiment, resistances for respective rows are measured and defined as $R_{s1}$ to $R_{sm}$. $R_1$ to $R_m$ are aligned in the order from a larger one, and pairs By of them are formed (steps S121 and S122).

The paired wiring resistances are compared with each to other. A pair (group) having a difference of 0.1 Ω or less is canceled. Cancelled wiring resistances are aligned in the order from a larger one of the resistances ($R_{s1}$ to $R_{sm}$) of the conductive film (step S123). In FIG. 85, groups Nos. 1 to 3 set in step S122 are canceled and realigned. A group having a difference of 0.1 Ω or more from preceding and subsequent groups is kept unchanged (in FIG. 85, groups Nos. m/2-1 and m/2).

Pairs of the realigned wiring resistances are formed in the order from a larger one. Finally, selection rows having similar wiring resistances are paired and written in a selection line memory unit 75107 (step S124).

The reason for realigning wiring resistance values with reference to 0.1 Ω will be explained. In this example. for n=1000 and r=10 mΩ, the maximum potential drop on the row wiring is about 2.5 V. The difference of 0.1 Ω in wiring resistance is converted in r into 0.1 mΩ for 1.0/1000. This difference causes a potential drop shift of 0.025 V at maximum. This shift amount is about 0.14% with respect to an activation application voltage of 18 V, which can be substantially ignored.

For this reason, grouping is more effectively done by giving priority to not the difference in wiring resistance but the difference in activation current. Row wirings are therefore grouped again depending on the conductive film resistance.

Note that the value 0.1 Ω is merely an example. The difference in wiring resistance is not limited to 0.1 Ω and can be properly set in accordance with the number n, the absolute value of the wiring resistance, and the like.

As described above, the activation apparatus according to the 20th embodiment can make the electron-emitting characteristics of all surface-conduction emission type electron-emitting devices uniform. The electron source substrate can be used to realize a high-quality image display apparatus almost free from variations in luminance or density.

The 18th to 20th embodiments have exemplified the wiring resistance and conductive film resistance, and their combinations as measurement values for setting in advance row wirings selected in activation. However, the measurement value is not limited to them, and a newly found correlation may be added as far as the difference in voltage distribution in activation can be predicted. In each embodiment, the number of simultaneous driving lines is two or three. However, the number of row wirings is not limited to them, and the maximum number of lines is determined by the thermal strength of the multi surface-conduction emission type electron-emitting device substrate, or the like.

In the embodiments of the present invention, the compensation potential applied to the column wiring is determined based on the device current flowing through the to row wiring. Instead, the compensation potential applied to the row wiring may be determined based on the device current flowing through the column wiring.

According to the present invention, in activating electron-emitting devices arranged in a matrix, the wiring resistances of a plurality of row wirings are measured before arranging electron-emitting devices. Predetermined row wirings are selected in accordance with the resistance values of the wiring resistances. A compensation potential corresponding to the potential distribution on each selected row wiring is applied from a column wiring perpendicular to this row wiring, thereby activating the row wiring.

As a result, the electron-emitting characteristics of all electron-emitting devices can be made uniform. These electron-emitting devices can be used to realize a high-quality image display apparatus free from variations in luminance or density.

21st Embodiment

In the following embodiments, a multi electron-emitting device has the following arrangement.

That is, the multi electron-emitting device is obtained by connecting a plurality of electron-emitting devices in a matrix by row wirings and column wirings perpendicular to them, activating the electron-emitting devices in units of rows or columns, and applying a compensation potential corresponding to the potential distribution on activation unit wirings from wirings perpendicular to the activation unit wirings. The voltage application unit is a plurality of columns or rows, and a combination of application rows or columns is determined by the design value of the multi electron-emitting device.

To activate the multi surface-conduction emission type electron-emitting device obtained by connecting a plurality of surface-conduction emission type electron-emitting devices in a matrix by row wirings and column wirings perpendicular to them, the activation apparatus comprises a line selection means and power supply means for selecting row or column wirings to simultaneously activate a plurality of lines, a current detection means for measuring currents flowing through devices upon activation in units of lines, a driving means connected to column or row wirings perpendicular to row or column wirings connected to the line selection means for determining the potential based on the detected values of the current detection means, a selection line memory means for storing simultaneous selection line numbers that are determined by measuring the multi surface-conduction emission type electron-emitting device, and a control means for controlling the line selection means, power supply means, and driving means on the basis of the selection line memory means which stores selection lines corresponding to the detected values of the current detection means.

The 21st embodiment according to the present invention will be described in detail with reference to the accompanying drawings.

An example of an activation apparatus for the surface-conduction emission type electron-emitting device according to the 21st embodiment will be explained with reference to FIG. 89.

Figure 89:
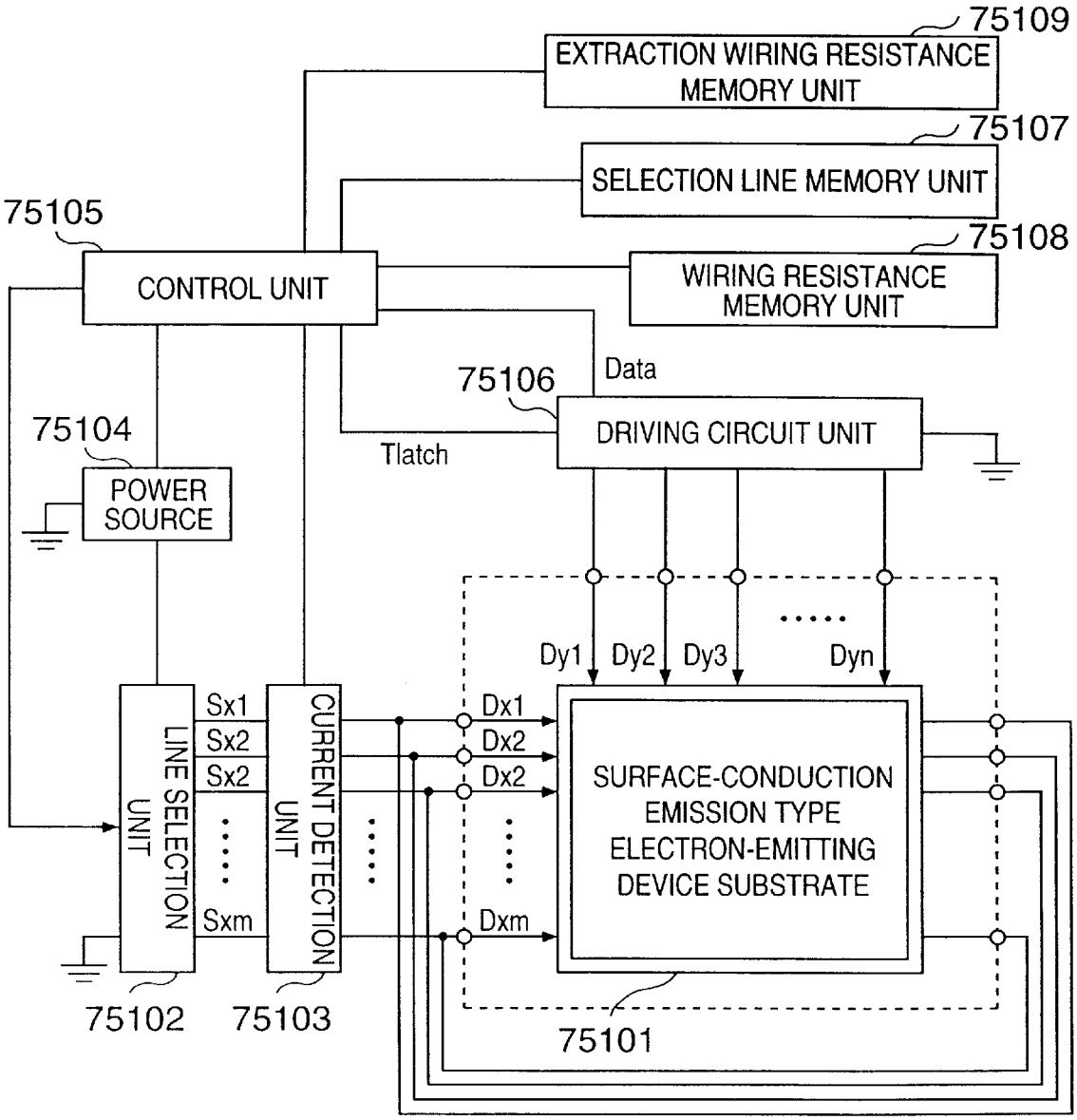
FIG. 89 is a block diagram showing the arrangement of an activation apparatus in the 21st embodiment.

In FIG. 89, reference numeral 75101 denotes a surface-conduction emission type electron-emitting device substrate to be activated. (On the substrate 75101 in the 21st embodiment, a plurality of surface-conduction emission type electron-emitting devices are arranged in a matrix and have already undergone forming processing.) The substrate 75101 is connected to an evacuation device (not shown), and evacuated to about $10^{-4}$ to $10^{-5}$ Torr. the substrate 75101 is further connected to an external electric circuit via row-direction wiring terminals $D_{x1}$ to $D_{xm}$ and column-direction wiring terminals $D_{y1}$ to $D_{yn}$. Reference numeral 75102 denotes a line selection unit for selecting a line to be activated, as shown in FIG. 76. The line selection unit 75102 simultaneously selects two or more row-direction wirings and applies the potential of a power source 75104 to them in accordance with a command output from a control unit 75105 which refers to a selection line memory unit 75107 for storing combinations determined in advance on the basis of the design value of the surface-conduction emission type electron-emitting device substrate, as will be described later. Reference numeral 75103 denotes a current detection unit for individually monitoring currents flowing through selected rows upon applying the voltage to the selected row-direction wirings. As shown in FIG. 77, the current detection unit 75103 comprises a detection resistance $R_{mon}$, and a measurement amplifier for measuring the voltage generated across this resistance. With these components, the current detection unit 75103 detects currents $I_f$ flowing from a power source 75104 into the selected row wirings, and outputs the detected current values to the control unit 75105. The detection resistance $R_{mon}$ is set to a small resistance value enough to prevent the influence of the application voltage to the surface-conduction emission type electron-emitting device by a potential drop caused by the flowing device current $I_f$. The power source 75104 generates a potential to be applied to the row-direction wiring terminal of the surface-conduction emission type electron-emitting device substrate in accordance with a command value from the control unit 75105.

Reference numeral 75106 denotes a driving circuit unit for driving the column-direction wiring terminals $D_{y1}$ to $D_{yn}$ of the surface-conduction emission type electron-emitting device substrate 75101 at a timing synchronized with a control clock signal $T_{latch}$ from the control unit 75105.

In the 21st embodiment, the progress of activation is grasped by the current amount flowing upon activation, e.g., the activation current. The control unit 75105 starts activation upon reception of an activation start command. Although not described in detail, the control unit 75105 sequentially corrects the driving potential distribution on column-direction devices that changes with the progress of activation. That is, the control unit 75105 calculates a potential amount for compensating for each device using wiring resistance value data stored in a wiring resistance memory unit 75108, extraction wiring resistance value data stored in an extraction wiring memory unit 75109, and an output from the current detection unit 75103, and sets this potential amount as an output setting value in the driving circuit unit 75106. The driving circuit unit 75106 generates a driving potential corresponding to the output setting value and applies it to the column-direction electrode of the device. Thus, the potential distribution generated by device currents and row-direction wiring resistances on respective devices is corrected to always apply a constant voltage to respective devices. Data of the driving circuit unit 75106 is sequentially updated with the progress of activation to correct the potential distribution till the end of activation. The control unit 75105 monitors the progress of activation based on the activation current value, and selects simultaneous driving row-direction wirings by the power source 75104 via the line selection unit 75102. This operation will also be described in detail. The control unit 75105 transmits a driving line setting signal to the line selection unit 75102 to set driving row-direction wirings.

The line selection unit 75102 will be described with reference to FIG. 76.

The line selection unit 75102 incorporates m switching elements ($SW_{x1}$ to $SW_{xm}$). Each switching element selects either one of an output potential from the power source 75104 and 0 V (ground level) to electrically connect the selected one to the terminals $D_{x1}$ to $D_{xm}$ of the surface-conduction emission type electron-emitting device substrate 75101. Each switching element operates based on a control signal output from the control unit 75105. The switching element can be easily constituted by a combination of switching elements such as FETs or relays. In FIG. 76, the first ($S_{x1}$) and third ($S_{x3}$) lines are selected. Only the row-direction wirings $D_{x1}$ and $D_{x3}$ receive an output potential from the power source 75104, while the remaining row-direction wirings are grounded.

FIG. 78 is a circuit diagram showing the arrangement of the driving circuit unit 75106.

The driving circuit unit 75106 comprises n latch (Latch) circuits 75401, n D/A converters 75402, and n buffer amplifiers 75403. The driving circuit unit 75106 generates a driving signal for driving n column-direction wirings on the surface-conduction emission type electron-emitting device substrate 75101. The control unit 75105 sequentially updates driving potential values $B_{y1}$ to $B_{yn}$ for driving respective column-direction wirings on the basis of the activation current value by the following procedure. The control unit 75105 transfers digital output data (Data) corresponding to the driving potential amount to the latch circuit 75401 of the driving circuit unit 75106. Upon completion of a series of operations: measurement of the activation current→calculation of output data→data transfer to the latch circuit, the control unit 75105 applies a latch clock ($T_{latch}$) for updating output data from the D/A converters 75402 to all the latch circuits 75401.

A method of determining simultaneous selection lines (a pair of lines because two lines are simultaneously activated in the 21st embodiment) in the 21st embodiment will be described. As described above, the first cause of the difference in potential drop during activation is variations in extraction wiring resistance. The 21st embodiment relates to a method of reducing the variations.

Figure 90A:
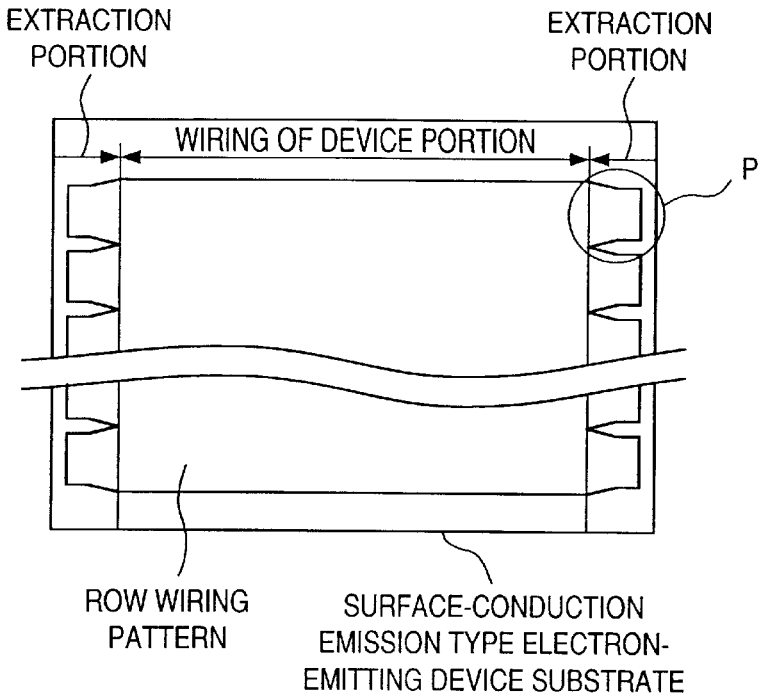
FIGS. 90A and 90B are views for explaining the extraction wiring pattern.
Figure 90B:
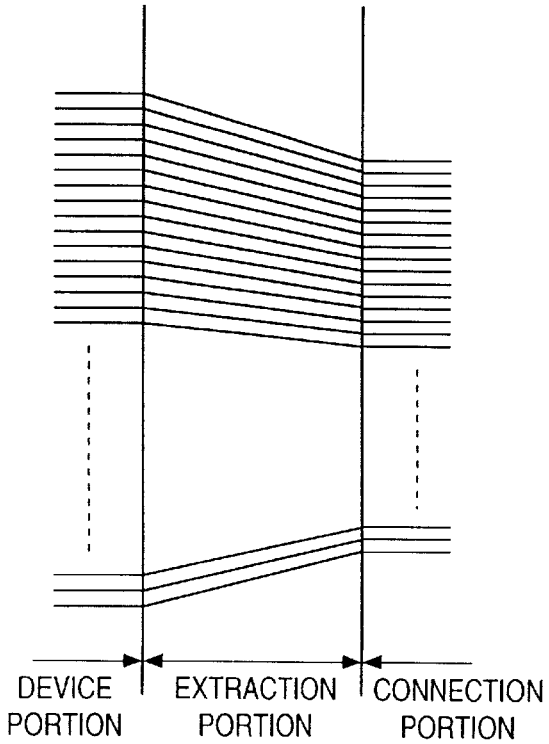

An example of different extraction wiring resistances between row wirings will be explained with reference to FIGS. 90A and 90B. FIG. 90A schematically shows the outline of the entire row wiring pattern on the surface-conduction emission type electron-emitting device substrate. This pattern can be roughly divided into a device wiring portion and extraction wiring portion. The pattern of the extraction portion is narrowed in units of a predetermined number of row wirings, and connected to the connection portion. FIG. 90B shows the P portion in detail. This pattern is designed to contact-bond a so-called flexible wiring and the like. In general, the width of the flexible wiring which can be contact-bonded with the connection portion shown in FIG. 90B is limited because of the dimensional accuracy of the flexible wiring or the like. The flexible wiring requires dead spaces on its two sides for each width. FIG. 91A shows the resistance of the extraction portion plotted for each row wiring number. In the following description, the number m of row wirings is 480, and the flexible wiring unit is 80. The extraction wiring resistance repeats every 80 rows, similar to the wiring pattern. The combination numbers 1 to 40 and 41 to 80 are respectively symmetrical in flexible units. The resistance values shown in FIG. 91A can be easily calculated from the wiring pattern if the wiring material and wiring film thickness are determined, and therefore can be obtained after the pattern design is determined. Extraction wiring resistances obtained in this manner are stored as $R_{d1}$, $R_{d2}$, $R_{d3}$, . . . , $R_{d480}$ in the extraction wiring resistance memory unit 75109. A combination of simultaneous selection rows is determined based on the obtained extraction wiring resistances, as shown in FIG. 91B. That is, row wirings symmetrical in the wiring pattern are combined to set 240 simultaneous driving row numbers and store them in the selection line memory unit.

The procedure of activating the surface-conduction emission type electron-emitting device substrate 75101 will be described with reference to FIGS. 89 and 78. Activation is performed such that the values $I_f$ of all devices exceed a target current value. The target current value is determined by a necessary electron emission amount and the like. In the 21st embodiment, activation processing is done while monitoring an output from the current detection unit 75103 so as to set the device currents of respective devices on the surface-conduction emission type electron-emitting device substrate 75101 to 2 mA at last.

The flow of activation will be explained.

When the control unit 75105 receives an activation start command (externally input by the operator), it controls the line select unit 75102 and power source 75104 in order to perform electrification processing in units of rows.

The control unit 75105 sets the signal value Data so as to set the column-direction wiring terminals $D_{y1}$ to $D_{yn}$ to the ground potential. The control unit 75105 sequentially applies activation potential pulses to the row-direction wiring terminals $D_{x1}$ to $D_{xm}$. (For example, the pulse width is 1 msec and the pulse height is 18 V: this potential will be referred to as Eac). Then, the surface-conduction emission type electron-emitting device substrate 75101 sequentially receives the pulse potential in units of row-direction wirings to start activation in units of lines. Note that two lines are simultaneously activated as a unit based on the pairs stored in the selection line memory unit in order to shorten the time.

The following description is directed to a method used in the 21st embodiment in order to correct variations in device characteristics arising from the distance from the feeding terminal when electrification processing is done in units of lines. In the 21st embodiment, in simultaneously driving the two row-direction wiring terminals $D_{x1}$ and $D_{x80}$, attention is paid to one of the two row-direction wirings to activate n devices on the line of the row wiring terminal $D_{x1}$.

Attention is given to a surface-conduction emission type device group on the first row (line $D_{x1}$) to which the activation voltage is applied. A surface-conduction emission type electron-emitting device group 75701 is represented by a model including the wiring resistances of respective devices. The state of activating this device group will be explained with reference to FIG. 92. In FIG. 92, reference symbols $F_1$ to $F_n$ denote surface-conduction emission type electron-emitting devices on the line of the row-direction wiring terminal $D_{x1}$; r1 to rn+1, wiring resistances at respective portions on the row wiring $D_{x1}$; rd1, an extraction wiring resistance on the row wiring $D_{x1}$; and $R_y$, a wiring resistance from the feeding terminal of each of the wirings $D_{y1}$ to $D_{yn}$ to a corresponding surface-conduction emission type electron-emitting device.

Since the row wiring except for the extraction wiring is designed to be formed with a constant line width, thickness, and material, r1 to rn+1 are considered to be equal except for variations in the manufacture. Since the column wirings are designed uniform, they are considered to have the same $R_y$. Although the equivalent resistance value of each surface-conduction emission type electron-emitting device changes (decreases) before and after activation, the equivalent resistance of the device is much higher than the value $R_y$. Even if two lines are simultaneously driven as in the 21st embodiment, the potential drop amount across $R_y$ is small to a negligible degree. The equivalent resistance values of the surface-conduction emission type electron-emitting devices $F_1$ to $F_n$ are designed higher than r1 to rn+1.

To activate the surface-conduction emission type electron-emitting device group 75701, the control unit 75105 controls the line selection unit 75102 to connect the power source 75104 for outputting the activation potential Eac and the current detection unit 75103 to the row-direction to. wiring terminal $D_{x1}$. Then, the terminal $D_{x1}$ is driven by the activation potential Eac.

On the other hand, the terminals $D_{y1}$ to $D_{yn}$ as other electrode terminals on the line $D_{x1}$ are driven by the driving circuit unit 75106. The driving circuit unit 75106 operates to sink activation currents $i_1$ to $i_n$ from the devices $F_1$ to $F_n$.

The driving voltage distribution to respective devices in activation will be described to explain a method of setting an output from the driving circuit unit 75106.

In activation, the electrical characteristics of the device change as shown in FIG. 41. That is, the device current does not substantially flow at the start of activation, starts flowing along with the progress of electrification, and saturates. At this time, potentials $G_{y0}$ and $G_{y0}'$ on the row wiring $D_{x1}$ gradually decrease owing to the extraction wiring resistance rd1. Letting ΔV1 be the potential drop amount, ΔV1 can be given by $$\Delta V1 = rd1 \times I/2$$

(where I is the current flowing from the feeding terminal to the row wiring $D_{x1}$ as shown in FIG. 92.)

Further, the potential of the device group on the row wiring $D_{x1}$ is monitored to find that the potentials $G_{y1}$ to $G_{yn}$ drop under the influence of the wiring resistances r1 to rn. The potential drop increases with the progress of activation and maximizes at the end of activation. For example, for an activation current of 2 mA/device, r1 to rn+1=10 mΩ, and n=1000, a potential drop up to about 2.5 V:

$$\Delta V2 = \tfrac{1}{2} \times 500 \times 501 \times 2\ \text{mA} \times 10\ \text{m}\Omega$$

occurs at the terminal $G_{yn/2}$ of the device $F_{n/2}$ farthest from the feeding terminal. At this time, for rd1=1 Ω, ΔV1 is given by $$\Delta V1 = 1\ \Omega \times 2\ \text{mA} \times 1000/2 = 1\ \text{V}$$

The sum of ΔV1 and ΔV2, i.e., a total potential drop of about 3.5 V occurs.

To prevent this, the driving circuit unit 75106 generates a potential distribution identical to this potential distribution to drive the terminals $D_{y1}$ to $D_{yn}$ so as to cancel the potential distribution generated on respective devices.

More specifically, the control unit 75105 calculates the potential drop distribution generated at the terminals $G_{y1}$ to $G_{yn}$ by a potential drop at the extraction wiring resistance rd1, currents flowing through the devices $F_1$ to $F_n$, and the wiring resistances r1 to rn along with the progress of activation. In this way, the output value of the D/A converter of the driving circuit unit 75106 is set to reproduce the potential drop distribution at the outputs $B_{y1}$ to $B_{yn}$. Assuming that activation of the devices $F_1$ to $F_n$ substantially uniformly progresses, the device currents $i_1$ to $i_n$ flowing through respective devices are almost equal, and the current values can be given using a current amount I detected by the current detection unit 75103:

$$i_{ave} = (i_1 = i_2 = \ldots = i_n =) I/n$$

At this time, the sum of ΔV1 and the potential drop distribution generated at the terminals $G_{y1}$ to $G_{yn}$ by currents flowing through the devices $F_1$ to $F_n$ and the wiring resistances r1 to rn+1, i.e., the potentials $B_{y1}$ to $B_{yn}$ to be output to the output terminals of the driving circuit unit 75106 are calculated using the wiring resistance values r1 to rn and $i_{ave}$:

$$B_{y1} = -r1 \times n \times i_{ave} - \Delta V1$$

$$B_{y2} = -r2 \times (n-1) \times i_{ave} + B_{y1} - \Delta V1$$

$$\vdots$$

$$B_{yn/2} = -rn/2 \times i_{ave} + B_{yn-1} + B_{yn-2} + \ldots + B_{y1} - \Delta V1$$

Since the wiring resistances r1 to rn are designed to the same value and actually have almost the same value, $r = R_1/n$ is effective ($R_1$ is the row wiring resistance value of the first row measured in advance). Equations (12) are generalized into $$B_{yk} = \Sigma\{r \times i_{ave} \times (n/2 - k + 1)\} - \Delta V1$$

(where Σ is the sum of k=1, 2, . . . , n/2+1)

$$B_{yk}=\Sigma\{r\times i_{ave}\times(k-n/2)\}-\Delta V1 \quad (13)$$

(where Σ is the sum of k=n, n−1, . . . , n/2)

The control unit 75105 measures the activation current which changes with the progress of activation, sequentially calculates the output potentials $B_{y1}$ to $B_{yn}$ and outputs digital output data to the latch circuit 75401 of the driving circuit unit 75106. Upon completion of a series of operations: current measurement→calculation of output data→data transfer to the latch unit, the control unit 75105 applies a latch clock to all the latch circuits 75401 to update data in synchronism with the latch clock. Then. the driving circuit unit 75106 generates a potential distribution identical to the potential drop distribution generated at the terminals $G_{y1}$ to $G_{yn}$ of the devices $F_1$ to $F_n$. Accordingly, voltages applied between the terminals of the devices $F_1$ to $F_n$ can be made uniform regardless of the device number and the progress of activation.

FIGS. 93A and 93B show potential distributions applied across the devices $F_1$ to $F_n$ at the start and end of activation, respectively. FIG. 93A shows the potential distribution immediately after the start of activation. The abscissa represents device numbers $F_1$ to $F_n$, which correspond to device positions. The ordinate represents the terminal potential across the device. As described above, currents flowing through respective devices are small immediately after the start of activation. Therefore, the activation potential Eac=18 V from the power source 44104 is applied to the terminals $G_{y1}$ to $G_{yn}$ of respective devices. Since almost no activation current flows, the potential setting value of the driving circuit unit 75106 is almost "0", and the outputs $B_{y1}$ to $B_{yn}$ from the driving circuit unit 75106 and the output from the buffer amplifier 75403 are also almost 0 V. For this reason, a predetermined voltage up to about 18 V is applied to respective devices to progress activation.

FIG. 93B shows the voltage distribution at the end of activation. At the end of activation, currents flowing through respective devices become almost 2 mA. The activation potential Eac=18 V applied from the power source 75104 decreases under the influence of a potential drop by the wiring resistance during voltage application to the terminals $G_{y1}$ to $G_{yn}$ of respective devices. At this time, the output setting value of the driving circuit unit 75106 can be calculated by the control unit 75105 on the basis of equations (13). The distributions of the outputs $B_{y1}$ to $B_{yn}$ from the driving circuit unit 75106 and output from the buffer amplifier 75403 are made equal to that of $G_{y1}$ to $G_{yn}$. Therefore, a constant voltage of 18 V at maximum is applied to the respective elements, thereby performing activation.

More specifically, when the device current increases with the progress of activation, the voltage distribution applied to devices always changes under the influence of the wiring resistance. At this time, the potential distribution amount is calculated and set as the output setting value of the driving circuit unit 75106. The output potential values $B_{y1}$ to $B_{yn}$ from the driving circuit unit 75106 are sequentially updated to activate all devices by a constant voltage from the start to end of activation. When the average device current $i_{ave}$ of respective devices reaches 2 mA, activation ends.

In the above description, devices on the row wiring $D_{x1}$ are activated. The 21st embodiment can be similarly applied to activation of devices on another line. In the 21st embodiment, a plurality of activation lines are simultaneously activated while sequentially switching them. In the 21st embodiment, since two lines are simultaneously activated, selection of simultaneous activation lines must be considered. However, wirings having paired row numbers stored in the selection line memory unit 75107 in advance are selected, as described above. These wrings have similar potential drop amounts (i.e., similar potential distribution amounts in the driving circuit unit 75106), and no shift in device application voltage by simultaneous driving occurs.

In this manner, activation of the surface-conduction emission type electron-emitting device substrate 75101 is complete. Since the outputs $B_{y1}$ to $B_{yn}$ from the driving circuit unit 75106 are sequentially updated to compensate for a potential drop caused by the activation current and wiring resistance, all devices can be uniformly activated by a constant voltage from the start to end of activation. Since two lines are simultaneously driven, activation processing can be completed within half the processing time required to drive lines one by one.

In the 21st embodiment, the power source 75104 applies a positive output to flow the current from the $D_{x1}$ to the terminals $D_{y1}$ to $D_{yn}$, thereby activating devices. Alternatively, the power source 75104 may apply a negative output to flow the current from the terminals $D_{y1}$ to $D_{yn}$ to the terminal $D_{x1}$, thereby activating devices. In this case, the potential distribution is also inverted, so that the buffer amplifier 75403 is constituted as a (−1)-time inverting buffer amplifier to source the current, thereby obtaining the same effects.

In the 21st embodiment, the driving circuit unit 75106 comprises D/A converters equal in number to the number n of column-direction wirings on the surface-conduction emission type electron-emitting device substrate 75101. Instead, the number of D/A converters may be decreased to define the potential value applied to the decreased number of column-direction wiring terminals by resistance division because the compensation potential distribution changes gradually, as shown in FIGS. 93A and 93B. A smaller number of D/A converters lead to cost reduction.

If the number n of devices in the column wiring direction increases, a long time may be spent by a series of operations: measurement of the device current→calculation of output data→data transfer. However, the time can be shortened by parallel-processing respective devices or using a look-up table (LUT) for generating a compensation potential value from the current value, wiring resistance value, and position on the column-direction wiring.

As described above, the activation apparatus of the 21st embodiment can make the electron-emitting characteristics of all devices uniform. The electron source substrate can be used to realize a high-quality image display apparatus almost free from variations in luminance or density.

22nd Embodiment

An activation apparatus in the 22nd embodiment of the present invention has the same arrangement as in the 21st embodiment, and a description thereof will be omitted. The 22nd embodiment is different from the 21st embodiment by a selection/combination method, which will be described.

As described above, when simultaneously selected units have different activation currents in activation units (rows in the 22nd embodiment), the device application voltage shifts to vary characteristics. Different activation currents result from the pressure distribution of material gas upon activation caused by the structural factor of an airtight container containing an exhaust pipe. In the 22nd embodiment, simultaneous driving row wirings are determined in design on the basis of the activation material gas distribution caused by the structural factor.

The airtight container in the 22nd embodiment has the same structure as that shown in FIG. 71, and is connected to an evacuation device and activation material gas supply source via four exhaust pipes. The material gas exhibits a pressure distribution in FIG. 72. This distribution will be explained with reference to FIGS. 94A and 94B. FIG. 94A shows the device matrix on the material gas distribution. The pressure distribution of the device matrix in FIG. 94A actually influences the activation current. FIG. 94B schematically shows the pressure distribution of this device matrix taken along the line A–A'. In FIG. 94B, the abscissa represents the row wiring number of the matrix, and m=480 similarly to the 21st embodiment. As shown in FIGS. 94A and 94B, the pressure distribution is symmetrical about the center along the row wiring number for a symmetrical structure. This pressure distribution is determined by the structure of the airtight container, the type of activation material gas, the supply pressure, and the like, and can be predicted.

A method of combining selection lines will be described with reference to FIGS. 95A and 95B. FIG. 95A shows the activation material gas distribution along the row wiring number that is plotted for some wiring numbers. FIG. 95B shows a combination of two row wirings in correspondence with the activation material gas distribution and row wiring number. As shown in FIGS. 95A and 95B, row wirings having the same activation gas pressure value are combined. More specifically, row wirings 1 and 480, 2 and 479, . . . , n and 481-n (n is an integer of 1 to 240), . . . , 239 and 240 are combined to obtain 240 pairs. The table in FIG. 95B is stored in a selection line memory unit. In the 22nd embodiment as well as the 21st embodiment, two row lines are simultaneously driven.

After that, the activation apparatus operates in accordance with this table. The procedure of compensating for a potential drop and activating devices, and the like are the same as in the 21st embodiment, and a description thereof will be omitted.

As described above, grouped row wiring numbers are simultaneously selected and activation. The activation apparatus of the 22nd embodiment can make the electron-emitting characteristics of all devices uniform. The electron source substrate can be used to realize a high-quality image display apparatus almost free from variations in luminance or density.

The 21st to 22nd embodiments have exemplified the extraction wiring resistance, and the activation gas distribution caused by the structure design of the airtight container as design values for setting simultaneous selection row wirings in activation in advance. However, the design value is not limited to them, and a newly found correlation may be added as far as the difference in voltage distribution in activation can be predicted. In the 21st and 22nd embodiments, the number of simultaneous driving lines is two. However, the number of row wirings is not limited to them, and the maximum number of lines is determined by the thermal strength of the multi surface-conduction emission type electron-emitting device substrate, or the like. In addition, not only row wirings having the same extraction wiring resistance and gas pressure, but also row wirings having a negligible error on the voltage potential distribution can be combined.

According to the 21st and 22nd embodiments, in activating a multi surface-conduction emission type electron-emitting device obtained by connecting a plurality of surface-conduction emission type electron-emitting devices in a matrix by row wirings and column wirings perpendicular to them, row or column wirings are simultaneously selected to activate a plurality of lines, and voltage distributions generated on the given wirings upon activation are compensated for from column or row wirings perpendicular to the given wirings. In this activation method, a combination of simultaneous selection lines is set in advance from the design value of the surface-conduction emission type electron-emitting device substrate. As a result, the electron-emitting characteristics of all devices can be made uniform. The electron source substrate can be used to realize a high-quality image display apparatus free from variations in luminance or density.

As has been described above, the present invention can reduce particularly variations in electron-emitting characteristics of respective electron-emitting devices connected in a matrix.

As many apparently widely different embodiments of the present invention can be made without departing from the spirit and scope thereof, it is to be understood that the invention is not limited to the specific embodiments thereof except as defined in the appended claims.

What is claimed is:

1. An electron source manufacturing method comprising the step of:

applying a potential to first portions of a plurality of conductive members serving as at least part of electron-emitting devices via a wiring commonly connected to the plurality of conductive members; and applying a potential to second portions of the plurality of conductive members, thereby applying a voltage to the plurality of conductive members, wherein the potential applied to the second portions of the plurality of conductive members is set to relax a difference in voltage applied to the plurality of conductive members owing to a difference between potentials at portions respectively connected to the first portions of the plurality of conductive members in the wiring commonly connected to the plurality of conductive members.

2. The method according to claim 1, wherein the potential applied to the second portion is changed in accordance with a change in potential applied to the first portion.

3. The method according to claim 1, wherein the potential applied to the first portion is estimated.

4. The method according to claim 3, wherein the potential applied to the first portion is estimated by measuring a current flowing through the wiring.

5. The method according to claim 3, wherein the potential applied to the first portion is estimated by measuring a current flowing through a wiring connected to the second portion.

6. The method according to claim 3, wherein the potential applied to the first portion is estimated based on stored data.

7. The method according to claim 1, wherein the potential to be applied to the second portion is determined by using an equivalent wiring resistance array obtained by arranging resistances substantially equal to a resistance of the wiring in an array.

8. The method according to claim 7, wherein the potential to be applied to the second portion is determined by sinking a predetermined current amount or using the predetermined current amount as a current source from portions of the equivalent wiring resistance array respectively connected to the second portions.

9. The method according to claim 1, wherein one or both of the potential applied to the first portion and the potential applied to the second portion are applied as pulses.

10. The method according to claim 1, wherein a potential applied to the wiring commonly connected to the plurality of conductive members and the potential applied to the second portion are applied as pulses, and the pulse potential applied to the wiring commonly connected to the plurality of conductive members is applied after the pulse potential applied to the second portion.

11. The method according to claim 1, wherein the conductive member is connected to one of a plurality of row wirings and one of a plurality of column wirings that constitute a matrix, and the voltage application step comprises the step of applying a voltage to conductive members connected to a row wiring selected from the plurality of row wirings by a potential applied to the first portions in accordance with a potential applied to the selected row wiring and a potential applied to the second portions in accordance with a potential applied to the plurality of column wirings.

12. The method according to claim 11, wherein the voltage application step comprises the step of applying, to an unselected row wiring out of the plurality of row wirings, a potential for suppressing a current flowing through the unselected row wiring owing to a potential difference from the potential applied to the column wiring.

13. The method according to claim 12, wherein one or both of the potential applied to the unselected row wiring and the potential applied to the column wiring are set to set the potential of the unselected row wiring to a potential between maximum and minimum values of the potential applied to the plurality of column wirings.

14. The method according to claim 12, wherein one or both of the potential applied to the unselected row wiring and the potential applied to the column wiring are set to set a ground potential between maximum and minimum values of the potential applied to the plurality of column wirings.

15. The method according to claim 11, further comprising the step of applying the voltage while sequentially switching row wirings to be selected.

16. The method according to claim 15, wherein row wirings to be selected are switched upon completion of the step of applying the voltage to the conductive members connected to the selected row wiring.

17. The method according to claim 15, further comprising the steps of: selecting a given row wiring and applying the voltage to conductive members connected to the selected row wiring at a time interval, thereby applying the voltage; and selecting another row wiring during the time interval and applying the voltage to conductive members connected to said another row wiring.

18. A method of manufacturing an image forming apparatus having an electron source and an image forming member for forming an image upon irradiation of electrons emitted by the electron source, comprising the steps of:

manufacturing the electron source by the electron source manufacturing method defined in claim 1; and assembling the electron source and the image forming member.

19. An electron source manufacturing apparatus, comprising:

a first circuit for applying a potential to first portions of a plurality of conductive members serving as at least part of electron-emitting devices via a wiring commonly connected to the plurality of conductive members; and a second circuit for applying a potential to second portions of the plurality of conductive members, wherein said second circuit sets the potential applied to the second portions of the plurality of conductive members so as to relax a difference in voltage applied to the plurality of conductive members owing to a difference between potentials at portions respectively connected to the first portions of the plurality of conductive members in the wiring commonly connected to the plurality of conductive members.

20. The apparatus according to claim 19, wherein said second circuit comprises an equivalent wiring resistance array having a resistance substantially equal to a resistance of the wiring, and a control current circuit for sinking or sourcing a predetermined current.

21. The apparatus according to claim 19, further comprising a current monitoring circuit for monitoring a current flowing through the conductive member.

22. The apparatus according to claim 21 wherein said current monitoring circuit monitors a current flowing through the wiring.

23. The apparatus according to claim 21 wherein said current monitoring circuit monitors currents respectively flowing through the conductive members.

24. The apparatus according to claim 19, wherein said second circuit sets the potential on the basis of a current flowing through the conductive member.

25. The apparatus according to claim 24, wherein said second circuit comprises a latch circuit for storing a digital value corresponding to a current value flowing through the conductive member, and a D/A converter for converting the digital value stored in said latch circuit into a current value.

26. The apparatus according to claim 19, wherein said second circuit controls the potential applied to the second portion in accordance with an application time of the potential to the second portion.

27. The method according to claim 19, wherein said second circuit comprises memory means to set the potential applied to the second portion.

28. The apparatus according to claim 19, wherein the first circuit applies a potential from two sides of the wiring.

29. A voltage applying circuit applying a voltage to a plurality of conductive members connected with a plurality of row wirings and a plurality of column wirings which form a matrix, comprising:

first circuit supplying a predetermined potential to a row wiring selected among the plurality of row wirings; and second circuit supplying a predetermined potential to each of the plurality of column wirings, wherein said second circuit includes a potential distribution generating circuit having an equivalent wiring resistance array and a source of a control current, wherein the equivalent wiring resistance array has a resistance substantially equal to the resistance of the row wiring, and the source of the control current serves to sink or supply a current flowing through said plurality of conductive members.

30. A circuit according to claim 29, wherein said second circuit has a circuit for superposing the potential distribution generated by said potential distribution generating circuit and an offset potential.

31. A method of manufacturing an electron source having a plurality of electron-emitting devices, comprising the step of applying a voltage to a plurality of conductive members serving at least part of the electron-emitting devices connected to simultaneously selected row-wirings by using a matrix wiring made up of pluralities of row and column wirings arranged substantially along directions which cross each other, wherein the voltage application step has the step of applying a potential to first portions of the plurality of conductive members via the selected rot wirings, and applying a potential to second portions of the plurality of conductive members via the plurality of column wirings, thereby applying a voltage by a difference between potentials applied via the row and column wirings, and the potential applied to the second portions of the plurality of conductive members is set to reduce differences between voltages applied to the respective conductive members caused by differences between potentials at portions connected to the first portions of the respective conductive members on the row wiring.

32. The method according to claim 31, wherein the voltage application step is repeated a plurality of number of times until all the row wirings are selected at least once.

33. The method according to claim 31, further comprising the step of determining simultaneously selected row wirings which select simultaneously in said voltage application step.

34. The method according to claim 33, wherein the determination step comprises the step of excluding a row wiring through which a current having a predetermined value flows upon selection, from selection target row wirings.

35. The method according to claim 31, wherein the simultaneously selected row wirings are row wirings not adjacent to each other.

36. The method according to claim 31, wherein the simultaneously selected row wirings are row wirings having similar current values upon selection.

37. The method according to claim 31, wherein the simultaneously selected row wirings are row wirings having similar compensation potentials applied from the column wirings upon selection.

38. The method according to claim 31, wherein the number of simultaneously selected row wirings is changed to repeat the voltage application step a plurality of number of times.

39. The method according to claim 31, wherein the number of simultaneously selected row wirings is determined based on power applied to the electron source in the voltage application step.

40. The method according to claim 31, wherein the simultaneously selected row wirings are determined so that differences between potentials applied to the second portions of the respective conductive members connected to a plurality of simultaneously selected row wirings and common column wirings are set to not more than a predetermined value.

41. The method according to claim 31, wherein the potential applied to the column wiring in the voltage application step is determined so that differences between potentials applied to the second portions of the respective conductive members connected to a plurality of simultaneously selected row wirings and common column wirings are set to not more than a predetermined value.

42. The method according to claim 31, wherein the potential applied via the column wiring is determined based on current values flowing through selected row wirings.

43. The method according to claim 31, wherein the potential applied via the column wiring is determined based on an average of currents flowing through simultaneous selection row wirings.

44. The method according to claim 43, further comprising the step of determining whether current values flowing through simultaneous selection row wirings are used to calculate an average.

45. The method according to claim 44, wherein the determining step is done based on a difference between a predetermined value and a maximum one of current values flowing through simultaneous selection row wirings.

46. The method according to claim 44, wherein the determining step is done based on a difference between a predetermined value and a minimum one of current values flowing through simultaneous selection row wirings.

47. The method according to claim 31, wherein the voltage application step comprises the step of controlling the voltage applied to the conductive member to not less than a predetermined value.

48. The method according to claim 31, wherein the voltage application step comprises the step of controlling the potential applied via the column wiring to not less than a predetermined value.

49. The method according to claim 31, further comprising the step of determining which of the plurality of row wirings is not selected.

50. The method according to claim 49, wherein the unselected row wiring is an abnormal row wiring.

51. The method according to claim 49, wherein a value of a current flowing through the unselected row wiring falls outside a predetermined range.

52. The method according to claim 49, wherein the unselected row wiring is a row wiring having a rate of change in a flowing current value which falls outside a predetermined range.

53. The method according to claim 49, further comprising the further voltage application step of applying a voltage to conductive members serving as at least part of electron-emitting devices connected to an unselected row wiring.

54. The method according to claim 53, wherein the further voltage application step comprises the step of selecting an unselected row wiring to apply a predetermined potential, and applying a potential different from the potential applied to the first portions from the row wiring receiving the predetermined potential via the plurality of column wirings, to the second portions of conductive members connected to the row wiring receiving the predetermined potential, thereby applying a voltage.

55. The method according to claim 53, wherein the further voltage application step comprises the step of selecting an unselected row wiring to apply a predetermined potential, and applying a potential different from the potential applied to the first portions from the row wiring receiving the predetermined potential via the plurality of column wirings, to the second portions of conductive members connected to the row wiring receiving the predetermined potential, thereby applying a voltage, and the potential applied to the second portions of the plurality of conductive members is set to reduce differences between voltages applied to the respective conductive members caused by differences between potentials at portions connected to the first portions of the respective conductive members on the row wiring.

56. The method according to claim 31, wherein the voltage application step comprises the step of determining simultaneous selection row wirings, and the determination step comprises the step of measuring wiring resistances of the plurality of row wirings, and determining simultaneous selection row wirings on the basis of the resistances.

57. The method according to claim 56, wherein the method further comprises the step of arranging conductive members, and the determination step is done before the conductive members are arranged.

58. The method according to claim 56, wherein the method further comprises the step of forming gap portions serving as electron-emitting portions in conductive members, and the determination step is done before the gap portions are formed.

59. The method according to claim 58, wherein the determination step is done before the gap portions are formed after the conductive members are formed.

60. The method according to claim 31, wherein the voltage application step comprises the step of determining simultaneous selection row wirings, and the determination step comprises the step of determining simultaneous selection row wirings on the basis of a structure of the electron source.

61. The method according to claim 31, wherein the voltage application step comprises the step of determining simultaneous selection row wirings, and the determination step comprises the step of determining simultaneous selection row wirings on the basis of potential drops on extraction wirings respectively connected to the plurality of row wirings.

62. The method according to claim 31, wherein the voltage application step comprises the step of determining simultaneous selection row wirings, and the determination step comprises the step of determining simultaneous selection row wirings on the basis of atmospheres at positions of respective conductive members.

63. The method according to claim 62, wherein the determination step comprises the step of determining simultaneous selection row wirings on the basis of atmospheric pressures at positions of respective conductive members.

64. The method according to claim 31, wherein the potential applied to the second portion is changed in accordance with a change in potential applied to the first portion.

65. The method according to claim 31, wherein one or both of the potential applied to the first portion and the potential applied to the second portion are applied pulse waves.

66. The method according to claim 31, wherein the voltage application step comprises the step of selecting a given row wiring to apply a voltage to conductive members connected to the selected row wirings at a time interval, and the step of selecting other row wiring at the time interval to apply a voltage to conductive members connected to the other row wiring.

67. A method of manufacturing an image forming apparatus having an electron source and an image forming member for forming an image upon irradiation of electrons emitted by the electron source, comprising the steps of:

manufacturing the electron source by the electron source manufacturing method defined in claim 31; and assembling the electron source and the image forming member.

68. An apparatus for manufacturing an electron source having a plurality of electron-emitting devices, comprising a voltage application device for applying a voltage to a plurality of conductive members serving as at least part of the electron-emitting devices connected to simultaneously selected row wirings by using a matrix wiring made up of pluralities of row and column wirings arranged substantially along directions which cross each other, said voltage application device having:

means for applying a potential to first portions of the plurality of conductive members via the selected row wirings; and means for applying a potential to second portions of the plurality of conductive members via the plurality of column wirings, wherein the potential applied to the second portions of the plurality of conductive members is set to reduce differences between voltages applied to the respective conductive members caused by differences between potentials at portions connected to the first portions of the respective conductive members on the row wiring.

69. A method for manufacturing an electron source, said electron source having a plurality of electron emitting devices, each of said electron emitting devices emitting electrons by applying a voltage to a gap thereof, the method comprising the steps of:

applying a potential to first sides of gaps of the plurality of electron emitting devices via a wiring and applying a potential to second sides to the gaps, thereby applying a voltage to the gaps; and setting each potential applied to the second side of each gap so as to relax a difference in voltage applied to the gaps due to a difference between potentials applied to the first sides of the gaps.

* * * * *

UNITED STATES PATENT AND TRADEMARK OFFICE

CERTIFICATE OF CORRECTION

PATENT NO. : 6,534,924 B1
DATED : March 18, 2003
INVENTOR(S) : Takahiro Oguchi et al.

It is certified that error appears in the above-identified patent and that said Letters Patent is hereby corrected as shown below:

Title page,
Item [56], References Cited, FOREIGN PATENT DOCUMENTS,
“09161664 A” should read -- 09-161664 A --.

Column 1,
Line 39, “to” should read -- M.I. --;
Line 51, “1975)),” should read -- 1975)], --;
Line 61, “anH” should read -- an H --;
Line 62, Anelectron-emittingportion” should read -- An electron-emitting portion --; and
Line 64, “conductivethin” should read -- conductive thin --.

Column 6,
Line 43, “to FIGS.” should read -- FIGS. --.

Column 8,
Line 57, “-wirings.” should read -- wirings. --; and
Line 60, “emittingdevices” should read -- emitting devices --.

Column 9,
Line 43, "rn" should be deleted.

Column 10,
Line 19, "torN" should read -- to rN --;
Line 26, "emittingdevice," should read -- emitting device, --.

Column 18,
Line 9, "Torrin" should read -- Torr in --.

Column 19,
Line 64, "With" should read -- with --.

Column 21,
Line 49, "when" should read -- When --.

Column 22,
Line 37, "$L_c$" should read -- $I_e$ --

UNITED STATES PATENT AND TRADEMARK OFFICE

CERTIFICATE OF CORRECTION

PATENT NO. : 6,534,924 B1
DATED : March 18, 2003
INVENTOR(S) : Takahiro Oguchi et al.

It is certified that error appears in the above-identified patent and that said Letters Patent is hereby corrected as shown below:

Column 24,
Line 23, "$I_e$" should read -- $I_e$, --.

Column 26,
Line 55, "n" (first occurrence) should be deleted.

Column 28,
Line 12, "to" (second occurrence) should be deleted.

Column 32,
Line 4, "$DX_1$" should read -- $D_{x1}$ --; and
Line 62, "upondriving" should read -- upon driving --.

Column 33,
Line 11, "DA1" should read -- $D_{x1}$ --.

Column 35,
Line 67, "$R_{mon}$" should read -- $R_{mon}$. --.

Column 36,
Line 6, "to in" should read -- to $i_n$ --.

Column 41,
Line 7, "andrepeatedlyexecutes" should read -- and repeatedly executes -- and "theprocessingfromstep" should read -- the processing from step --.

Column 42,
Line 42, "thevariable" should read -- the variable --.

Column 44,
Line 45, "usec." should read -- μ sec. --; and
Line 51, "generatinga" should read -- generating a --.

UNITED STATES PATENT AND TRADEMARK OFFICE

CERTIFICATE OF CORRECTION

PATENT NO. : 6,534,924 B1
DATED : March 18, 2003
INVENTOR(S) : Takahiro Oguchi et al.

It is certified that error appears in the above-identified patent and that said Letters Patent is hereby corrected as shown below:

Column 50,
Line 43, "$R_y$" should read -- $R_y$. --; and
Line 45, "activation" should read -- activation, --.

Column 51,
Line 12, "respective" should read -- of respective --.

Column 54,
Line 31, "checks" should read -- check --.

Column 55,
Line 37, "in." should read -- in --; and
Line 43, "and 488." should read -- and 48B. --.

Column 56,
Line 52, "Fordescriptiveconvenience," should read -- For descriptive convenience, --.

Column 61,
Line 10, "fromthebufferamplifier" should read -- from the buffer amplifier --;
Line 50, "specifically." should read -- specifically, --; and
Line 64, "l/2(m+5)·i." should read -- 1/2·(m+5)·i --.

Column 64,
Line 29, "$D^{x161}$;" should read -- $D_{x161}$; --; and
Line 32, "to" should read -- to rn --.

Column 66,
Line 32, "$I_{fave}$." should read -- $I_{fave}$ --.

Column 68,
Line 17, "drive." should read -- drive --;
Line 26, "source 441047," should read -- source 44104, --; and
Line 40, "wirings." should read -- wirings, --.

Column 71,
Line 23, "purpose." should read -- purpose, --; and
Line 64, "Variations" should read -- variations --.

UNITED STATES PATENT AND TRADEMARK OFFICE

CERTIFICATE OF CORRECTION

PATENT NO. : 6,534,924 B1
DATED : March 18, 2003
INVENTOR(S) : Takahiro Oguchi et al.

It is certified that error appears in the above-identified patent and that said Letters Patent is hereby corrected as shown below:

Column 73,
Line 44, "problem." should read -- problem, --.

Column 75,
Line 1, "to" should be deleted; and
Line 2, "to" should be deleted.

Column 78,
Line 7, "row," should read -- row. --; and
Line 35, "electrode." should read -- electrode --.

Column 81,
Line 50, "step 566," should read -- step S66, --.

Column 82,
Line 67, "tn" should be deleted.

Column 83,
Line 48, "fat" should be deleted.

Column 85,
Line 38, "In" should be deleted;
Line 56, "Instep" should read -- In step --;
Line 57, "in" should be deleted;
Line 63, "tn" should be deleted; and
Line 65, "Bed" should be deleted.

Column 86,
Line 11, "step 595," should read -- step S95, --; and
Line 46, "tn" should be deleted.

Column 87,
Line 64, "+5" should read -- T5 --.

Column 88,
Line 40, "step 5103." should read -- step S103. --.

UNITED STATES PATENT AND TRADEMARK OFFICE

CERTIFICATE OF CORRECTION

PATENT NO. : 6,534,924 B1
DATED : March 18, 2003
INVENTOR(S) : Takahiro Oguchi et al.

It is certified that error appears in the above-identified patent and that said Letters Patent is hereby corrected as shown below:

Column 89,
Line 19, "to" should be deleted.

Column 91,
Line 16, "rn≦l" should read -- rn-1 --;
Line 23, "$I_e$" should read -- $I_f$ --; and
Line 24, "$D_{y1\ to\ Dyn}$." should read --$D_{y1}$ to $D_{yn}$.--.

Column 94,
Line 13, "Try" should be deleted; and
Line 30, "$SW_n$)." should read -- $SW_m$). --.

Column 97,
Line 24, "to" should read -- to rn --;
Line 46,

"$B_{y1}$=-r1×n ×$i_{ave}$By2=-r2 ×(n-1)×$i_{ave}$+$B_{y1}$$B_{yn/2}$=-m/2 ×$i_{ave}$+$B_{yn-1}$+ $B_{yn-2}$+$B_{y1}$"

should read

--$B_{y1}$ = -r1 × n × $i_{ave}$
$B_{y2}$ = -r2 × (n - 1) × $i_{ave}$ + $B_{y1}$
$B_{yn/2}$ = -rn/2 × $i_{ave}$ + $B_{yn-1}$ + $B_{yn-2}$ +...+ $B_{y1}$
(9)--.

Column 98,
Line 19, "f" should be deleted;
Line 20, "lows," should read -- flows, --; and
Line 54, "to" should be deleted.

Column 99,
Line 7, "$B_{y1}$, to By" should read -- $B_{y1}$ to $B_{yn}$ --;
Line 39, "In" should be deleted; and
Line 64, "to" should be deleted.

Column 100,
Line 48, "By" should be deleted;
Line 50, "to" should be deleted; and
Line 65, "example." should read -- example, --.

UNITED STATES PATENT AND TRADEMARK OFFICE

CERTIFICATE OF CORRECTION

PATENT NO. : 6,534,924 B1
DATED : March 18, 2003
INVENTOR(S) : Takahiro Oguchi et al.

It is certified that error appears in the above-identified patent and that said Letters Patent is hereby corrected as shown below:

Column 102,
Line 39, "the" should read -- The --.

Column 105,
Line 53, "to." should be deleted.

Column 107,
Line 13, "Then." should read -- Then, --.

Column 109,
Line 38, "activation." should read -- activated. --.

Column 112,
Line 66, "rot" should read -- row --.

Signed and Sealed this

Ninth Day of March, 2004

JON W. DUDAS
*Acting Director of the United States Patent and Trademark Office*